US007802582B2

(12) United States Patent
Livacich et al.

(10) Patent No.: US 7,802,582 B2
(45) Date of Patent: Sep. 28, 2010

(54) SYSTEM FOR CONCEALMENT AND SHELTER WITH STRUCTURE FOR RAPID SETUP AND TIGHT SKIN

(75) Inventors: John Livacich, Sunnyvale, CA (US); Kendyl Allen Roman, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 470 days.

(21) Appl. No.: 11/788,495

(22) Filed: Apr. 20, 2007

(65) Prior Publication Data

US 2008/0006317 A1 Jan. 10, 2008

Related U.S. Application Data

(63) Continuation-in-part of application No. 11/484,106, filed on Jul. 10, 2006.

(51) Int. Cl.
*E04H 15/48* (2006.01)
*E04H 15/36* (2006.01)
*E04H 15/54* (2006.01)

(52) U.S. Cl. ..... 135/147; 135/135; 135/126; 135/905

(58) Field of Classification Search ..... 135/98, 135/124, 126, 133, 135, 143, 147, 120.3, 135/120.4, 901, 905, 906, 907
See application file for complete search history.

(56) References Cited

U.S. PATENT DOCUMENTS

| | | | | |
|---|---|---|---|---|
| 74,933 A | | 2/1868 | Palmer | |
| 891,622 A | | 6/1908 | Kroder | |
| 926,945 A | | 7/1909 | Howland | |
| 1,079,431 A | | 11/1913 | Nitka | |
| 1,288,518 A | | 12/1918 | Collier | |
| 1,298,634 A | | 4/1919 | Allen | |
| 1,414,616 A | * | 5/1922 | Beehler | 135/90 |
| 1,435,110 A | | 11/1922 | Efford | |

(Continued)

FOREIGN PATENT DOCUMENTS

| | | |
|---|---|---|
| EP | 222048 | 11/1985 |
| GB | 475811 | 11/1937 |

(Continued)

*Primary Examiner*—David Dunn
*Assistant Examiner*—Danielle Jackson

(57) ABSTRACT

An easy to use, universal, simple, lightweight compact, portable, dynamically configurable and modular system of concealment and shelter. An operator configures a number of concealment blinds or shelters using brackets, support, segmented and telescoping shafts, covers, curtains, and skirts, and more complex modules. The brackets and supports are used to secure a configuration to a tree or the ground. Advanced modules included user adjustable domes and cylindrical arches. The system can be configured for placement on a hillside or over rough terrain and obstacles, or four different types use. The system provides covers with novel windows, movable panels, and configuration attachments. The operator changes the configuration of the structure to quickly provide cover, to increase cover, and to adapt to terrain or changing weather. The system includes novel methods of tightening the skin on a cover to reduce movement and noises. Methods include using the full human body, from hands to feet, and its strongest muscle groups to rapidly set up the system with tighter skin. Foot attaching means and hand attachment means enable methods for setting up a fast setup frame with the body in a horizontal seated row or a vertical power jerk position.

8 Claims, 82 Drawing Sheets

U.S. PATENT DOCUMENTS 1,516,372 A 11/1924 Brooks
1,528,910 A 3/1925 Carlson
1,572,845 A 2/1926 Efford et al.
1,619,740 A 3/1927 Long et al.
1,649,219 A 3/1927 Goldberg
2,159,273 A 5/1939 Killinger
2,175,501 A 10/1939 Bergh
2,186,482 A 1/1940 Frank
2,188,747 A 1/1940 Bittick
2,573,414 A 10/1951 Dunn
2,619,101 A 11/1952 McGerry et al.
2,826,758 A 3/1958 Kahn
2,835,262 A 5/1958 Collins
2,864,389 A * 12/1958 Smith et al. ..... 135/98
2,865,386 A 12/1958 Burns
2,888,021 A 5/1959 Adams
2,928,404 A 3/1960 Klages
3,039,478 A 6/1962 Timmons
3,068,046 A 12/1962 Bourgoin
3,116,746 A 1/1964 Bird
3,165,110 A 1/1965 Brooks
3,195,898 A 7/1965 Respini
3,441,037 A 4/1969 Transeau
3,468,299 A 9/1969 D'Amato
3,515,194 A 6/1970 Carhart et al.
3,537,688 A 11/1970 Stein
3,590,864 A 7/1971 Vechesloff
3,610,323 A 10/1971 Troyer
3,794,054 A 2/1974 Watts
3,855,635 A 12/1974 Ramirez
3,911,499 A 10/1975 Benevento et al.
3,950,789 A 4/1976 Konz et al.
3,957,069 A 5/1976 Denaro
4,055,173 A 10/1977 Knab
4,084,599 A 4/1978 Matthews
4,146,933 A 4/1979 Jenkins et al.
4,175,576 A 11/1979 Iby
4,195,651 A * 4/1980 Watts et al. ..... 135/135
4,263,925 A 4/1981 Arganbright
4,352,362 A 10/1982 Nichols
4,369,528 A 1/1983 Vest et al.
4,449,542 A 5/1984 McSwain et al.
4,494,248 A 1/1985 Holder
4,524,463 A 6/1985 Ogden
4,558,468 A 12/1985 Landry et al.
4,576,364 A 3/1986 O'Fearna
4,578,825 A 4/1986 Vote
4,587,671 A 5/1986 Rodriguez et al.
4,651,727 A 3/1987 Howorth
4,653,120 A 3/1987 Leaf
4,696,066 A 9/1987 Ball et al.
4,718,210 A 1/1988 McCourt et al.
4,750,509 A 6/1988 Kim
4,787,101 A 11/1988 Feinberg
4,914,752 A 4/1990 Hinson et al.
4,945,936 A 8/1990 Surrendi
4,964,282 A 10/1990 Wagner
5,062,234 A 11/1991 Green
5,062,424 A 11/1991 Hooker
5,180,143 A 1/1993 Brower
5,218,982 A 6/1993 Kenji
5,255,390 A 10/1993 Gross et al.
5,259,077 A 11/1993 Hager et al.
5,299,331 A 4/1994 Badillo
5,301,706 A 4/1994 Jones
5,304,213 A 4/1994 Berke et al.
5,333,634 A 8/1994 Taylor
5,360,439 A 11/1994 Dickerhoff et al.
5,367,710 A 11/1994 Karmin
5,411,541 A 5/1995 Bell et al.
5,443,488 A 8/1995 Namenmye et al.
5,479,954 A 1/1996 Lin
5,564,232 A 10/1996 Callaway
5,572,742 A 11/1996 McFadden
5,575,006 A 11/1996 Wolfe
5,609,176 A 3/1997 Weeks
5,611,087 A 3/1997 Adkins
5,620,482 A 4/1997 Augustine et al.
5,647,660 A 7/1997 Lee
5,697,963 A 12/1997 Augustine
5,746,555 A 5/1998 McEvoy
5,785,716 A 7/1998 Bayron
5,865,355 A 2/1999 Camara
5,871,026 A 2/1999 Lin
5,876,011 A 3/1999 Blasing
5,891,187 A 4/1999 Winthrop et al.
5,934,628 A 8/1999 Bosnakovic
5,937,883 A 8/1999 Camara
5,970,519 A 10/1999 Weber
5,974,605 A 11/1999 Dickerhoff et al.
6,049,907 A 4/2000 Palomo
6,148,836 A 11/2000 Cananzey
6,154,883 A 12/2000 Spann et al.
6,199,572 B1 3/2001 Rousselle et al.
6,200,060 B1 3/2001 Vernay
6,216,270 B1 4/2001 Moquin et al.
6,230,728 B1 5/2001 Reese
6,230,928 B1 5/2001 Hanna et al.
6,235,659 B1 5/2001 McAmish et al.
6,279,877 B1 8/2001 Davis
6,286,531 B1 9/2001 Joo-Tai
6,336,465 B1 1/2002 Surrendi et al.
6,354,316 B1 3/2002 Chen
6,378,136 B2 4/2002 Matsushita
6,434,877 B1 8/2002 Shelton
6,450,187 B1 9/2002 Lin et al.
6,484,321 B1 11/2002 Shamam
6,511,501 B1 2/2003 Augustine et al.
6,523,558 B1 2/2003 Gillis
6,524,332 B1 2/2003 Augustine et al.
6,551,347 B1 4/2003 Elkins
6,571,574 B1 6/2003 Blackstone
6,581,617 B2 6/2003 Ham et al.
6,596,019 B2 7/2003 Turner et al.
6,647,552 B1 11/2003 Hogan
6,662,492 B2 12/2003 Oliver
6,694,522 B1 2/2004 Neal
6,766,623 B1 7/2004 Kalnay
6,776,177 B2 8/2004 Wu
6,792,622 B2 9/2004 Graves
6,799,332 B2 10/2004 Hatton
6,851,125 B2 2/2005 Fujikawa et al.
6,876,884 B2 4/2005 Hansen et al.
6,997,199 B1 2/2006 Wright
7,001,416 B2 2/2006 Augustine et al.
7,044,145 B2 5/2006 Bouchard
7,100,626 B2 9/2006 Livacich
7,152,614 B2 12/2006 Kalnay
7,226,454 B2 6/2007 Albrecht et al.
7,264,011 B2 9/2007 Cohen
7,276,076 B2 10/2007 Bieberich
7,364,584 B2 4/2008 Anderson
2002/0020439 A1 2/2002 Tate
2002/0026742 A1 3/2002 Washington
2004/0099299 A1 5/2004 Wu
2004/0159346 A1 8/2004 Huang
2005/0015127 A1 1/2005 Bieberich
2005/0016573 A1 1/2005 Wu
2005/0143796 A1 6/2005 Augustine et al.
2005/0161069 A1 7/2005 Wu
2005/0183761 A1 8/2005 Livacich
2005/0224107 A1* 10/2005 Yang ..... 135/135
2005/0252541 A1 11/2005 Chen
2006/0000499 A1 1/2006 Livacich

| | | | |
|---|---|---|---|
| 2006/0016467 | A1 | 1/2006 | Bae |
| 2006/0037636 | A1 | 2/2006 | Lin |
| 2006/0047332 | A1 | 3/2006 | Malmberg et al. |
| 2006/0122671 | A1 | 6/2006 | Albrecht et al. |
| 2006/0122672 | A1 | 6/2006 | Anderson |
| 2006/0147320 | A1 | 7/2006 | Hansen et al. |
| 2006/0162756 | A1 | 7/2006 | Gao |
| 2006/0184216 | A1 | 8/2006 | Van Duren |
| 2006/0184217 | A1 | 8/2006 | Van Duren |
| 2006/0184218 | A1 | 8/2006 | Bieberich |
| 2006/0185704 | A1 | 8/2006 | Guo et al. |
| 2006/0259104 | A1 | 11/2006 | Panser |
| 2006/0283491 | A1 | 12/2006 | Livacich |
| 2006/0283492 | A1 | 12/2006 | Livacich |
| 2007/0000533 | A1 | 1/2007 | Tseng |
| 2007/0093882 | A1 | 4/2007 | Anderson et al. |
| 2007/0093883 | A1 | 4/2007 | Anderson et al. |
| 2007/0093884 | A1 | 4/2007 | Anderson et al. |
| 2007/0093885 | A1 | 4/2007 | Anderson et al. |
| 2007/0175504 | A1 | 8/2007 | Tseng |
| 2007/0239239 | A1 | 10/2007 | Albrecht et al. |
| 2008/0027521 | A1 | 1/2008 | Bieberich |
| 2008/0027522 | A1 | 1/2008 | Bieberich |
| 2008/0125840 | A1 | 5/2008 | Anderson |
| 2009/0065039 | A1 | 3/2009 | Livacich |

FOREIGN PATENT DOCUMENTS

| | | |
|---|---|---|
| GB | 2054002 | 2/1981 |
| GB | 2259927 | 3/1993 |
| GB | 2265165 | 9/1993 |
| GB | 1 462 033 | 1/1997 |
| JP | 5113059 | 5/1993 |
| SE | 525 415 | 2/2005 |
| WO | WO 97/14381 | 4/1997 |
| WO | WO 98/48652 | 11/1998 |
| WO | WO 00/62726 | 10/2000 |
| WO | WO 03/086500 | 10/2003 |
| WO | WO 03/106897 | 12/2003 |
| WO | WO 2004/004500 | 1/2004 |
| WO | WO 2006/020170 | 2/2006 |
| WO | WO 2006/062910 | 6/2006 |
| WO | WO 2006/063027 | 6/2006 |
| WO | WO 2006/086587 | 8/2006 |
| WO | WO 2007 047917 | 4/2007 |
| WO | WO 2008 013603 | 1/2008 |
| WO | WO 2008 091486 | 7/2008 |

* cited by examiner

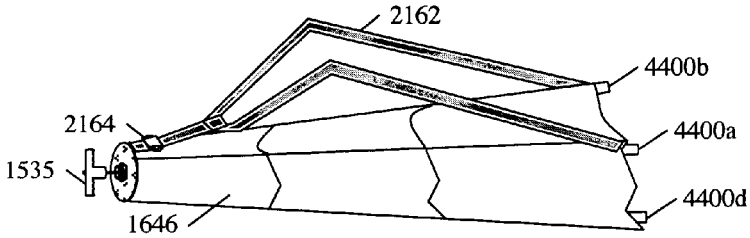
Fig. 17Q
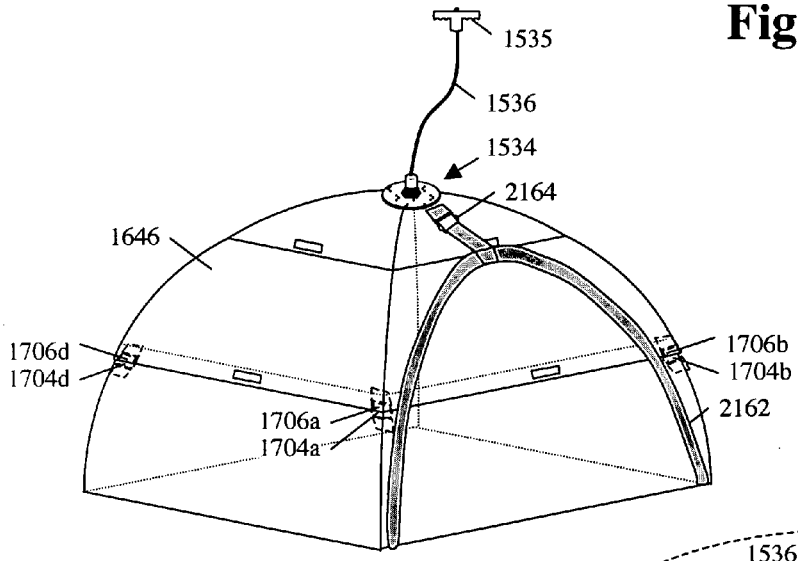
Fig. 17R
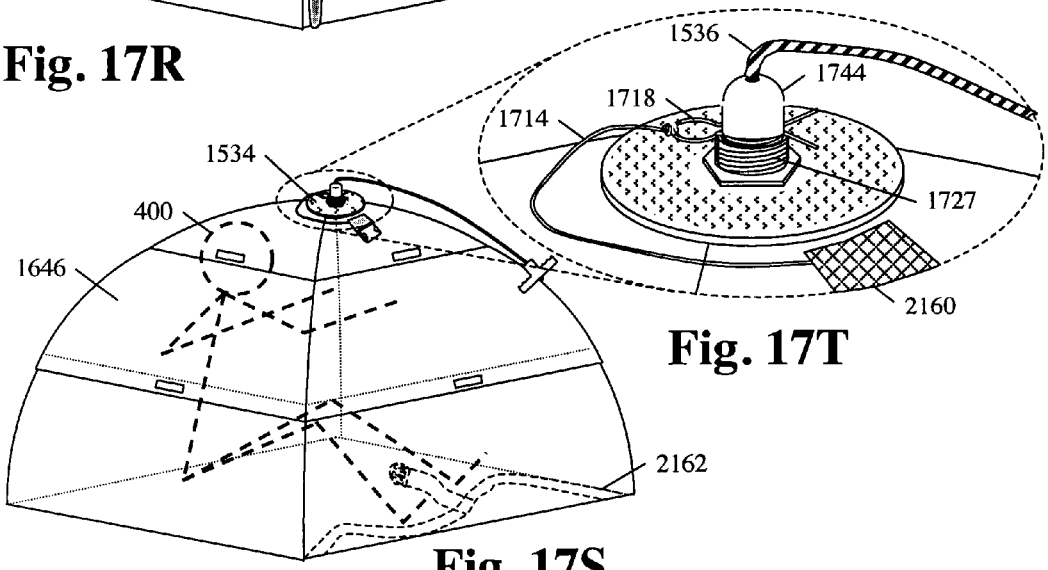
Fig. 17T
Fig. 17S

SYSTEM FOR CONCEALMENT AND SHELTER WITH STRUCTURE FOR RAPID SETUP AND TIGHT SKIN

RELATED APPLICATIONS

The following summarizes the related applications. The subheadings are internal docket numbers and are used for shorter reference to the related application or patent.

| | | |
|---|---|---|
| MOC-PPA | Lightweight portable concealment means and methods | |
| | Provisional Application Serial #60/295,956 | Filing Date: Jun. 4, 2001 |
| MOC1 | Lightweight portable concealment means and methods | |
| | Patent Application Serial #10/161,986 | Filing Date: Jun. 4, 2002 |
| | Publication Number 2002/0189660 | Publication Date: Dec. 19, 2002 |
| | Now U.S. Pat. No. 7,100,626 | Issue Date: Sep. 5, 2006 |
| MOC2 | Universal lightweight portable concealment means and methods | |
| | Patent Application Serial #11/045,736 | Filing Date: Jan. 28, 2005 |
| | Publication Number 2005/0183761 | Publication Date: Aug. 25, 2005 |
| MOC3 | Modular system for concealment and shelter | |
| | Patent Application Serial #11/155,398 | Filing Date: Jun. 16, 2005 |
| | Publication Number 2006/0000499 | Publication Date: Jan. 5, 2006 |
| MOC4 | Modular system for concealment and shelter | |
| | Patent Application Serial #11/295,305 | Filing Date: Dec. 5, 2005 |
| | Publication Number 2006/0283491 | Publication Date: Dec. 21, 2006 |
| POLE1 | Modular system including shaft segments having configuration and breakdown attachments | |
| | Patent Application Serial #11/484,106 | Filing Date: Jul. 10, 2006 |
| | Publication Number 2006/0283492 | Publication Date: Dec. 21, 2006 |

CONTINUATION AND PRIORITY CLAIMS

This application is a continuation-in-part of, and claims priority based on POLE1 (i.e., U.S. patent application Ser. No. 11/484,106, filed Jul. 10, 2006). This application also continues subject matter disclosed first in U.S. Pat. No. 7,100,626 and co-pending application Ser. Nos. 11/045,736, 11/155,389, and 11/295,305. The related applications are herein included by reference. This application claims priority based on each of the related applications, back to, and including, U.S. provisional application Ser. No. 60/295,956, filed Jun. 4, 2001.

BACKGROUND

1. Field of the Invention

This invention relates to lightweight portable concealment and shelter systems and methods.

2. Description of Prior Art

There is often a need to conceal oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Various methods have been employed to accomplish these tasks.

In the past, quite complex, heavy structures have been built or constructed for concealment. Hunters have built permanent hunting blinds. Portable huts, shower stalls, dressing shelters, tents, canopies, and complex tree blind structures have been carried into the great outdoors.

The related applications provided lists of patents and products relating to this field of invention. The discussion of these prior art references is included by reference.

The use of such devices has several disadvantages such as being heavy, bulky, noisy, expensive, and complicated to assemble or use. Most of these devices have only a single use with poor performance. There is a need for a simple, lightweight, compact, portable, multi-use means of concealment.

To avoid being detected by their scent, hunters and other wildlife observers climb trees using tree steps and then remain for hours in a tree stand watching and waiting for animals to pass by. However, a person in a tree stand makes a silhouette against the sky or background and is exposed to a 360-degree view. Animals can easily detect the human silhouette or movement. Further, if the person or equipment makes a noise the animal will know where to look. There is a need for a device that eliminates the silhouette.

Complicated equipment or procedures create a situation where a person may drop equipment or, even worse, fall from the tree stand. Most of the existing devices block the view or mobility of the person.

Metal objects screwed into trees are sometimes forgotten and become over grown by the tree. Later when the lumber is harvested and cut, the saw strikes the metal object and can cause severe damage. Some states have banned the use of metal tree screws or spikes. Any device used for attaching to trees in the forest needs an embodiment that attaches to the outside of the tree and can be easily removed.

The following ground blinds or tents are known in the art:

Hunter's Specialties' "Lightweight Portable Ground Blind"

Avery' "Avery Quick Carry Ground Blind"

U.S. Pat. No. 5,062,234, entitled "Portable Blind"

Double Bull "Matrix"

Cabela's "Lightning Set" and "Lightning Set 4-Season"

Black Stump's "Instant Tent"

There are a number of very old patents relating to curtain support brackets. These are associated with hanging curtains inside a building on a wall and fail to anticipate many novel features of the present invention.

There are also a number of very old patents relating to tents with hinged shafts, such as U.S. Pat. No. 1,502,898, Berg, filed Jan. 12, 1924, or umbrella tents, such as U.S. Pat. No. 1,649,219, Goldberg, filed Mar. 23, 1927. U.S. Pat. No. 74,933, Palmer, issued Feb. 25, 1868, disclosed an inverse umbrella-type frame deployed by a rope external to the enclosure. U.S. Pat. No. 3,794,054, Watts, issued Feb. 26, 1974, disclosed an inverse umbrella tent.

However, these are limited in various ways as discussed above and below.

It is also desirable to have a blind that can provide shelter from the elements. Lightweight, portable tents with nylon shells, rain flies, and external fiberglass poles are well known, but there have not been major innovations in basic structure and configuration of such tents in the last two decades. Each tent comes with a predetermined number of parts and is limited to a single configuration.

What is needed is a modular system of components that could be used to construct a wide variety of outdoor blinds and shelters. With such a modular system, the same components could be used to shelters.

BACKGROUND

Human Body Strength and Skin Tightening

In the field of lightweight, portable outdoor blinds, there is a long felt need to have skins extremely tight to avoid detectable movement and noise. Numerous blind designs have attempted to provide the desired skin tightness but have failed without using complex, heavy frames that require significant time and athleticism to setup. Those that are lightweight and fast, such as conventional umbrella designs, fail to put enough force into the frame to provide the desired result. Further, because many blind products have promised, but have failed to deliver, cover skins that remain substantially motionless in windy conditions encountered while hunting, consumers are skeptical. To be successful a product must also stay taut when shaken by potential buyers on the trade show floor or in dealers' show rooms.

The arm muscles (biceps and triceps) of the human body are relatively weak compared to other muscle groups such as the legs, abdomen, back, and shoulders. This is especially true when arms are extended away from the body above the shoulders as is required to deploy conventional umbrella type blinds. Such blinds are setup with the frame expanded in an upright position and the operator either a) pushing up from inside with one hand while pulling a pull cord or shaft down with the other hand, or b) pushing down from outside with one hand while pulling a pull cord up with the other hand while standing beside the structure. For example, see the art cited in U.S. Pat. No. 6,354,316, Chen. Neither of these conventional methods take advantage of the strongest muscles groups in the body to provide the skin tightening force.

In the power jerk position, the full human body can apply hundreds of pounds of force between the hands and the feet. In 1970 for example, Olympic lifters were able to clean and jerk over 500 lbs. A typical outdoorsman can apply up to about 75 pounds of continual force in the power jerk position. A six-foot human body has about 33 inches up to about 40 inches of range of motion in the power jerk.

In a horizontal, seated row position, for example as used in Olympic rowing, all of the large muscle groups of the body, including legs, abdomen, back, shoulder, and arms, are used to apply the force through the body between the feet and the hands. A typical outdoorsman can apply up to about 75 pounds of force in the seated row position, with an average of about 40 pounds over the full stroke. A six-foot human body has up to about 45 inches of range of motion in the seated row position (and about up to 65 inches if the arms are extended beyond the head).

Work or energy is measured in foot-pounds. When an operator applies an average of 45 pounds of force over a distance of 3.5, feet (i.e. 42 inches) about 157 foot-pounds of energy is applied. About the same amount of energy could also be stored by applying 57 pounds of force over a distance of 2.75 feet (i.e. 33 inches).

What is needed is a method of setting up a blind where the full muscle strength of the human body from hands to feet can be used to quickly provide the skin tightening force to a lightweight, portable blind.

SUMMARY OF THE INVENTION

Accordingly, it is an objective of the present invention to provide an easy to use, universal, simple, lightweight, compact, portable, quiet, multi-use modular system for concealment and shelter, which can additionally be rapidly setup using the large muscle groups of the full human body resulting in tight cover skin.

OBJECTS AND ADVANTAGES

Accordingly, beside the objects and advantages described above, some additional objects and advantages of the present invention are:

1. To provide a modular system of components that can be used to construct a variety of outdoor blinds and shelters.
2. To provide a basic module that can be used to create a tree blind, ground blind, and waterfowl blind by reconfiguring the same components.
3. To provide advanced modules that can be used with one or more basic modules to form more complex structures for use as both blinds and shelters.
4. To provide blind and shelter modules that can be interconnected with other modules to accommodate the needs of larger groups.
5. To provide overhead cover to enhance the effectiveness of an otherwise open blind.
6. To provide modular components that can be assembled in a specific configuration and then can be broken down without disassembly, so that the specific configuration can be quickly put up at a later time.
7. To provide a bracket that can be attached to either a vertical or horizontal structure, or that can be inserted into the ground.
8. To provide a multi-legged bracket wherein the legs can be configured and then held at any angle.
9. To provide a method of removably attaching shaft segments whereby shafts can pass through a material whereby portions of the shaft can be inside a structure and other portions of the same shaft can be outside the structure.
10. To provide a method of removably attaching shaft segments whereby the shaft segments are held together regardless of whether an external pressure is forcing them towards or away from each other.
11. To provide a method of assembling an outdoor structure wherein the supports for the structure are secured to the ground independent of having the supports interconnected or covered.
12. To provide a modular system that can be used on steep terrain.

13. To provide methods of tightening a skin of a blind to reduce undesired motion.
14. To provide a method of tightening a shoot through panel to reduce the drag or other effect on a projectile as it passes through the panel.
15. To provide a covered structure with unobstructed openings.
16. To provide a blind or shelter structure with an overhead window whereby a rain fly can be installed and removed without leaving the structure.
17. To provide a blind with upper opening, in addition to other horizontal openings, whereby the operator's line of sight is not obstructed vertically.
18. To provide a cover module that can be used alone or as part of a more complex combination of components.
19. To provide a method of holding cover shafts taut within a cover component whereby the cover can be used alone or placed and secured on other basic modules.
20. To provide a method of holding cover shafts taut within a cover component wherein the cover shafts can have more than one predetermined length.
21. To provide a method of holding the end of a cover shaft inside a cover without damaging the cover during repetitive use.
22. To provide shoot-through (or blackout sections) that can be moved to cover openings in a blind or shelter structure.
23. To provide shoot-through (or blackout sections) that can be moved to cover openings in a blind or shelter structure while maintaining skin tightness.
24. To provide a fully enclosed blind that allows unobstructed line of sight in 360 degrees of a substantially horizontal plane.
25. To provide a fully enclosed blind that allows unobstructed line of sight in 180 degrees in a substantially vertical plane on steep terrain.
26. To provide an improved wildlife research blind.
27. To provide an improved hunting blind.
28. To provide an improved tree stand concealment means.
29. To provide a quick, silent means of lowering or raising a screen, window, or panel.
30. To provide a pivotal means of attachment that maintains its frictional force.
31. To provide an option for attaching to the outside of a tree.
32. To provide unobstructed vision or shooting lanes.
33. To provide a means of concealment by hiding in front of a similar pattern.
34. To provide a system that can be used as a ground blind as well as a tree blind.
35. To provide a universal support with multiple legs which can be used with a curtain to form various configurations to meet the needs of various environments and uses.
36. To provide improved means of construction with lower cost and longer reliability.
37. To provide methods and means of tightening the skin on the sides of a blind cover to reduce movement and flutter.
38. To provide means for attaching a bow cord to a cover shaft.
39. To provide a corner loop in a cover for securing the cover to a support or a ground stake.
40. To provide a blind window with four or more sections such that any section or groups of sections can be independently opened while maintaining taut cover panels.
41. To provide a cover that can have the top fully opened.
42. To provide a window section attachment such that non-adjacent sections can be attached.
43. To provide a low profile, quiet blind.
44. To provide a cover for a blind or shelter that can be configured in a taller position and in a lower position, while still maintaining taut cover panels.
45. To provide a cover for a blind or shelter that can be configured in a horizontal position and in a rotated position, while still maintaining taut cover panels.
46. To provide a cover for a blind or shelter that can be configured in a rotated position whereby the user can come up out of the blind without hitting the shaft interconnection directly overhead.
47. To provide methods and means for extending cover shafts and removably attaching the corners of the cover at predetermined configuration lengths.
48. To provide a frame base for a standalone configuration.
49. To provide a frame base for improved skin tightening.
50. To provide an adjustable frame base for improved skin tightening.
51. To provide pivoting arches for rapid breakdown and relocation.
52. To provide tie downs for improved integrity in high wind conditions.
53. To provide an umbrella support for attaching to a tree whereby an umbrella is positioned in multiple positions, including a closed position away from an operator.
54. To provide methods and means for reducing scent detection.
55. To provide an arch flattening means for an arched structure where usable headroom under the arch is increased.
56. To provide a self-adjusting docking mechanism comprising a dock with a broad curved docking surface and a docking shaft with a rounding tip, each connected to a plate.
57. To provide a method of manufacturing docking mechanism plates with easy assembly and repair reassembly.
58. To provide a safety means to protect an operator from unplanned release of force stored in a setup frame.
59. To provide a cover locking means to prevent cover material from fouling the docking mechanism.
60. To provide foot attaching means to facilitate the setup of a blind using the large muscle groups of the full human body.
61. To provide hand attaching means to facilitate the setup of a blind using the large muscle groups of the full human body.
62. To provide hand attaching means which protects the hands from injury from the docking mechanism.
63. To provide hand and foot attaching means to facilitate the setup of a bind the horizontal rowing position.
64. To provide a spreading strap to facilitate the substantially horizontal setup of a folding blind.
65. To provide a spreading strap means that doubles as a carrying strap means.
66. To provide an arch flattening hinge that provides structure strength and stability during initial spreading and during final docking, resulting in smooth setup and reducing breakage.
67. To provide a method of rapidly releasing stored forces in a frame using a booted foot whereby the hands and head of the operator are safely positioned away from the force release area.
68. To provide a shaft hinge that is easily locked and unlocked.
69. To provide a shaft hinge locked by a channeled sliding cylinder.
70. To provide a shaft hinge locked by a magnetic sliding cylinder.

71. To provide a telescoping shaft comprised of a solid, elastically flexible shaft and at least one hollow, elastically flexible shaft whereby the telescoping shaft provides a spring force while bent regardless of the degree of telescoping.
72. To provide a multiply arched cylindrical.
73. To provide hand and foot attaching means to facilitate the setup of a blind using the power jerk position.
74. To provide a collapsible, adjustable fan configuration that results in an arched dome structure. These and other features and advantages of the present invention will become apparent upon consideration of the following specification, claims, and drawings.

DRAWING FIGURES

In the drawings, closely related figures have the same number but different alphabetic suffixes.

REFERENCE NUMERALS IN DRAWINGS

Figure 1A:
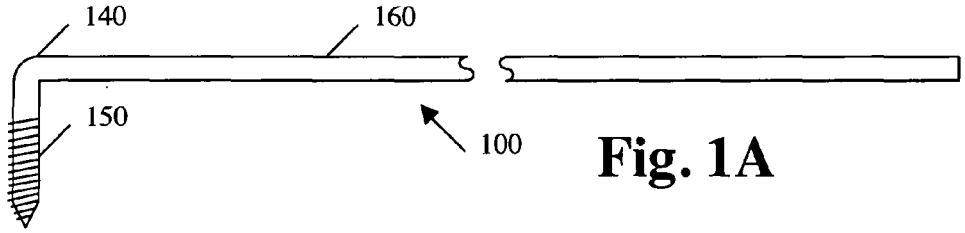
FIG. 1A through FIG. 1C show various embodiments of the support of the present invention.

| | |
|---|---|
| 100 | attaching pivoting support |
| 101 | alternate support |
| 102 | threaded support |
| 106 | shaft |
| 107 | segmented shaft |
| 108 | telescoping shaft |
| 126b | cord attachment or knot |
| 126 | elastic cord |
| 130 | attaching structure |
| 140(a-b) | bend |
| 150 | first leg |
| 160 | second leg |
| 165 | third section |
| 170 | end-cap |
| 194 | dimpled connector |
| 197(a-c) | retaining dimple |
| 300 | curtain |
| 307(a-d) | alternate curtain |
| 350 | slit |
| 362 | drawstring clip |
| 364 | drawstring |
| 368(a-d) | grommet |
| 400(a-b) | operator |
| 410 | path |
| 640 | curtain opening |
| 700 | straight connector |
| 760(a-e) | connected shaft |
| 1070 | inserting end(male) |
| 1072 | receiving end(female) |
| 1075 | cord retainer |
| 1077 | connector threads |

-continued

| | |
|---|---|
| 1088 | bolt |
| 1096 | slot mark |
| 1097(a-i) | indicator |
| 1210 | top window fastener |
| 1212a | left window fastener |
| 1212b | right window fastener |
| 1212 | side window fastener |
| 1218a | top left section |
| 1218b | top right section |
| 1220 | triangle section |
| 1230a | left section |
| 1230b | right section |
| 1240 | cover hole |
| 1300 | case |
| 1310 | belt loop |
| 1410(a-g) | intersection clip |
| 1412(a-d) | clip member |
| 1500(a-b) | cover shafts |
| 1500 | segmented cover shaft |
| 1510a | top cover shaft |
| 1510b | bottom cover shaft |
| 1510 | alternate cover shaft |
| 1511 | cover shaft intersection |
| 1512(a-d) | hinged(halfarch) cover shaft |
| 1513(a-d) | shaft end with hole |
| 1514(a-d) | arch flattening shaft |
| 1516(a-d) | arch flattening hinge |
| 1518(a-b) | hinge wall |
| 1526 | tie down cord |
| 1528 | tie down loop |
| 1530 | shelter frame |
| 1531 | framebase |
| 1533 | pull cord extension |
| 1534 | fast setup frame |
| 1535 | pull handle |
| 1536 | pull cord |
| 1537 | handle snap |
| 1538 | handle snap receiver |
| 1539 | handle standoff |
| 1540 | cover |
| 1542(a-d) | cover panel |
| 1544 | cover seam |
| 1546 | cover roll |
| 1550 | rain fly |
| 1554 | fly cord |
| 1556 | fly fastener |
| 1559 | rain fly shaft |
| 1571 | topattachment |
| 1573 | bottomattachment |
| 1574(a-b) | bow cordattachment |
| 1576 | slip knot |
| 1602 | opening |
| 1604 | cylindricalarched roof unit |
| 1612(a-d) | cover window |
| 1622(a-d) | corner loop |
| 1624(a-b) | cover loop |
| 1626 | bow cord |
| 1630 | alternate cover |
| 1631 | cover cap |
| 1632(a-d) | overhead window |
| 1634 | door |
| 1636 | door fastener |
| 1642 | shoot-through panel |
| 1643 | extended configuration with star windows |
| 1646 | quiet cover |
| 1650 | rain fly configuration |
| 1651 | ridge |
| 1652 | fly loop |
| 1660 | cover with windows |
| 1661 | alternate cover with windows |
| 1662 | overhead window fastener |
| 1672 | window roll |
| 1684 | strapattachment |
| 1686(a-d) | skirt strap |
| 1695 | coverbottomarc |
| 1704(a-d) | receiving clip |
| 1705 | safety strap |
| 1706(a-d) | inserting clip |

-continued

| | |
|---|---|
| 1714 | safety clip cord |
| 1715 | safety clip |
| 1716 | safety clip edge |
| 1717 | round wire clip |
| 1718 | rectangular wire clip |
| 1722 | intersection dock |
| 1723 | dock |
| 1724 | dock plate |
| 1725 | dock curved surface |
| 1727 | dock conduit |
| 1728 | washer nut |
| 1740b | receiving-to-receiving connector |
| 1742 | dockingassembly |
| 1743 | docking shaft |
| 1744 | docking tip |
| 1745 | safety groove |
| 1746 | docking plate |
| 1760b | inserting-to-inserting connector |
| 1763(a-d) | threadedaxles |
| 1764(a-b) | half plate |
| 1766 | axle ring |
| 1767 | ring opening |
| 1768 | ring groove |
| 1769 | plate hole |
| 1776 | hand grip |
| 1778 | hand guard |
| 1780 | umbrella |
| 1790 | footattaching means |
| 1792 | foot plate |
| 1794 | gripping texture |
| 1795 | foot pad |
| 1796 | foot plate with foot pads |
| 1797 | foot plate notch |
| 1798(a-b) | toe strap |
| 1799(a-b) | stirrup |
| 1800 | adjustable bracket |
| 1810(a-d) | bracket leg |
| 1820 | quick release |
| 1847 | nut |
| 1851 | fan fly material |
| 1858 | batten |
| 1860b | shoot-through umbrella section |
| 1862 | wider umbrella section |
| 1870(a-b) | vertical hem |
| 1871 | gather |
| 1872(a-b) | frown edge |
| 1910 | guyline module |
| 1912(a-d) | guyline |
| 1920 | blackout panel |
| 1922 | see-through panel |
| 1936 | guyline hook |
| 1937 | closable clip |
| 2010 | skirt |
| 2050 | skirt door |
| 2100 | hinged inserting end |
| 2102 | hinge pin |
| 2104 | tenon |
| 2160(a-b) | spreading strap |
| 2162 | wishbone strap |
| 2164 | spreading strap clip |
| 2166 | closure strap |
| 2235 | unthreadedarm(or leg) |
| 2252 | stake with hook |
| 2260 | locking slide |
| 2262 | magnetic slide |
| 2264 | shaft hinge |
| 2266 | telescope locking means |
| 2268 | threaded sleeve |
| 3072 | channeled receiving end |
| 3074 | dual-locking channeled receiving end |
| 3093 | multi-leg locking channel |
| 3094(a-d) | locking channel |
| 3095(a-d) | neck |
| 3096(a-d) | channel leg |
| 3097(a-c) | alternate indicator |
| 3102 | sleeved support |
| 3103 | graduated sleeve |
| 3104(a-h) | sleeve |
| 3106 | cord opening |

-continued

| | |
|---|---|
| 3107 | shaft opening |
| 3108 | plain sleeve |
| 3180(a-d) | banded support |
| 3181(a-b) | retainingband |
| 3193(a-h) | retaining shaft |
| 3194(a-b) | channeled connector |
| 3195(a-i) | hemispherical outward protrusion |
| 3196(a-i) | rectangular pyramidal outward protrusion |
| 3197(a-d) | half-length shaft segment |
| 3198(a-d) | retaining sleeve |
| 3199(a-l) | channeled shaft segment |
| 3206 | graduated channeled receiving end |
| 3410(a-b) | pole clip |
| 3414(a-d) | cord clip |
| 3416(a-b) | bow cord clip |
| 3420(a-b) | swivel clip |
| 3434(a-b) | flared edge |
| 3450(a-d) | stake with cord clips |
| 3452 | multiple cord clip member |
| 3454 | stake member |
| 3456 | stake with cord clipsand leg |
| 3458 | stake with single cord clip |
| 3460(a-d) | alternate dual-swivel clip |
| 3462(a-b) | fixed cord clip |
| 3464(a-b) | inserting end swivel |
| 3466 | alternate swivel clip |
| 3468 | alternate dual-swivel hub |
| 3500 | pivoting intersection connector |
| 3510 | intersection member with band |
| 3512 | intersection band |
| 3514 | intersection member with alternate band |
| 3516 | alternate band |
| 3520 | intersection member with hub |
| 3522 | intersection hub |
| 3524 | latch thumb grip |
| 3526 | intersection latch |
| 3530 | dual-swivel pole receptacle |
| 3531 | threaded dual-swivel pole receptacle |
| 3532 | alternate dual-swivel pole receptacle |
| 3533 | alternate threaded dual-swivel pole receptacle |
| 3534(a-b) | pole receptacle |
| 3535 | threaded pole receptacle |
| 3536 | corner pole receptacle |
| 3537 | threaded corner pole receptacle |
| 3538 | male alternate dual-swivel pole receptacle |
| 3539 | male alternate dual-swivel pole receptacle with bow cord clip |
| 3540 | pressure release spring |
| 3542 | sheath(protective tubing) |
| 3560(a-d) | dual-universal clip base |
| 3570(a-h) | corner base connector |
| 3572 | alternate corner base connector |
| 3574 | corner base connector with clips |
| 3600(a-d) | base segmented shaft |
| 3610(a-h) | base cross shaft |
| 3700(a-b) | pivoting arches |
| 3802 | receiving support with bends |
| 4100 | corner hook |
| 4102(a-c) | side loop |
| 4104(a-c) | corner tightening |
| 4106(a-b) | side loop attachment |
| 4400(a-d) | end piece with hook |
| 4402 | end piece with slot |
| 4404 | end piece slot |
| 4406 | pull tab |
| 4410 | extension |
| 4500(a-d) | locking elbow |
| 4502 | elbow |
| 4504 | elbow hole |
| 4575 | piston |
| 4577 | elbow threads |
| 4579 | elbow screw |
| 4700(a-b) | magnet |
| 4701 | magnetic piece |

SPECIAL DEFINITIONS cord—a flexible, and possibly elastic, filament including but not limited to a fiber, thread, string, rope, twine, wire, cable, yarn, thong, tendon, or line.

curtain—a concealing or protecting sheet (or strips) of material.

grommet—a flexible loop that serves as a fastening, support, or reinforcement or an eyelet of firm material to strengthen or protect an opening or to insulate or protect something passed through it.

eyelet—a typically metal or plastic reinforcement for a hole.

shaft—a supporting member in construction including but not limited to any solid or hollow, round or rectangular bar, beam, pole, rod, spar, or tube composed of wood, plastic, metal, or composite material.

DESCRIPTION OF THE INVENTION

The present invention comprises an easy to use, simple, lightweight, compact, portable modular system for concealment and shelter and methods for its construction and use. The main components of a basic module are various novel supports and a curtain. The support attaches to a structure and pivots at the attachment. Other modules include novel covers with cover shafts, a removable floor, a rain fly, and various novel flies and shields. The modules can be combined to form various tree blinds, ground blinds, waterfowl blinds, blinds attached to vessels or vehicles, and various shelters. The system uses novel shaft segments that can be attached in various configurations and then broken down without detaching the attachments. The present invention encompasses various embodiments of the attaching pivoting support as well as various embodiments of curtains with various features. A method of the present invention allows for 360-degree concealment. In addition to a method of being fully enclosed, a method of the present invention is based on the concept of "hiding in front" of a similar pattern.

The present invention is also directed to various structures and methods for skin tightening for a shelter or blind, especially hunting blinds. Novel frame structures are used to stretch and thereby tighten the skin of a hunting blind. The present invention includes the discovery that when a cover is stretched over an arched dome, the lower portion of each cover wall is relatively loose. Various solutions to this problem are provided. Various prior attempts to provide lightweight portable blinds with cover skins that remain tight in blustery, hunting conditions have failed because the structure is too weak and/or the setup method does not allow a human operator to apply a sufficient force to the skin tightening mechanism. The present invention includes novel structures and methods that allow the large muscle groups of the full human body to apply a skin stretching force to setup a blind with previously unrealized results.

Figure 1B:
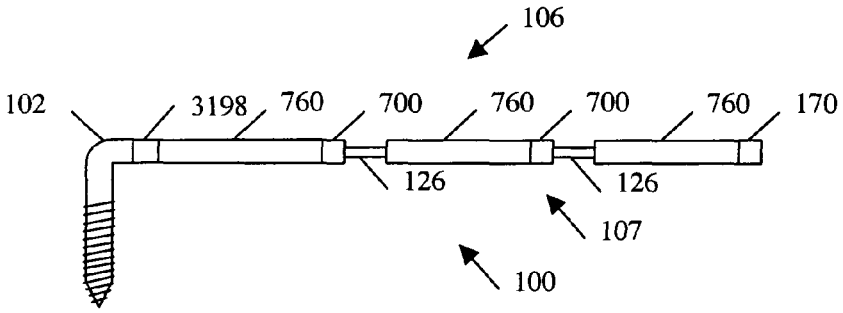
Figure 1C:
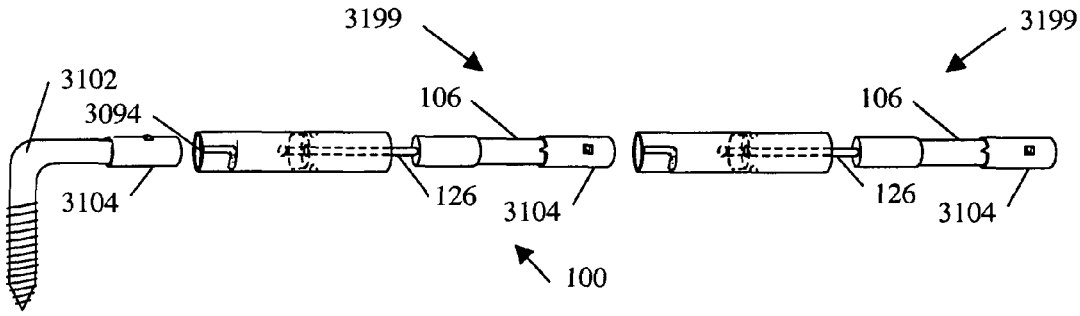

FIG. 1A Through FIG. 1C

FIG. 1A illustrates an exemplary embodiment of an attaching pivoting support 100. The support 100 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230. The bend 140 allows a user to exert a force on the second leg 160 that acts as a lever to screw the first leg 150 into the attaching structure 130.

The angle of the bend 140 is shown as a 90-degree angle; however, good results have also been obtained by using an obtuse angle. An obtuse angle still provides a leveraged force but is less likely to cause the second leg 160 to be blocked by tree branches or other obstructions.

In this exemplary embodiment, a portion of the threaded portion of the first leg 150 is cylindrical, not tapered, so that once attached to the attaching structure 130, the second leg 160 can be rotated up and down around the first leg 150 without losing frictional force necessary to hold the attaching pivoting support 100 in the position the operator leaves it.

The attaching pivoting support 100 can be constructed of a single shaft. However, depending on construction materials, a lighter embodiment can be constructed by combining various components. This invention anticipates that any combination of parts can be used to make the attaching pivoting support 100 with equivalent structural features and functions. Examples of some embodiments are shown in FIG. 1B and FIG. 1C.

FIG. 1B shows an embodiment of the attaching pivoting support 100 comprised of the threaded support 102, the threaded connector 104, and the shaft 106. The threaded connector 104 screws onto the threaded support 102 and is attached to the shaft 106. Good results have been obtained by making the threaded support 102 from hardened steel, by making the threaded connector 104 from a metal tube, and by making the shaft 106 from fiberglass. Good attachment results have been obtained by gluing the metal tube to the fiberglass. In this embodiment the shaft 106 is comprised of a plurality of connected shafts 760 each connected to a connector. In this embodiment each connected shaft 760 is connected to a straight connector 700. These collectively form a segmented shaft 107.

FIG. 1B further shows an example where the shafts are hollow and connected with an elastic cord 126. The elastic cord 126 running through the centers of the shaft 106 components (e.g. 760) connects the components. The elastic cord 126 prevents components from falling and makes it easier to assemble the shaft 106.

FIG. 1C shows a currently preferred embodiment the attaching pivoting support 100 comprised of the sleeved support 3102 and the second leg 160 comprised of a plurality of channeled shaft segments 3199 (which is one embodiment of a shaft segment 199). The sleeved support will be described in more detail in reference to FIG. 3F. The channeled shaft segments 3199 will be described in more detail in reference to FIGS. 2B and 2D.

Additional details and alternatives of construction and advantages regarding FIG. 1A through FIG. IC are provided in the POLE1 application included herein by reference.

FIG. 2A Through FIG. 2E

Figure 2A:
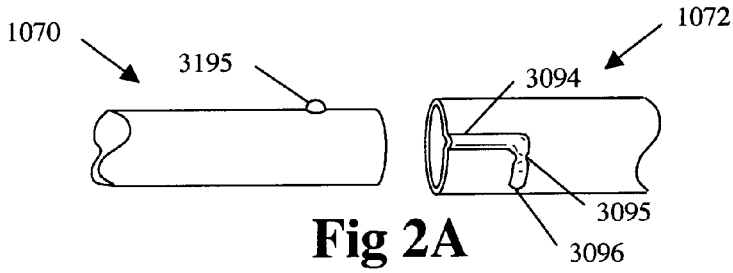
FIG. 2A through FIG. 2E show various connectors having outward protrusions.

FIG. 2A shows a novel embodiment of a receiving end 1072 having a locking channel 3094 capable of receiving an inserting end 1070 with an outward protrusion. As shown in FIG. 2A the locking channel has a bend in the path forming a channel leg 3096. The locking channel 3094 also features a neck 3095 that is a relatively narrow portion of the channel.

Figure 3A:
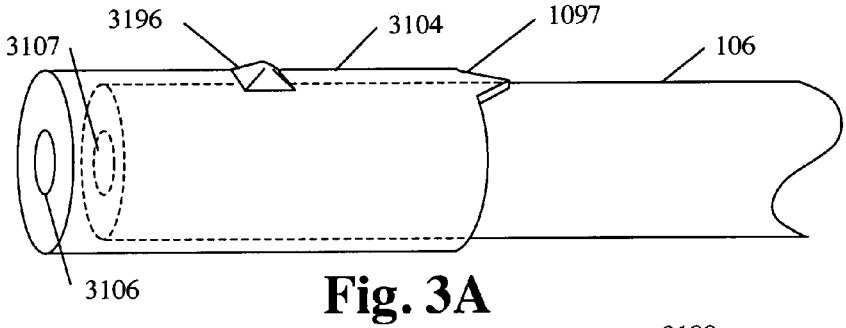
FIG. 3A through FIG. 3G show various embodiments having sleeves and channeled connectors.

FIG. 2A also shows a corresponding novel embodiment of an inserting end 1070 having an outward protrusion. As shown in FIG. 2A the outward protrusion is a hemispherical outward protrusion 3195. The outward protrusion is not limited to hemispherical shape; for example, in the currently preferred embodiment as shown in FIG. 3A, the outward protrusion is shown as a pyramidal outward protrusion 3196.

When an outward protrusion passes through the locking channel 3094 and reaches the neck 3095, the user must assert a slightly stronger force to cause the outward protrusion to pass the neck 3095. The neck 3095 will then prevent the outward protrusion from passing back out of the locking channel without the assertion of a slightly stronger force. Thus the locking channel 3094 operates with the outward protrusion (3195 or 3196) to form a configuration connection that will remain connected until disconnected by the user.

Figure 2B:
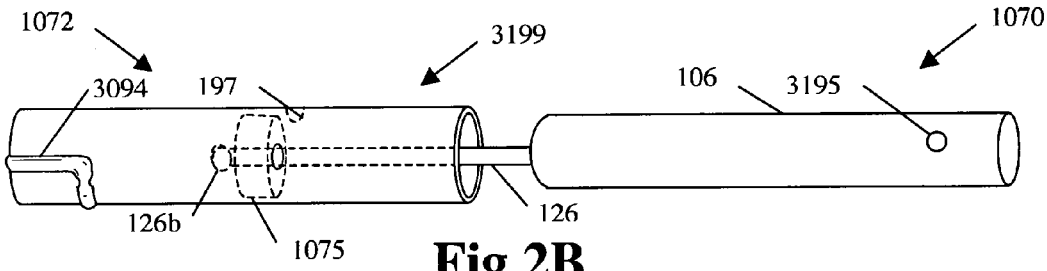

FIG. 2B shows the details of the novel channeled shaft segment 3199 (shown earlier in FIG. 1C). In addition to the configuration attachment shown in FIG. 2A, each shaft segment 3199 also has a breakdown attachment.

Figure 2C:
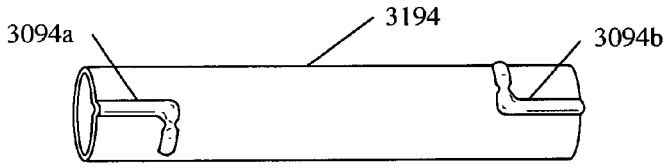

FIG. 2C shows a novel embodiment of a channeled connector 3194 having two receiving ends 1072 each having a locking channel 3094*a* and 3094*b*, respectively. Each locking channel 3094 is capable of receiving an inserting end 1070 with an outward protrusion.

Figure 2D:
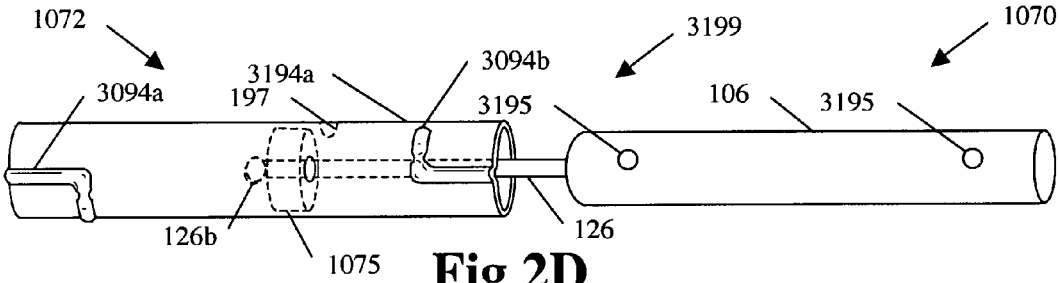

FIG. 2D shows an alternate embodiment of novel channeled shaft segment 3199. In contrast to the embodiment shown in FIG. 2B, this embodiment comprises a channeled connector 3194 and a shaft 106 with two outward protrusions (3195 shown as shown or 3196), one on each end of the shaft.

Figure 2E:
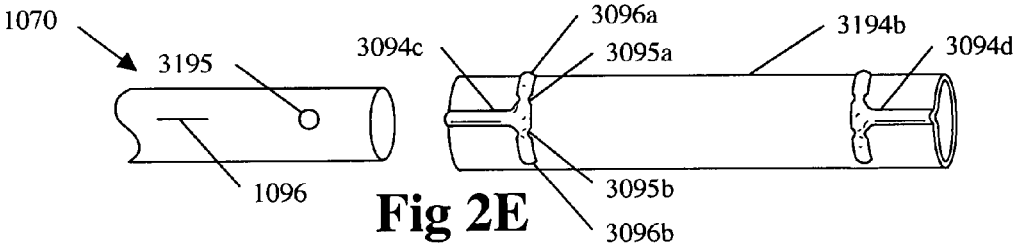

FIG. 2E shows another embodiment of a channeled connector 3194*b* having two receiving ends 1072 each having alternate locking channels 3094*c* and 3094*d*, respectively. In this embodiment each locking channel 3094 has two opposing channel legs 3096*a* and 3096*b*, respectively. Each channel leg has a neck 3095*a* and 3095*b*, respectively. This embodiment has the advantage of being able to lock with either a clockwise or counter-clockwise rotation.

FIG. 2E also shows the inserting end 1070 having a slot mark 1096 on the shaft 106. The slot mark 1096 is aligned with the outward protrusion 3195 so that the user can determine which direction to rotate the connection to lock or unlock the connection.

Additional details and alternatives of construction and advantages related to FIG. 2A through FIG. 2E are provided in the POLE1 application included herein by reference.

FIG. 3A Through FIG. 3G

FIGS. 3A through 3G show embodiments of novel sleeves 3104. The present invention includes a sleeve that protects the tip of the pole from breakage. The sleeve also makes the pole system more reliable by reducing breakage by protecting a pole segment from being scratch or scored by contact with the edge of the ferrule and, further, by providing a cushion for the forces between the pole segments and the ferrule and other interconnection parts.

Figure 3B:
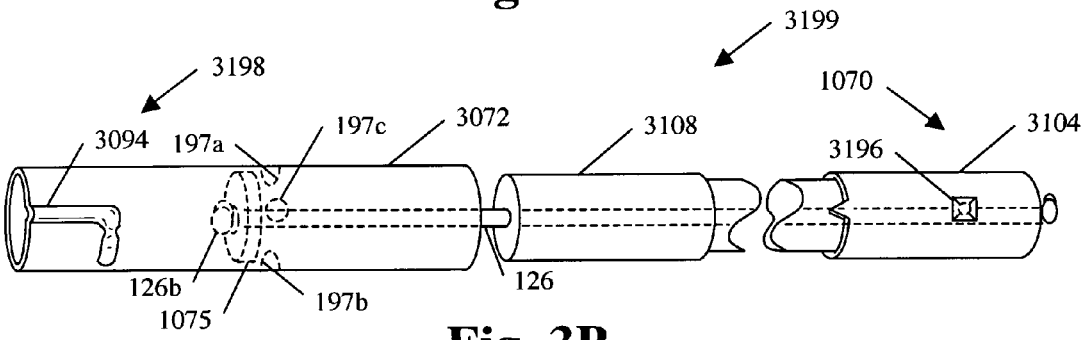

FIG. 3A and FIG. 3B show an embodiment of a sleeve 3104 having a rectangular pyramidal outward protrusion 3196. The sleeve has an end that covers and protects the ends of the fiberglass strands that are normally exposed in the tip of the fiberglass shaft. The sleeve end has a cord opening 3106 that allows an elastic cord 126 (FIG. 3B) to pass through the sleeve 3104. The sleeve also has an indicator 1097 that shows the user where the outward protrusion 3195 is located when it is inserted in a locking channel 3094.

The same sleeve 3104 can be used on solid shafts with the same protective and interlocking advantages.

FIG. 3A shows a sleeve 3104 positioned over the tip of a hollow shaft 106. The cord opening 3106 is aligned with the shaft opening 3107. The sleeve may be permanently bonded to the end of the shaft 106. Good flexible adhesion results have been obtained using Mr. Sticky's brand Underwater Glue manufactured by AII of Fairoaks, Calif.

A currently preferred embodiment of the sleeve 3104 is made of plastic, such as polyoxymethylene or acetal. The sleeve wall is preferably 2 millimeters thick and the sleeve end is preferably 4 millimeters thick.

FIG. 3B shows a currently preferred embodiment of the interconnections of the present invention. The inserting end 1070 of the shaft 106 is protected by a sleeve 3104. The opposite end of the shaft 106, which inserts into the breakdown side of the channeled receiving end 3072, is protected with a plain sleeve 3108.

Unlike conventional pole systems where the inside diameter is approximately the same size as the outside diameter of the fiberglass pole, in this embodiment, the inside diameter of the ferrule is approximately 2.5 millimeters larger than the outside diameter of the poles (e.g. shafts 106). The separation between the metal ferrule and the fiberglass pole prevents the edge of the metal ferrule from scratching or scoring the fiberglass pole.

Alternatively, the channeled receiving end 3072, as well as similar parts, can be made of engineering plastic instead of metal. When made of plastic, the entire unit including locking channel 3094 and the cord retainer 1075 may be molded as single piece, thus eliminating the need for the retaining dimples 197 and simplifying the manufacturing assembly of the various components such as the channeled shaft segment 3199.

Figure 3C:
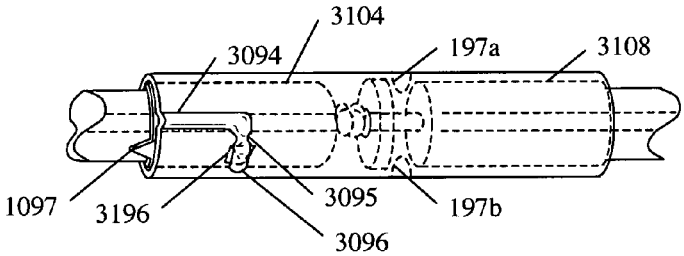

FIG. 3C shows a currently preferred embodiment with the configuration attachment locked and the breakdown attachment made. The outward protrusion 3196 is shown locked past the neck 3095 of the channel 3094 in the channel leg 3096. This embodiment is also shown with two retaining dimples 197*a* and 197*b*, respectively. The use of two retaining dimples 197 is currently preferred to hold the cord retainer 1075 in place. The cord retainer 1075 is preferably six millimeters in length. The cord knots are approximately six millimeters in length. The two sleeve ends are about 2.5 millimeters in length each. Thus, the space required inside the ferrule between the two fiberglass poles is approximately thirty millimeters (or 3 centimeters). The outward protrusion (3195 or 3196) and the bend forming the channel leg are both about 16 millimeters from the respective end. This allows each inserting end to be inserted about 34 millimeters. A ferrule length of ninety millimeters is sufficient to make the necessary configuration connection.

Figure 3D:
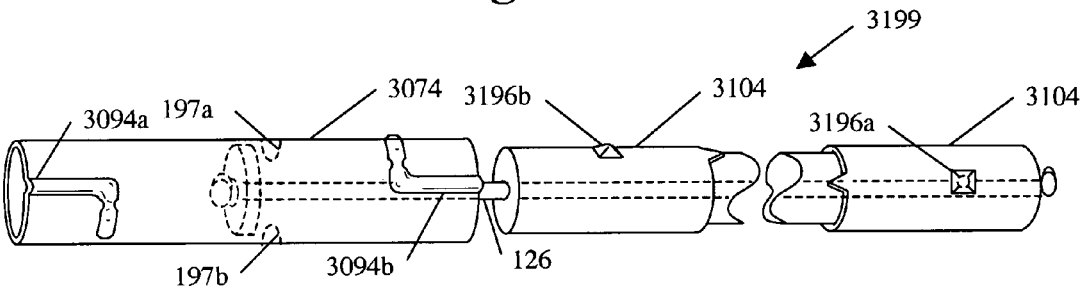

FIG. 3D shows an alternate embodiment comprising a dual-locking channeled receiving end 3074 wherein the opposite end of the shaft 106 which inserts into the breakdown side of the dual-locking channeled receiving end 3074, i.e. into locking channel 3094*b*, is protected with a sleeve 3104 which is identical to the sleeve 3104 on the inserting end 1070.

Figure 3E:
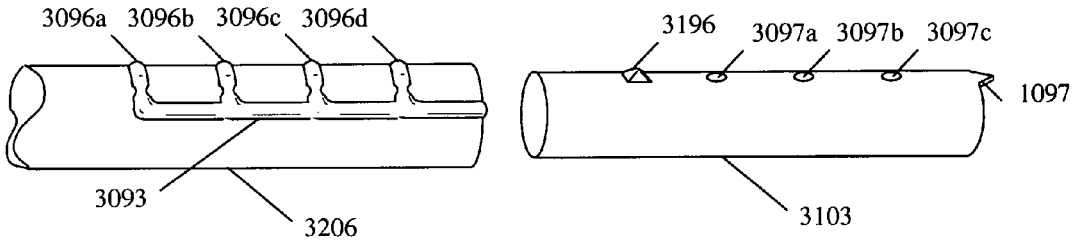

FIG. 3E illustrates a graduated channeled receiving end 3206 have a plurality of channel legs (shown as 3096*a* through 3096*d*). A corresponding graduated sleeve 3103 is also shown with an outward protrusion 3196 which can be inserted into the graduated channeled receiving end 3206 and locked into any of the channel legs (3096*a* through 3096*d*, respectively) to vary the length of a segmented shaft 107. In addition to the indicator 1097, the graduated sleeve 3103 has alternate indicators 3097*a* through 3097*c* that show the user the position of the outward protrusion 3196 when inserted into the graduated channeled receiving end 3206. For example, if the user wants to lock the outward protrusion 3196 in the channel leg 3096*c*, the user would pass the outward protrusion down the channel until alternate indicator 3097*b* is even with the edge of the graduated channeled receiving end 3206 and then turn the two ends with a clockwise rotation until the outward protrusion 3196 locks into channel leg 3096*c*.

This interconnect can be used to finely adjust the length of a segmented shaft. For example, in a frame base 1531 (e.g. FIG. 5J, FIG. 6A-D, FIG. 12F, FIG. 16A), to tighten skin that stretches and shrinks over time and with changing weather and sunlight.

Figure 3F:
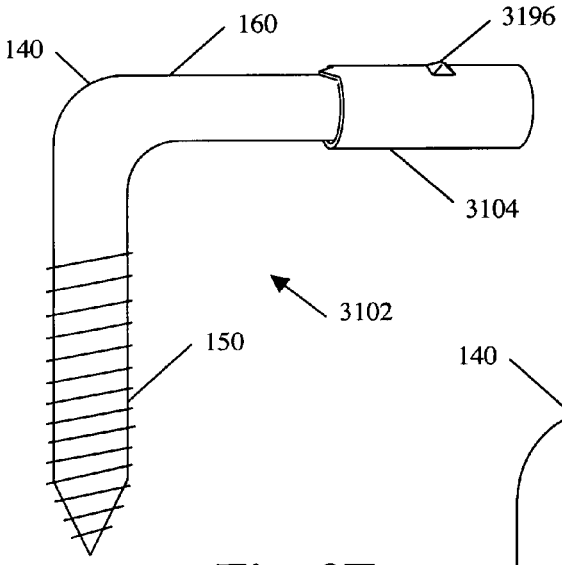

FIG. 3F shows the detail of the sleeved support 3102 (see FIG. 1C). The sleeved support 3102 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230 (as described in the ancestor applications). The second leg 160 comprises a sleeve 3104 having an outward protrusion 3196 (as shown, or 3195).

Figure 3G:
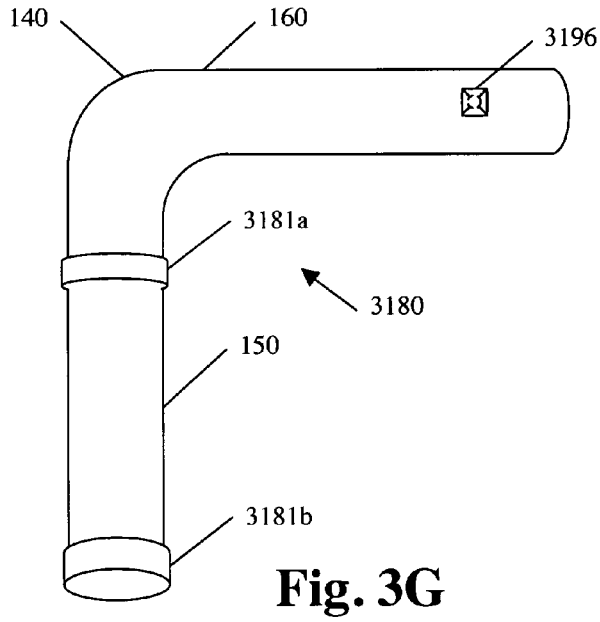

FIG. 3G shows a banded support 3180. The banded support 3180 is bent at an angle. The bend 140 results in two legs: a first leg 150 and a second leg 160. The first leg 150 has a smooth portion with two retaining bands 3181*a* and 3181*b*, respectively. The smooth portion is designed to clip into a pole clip 3410 as shown in FIG. 6A, FIG. 6D, and FIG. 14A through FIG. 14E. The retaining bands 3181 stop the banded support 3180 from slipping out of the pole clip 3410. The second leg 160 has an outward protrusion 3196 (as shown, or 3195) which can lock in any locking channel 3094. For example, in FIG. 14A through FIG. 14E, several banded supports 3180 are used to make the swivel connections for the base poles 3600 (FIG. 6A through 6D).

FIG. 4A Through FIG. 4D

Figure 4A:
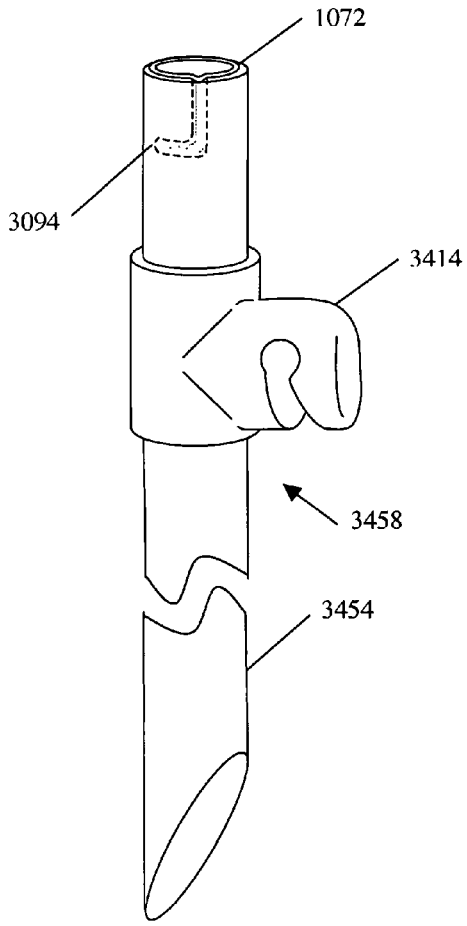
FIG. 4A through FIG. 4S show various corner end pieces with various means for securing a cover.

FIG. 4A shows a stake with single cord clip 3458. The stake with single cord clip 3458 comprises a receiving end with a locking channel 3094, a single cord clip 3414, and a stake member 3454.

Figure 4B:
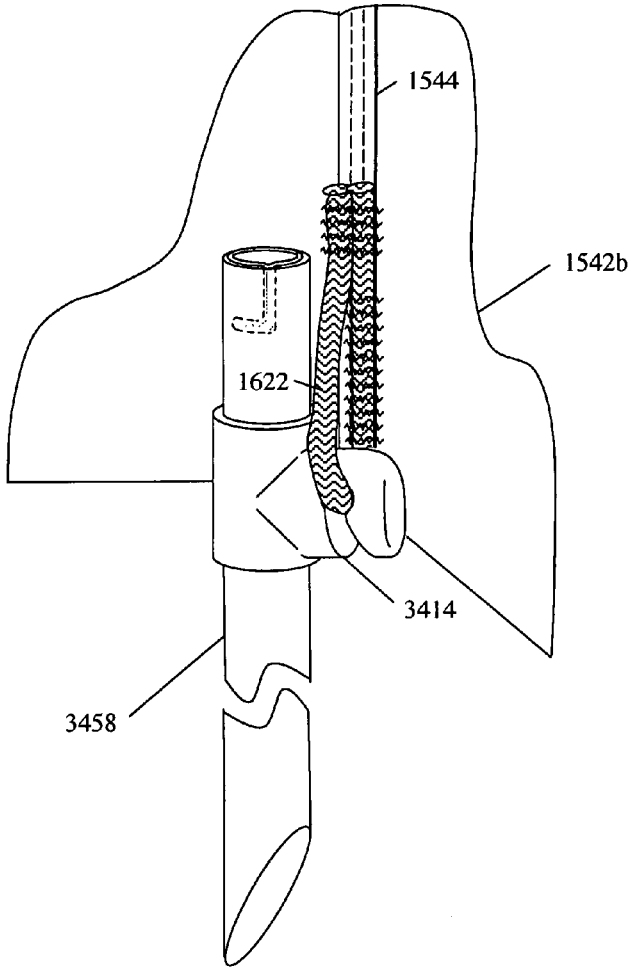
Figure 4C:
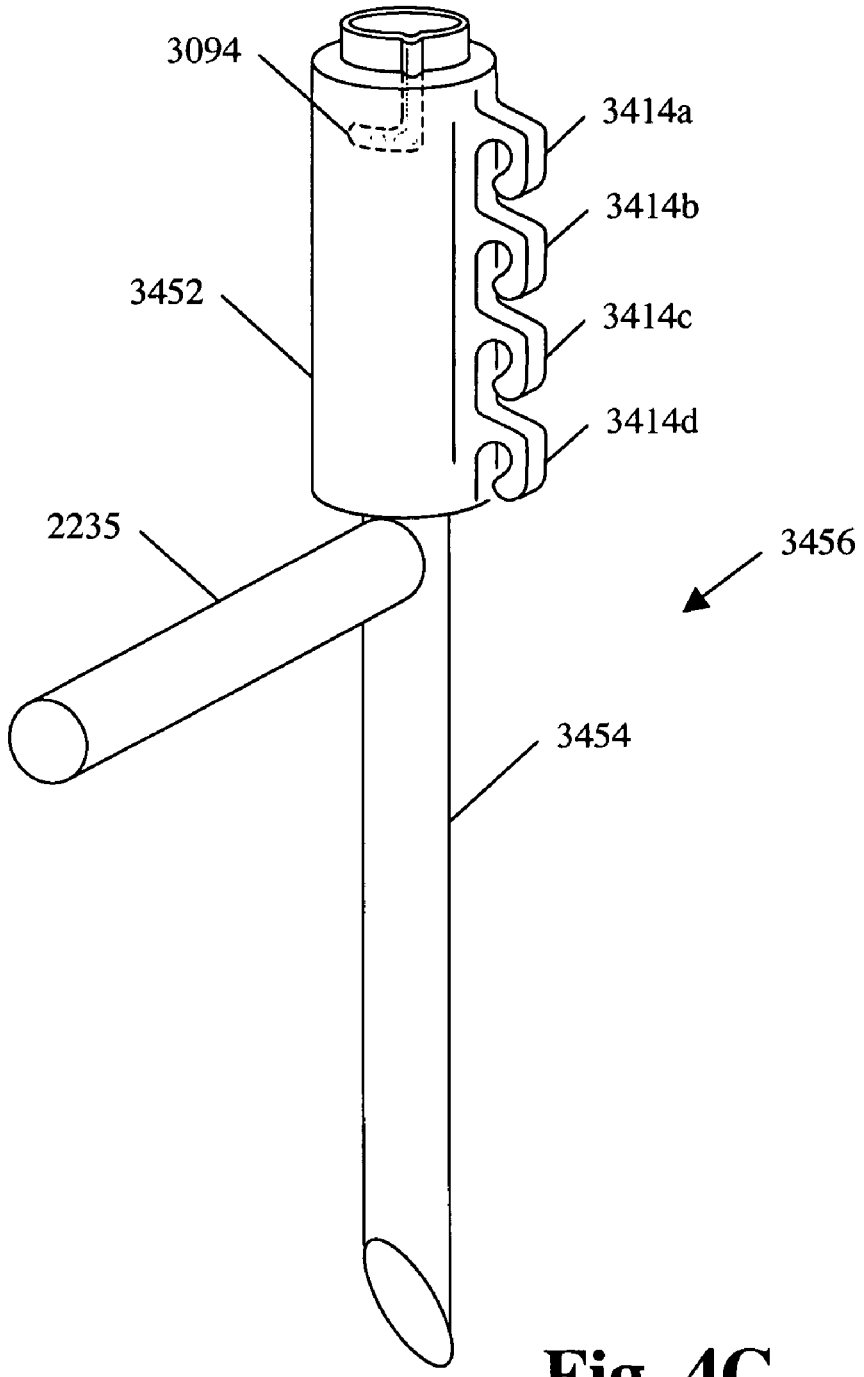
Figure 4D:
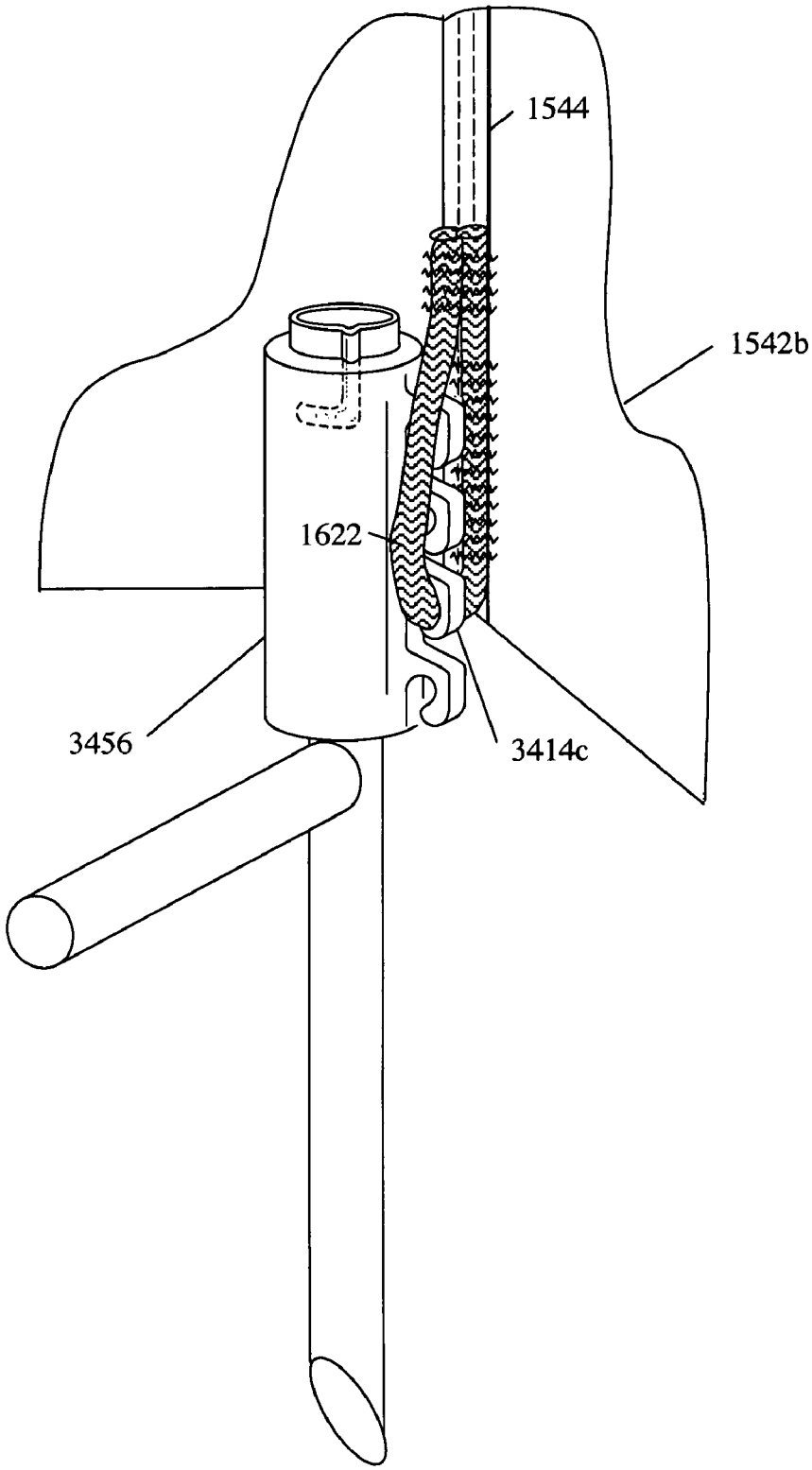
Figure 4E:
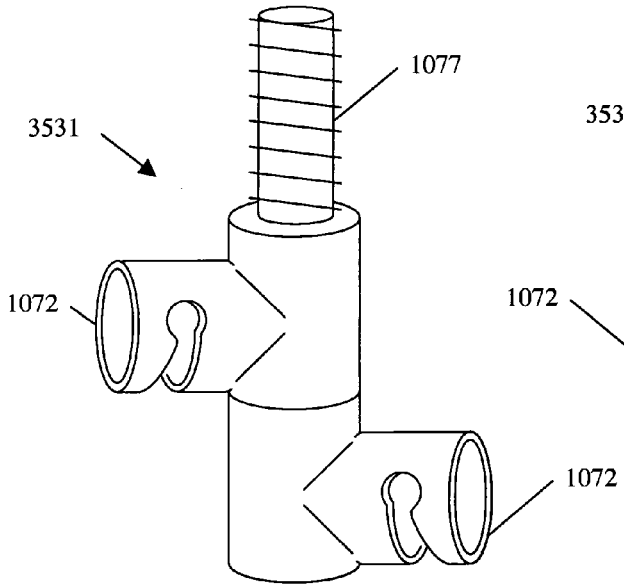
Figure 4F:
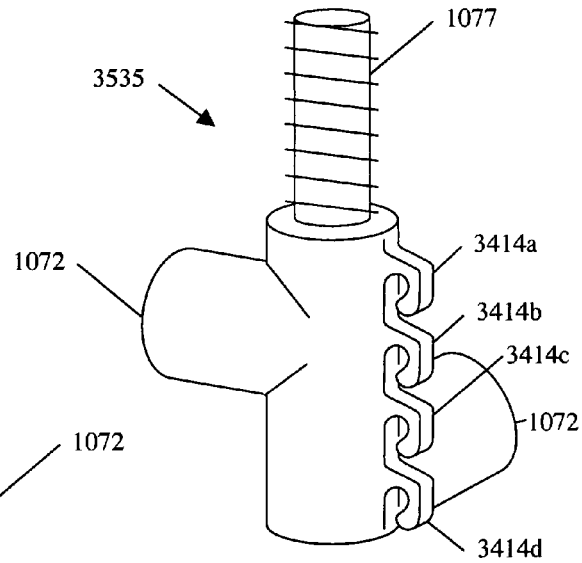
Figure 4G:
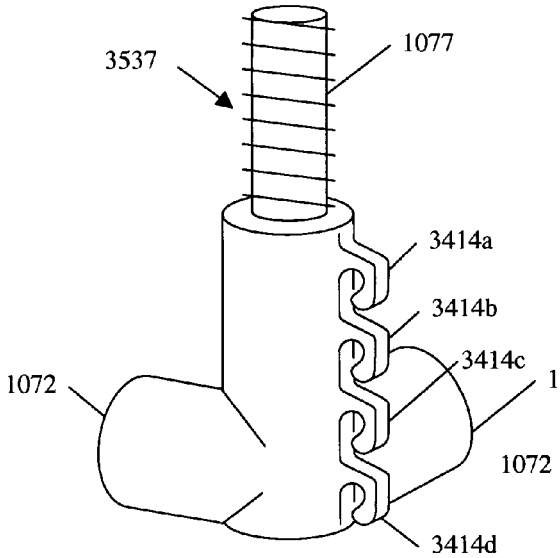
Figure 4H:
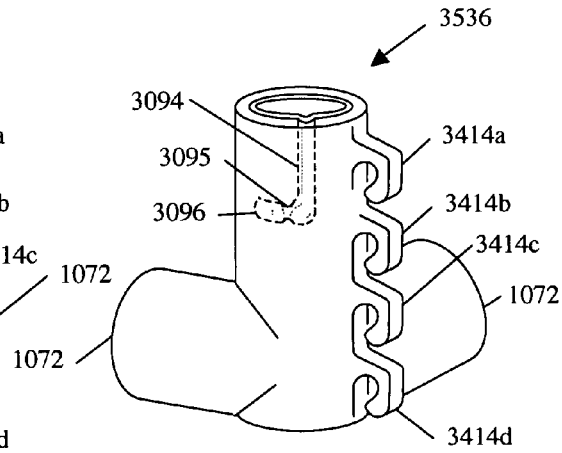
Figure 4I:
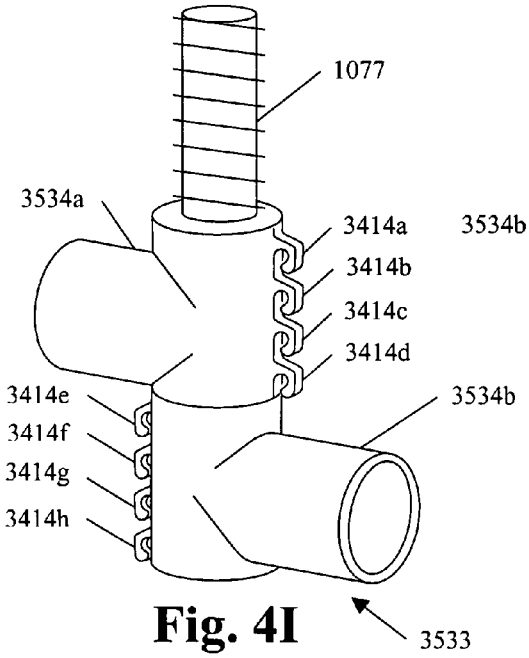
Figure 4K:
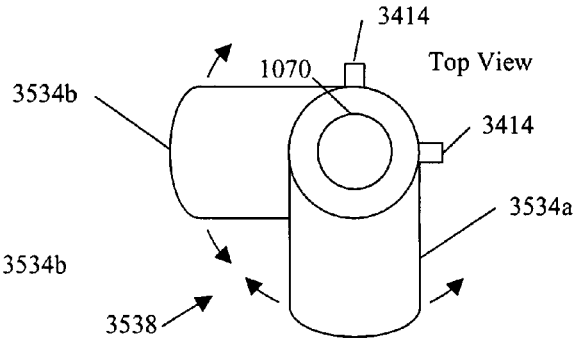
Figure 4J:
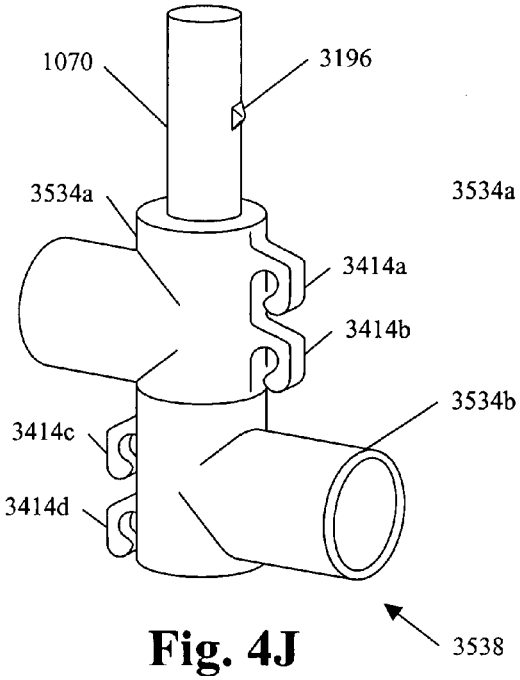
Figure 4L:
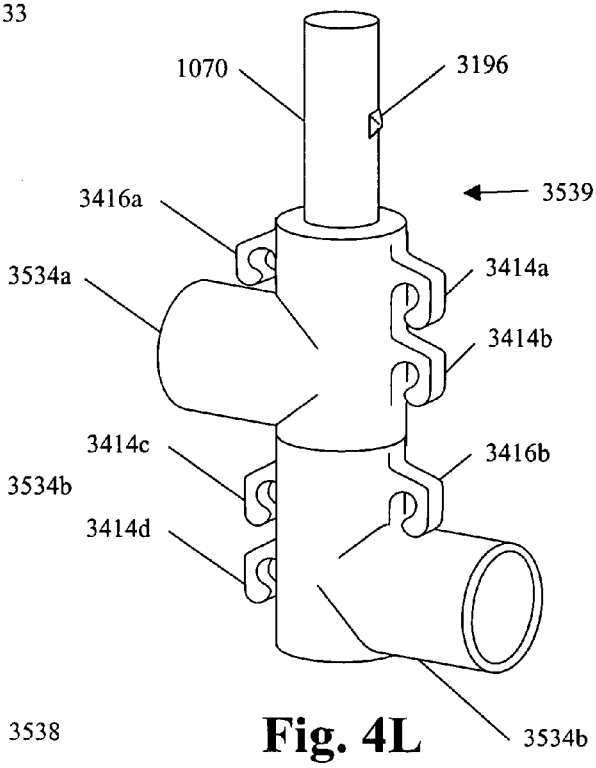
Figure 4M:
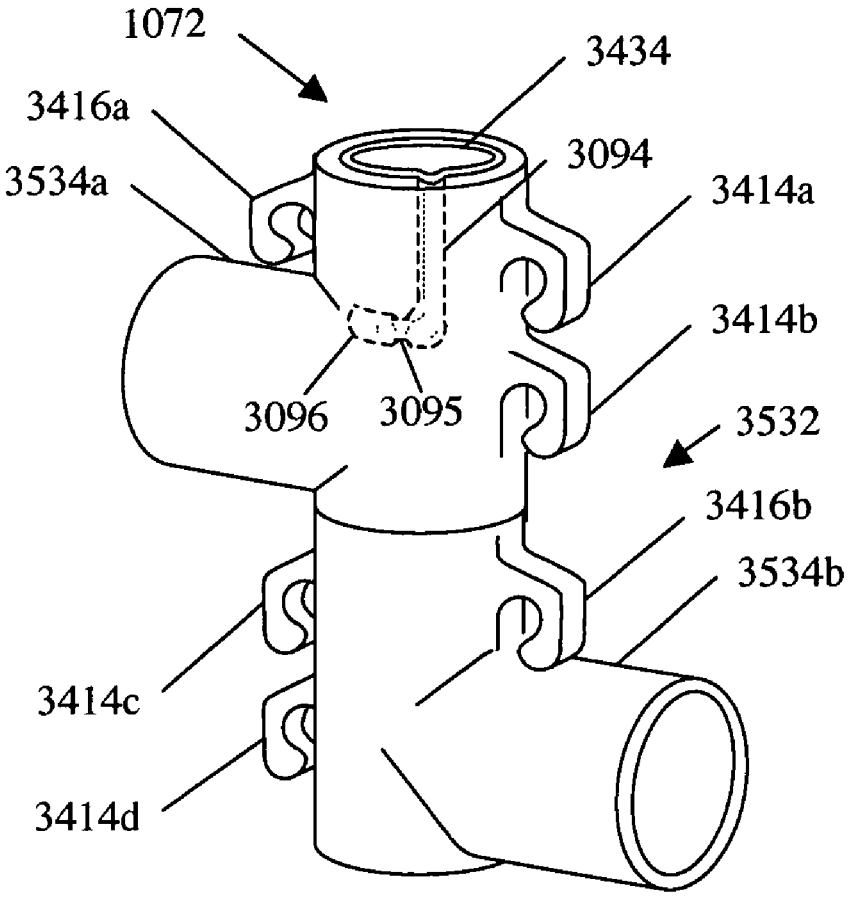
Figure 4N:
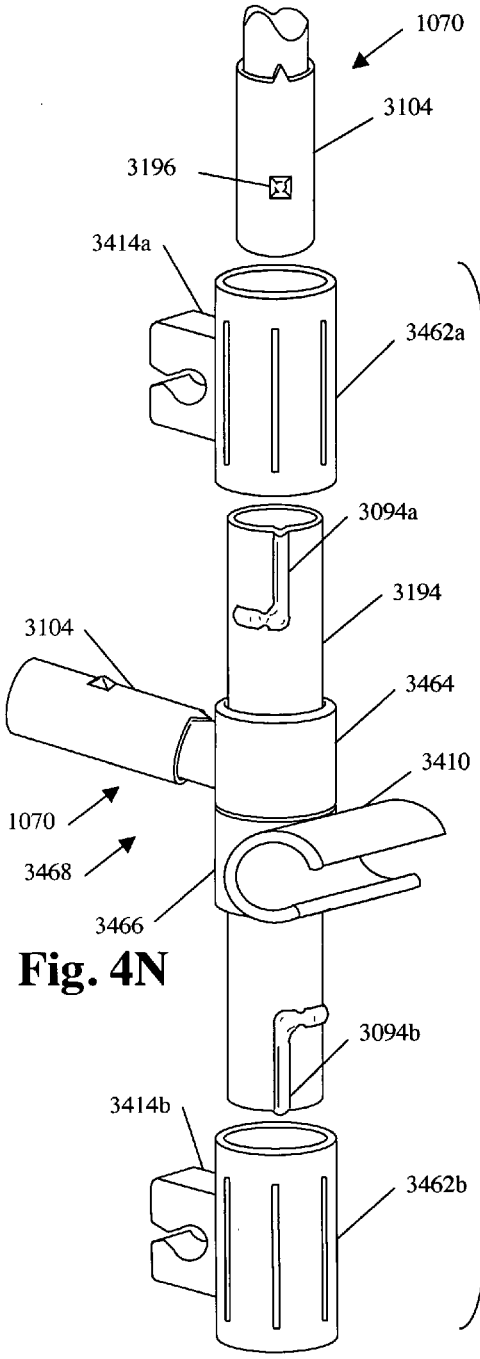
Figure 4O:
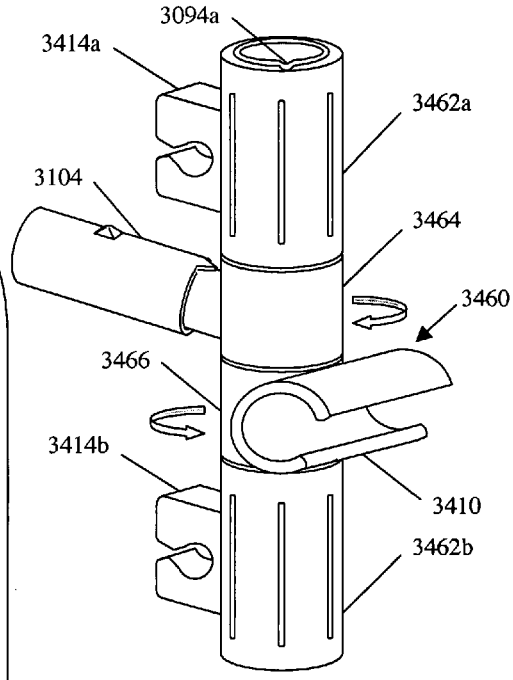
Figure 4P:
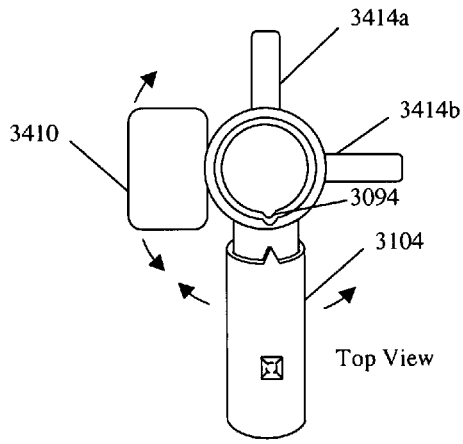
Figure 4Q:
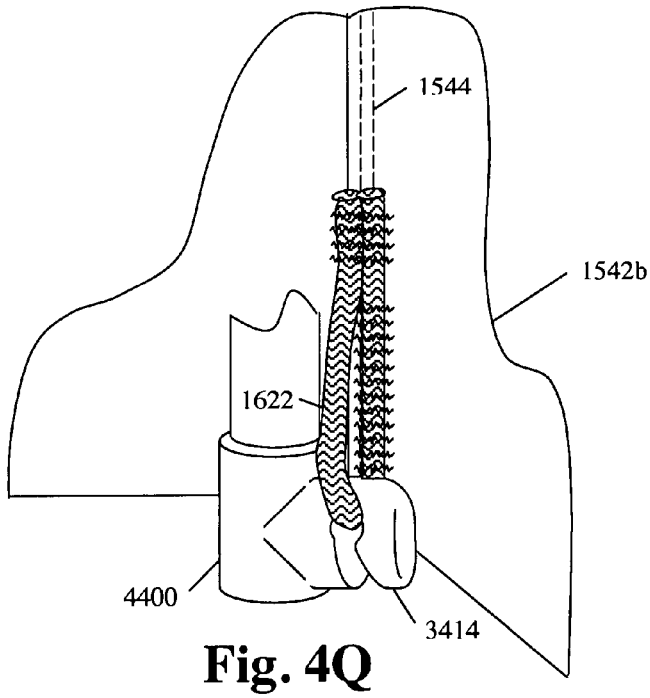
Figure 4R:
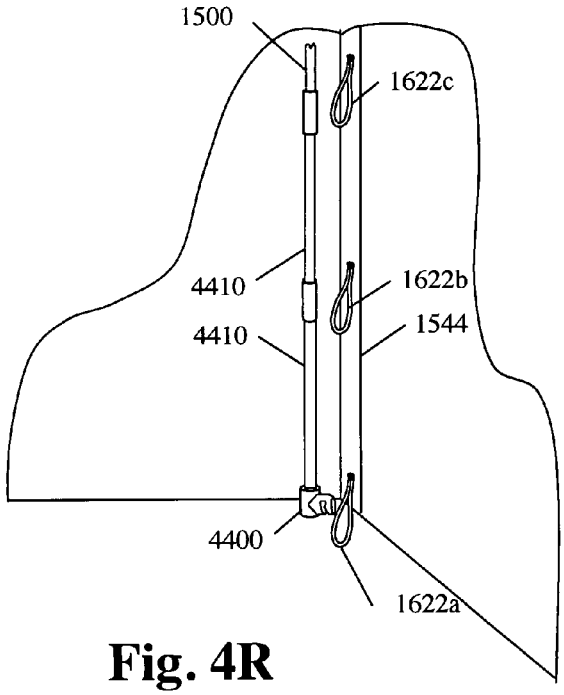
Figure 10A:
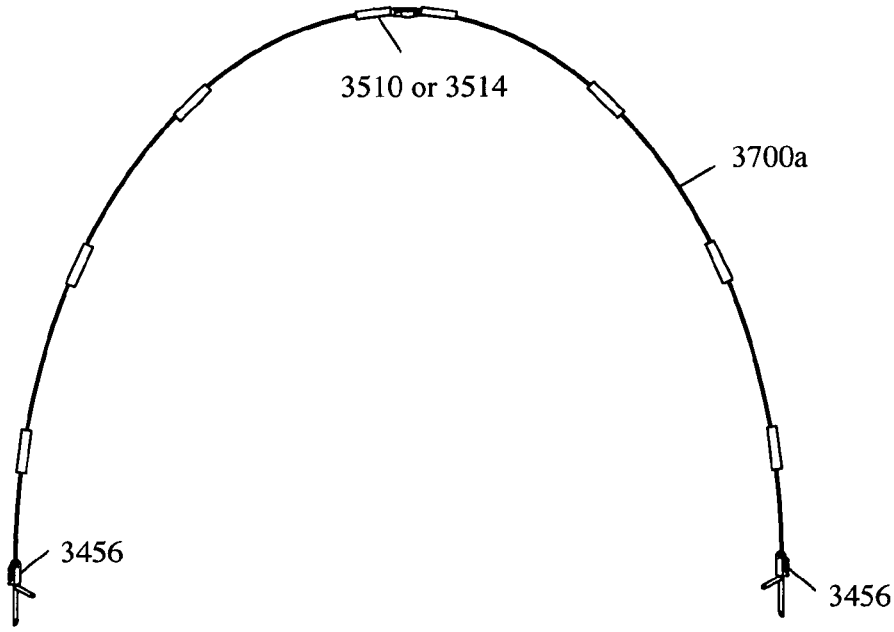
FIG. 10A through FIG. 10D show the operation of one embodiment of the shelter or blind.
Figure 10B:
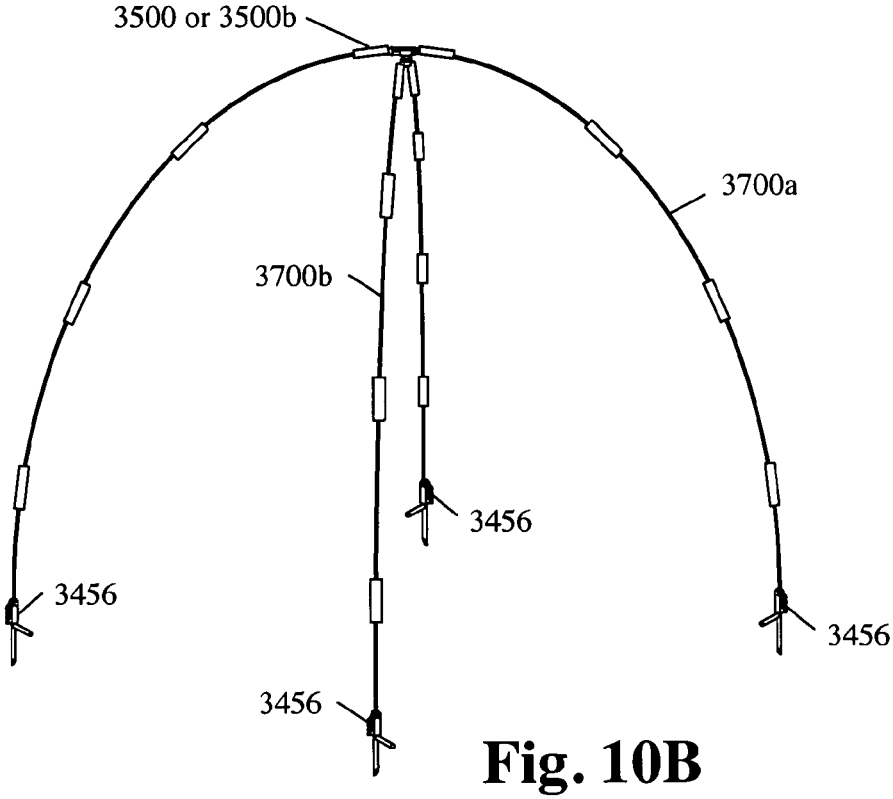
Figure 10C:
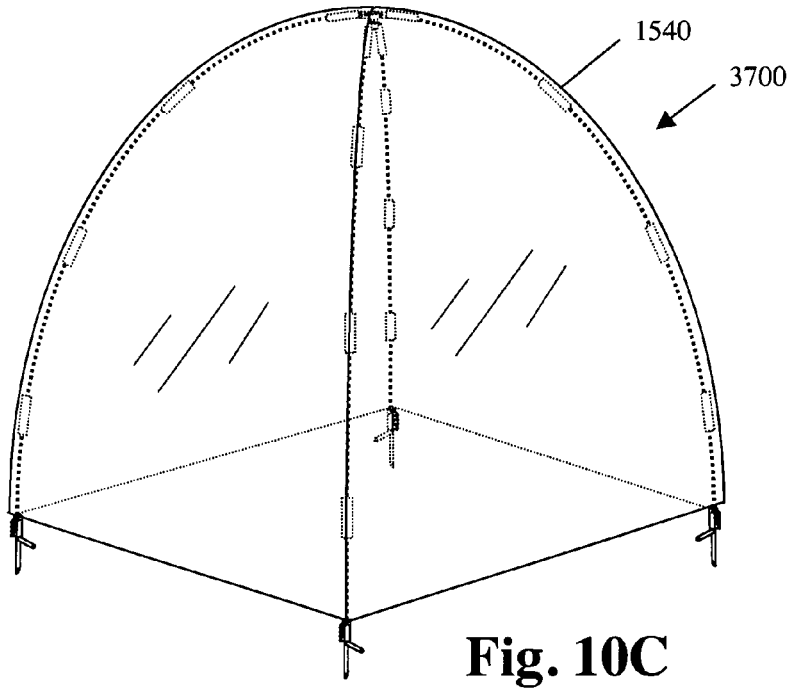
Figure 10D:
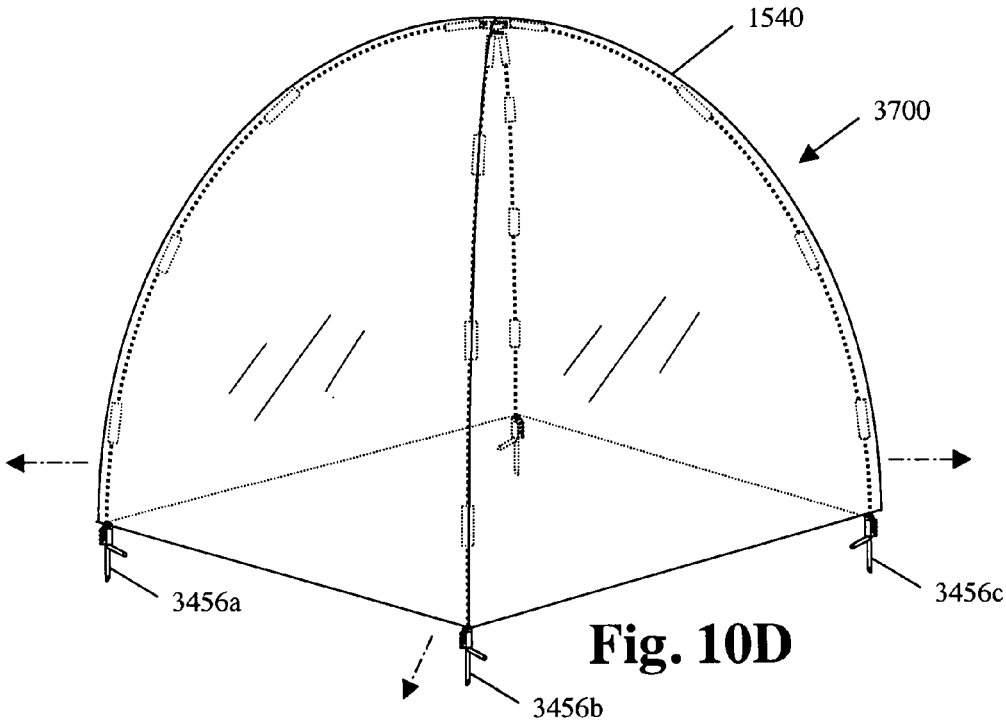
Figure 10E:
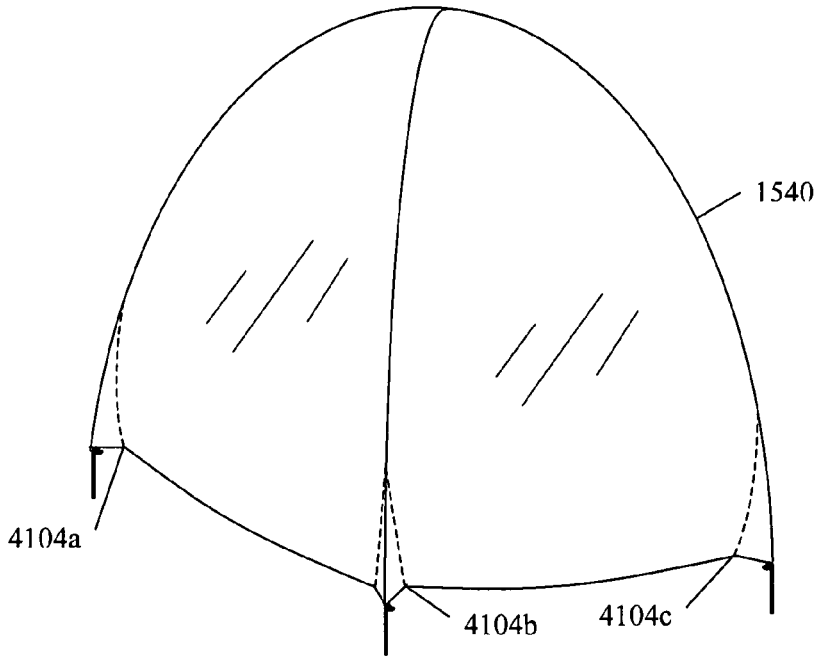
FIG. 10E through FIG. 10H show aspects and operation of cover corner tightening.
Figure 10F:
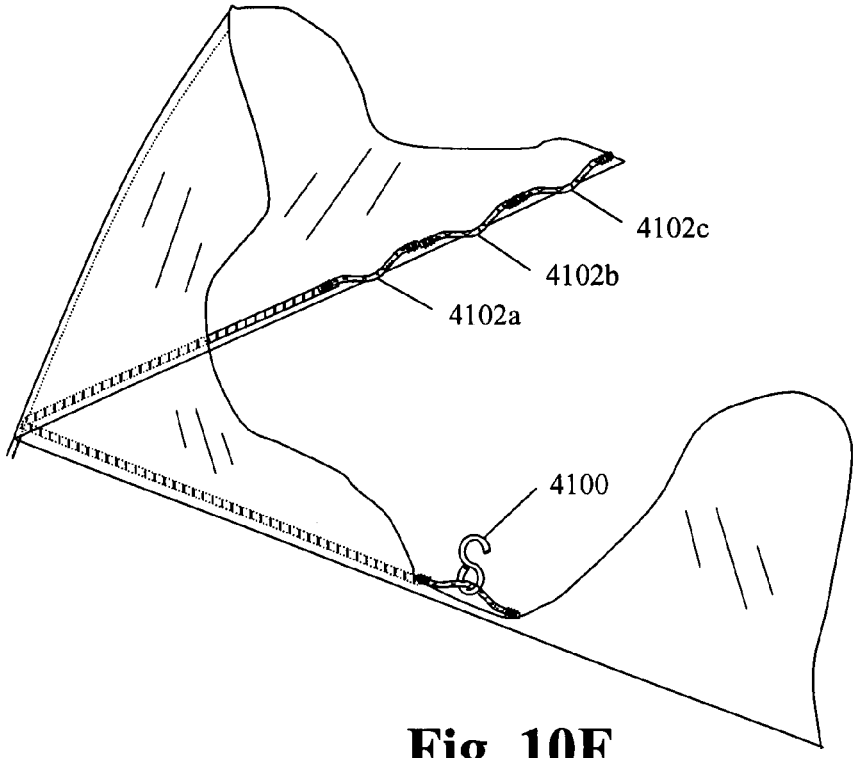
Figure 10G:
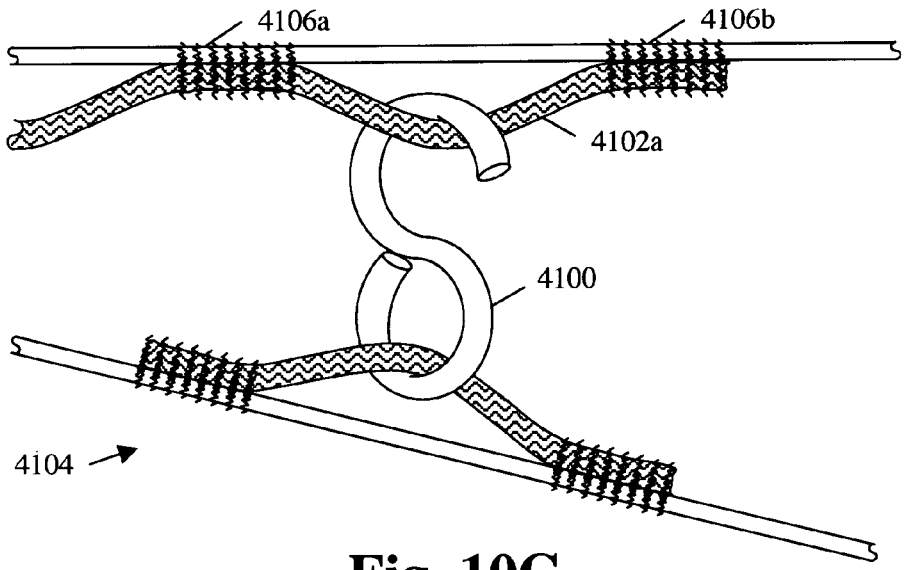
Figure 10H:
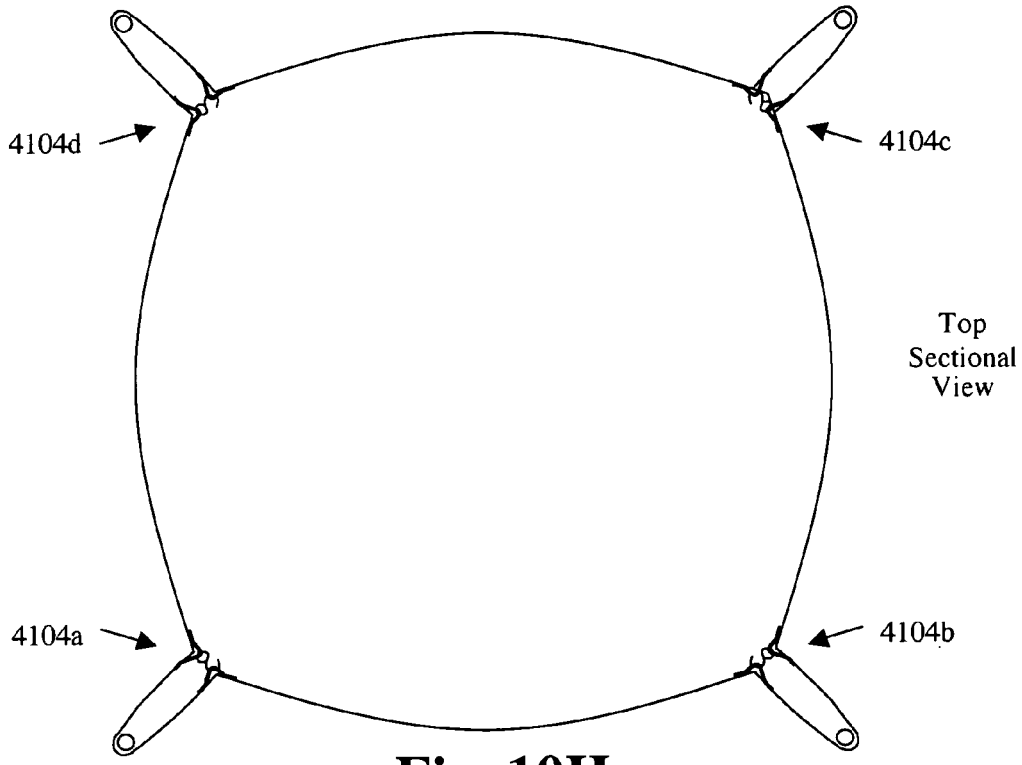
Figure 10I:
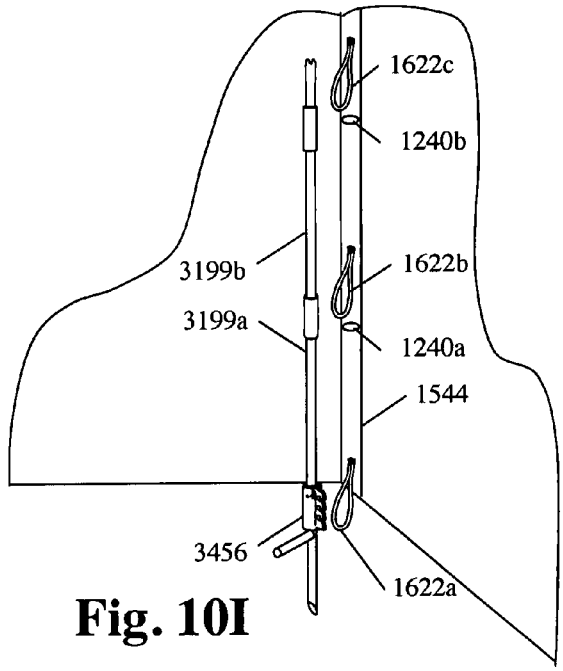
FIG. 10I and FIG. 10J show cover details of which provide for multiple configurations.
Figure 23A:
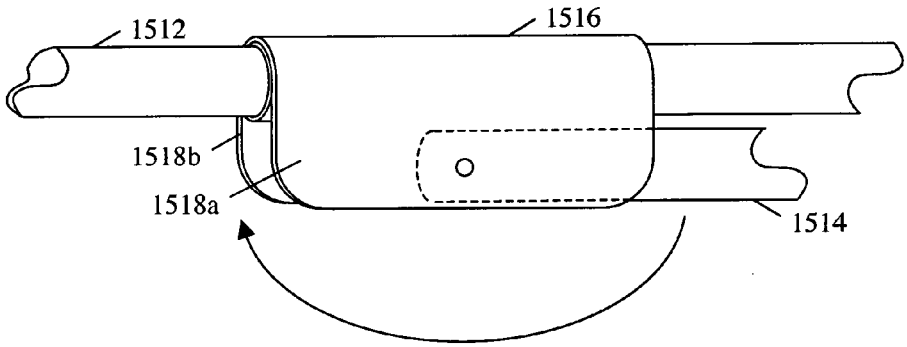
FIGS. 23A through 23C show details of the arch flattening hinge.
Figure 23B:
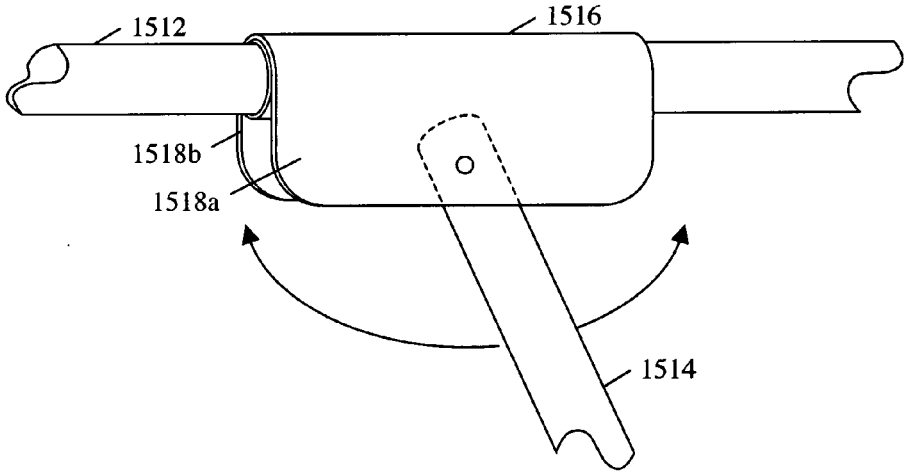
Figure 23C:
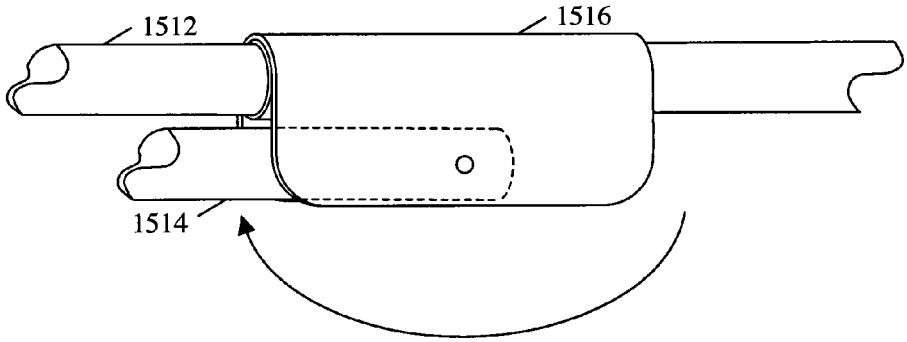
Figure 23D:
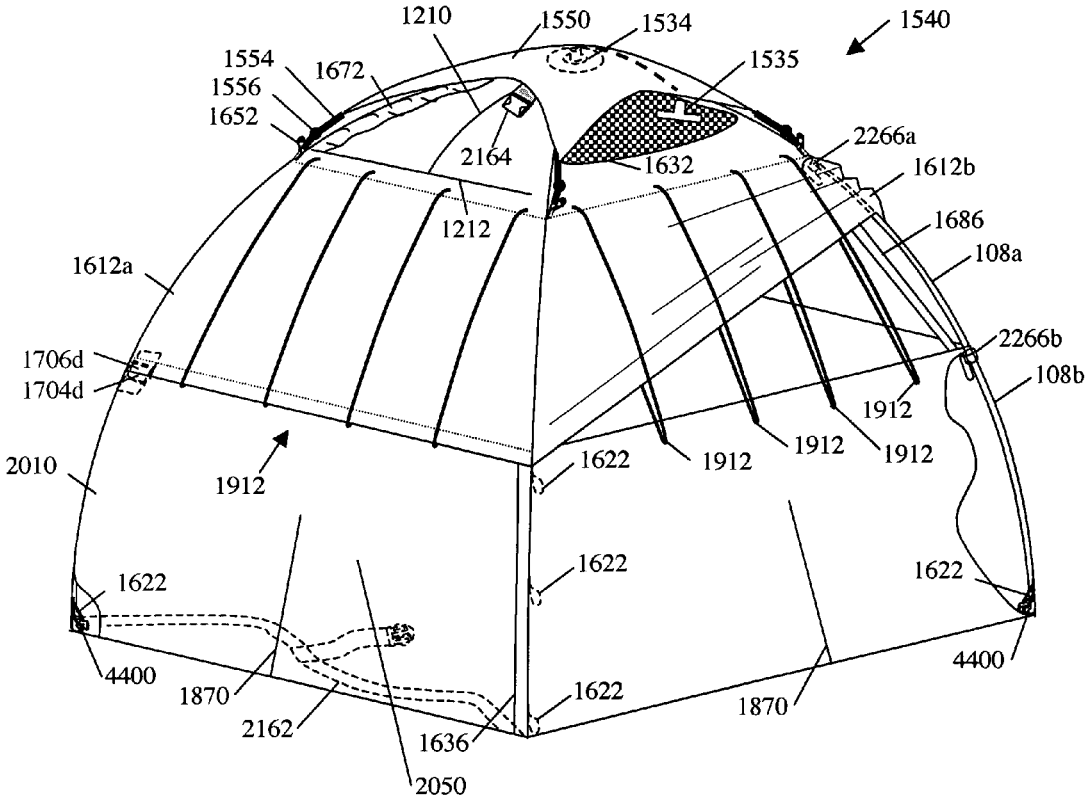
FIG. 23D shows various features of the currently preferred embodiment of the blind of the present invention.

As shown in FIG. 4B, the stake with single cord clip 3458 receives and holds in its cord clip 3414 any one of a plurality of corner loops 1622 (FIG. 4R, FIG. 10I, FIG. 23D). The stake with single cord clip 3458 may also be used to tie down a cover as shown in FIG. 12G (as an embodiment of stake with hook 2252).

An advantage of a cord clip 3414 over a simple hook (as shown in FIG. 22G of MOC4), is that when the stake with single cord clip 3458 is attached via locking channel 3094 at the end of a segmented cover shaft 1500, the configuration can be broken down and the corner loop 1622 will still be held when the blind or shelter is setup again, for example, after being moved.

FIG. 4C shows a stake with cord clips and leg 3456. The stake with cord clips and leg 3456 comprises a receiving end with a locking channel 3094, a multiple cord clip member 3452, a stake member 3454, and a leg 2335. The multiple cord clip member 3452 comprises a plurality of cord clips 3414. The stake leg 2235 is used to force the stake member 3454 into the ground; the stake leg 2235 may also be used to remove the stake 3456 from the ground.

As shown in FIG. 4D, the stake with cord clips and leg 3456 receives and holds in its cord clips 3414 any one of a plurality of corner loops 1622 (in particular see FIG. 10I). Another of its cord clips 3414 is available to attach to a bow cord 1626 (in particular see FIG. 9E). The stake with cord clips and leg 3456 may also be used to tie down a cover as shown in FIG. 12G (as an embodiment of stake with hook 2252).

The multiple cord clips 3414 are used to finely adjust the cover to tighten skin that stretches and shrinks over time and with changing weather and sunlight.

FIG. 4E Through FIG. 4M

FIG. 4E through FIG. 4M illustrate embodiments of various components that may be used to form corners, especially base corners, in various pole configurations.

Figure 9A:
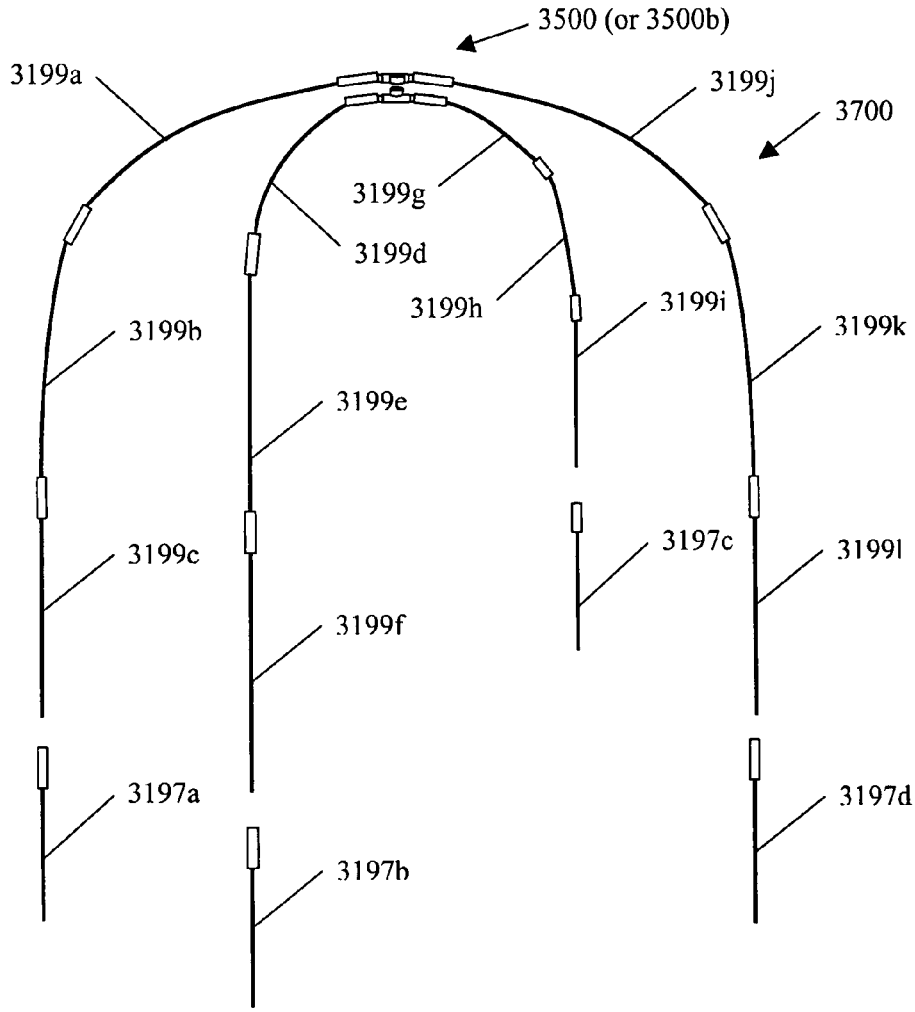
FIG. 9A through FIG. 9E show operation of pivoting arches including skin tightening bow cords.

A dual-swivel pole receptacle 3530 was disclosed in the POLE1 application. It is similar to the alternate dual-swivel pole receptacle 3532 (FIG. 4M) except it lacks the bow cord clip 3416. FIG. 4M shows alternate dual-swivel pole receptacle 3532. The alternate dual-swivel pole receptacle 3532 comprises two swivel members rotatably mounted on a channeled connector 3194 having a flared edge 3434. Each swivel member comprises a pole receptacle 3534 and a plurality of cord clips 3414. In this embodiment, each pole receptacle 3534*a* and 3434*b*, respectively, is large enough to loosely receive either an inserting end 1070 or a receiving end 1072 of the largest diameter shaft segment in the pole system. The cord clips 3414*a* through 3414*d* allow for different levels of tightness on a cord that is attached. For, example, a corner cord 1622 in a corner of a cover 1540 (e.g. FIG. 23D) may be attached to any of the cord clips 3414*a* through 3414*d*. If the fabric of the cover 1540 stretches through the heat of the day, the slack can be taken up by lowering the corner cord attachment, for example, from 3414*a* to 3414*d*. The locking channel 3094 is used to make a configuration attachment to any inserting end 1070 with an outward protrusion (3195 or 3196), for example, of a shaft segment (3197 or 3199) as shown in FIG. 9A. The alternate dual-swivel pole receptacle 3532 further comprises a bow cord clip 3416 opposite the cord clips 3414 on each swivel member. The bow cord clip 3416 provides a bow cord attachment 1574 (as shown in FIG. 9E).

FIG. 4E shows a threaded dual-swivel pole receptacle 3531 having two pole receptacles, each with receiving end 1072, which swivel about shaft with connector threads 1077. FIG. 4E also shows cutouts that allow the receptacle to also function as cord clips 3414.

FIG. 4F shows a threaded pole receptacle 3535 which has two fixed pole receptacles with receiving ends 1072 and a plurality of cord clips 3414(*a-d*). Like FIGS. 4E, 4G, and 4I, it has connector threads 1077.

FIG. 4G shows threaded corner pole receptacle 3537 similar to threaded pole receptacle 3535 (FIG. 4F) except that the pole receptacles are in the same horizontal plane.

FIG. 4H shows a corner pole receptacle 3536 similar to the threaded corner pole receptacle 3537 (FIG. 4G) except instead of connector threads 1077 it has receiving end with a locking channel 3094.

FIG. 4I shows an alternate threaded dual-swivel pole receptacle 3533 which is similar to the threaded dual-swivel pole receptacle 3531 (FIG. 4E) except the cord clips 3414 are positioned on the back of each swivel member.

FIG. 4J and FIG. 4K show a male alternate dual-swivel pole receptacle 3538 similar to the dual-swivel pole receptacle 3530 except that it has an inserting end 1070. FIG. 4K shows a top view and the swivel action.

FIG. 4L shows a male alternate dual-swivel pole receptacle with bow cord clip 3539, which adds bow cord clips 3416*a* and 3416*b*.

FIG. 4M is discussed at the beginning of this section.

FIG. 4N Through FIG. 4P

FIG. 4N through FIG. 4P illustrate an embodiment of a currently preferred, alternate dual-swivel clip 3460.

FIG. 4N shows an expanded view of the alternate dual-swivel clip 3460 comprising two fixed cord clips 3462, an inserting end swivel 3464 rotatably mounted on an alternate dual-swivel hub 3468, and an alternate swivel clip 3466 also rotatably mounted on an alternate dual-swivel hub 3468. In this embodiment, the fixed cord clips 3462 are permanently attached to the alternate dual-swivel hub 3468 and hold the inserting end swivel 3464 and the alternate swivel clip 3466 between them. The alternate swivel clip 3466 comprises a pole clip 3410 that is designed to clip and hold a pole (as shown FIG. 7D). The fixed cord clips 3462 have a gripping surface. The alternate dual-swivel hub 3468 is similar to the channeled connector 3194 (see FIG. 2C) having two locking channels 3094*a* and 3094*b*, respectively.

As shown in FIG. 4O, when assembled the inserting end swivel 3464 and the alternate swivel clip 3466 are held in place between the fixed cord clips 3462*a* and 3462*b*, respectively. The inserting end swivel 3464 and the alternate swivel clip 3466 rotate freely around the alternate dual-swivel hub 3468, as shown by the rotational arrows in FIG. 4O and FIG. 4P (top view).

To make the configuration attachment, the user holds the grip on one of the fixed cord clips 3462 and inserts the inserting end 1070 of a shaft segment (e.g. 3199) into the locking channel 3094 and rotates the inserting end 1070 clockwise. See FIG. 8F for an example configuration.

Figure 4S:
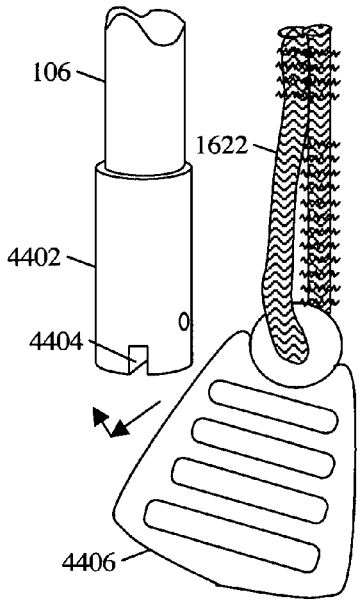

FIG. 4Q Through FIG. 4S

FIG. 4Q shows an end piece with hook 4400 that comprises a cord clip 3414. The end piece with hook 4400 may be permanently attached to the end of a shaft extension 4410 (e.g. see FIG. 22E and FIG. 23D) or removably attached to the end of a shaft extension (e.g. see FIG. 22B instead of end piece with slot 4402).

The cord clip 3414 receives and holds a corner loop 1622. As shown in FIG. 4R a cover shaft 1500 may be extended with one or more extensions 4410. With two extensions 4410 the end piece with hook 4400 would align with the bottom corner loop 1622*a*. With one extension it would align with the middle corner loop 1622*b*. With no extensions it would align with the top corner loop 1622*c*. The various extension means 4400 (see FIG. 22B through FIG. 22F) provide for various configurations such as those shown in FIG. 19B, FIG. 19K through FIG. 19N.

FIG. 4S shows another embodiment of a end piece for attaching to a corner loop 1622, an end piece with slot 4402 which can be attached to the end of a shaft 106. The end piece slot 4404 receives and holds the corner loop 1622. Optionally, a pull tab 4406 can be permanently attached to each corner loop 1622 to facilitate stretching the corner of the cover over the end piece and guiding it into the slot 4404. Alternatively, a short piece of cord can be tied into a loop and used to instead of the pull tab 4406.

FIG. 5A Through FIG. 5E

FIG. 5A through FIG. 5E illustrate embodiments of a pivoting intersection connector 3500.

Figure 5A:
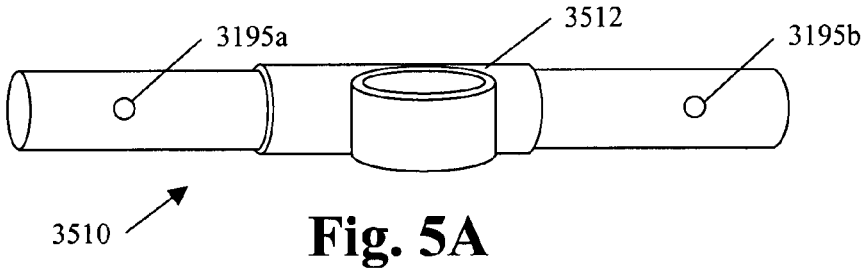
FIG. 5A through FIG. 5E show embodiments of a pivoting intersection connector.
Figure 5B:
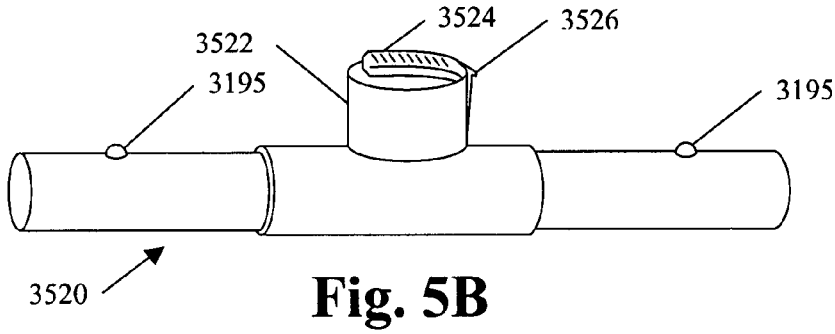
Figure 5C:
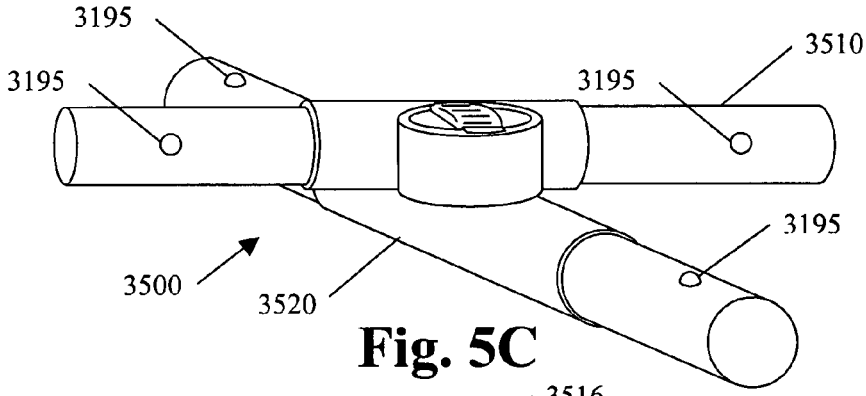

FIG. 5A shows an intersection member with band 3510, which is an embodiment of an inserting-to-inserting connector 1760 having an intersection band 3512 which operates with a intersection member with hub 3520 (FIG. 5B) to form a pivoting intersection connector 3500 (FIG. 5C).

FIG. 5B shows the intersection member with hub 3520, which is an embodiment of an inserting-to-inserting connector 1760 having an intersection hub 3522. The intersection hub 3522 comprises an intersection latch 3526. The intersection latch 3526 has a latch thumb grip 3524. The intersection hub 3522 may be removably attached through the intersection band 3512 (FIG. 5A). The intersection latch 3526 clips over the top of the intersection band 3512 and locks the two members (3510 and 3520) together to form the pivoting intersection connector 3500 as shown in FIG. 5C.

As shown in FIG. 5C, while connected, the two members (3510 and 3520) are capable of pivoting to any angle. The user may disconnect the two members (3510 and 3520) by applying an inward pressure on the latch thumb grip 3524 until the intersection latch 3526 moves inside, and releases, the intersection band 3512.

Figure 5D:
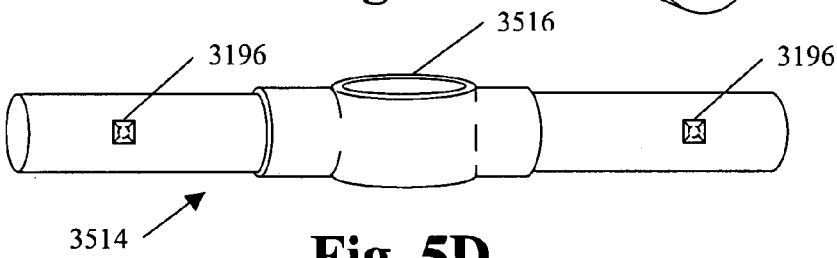
Figure 5E:
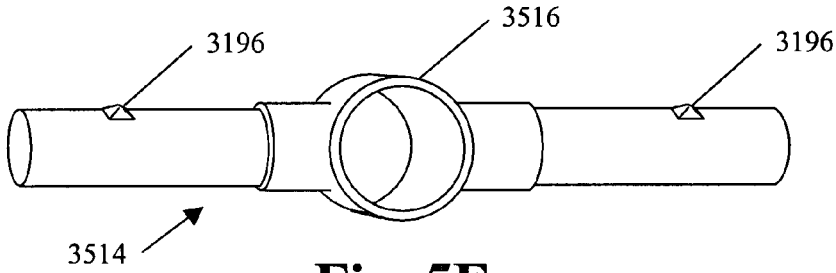

FIG. 5D and FIG. 5E show two views of an alternate embodiment of the intersection member with band 3510, a intersection member with alternate band 3514. The intersection member with alternate band 3514 has an alternate band 3516 symmetrically centered. The intersection member with alternate band 3514 (instead of member 3510) joins with intersection member with hub 3520 and operates in a similar manner.

FIG. 5F

Figure 5F:
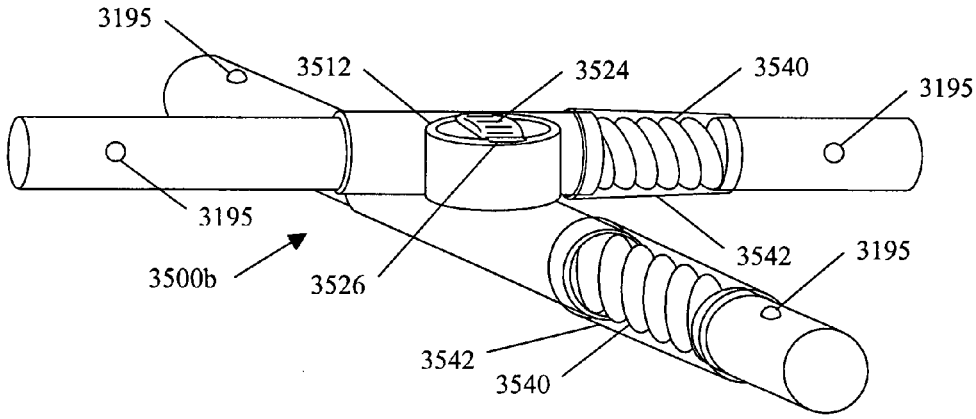
FIG. 5F through FIG. 5H show various embodiments having a means of pressure release.

FIG. 5F shows an alternate intersection member with band 3510*b*, which is an embodiment of an inserting-to-inserting connector 1760 having an intersection band 3512 which operates with an alternate intersection member with hub 3520*b* to form a pivoting intersection connector 3500*b* (FIG. 5R). This alternate embodiment further includes a pressure release to prevent breaking of the segmented shafts when the user applies too much bend to an arch.

The pressure release is a tightly wound, thick spring 3540 which holds the part straight during normal operation but, when the bending pressure exceeds a predetermined limit, will bend preventing any of the shaft segments from breaking. The pressure release spring 3540 is optionally covered with a protective sheath 3542 that prevents material (such as the cover 1540) from being caught in the coils of the bent spring (3540). Good results have been obtained by making protective sheath 3542 with a section of clear plastic tubing. A spring 3540 is a simple, low-cost means of pressure release. The means of pressure release could also be made in other ways, such as a short shaft 106 held to the intersection member 3510 with a pin and held in place with a spring-loaded latch. When the bending pressure exceeds the predetermined limit, the spring-loaded latch would release allowing the short shaft 106 to pivot about the pin.

The alternate intersection member with hub 3520*b* is an embodiment of an inserting-to-inserting connector 1760 having an intersection hub 3522. The intersection hub 3522 comprises an intersection latch 3526. The intersection latch 3526 has a latch thumb grip 3524. The intersection hub 3522 may be removably attached through the intersection band 3512. The intersection latch 3526 clips over the top of the intersection band 3512 and locks the two members (3510*b* and 3520*b*) together to form an alternate pivoting intersection connector 3500*b*.

While connected, the two members (3510*b* and 3520*b*) are capable of pivoting to any angle. The user may disconnect the two members (3510*b* and 3520*b*) by applying an inward pressure on the latch thumb grip 3524 until the intersection latch 3526 moves inside, and releases, the intersection band 3512.

Figure 5G:
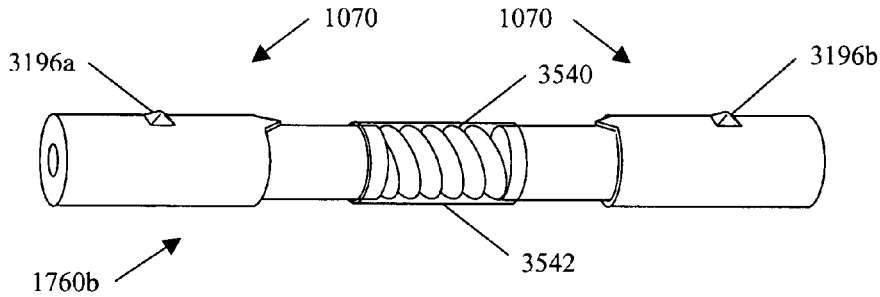
Figure 5H:
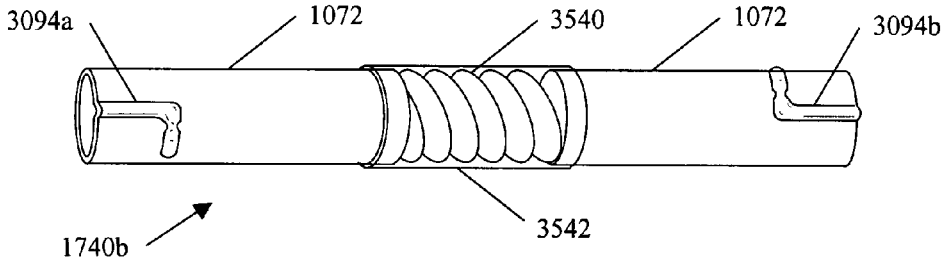

FIG. 5G and FIG. 5H

FIG. 5G and FIG. 5H illustrate alternate embodiments of connectors having a means of pressure release to prevent breaking of segmented shafts. These connectors may be used in an arch that does not intersect with another arch at the top of the respective arches. See related applications, FIG. 17A through 17D, and FIGS. 24C through 24E for various example configurations.

FIG. 5G shows an alternate inserting-to-inserting connector 1760*b* having two inserting ends connected by a means of pressure release, shown as a pressure release spring 3540 optionally covered with a protective sheath 3542. The pressure release prevents breaking of the segmented shafts when the user applies too much bend to an arch (as discussed above). The embodiment shown has an outward protrusion (3196*a* and 3196*b*, respectively) on each end.

FIG. 5H shows an alternate receiving-to-receiving connector 1740*b* having two receiving ends connected by a means of pressure release, shown as a pressure release spring 3540 optionally covered with a protective sheath 3542. The pressure release prevents breaking of the segmented shafts when the user applies too much bend to an arch (as discussed above). The embodiment shown has a receiving channel (3094*a* and 3094*b*, respectively) on each end.

FIG. 5I Through FIG. 5L

FIG. 5I through FIG. 5L illustrate various corner base connectors also having a means of pressure release to prevent breaking of segmented shafts.

Figure 5I:
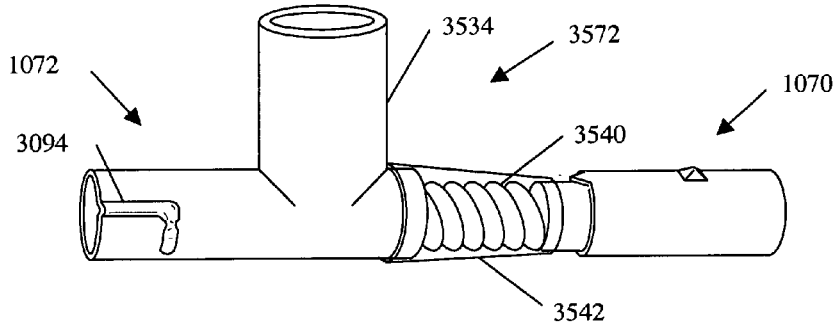
FIG. 5I through FIG. 5L show various uses of corner components, including adjustable base rings.
Figure 5J:
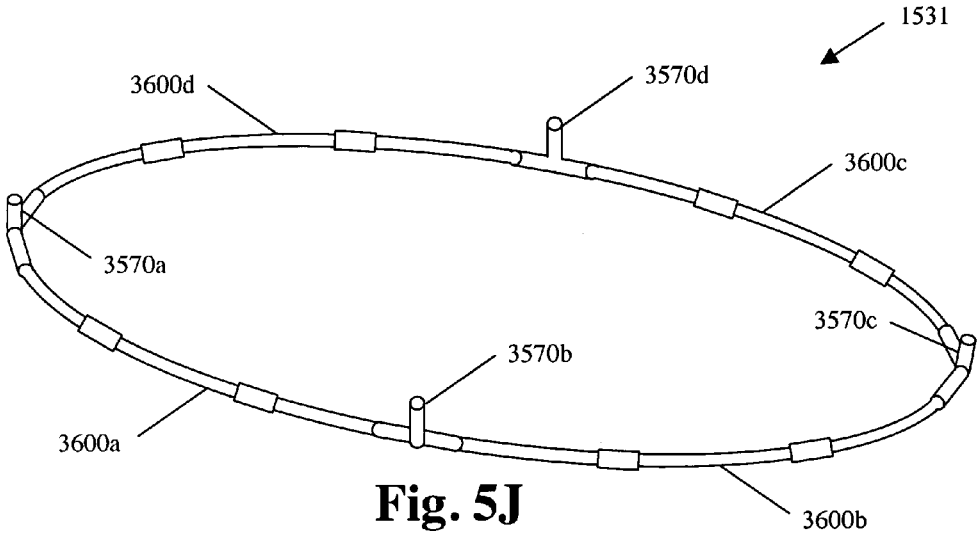

FIG. 5I shows an alternate corner base connector 3572 having one receiving end 1072 at a right angle with a pole receptacle 3534, and an inserting end connected by a means of pressure release, shown as a pressure release spring 3540 optionally covered with a protective sheath 3542. The pressure release prevents breaking of the segmented shafts when the user applies too much bend to a base ring (FIG. 5J). This connector may be used to configure a base structure which can receive a shaft in each corner as shown for example in FIG. 5J. The embodiment shown has an outward protrusion on the inserting end and a receiving channel 3094 on the channeled receiving end 1072.

FIG. 5J shows an exemplary base structure comprising a plurality of base segmented shafts (3600*a* through 3600*d*) connected by a plurality of base corner connectors (3570*a* through 3570*d*). The base structure is shown as a ring. This exemplarily base structure is capable of receiving two intersecting arches 3700 (FIG. 9A) (or two non-intersecting arches, see related applications for such configurations). The base structure is useful for creating a free standing blind or structure for use on rocky ground (e.g. where it is difficult to insert a stake 3450 or 3456), pavement (e.g. flee market), or floor (e.g. trade show).

Figure 5K:
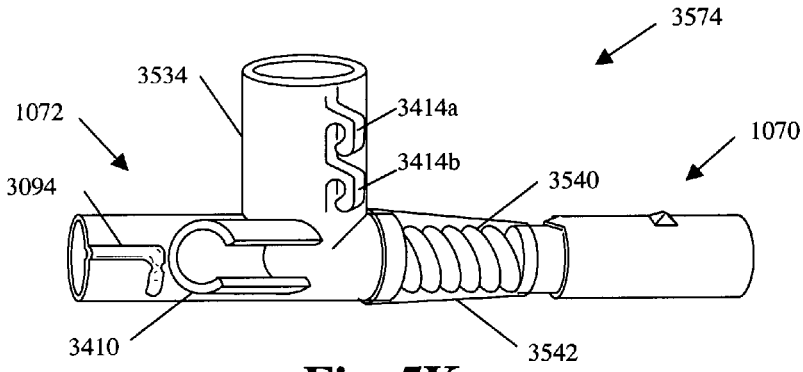
Figure 5L:
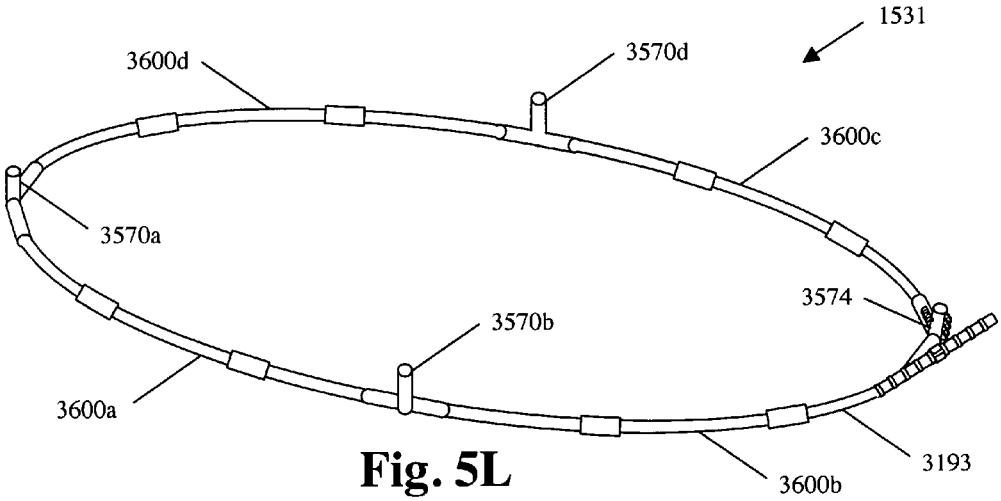

FIG. 5K shows a corner base connector with clips 3574 having one receiving end 1072 at a right angle with a pole receptacle 3534, and an inserting end connected by a means of pressure release, shown as a pressure release spring 3540 optionally covered with a protective sheath 3542. The embodiment shown has an outward protrusion on the inserting end and a receiving channel 3094 on the channeled receiving ends 1072. This embodiment further comprises a plurality of cord clips 3414 on the pole receptacle 3534 and a pole clip 3410 attached to the receiving end 1072. The pole clip allows the user to adjust the circumference of the base structure (FIG. 5L) (see discussion regarding FIG. 7D). Enlarging the circumference of the base ring will force the arches 3700 outward resulting in tighter cover skin for a blind.

Figure 5M:
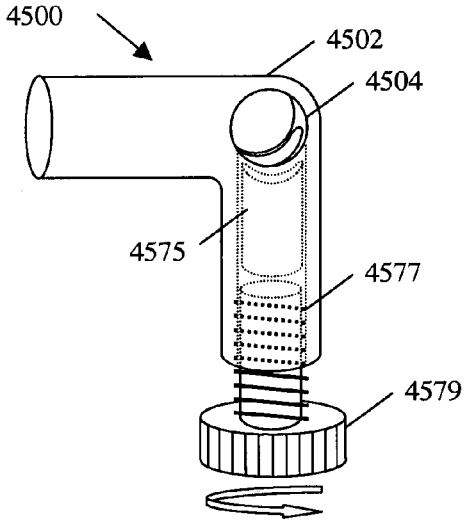
FIG. 5M and FIG. 5N shows a locking elbow.
Figure 5N:
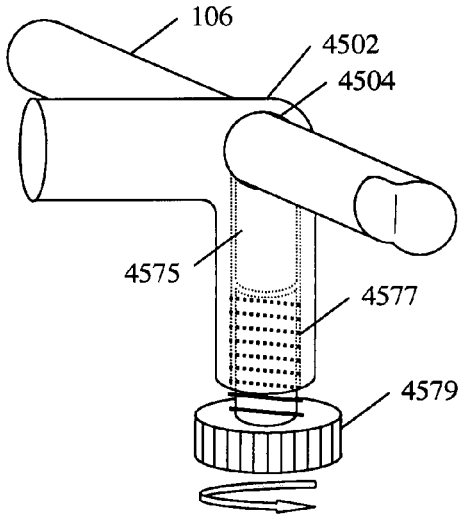

FIG. 5M and FIG. 5N

FIG. 5M through FIG. 5N illustrate a novel locking elbow 4500. The novel locking elbow 4500 comprises an elbow 4502 having an elbow hole 4504, an internal piston 4575, internal elbow threads 4577, and an elbow screw 4579. The elbow hole 4504 receives and passes along any shaft 106. The elbow 4502 is locked at any point along the shaft 106 by tightening the elbow screw 4579 which in turn presses the piston 4575 against the shaft, locking the elbow 4502 in place. Good results have been obtained by using off-the-self PVC elbow 4502 and making the piston from Delrin. The piston 4575 preferably has a semicircular face, which engages the shaft 106. On exemplary use of the locking elbows 4500 is shown in FIG. 16B.

FIG. 6A Through FIG. 6D

Figure 6A:
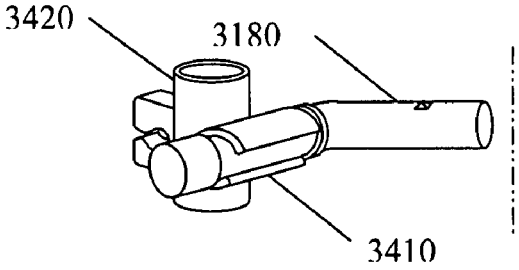
FIG. 6A through FIG. 6D shows one embodiment of a base segmented shaft.
Figure 6B:
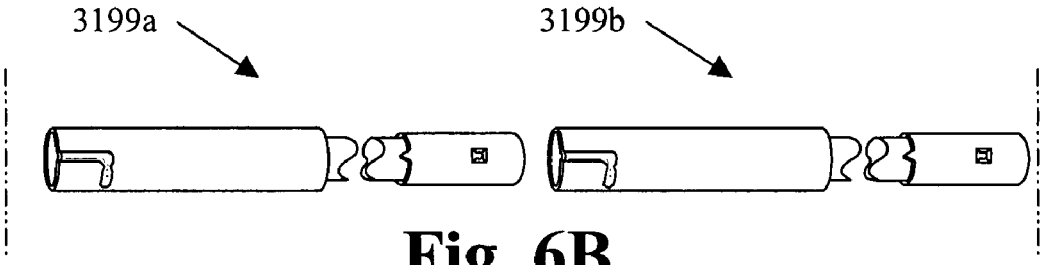
Figure 6C:
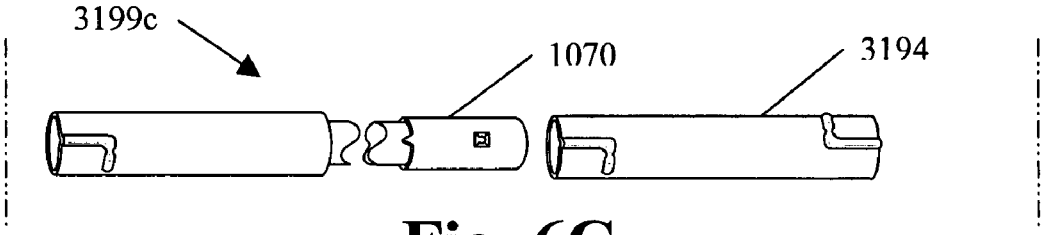
Figure 6D:
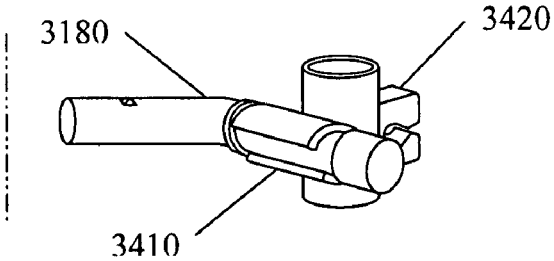

FIG. 6A through FIG. 6D illustrate a single segmented base shaft with universal corner attachments. As shown by the dotted and dashed lines, FIG. 6A is connected to FIG. 6B which is connected to FIG. 6C which is connected to FIG. 6D. On each end, shown in FIG. 6A and FIG. 6D respectively, a banded support 3180 is attached to a pole clip 3410. The pole clip 3410 can be part of a swivel clip 3420 or a similar component such as those shown, for example, in FIG. 4N and FIG. 4O, or FIG. 5K. The segmented base shaft is shown comprising three channeled shaft segments 3199*a* through 3199*c* and a channeled connector 3194.

FIG. 7A Through FIG. 7D

Figure 7A:
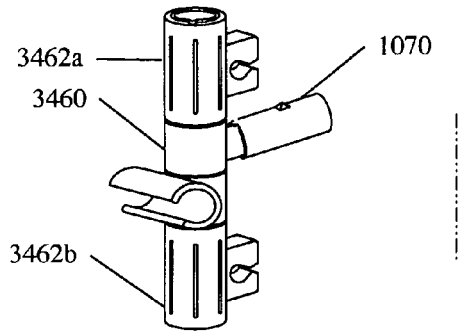
FIG. 7A through FIG. 7D shows another embodiment of a base segmented shaft.
Figure 7B:
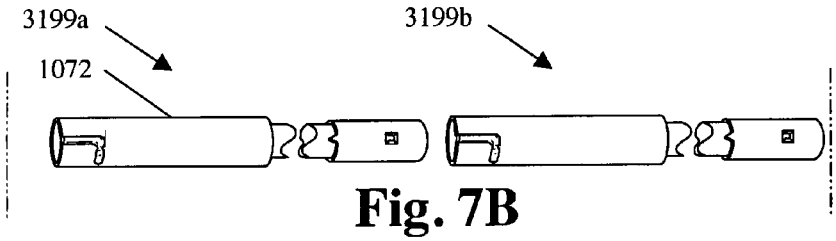
Figure 7C:
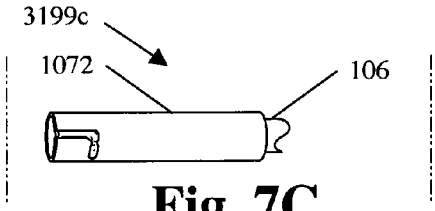
Figure 7D:
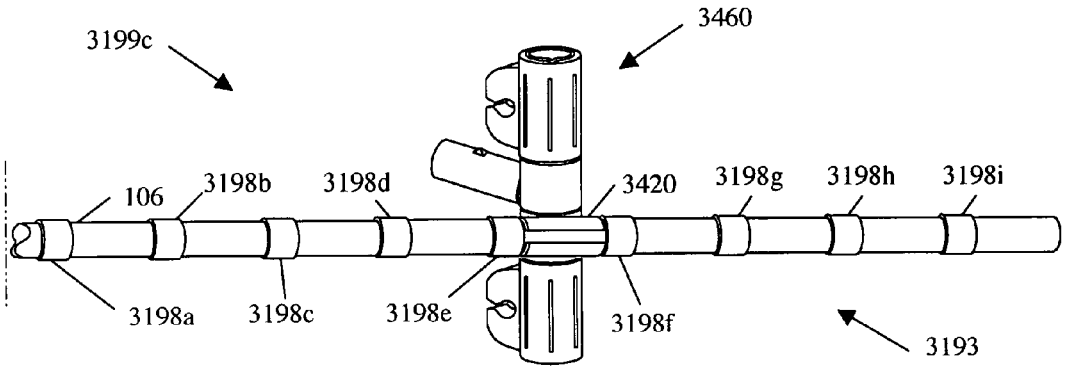

FIG. 7A through FIG. 7D illustrate a currently preferred alternate embodiment of a single segmented base shaft with universal corner attachments. As shown by the dotted and dashed lines, FIG. 7A is connected to FIG. 7B which is connected to FIG. 7C which is connected to FIG. 7D. On one end, shown in FIG. 7A, a corner component (shown as an alternate dual-swivel clip 3460) comprises an inserting end 1070. At the other end, shown in FIG. 7D the corner component has a pole clip 3410 (shown for example as alternate dual-swivel clip 3460). The segmented base shaft is shown comprising three channeled shaft segments 3199*a* through 3199*c*). The last channeled shaft segment 3199*c* is shown in part in FIG. 7C. The remaining part of channeled shaft segment 3199*c* is shown in FIG. 7D and has a plurality of retaining sleeves (3198*a* through 3198*h*). The pole clip 3410 can be attached to the shaft segment 3199*c* and the shaft segment can be held in that position by the retaining sleeves 3198.

Good results have been obtained by making the retaining sleeves of a flexible plastic tubing having an inside diameter substantially equal to the outside diameter of the segmented shaft 3199. In one embodiment, the position of the retaining sleeve 3198 can be adjusted by the user. In another embodiment, a plurality of retaining sleeves can be fixed in place on the shaft 106 with glue. Good results have been obtained using flexible glue such as Mr. Sticky (identified above).

FIG. 8A

FIG. 4B shows an operator 400 concealed by the present invention. The operator 400 may be washing or taking care of other personal hygiene.

The means of concealment quickly and quietly can be lowered as shown by an angular path 410. This allows the operator 400 to look over the curtain 300 or to shoot an arrow or fire a gun behind them without being obstructed by the means of concealment. After firing, the user can quickly and quietly return the curtain 300 to its normal position as shown.

As disclosed in the original provisional application, the curtain may contain one more slits (350 and 640) through which the operator may look or shoot. The curtain may comprise a plurality of vertically hanging sections (separated by curtain openings 640). A plurality of supports 100 may support a plurality of curtains 300.

One objective and advantage of the present invention is maintaining the frictional force of the first leg 150 with the attaching structure 130. This frictional force holds the attaching pivoting support 100 in place when not being moved by the operator 400. The operator 400 can also angularly raise the support 100 so that the operator's head is also concealed by curtain 300.

As explained earlier, the person makes a silhouette against the background and is observable from 360 degrees. In the method of present invention, first, the operator 400 attaches the attaching pivoting support 100 to the attaching structure 130 (in this example a tree). Next the operator 400 hides in front of the curtain 300. This novel approach revolutionizes wildlife observation as explained in the related applications.

FIG. 8B

Figure 8A:
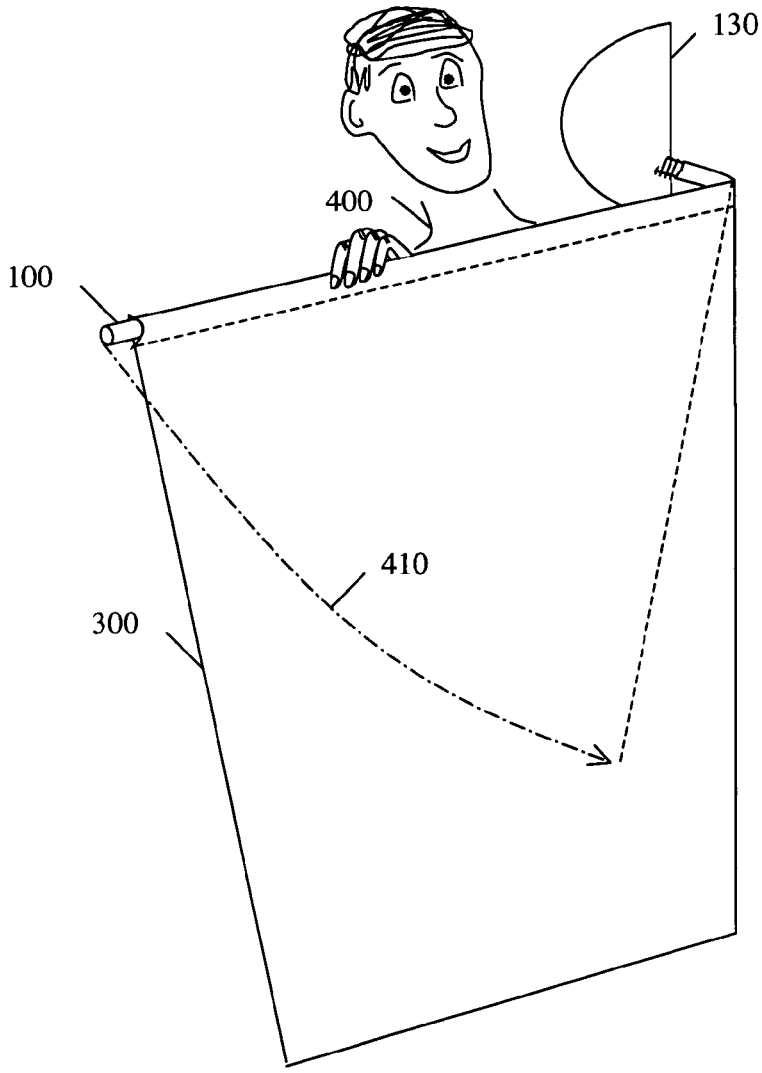
FIGS. 8A through 8C show tree and ground blind embodiments.
Figure 8B:
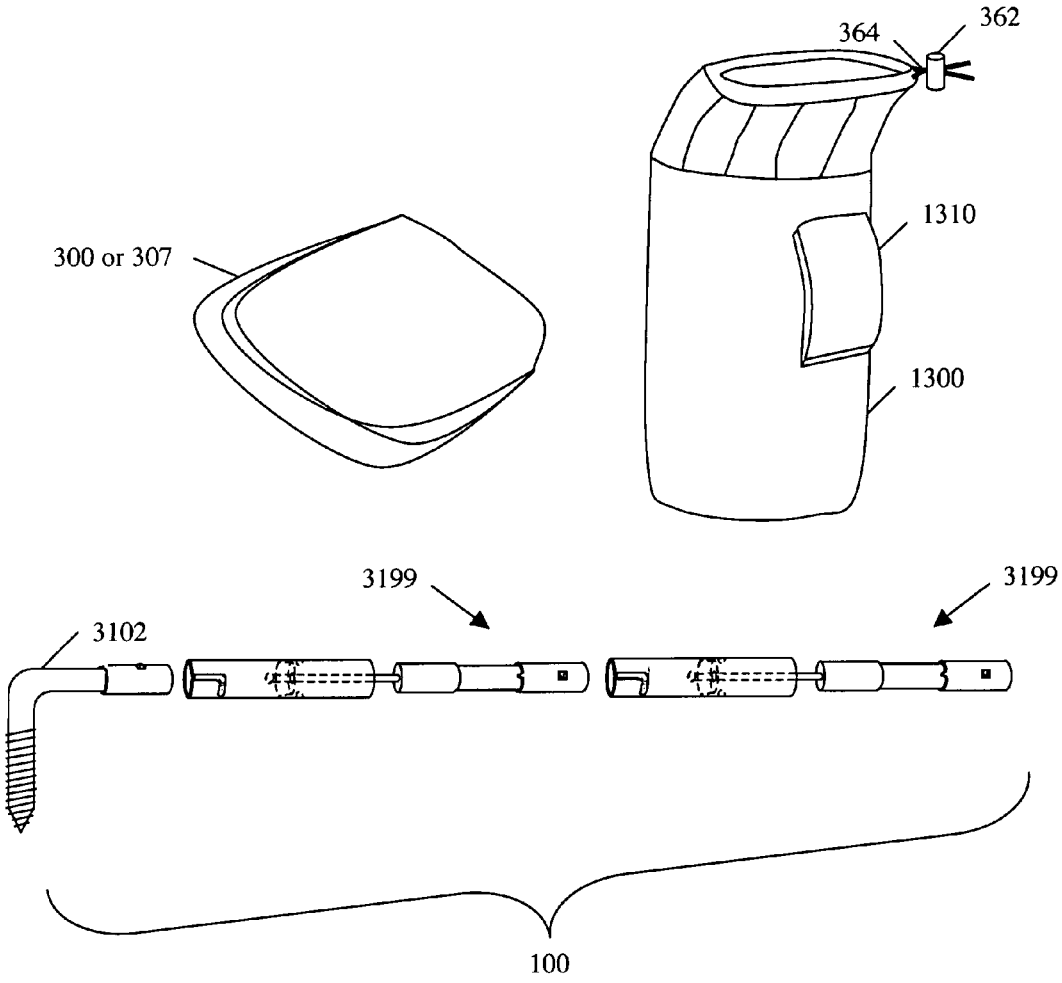

FIG. 8B shows a lightweight, portable embodiment of the present invention, known as the Pocket UnBlind®. FIG. 8B shows a folded curtain 300 (or alternate curtain 307); an attaching pivoting support 100 (shown exploded as described above in reference to FIG. 1C); and a carrying case 1300. The case 1300, which can hold the other components, is shown with a belt loop 1310, which makes it easy to carry. The case is closed with the drawstring 364, which can be held closed with a knot or the drawstring clip 362.

FIG. 8C

Figure 8C:
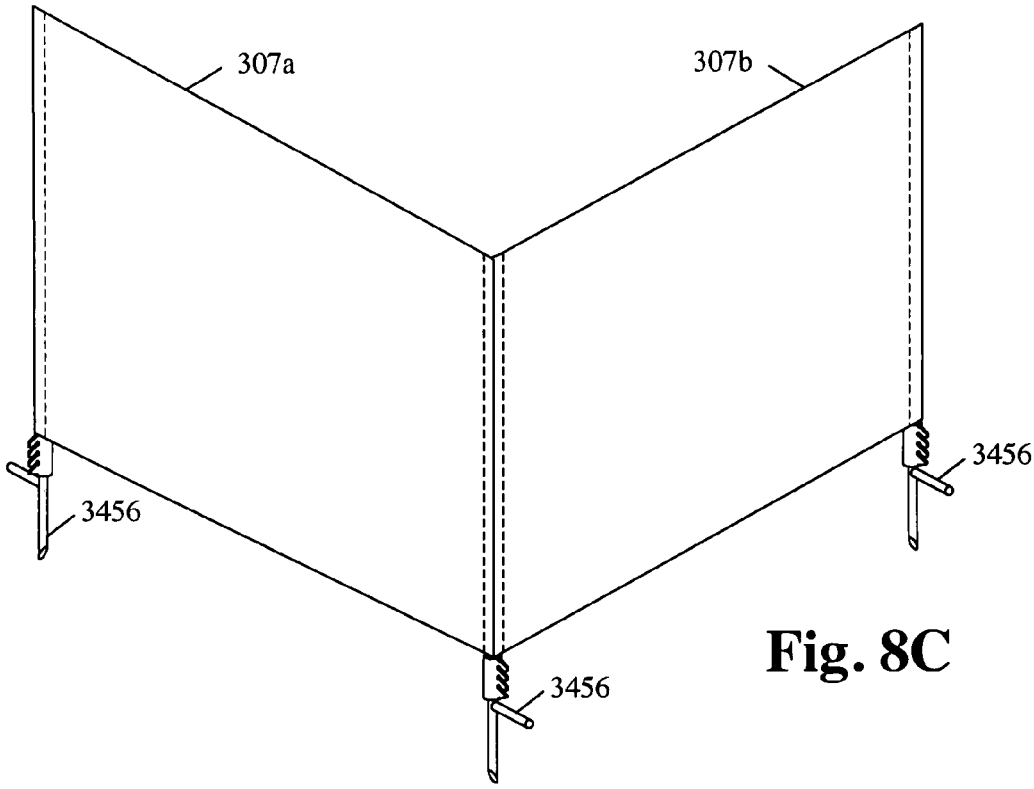

FIG. 8C shows the use of three stakes (stake with cord clips and leg 3456) and two alternate curtains 307 to form a ground blind. In this example, the stakes (3456) are inserted into the ground. Each stake (3456) is connected to a shaft 106 (not visible). Curtains 307*a* and 307*b* are supported by the shafts 106. The stakes 3456 can be placed in a line to form a wall, or diagonally to form a V-shaped blind.

Three or more curtains 300 could be used to form a fully enclosed ground blind.

Figure 8D:
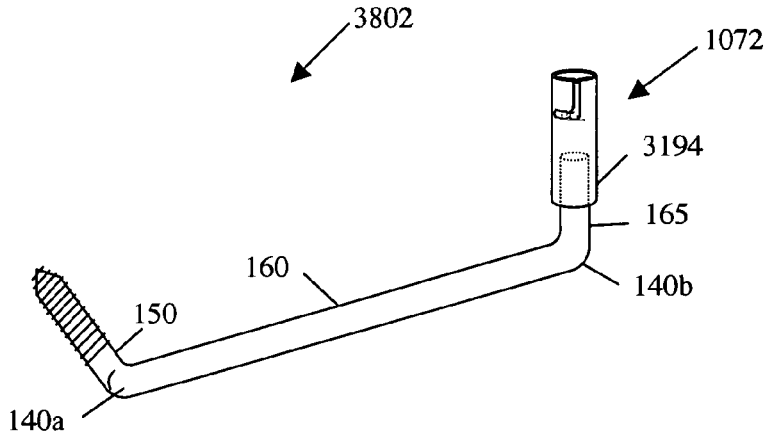
FIG. 8D through FIG. 8F show a novel support and its operation with a tree umbrella module.
Figure 8E:
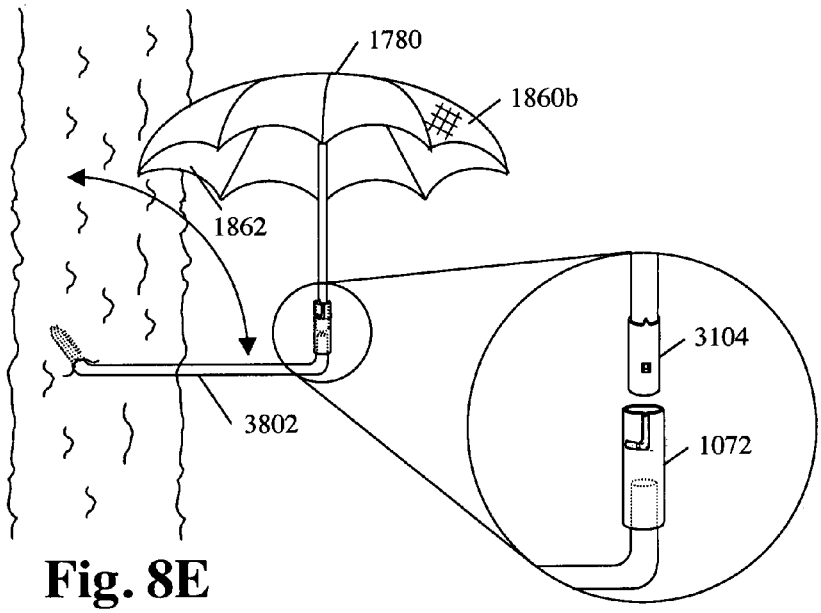
Figure 8F:
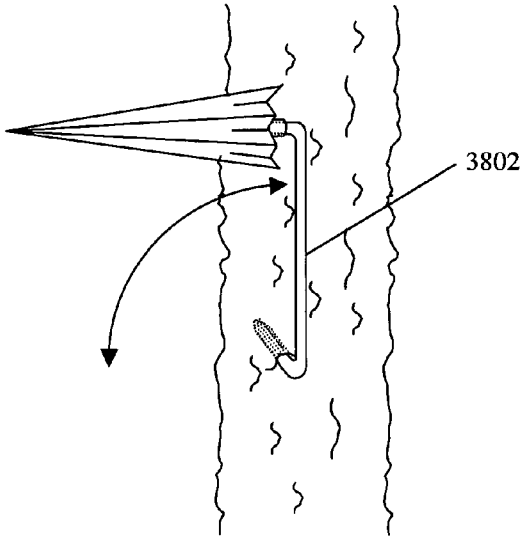

FIG. 8D Through FIG. 8F

FIG. 8D through FIG. 8F show novel features and operation of a receiving support with bends 3802.

As shown in FIG. 8D, the receiving support 3802 is an embodiment of the attaching pivoting support 100. The support 3802 comprises a first leg 150, a first bend 140*a* forming a second leg 160, a second bend 140*b* forming a third section 160, and a channeled connector 3194 providing a receiving end 1072. The second bend 140*b* is preferably in a plane perpendicular to the plane of the first bend 140*a*. The first leg 150 has a threaded portion for threaded attachment to an attaching structure 130, such as a tree (as shown in FIG. 8E), pole, rock, wall, or attaching fastener 230.

As shown in FIG. 8E and FIG. 8F, the support 100 (shown, as 3802) attaches to a tree, for example, with first leg 150, pivots around the attaching leg 150, and holds the angular position due the friction of the attachment (e.g. the teeth friction in the wood). An umbrella 1780 can be attached with an inserting end 1070 having a sleeve 3104 (FIG. 3A) and be positioned at any angle. This has the advantage of allowing the user 400 to dynamically position the umbrella 1780 at any angle, so that user is protected from rain or snow coming in at an angle due to heavy wind. It also has the advantage that the umbrella 1780 can be positioned in a downward angle to act as blind between the user and people or animals on the ground.

Preferably the umbrella 1780 is made with camouflage material. Like the moving shield 1852 (shown related applications), the umbrella 1780 preferably has a shoot-through section 1860 embodied as a shoot-through umbrella section 1860*b*. Unlike a conventional umbrella, the umbrella 1780 of the present invention preferable is one with a wider umbrella section 1862 which may be collapsed partially around the tree (when used in a configuration shown in FIG. 8E). The umbrella is preferably also attached to the tree with straps or a cord (not shown).

FIG. 8F shows the collapsed umbrella and moved out of the way of the operator. This has the advantages of avoiding interference with the operator when not needed and of reducing the risk of accidentally being knocked out of the tree.

FIG. 9A Through FIG. 9E

FIG. 9A through FIG. 9E show operation of pivoting arches 3700 including skin tightening bow cords 1626.

FIG. 9A illustrates a pair of pivoting arches 3700. The pair of pivoting arches 3700 comprises an embodiment of pivoting intersection connector 3500 (or 3500*b*) and a plurality of full-length channeled shaft segments 3199 or half-length shaft segments 3197. In a currently preferred embodiment, the pair of pivoting arches 3700 comprises three full-length channeled shaft segments 3199 and one half-length shaft segment 3197 on each side of each arch (as shown).

Figure 9B:
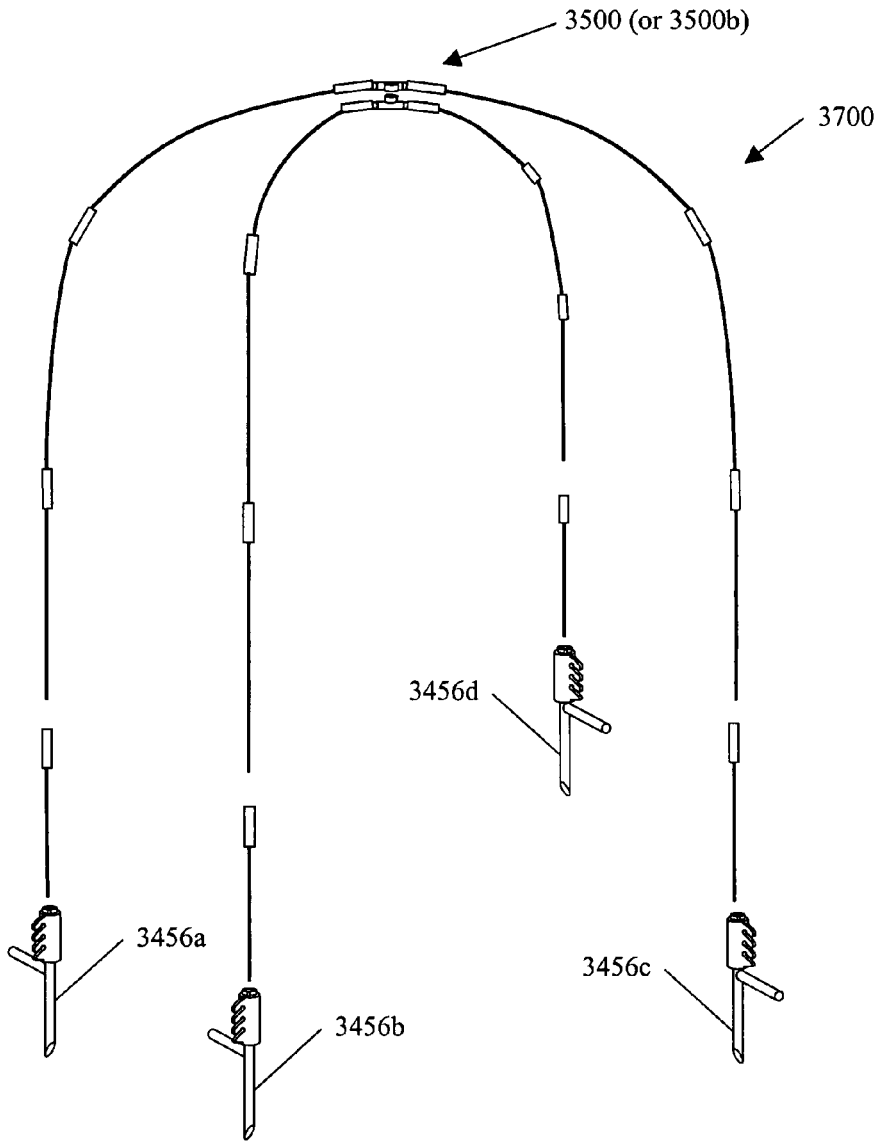
Figure 9C:
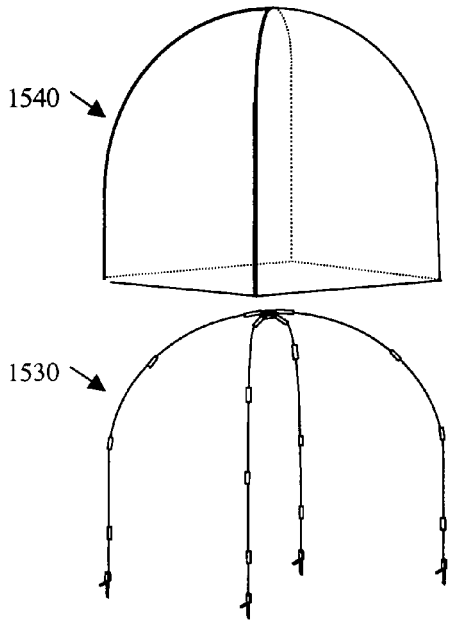

FIG. 9B shows the pair of pivoting arches 3700 configured with four stakes with cord clips and leg 3456. In this configuration, the arches can be inserted into the ground and covered with a cover 1540 to form a shelter or blind (as shown in FIG. 9C and in the related applications). Corner loops 1622 attached to the cover 1540 are adjustably connected to the cord clips 3414 as discussed above in reference to FIG. 4D. The legs on the stakes 3456 can be used to force the stakes 3456 into the ground and to remove the stakes from the ground.

Figure 9D:
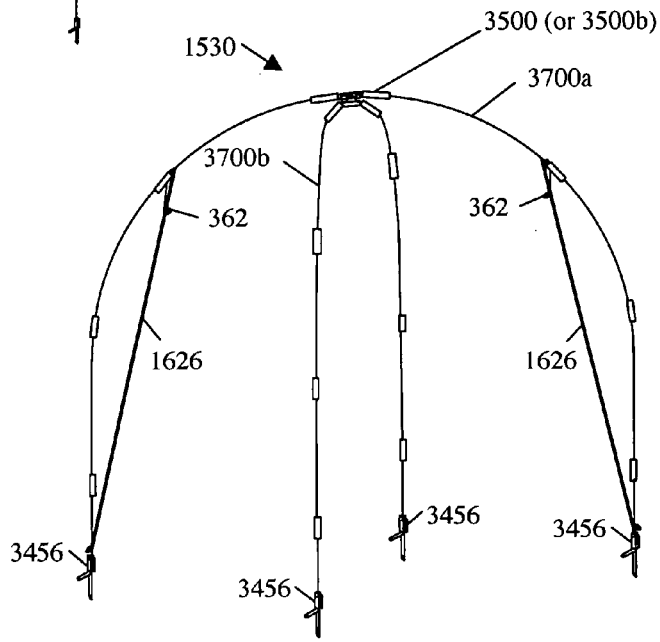
Figure 9E:
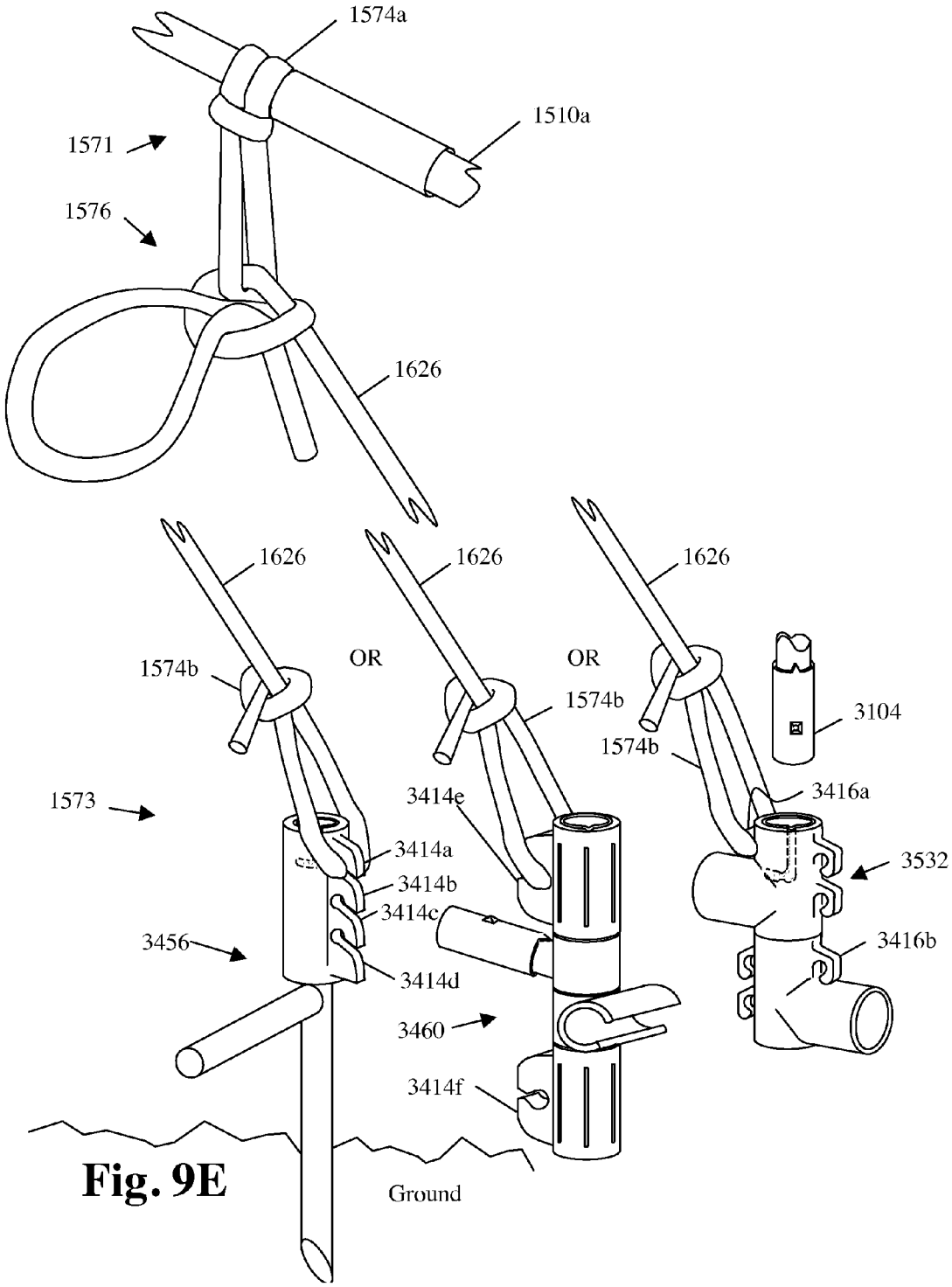

FIG. 9D shows the assembled shelter frame 1530 with a novel skin tightening feature. A plurality of bow cords 1626 is attached to the top one of the pivoting arches 3700*a*. Each of the two bow cords 1626 attach to each stake 3456 at a bottom attachment 1573 and the opposite end of each bow cord 1626 is attached (at a higher point in the arch) at a top attachment 1571. The bow cords are tightened, for example by using a drawstring clip 362 to assert a force on each side of the shelter cover. When tightened, the top one of the pivoting arches 3700*a* asserts a force on bottom one of the pivoting arches 3700*b*, thus only two bow cords are needed to apply a balanced force on both pivoting arches (3700*a* and 3700*b*) and to tighten the skin on all four sides of the cover 1540. This novel feature has the benefit of tightening the cover skin of the shelter on the sides of the cover to reduce movement and flutter. It does this with less weight and cost than conventional blinds. Bow cords 1626 comprise an arch flattening means whereby the apex of the arches of the blind is flattened providing greater usable space within the blind, the blind has a lower profile, and the cover skin is tightened.

With this novel arrangement and technique, the desired tightening is achieved because the stake 3456 and corner loop 1622 (FIG. 4D) hold the lower end of each pivoting arch (3700*a* and 3700*b*) securely in the corner of the cover 1540 and the bow cord 1626 bends a portion of the cover shaft causing an outward force on each corner.

FIG. 9E shows the details of the top attachment 1571 and the three alternatives for the bottom attachment 1573. The top attachment 1571 in this embodiment is made with a low-cost loop of cord passed around the shaft (e.g. 1510*a*) and through itself to form a knot that will catch against a connector. The knot forms the upper bow cord attachment 1574*a*. The lower bow cord attachment 1574*b* is formed by tying the bow cord 1626 around the bottom of the support 100 (as shown in the related applications) or attaching the knotted bow cord 1626 to a cord clip 3414 or bow cord clip 3416 (for example, on any of the following: stake with cord clips and leg 3456, alternate dual-swivel clip 3460, or alternate dual-swivel pole receptacle 3532. A quick release knot is used to tighten and hold the bow cord 1626. Specifically, the other end of the bow cord 1626 is passed through the free loop of the upper bow cord attachment 1574*a*, pulling the bow tight as desired, and securing it with a quick release knot, such as a slip knot 1576, as shown.

FIG. 10A Through FIG. 10D

FIG. 10A through FIG. 10D show an embodiment of a method of setting up an embodiment of the shelter or blind.

As shown in the sequence of FIG. 10A through FIG. 10D (and optional through 10E), a staked structure is configured by inserting a pair of pivoting arches 3700 in the ground using stakes (e.g. stake with cord clips and leg 3456) attached to the each end of each arch. FIG. 10A shows one of the pair of pivoting arches 3700*a* staked into the ground. FIG. 10B shows the second of the pair of pivoting arches 3700*b* staked into the ground and attached via a pivoting intersection connector 3500 (or 3500*b*). FIG. 10C shows the cover 1540 pulled over the stake arches and attached to the stakes (e.g. 3456) using the corner loops 1622 (shown more detail in FIG. 10I). The bottom corner loop 1622 of each cover corner is attached to a respective cord clip 3414 on a corner piece (shown as e.g. stake with cord clips and leg 3456). FIG. 10D shows the cover skin being tightened by moving the base of the arches outward from the center, taking advantage of the novel adjustability of the staked arches. The lower walls of the cover skins can optionally be tightened using as further shown and discussed in relation to FIG. 10E through FIG. 10H.

In field testing, operators sometimes bent the cover shaft arches (1500) too far thus breaking the hollow fiberglass poles. This potential breakage can be avoided by using connectors with pressure release spring 3540 as shown above in FIGS. 5F through 5H, or by using thicker or solid shafts.

FIG. 10E Through FIG. 10H

FIG. 10E through FIG. 10H show aspects and operation of cover corner tightening.

When a cover 1540 is stretched over a frame 1530 (comprising for example, cover shafts 1500, pivoting arches 3700, or fast setup frame 1534) and pulled down at the corners (e.g. via corner loops 1622), we discovered that the lower portion of the each cover panel 1542 is loose. This is illustrated in FIG. 18M where the bottom edge is like a frown (1872). This is because the forces pulling on the cover skin are toward the cover shafts (e.g. 1500, 1512, 3700) and toward the cover corners where the corner loops 1622 are attached to a cord clip 3414 on a stake (e.g., 3456 or 3458) or endpiece (e.g., 4400 or 4402). There is no force applied to the bottom edge. Various novel means have been developed to address this frown edge 1872 looseness.

As previously discussed in reference to FIG. 10D, the walls can be tightened by moving the stakes 3456 out from the center.

Further tightening can be accomplished by novel corner tightening 4104(*a-c*) as shown in FIG. 10E, where the extra material is brought together in the corners.

FIG. 10F shows the details of an embodiment for corner tightening. A cord is sewn along the base of cover corner such that a plurality of side loops 4102(*a-c*) are on one cover panel and a corner hook 4100 is on the other cover panel. The corner hook 4100 is permanently attached so that it is readily available and is selectively attached to one of the side loops 4102 to provide the desired tightness.

FIG. 10G shows even greater detail of the corner tightening 4104 with the corner hook 4100 attached to one of the side loops 4102*a*. The cord is attached at various points with side loop attachment 4106(*a-b*), for example by sewing the cord to the cover 1540 at various points.

FIG. 10H shows a cross section of the result shape near the base of the corner tightened blind.

Other embodiments of means for tightening the base of the cover skin will be discussed in reference to FIG. 11F, FIG. 12E, FIG. 12G, FIG. 15C, FIG. 15D, FIG. 15E, FIG. 16B, FIG. 17F, FIG. 18N, FIG. 19H, FIG. 23D, and FIG. 26B.

Figure 10J:
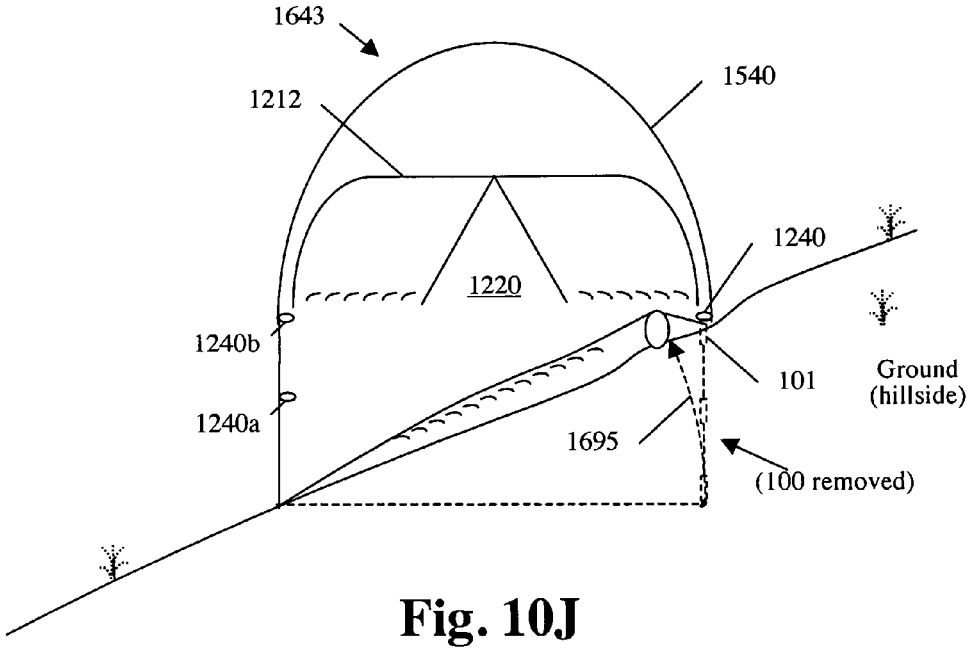

FIG. 10I and FIG. 10J

FIG. 10I and FIG. 10J show cover details of which provide for multiple configurations, such as those shown, for example, in FIG. 19K through FIG. 19N.

FIG. 10I, which is similar to FIG. 4R, shows the placement of corner loops (1622*a* through 1622*c*) at points that correspond to the bottom end of the cover shaft (e.g. 1500 or 3700) where a corner loop 1622*a* is attached to a cord clip 3414 of a corner piece (e.g. stake with cord clips and leg 3456, as detailed in FIG. 4C) to hold the cover securely against the shelter frame 1530. When on a moderate hillside, the lower shaft segment 3199*a* (shown embodied as a half-length shaft segment 3197) is removed, the corner piece attached half way up, and the middle corner loop 1622*b* is attached to a cord clip 3414 holding the cover corner taut. When on a steep hillside (as shown in FIG. 10J, see also FIGS. 14E and 19N), both shaft segments 3197 (or one 3199) are removed and the stake (e.g. 3456) is attached directly to the cover shaft (e.g. 1500 or 3700), and the top corner loop 1622*c* is attached to a cord clip 3414 holding the cover corner taut. Two cover holes 1240 are also placed in the cover seam 1544 so that the stake member 3454 can exit the cover and enter the ground as explained in more detail in reference to FIG. 10J. In other embodiments, the shafts are extended with extensions 4410 (see FIG. 4R, FIG. 22B through FIG. 22F, and FIG. 23D) that replace of cover shaft segments 3197 (or one 3199) with similar effect.

In a simpler embodiment, the corner loops 1622 are replaced with corner holes 1240 at the respective locations of corner loops 1622*a*, 1622*b*, and 1622*c*. In this simpler embodiment, for example, stake member 3454 passes through the desired cover hole 1240 with the same result of holding the cover 1540 taut. This eliminates the marginal cost, and associated convenience of the cover loop 1622.

FIG. 10J shows a side view of an alternate extended configuration 1643 anchored on a steep hillside. The uphill both shaft segments 3197 (or 3199) are removed and the stake (e.g. 3456) is attached directly to the cover shaft (e.g. 1500 or 3700). The cover bottom arc 1695 shows the path of the lower corner of the cover 1540 when it is raised. Without the cover hole 1240, when the cover 1540 is rolled up, forming cover roll 1546, the cover material would pull the cover shaft (1500 or 1510) and distort the shape of the tent, resulting in loose material that would flutter in the wind and scare off wildlife. The cover hole 1240 provides the benefits of a) maintaining the shape of the shelter frame 1530, b) allowing the shortened end of the cover shaft (1500 or 1510) to be anchored firmly to the ground, and c) allowing the novel skin tightening feature to work even when mounted on the side of a steep hill.

In a currently preferred embodiment, the cover hole 1240 is placed in each cover seam 1544 about three feet above the bottom edge of the cover (see FIG. 10I). The cover hole 1240 optionally is covered externally with a small flap of material (not shown) to prevent water from coming inside the cover in heavy rain.

Note that on a hill that is even steeper than the one shown, the shafts can be lengthened or shortened to match the terrain. The novel ability to dynamically configure the structure provides the benefit of having a generally level structure that maintains the forces necessary to keep the cover skin on the structure taut in the wind even when located in rough or steep terrain. Alternatively, in an embodiment of the cover having scent flaps (see related applications) the downhill flaps extend to cover the new opening.

Figure 11A:
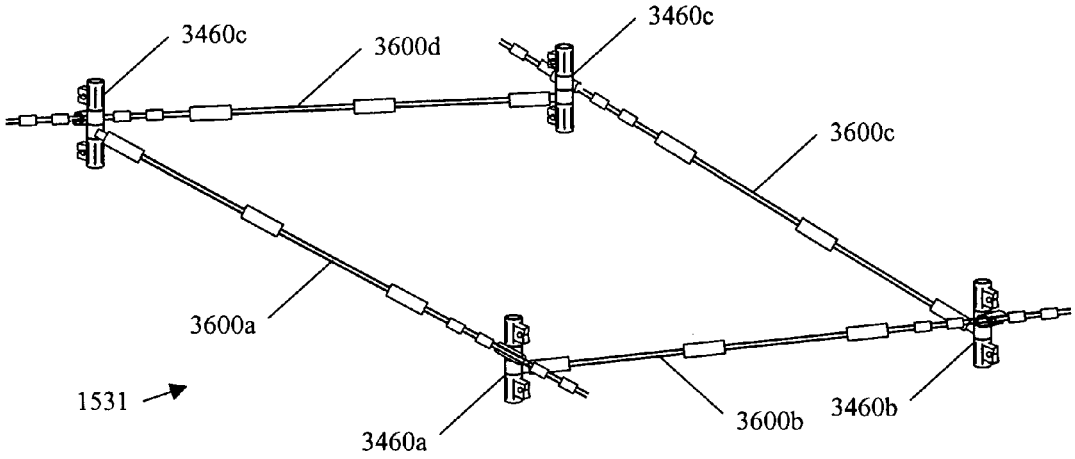
FIG. 11A and FIG. 11B show embodiments of frame base structures.
Figure 11B:
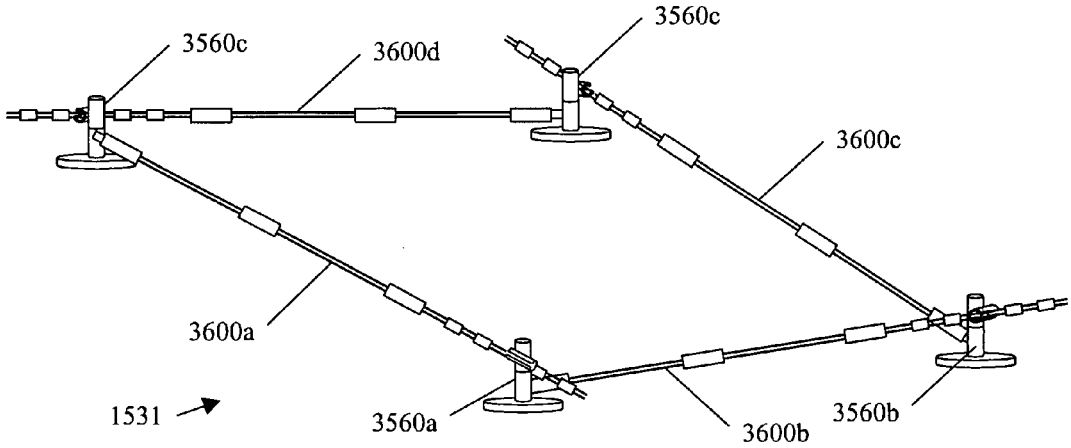

FIG. 11A and FIG. 11B

FIG. 11A and FIG. 11B show embodiments of frame base structures, which were previously detailed in the POLE1 application.

FIG. 11A and FIG. 8F illustrate a base structure configured with four base shafts. The base shafts are both shown having the novel adjustability provided by retaining shaft 3193 (FIG. 7D).

In FIG. 11A, each base segmented shaft 3600 is attached to an alternate dual-swivel clip 3460. One end of the base segmented shaft 3600 is connected to an inserting end and the other end is adjustably attached to a pole clip 3410.

In FIG. 11B, each base segmented shaft 3600 is attached to a dual-universal clip base 3560. One end of the base segmented shaft 3600 is connected to an inserting end and the other end is adjustably attached to a pole clip 3410.

FIG. 11C Through FIG. 11F

FIG. 11C through FIG. 11F show operation of an embodiment of the shelter or blind with a frame base.

Figure 11C:
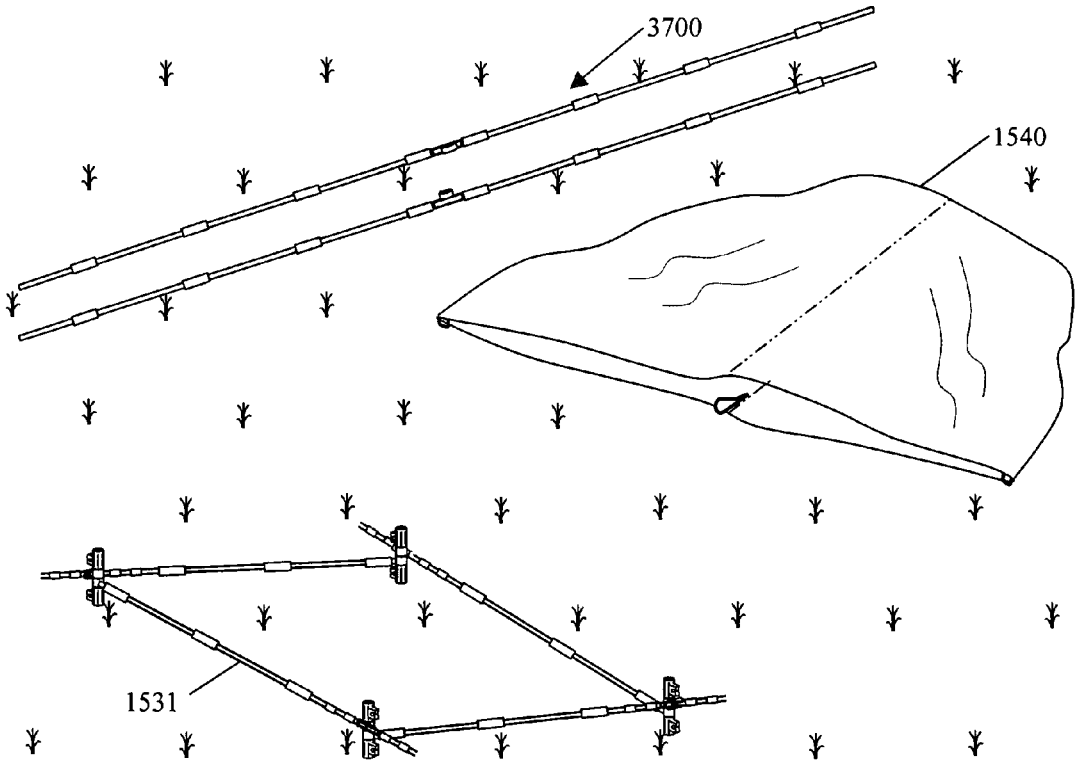
FIG. 11C through FIG. 11F show operation of an embodiment of the shelter or blind with a frame base.
Figure 11D:
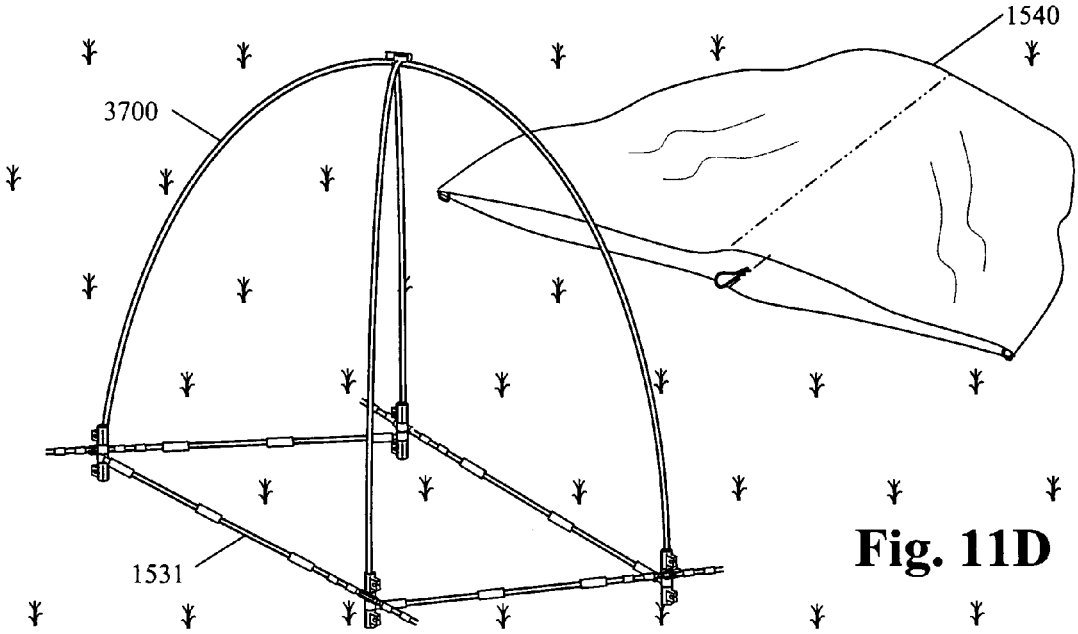

FIG. 11C illustrates a pair of pivoting arches 3700 laying separated on the ground, a cover 1540, and a frame base 1531.

Figure 11E:
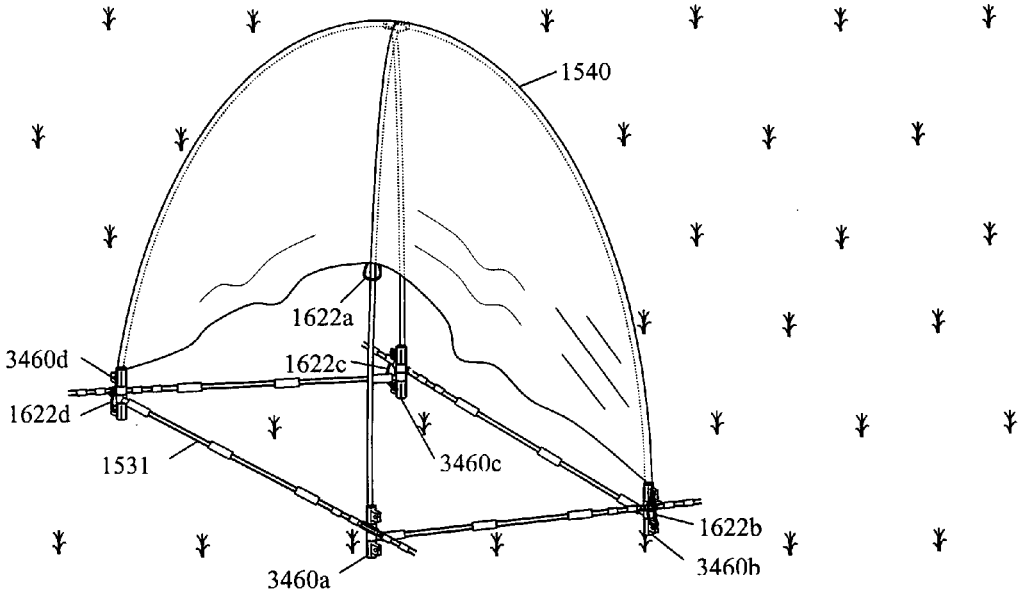
Figure 11F:
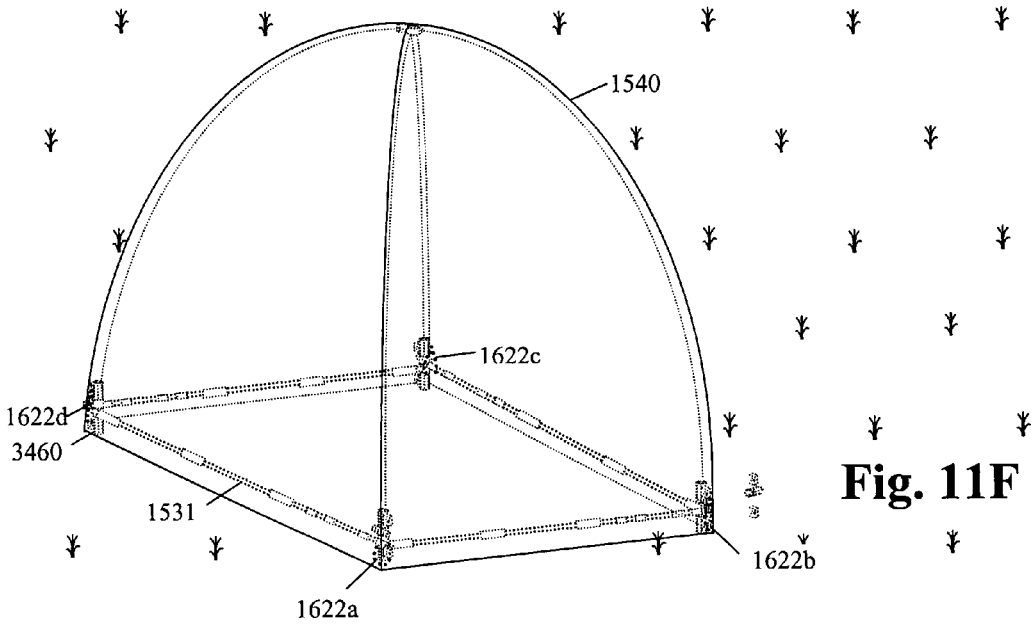

As shown in the sequence of FIG. 11C through FIG. 11F, a free standing structure is configured by assembling the frame base 1531 (FIG. 11C), attaching the pair of pivoting arches 3700 (FIG. 11D), and adding the cover 1540 which is attached to the base using the corner loops 1622 (FIG. 11E). As shown in 11E the bottom corner loop 1622 of each cover corner (1622*a* through 1622*d*) is attached to a respective cord clip 3414 on a corner piece (shown as alternate dual-swivel clip 3460*a* through 3460*d*). Finally, as shown in FIG. 11F, the skin is tightened by moving the base of the arches outward from the center, taking advantage of the novel adjustability provided by retaining shaft 3193 (FIG. 7D).

FIG. 12A Through FIG. 12G

FIG. 12A through FIG. 12G show alternate operation of an embodiment of the shelter or blind with or without a frame base, including cover tie downs.

In some parts of the country, the ground is so rocky that it is difficult to drive stakes in the ground and move stakes in order to adjust skin tightness. In order to address this problem, the modular system can be set up without the requirements for stakes.

Figure 12A:
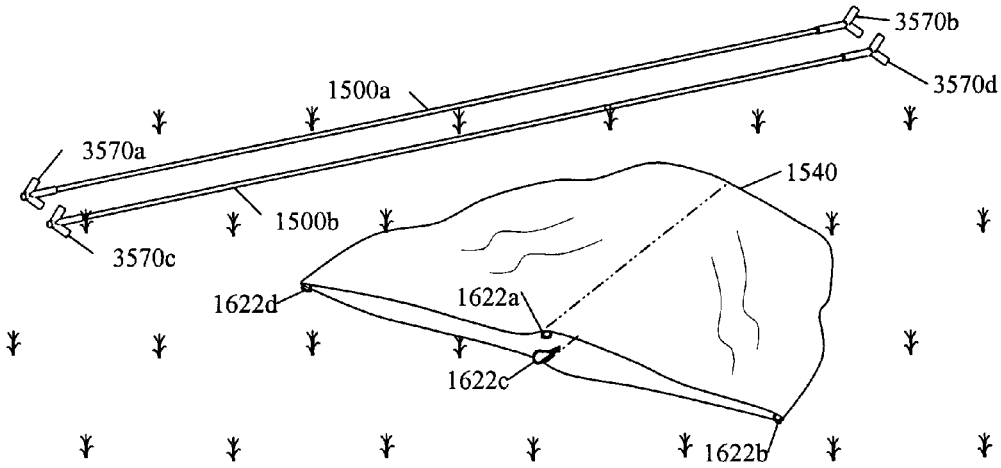
FIG. 12A through FIG. 12G show alternate operation of an embodiment of the shelter or blind with or without a frame base, including cover tie downs.
Figure 12B:
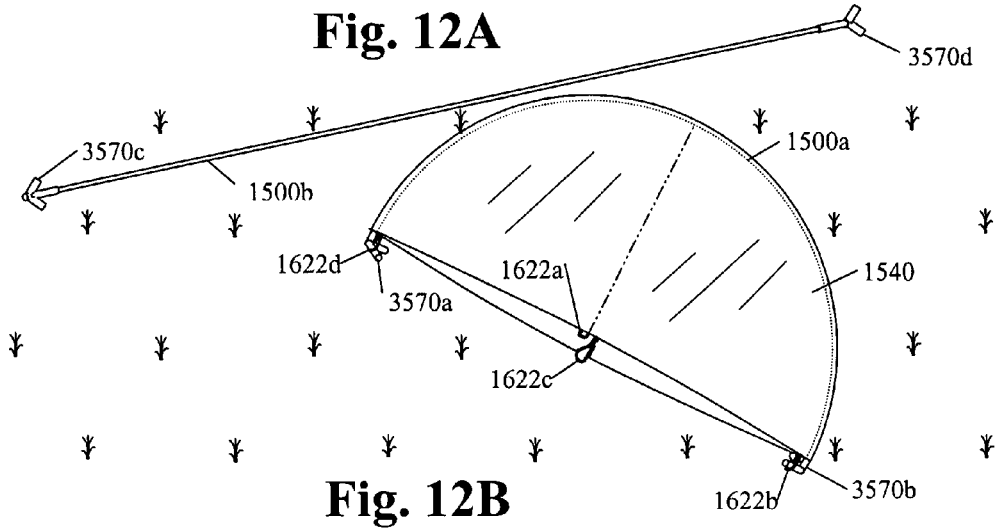
Figure 12C:
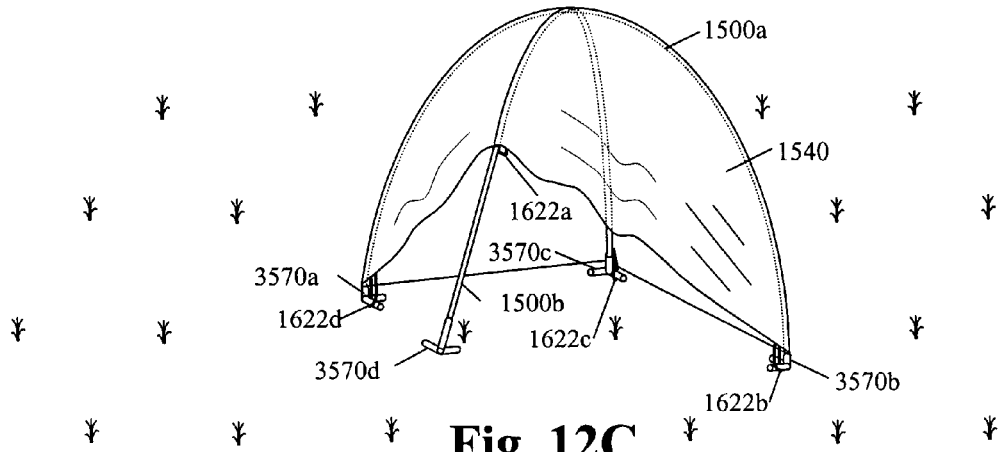
Figure 12D:
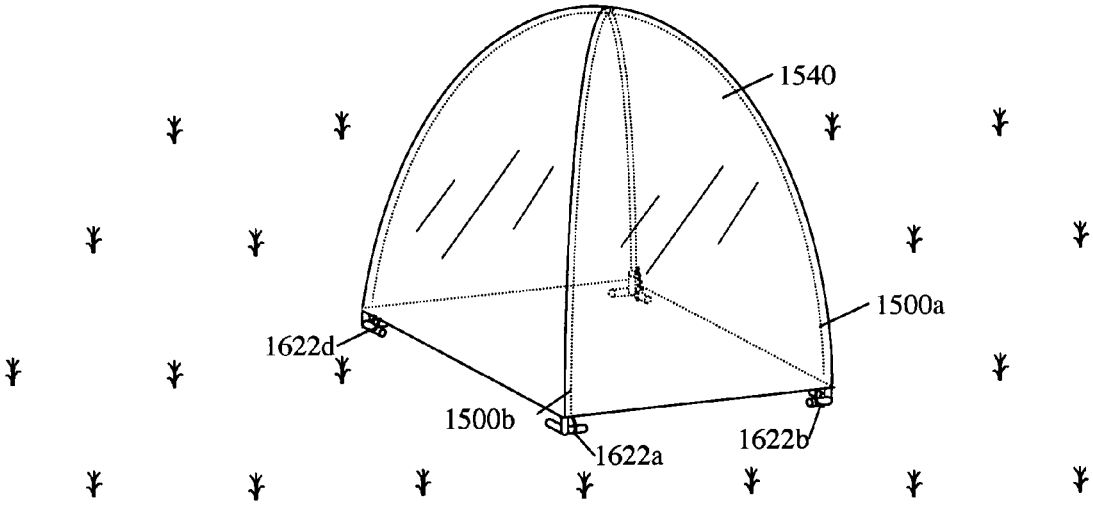
Figure 12E:
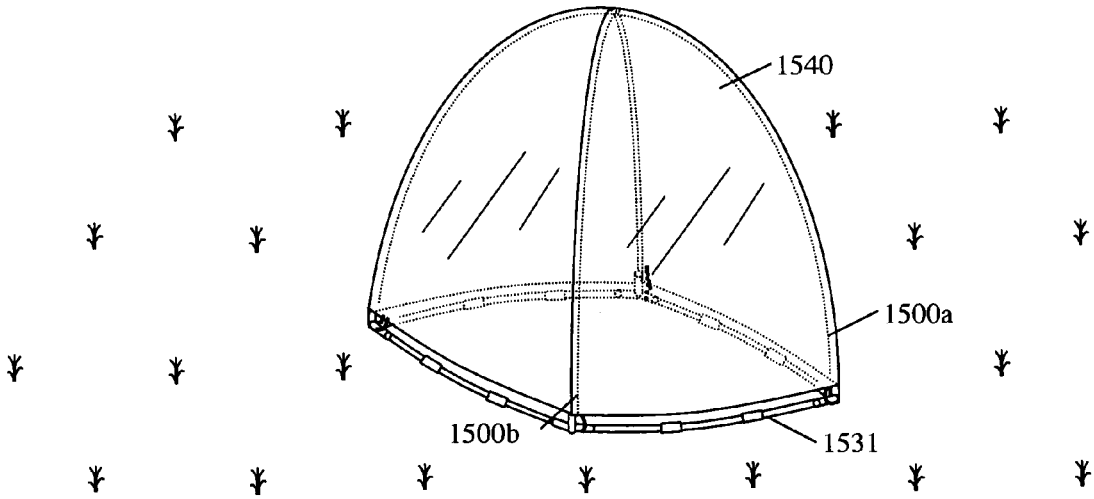
Figure 12F:
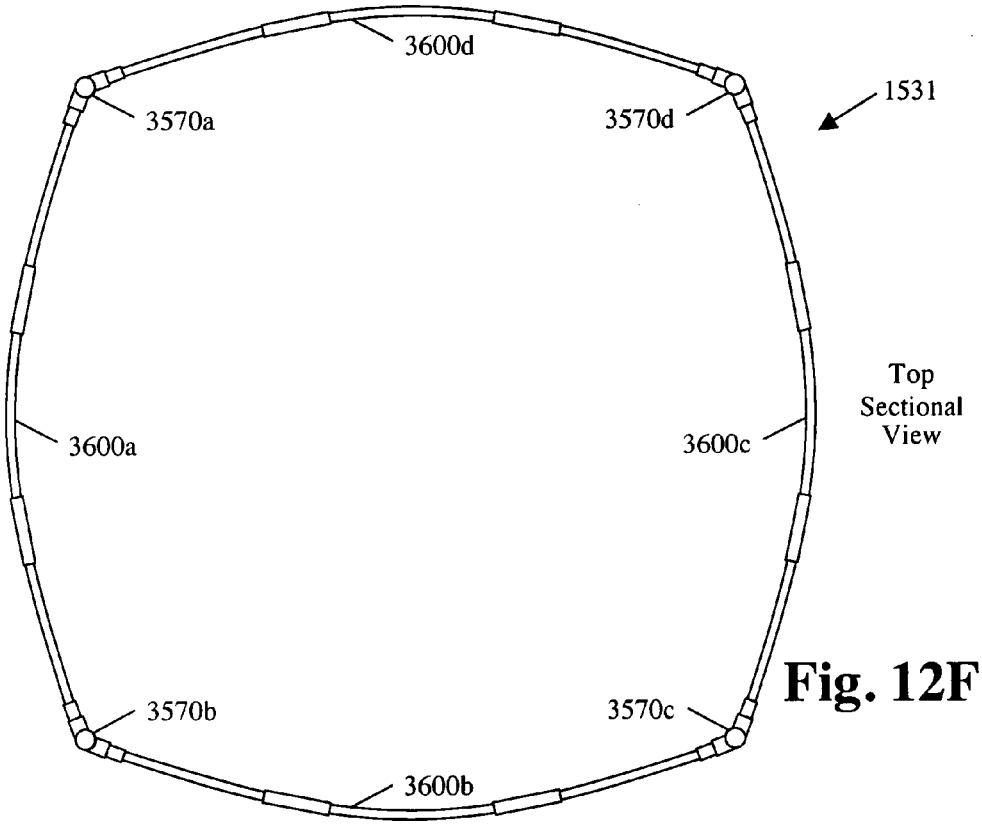
Figure 12G:
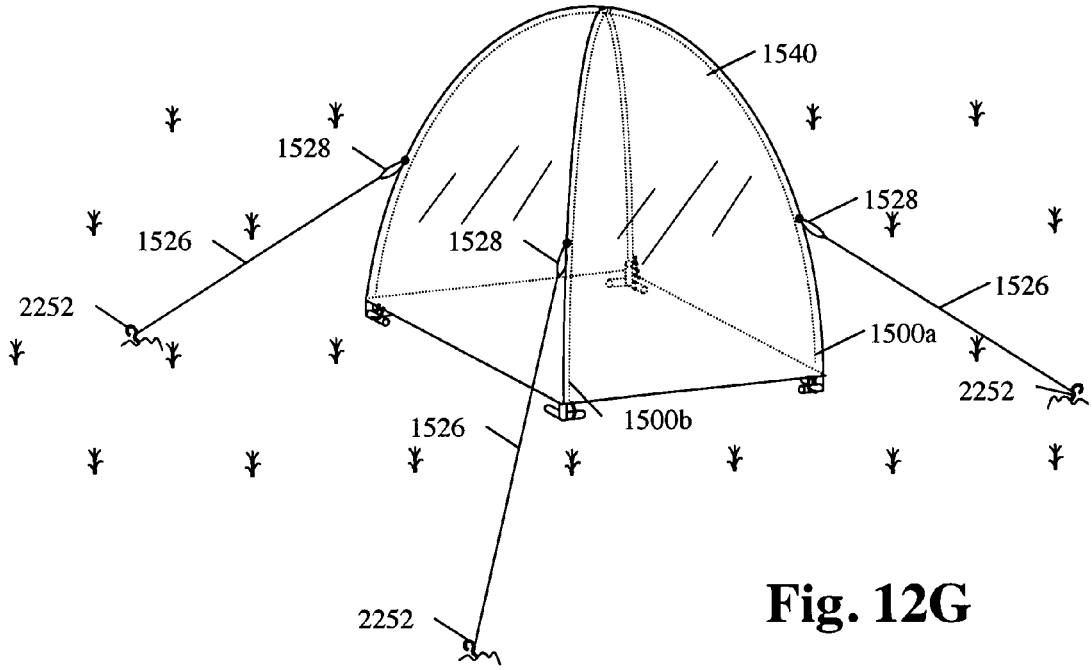

As shown in the sequence of FIG. 12A through FIG. 12F a standalone structure is configured using alternative novel components. FIG. 12A shows cover shafts 1500*a* and 1500*b*, each having corner base connector 3570(*a-d*) connected to each of the four ends of the shafts 1500. FIG. 12A also shows the cover 1540 spread out on the ground (in the rough shape of pita bread), having a corner loop 1622(*a-d*). FIG. 12B shows the now taut cover 1540 after the first cover shaft 1500*a* has been inserted into it and attached at opposite corners. The cover 1540 is still on the ground. Corner loop 1622*d* is connected to corner base connector 3570*a*, and corner loop 1622*b* is connected to corner base connector 3570*b*. FIG. 12C shows the second cover shaft 1500*b* attached to corner loop 1622*c* at corner base connector 3570*c*. As the operator feeds the second cover shaft 1500*b* into the cover 1540 the first arch (i.e. 1500*a*) starts to stand up and the operator continues to pull the final corner loop 1622*a* down the second cover shaft 1500*b* to the final corner base connect 3570*d*. FIG. 12D shows the free standing structure. At this point, the operator has two options. If the ground is hard, the operator can attach four base segmented shafts 3600(*a-d*) between each respective adjacent pair of the corner base connectors 3570(*a-d*) as shown in detail in FIG. 12F, resulting in a standalone structure with a frame base 1531 as shown in FIG. 12E.

Alternatively, if the ground can receive a smaller stake, such as stake with hook 2252, a standalone structure can be staked with tie down cords 1526 each attached to the cover 1540 with tie down loops 1528, as shown in FIG. 12G.

Staking other embodiments with tie down cords 1526 each attached to the cover 1540 with tie down loops 1528 is also advantageous to help maintain the shape of the arched dome in strong winds. In very strong winds, e.g. 40 mile per hour, the stakes can be skewed toward the wind to counteract the force of the wind against the windward cover panel or panels. Proper staking in high wind situation will reduce breaking of the cover shafts 1500.

FIG. 13A Through FIG. 13D

FIG. 13A through FIG. 13D show various operations with an embodiment of the shelter or blind with a segmented frame base 1531.

Figure 13A:
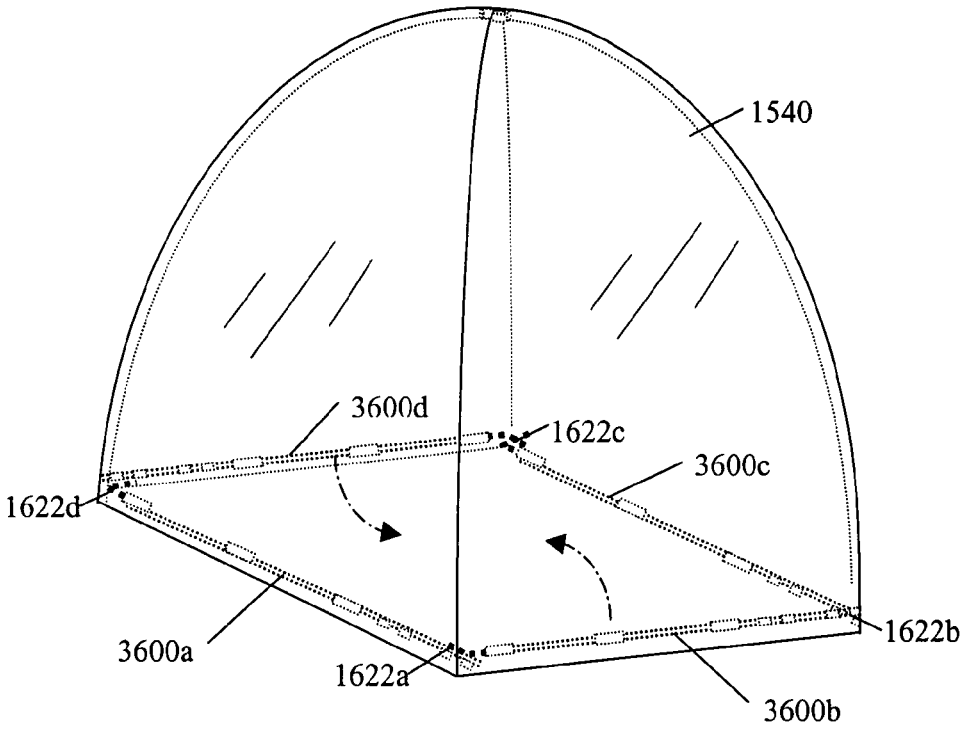
FIG. 13A through FIG. 13D show various operations with an embodiment of the shelter or blind with a segmented frame base.
Figure 13B:
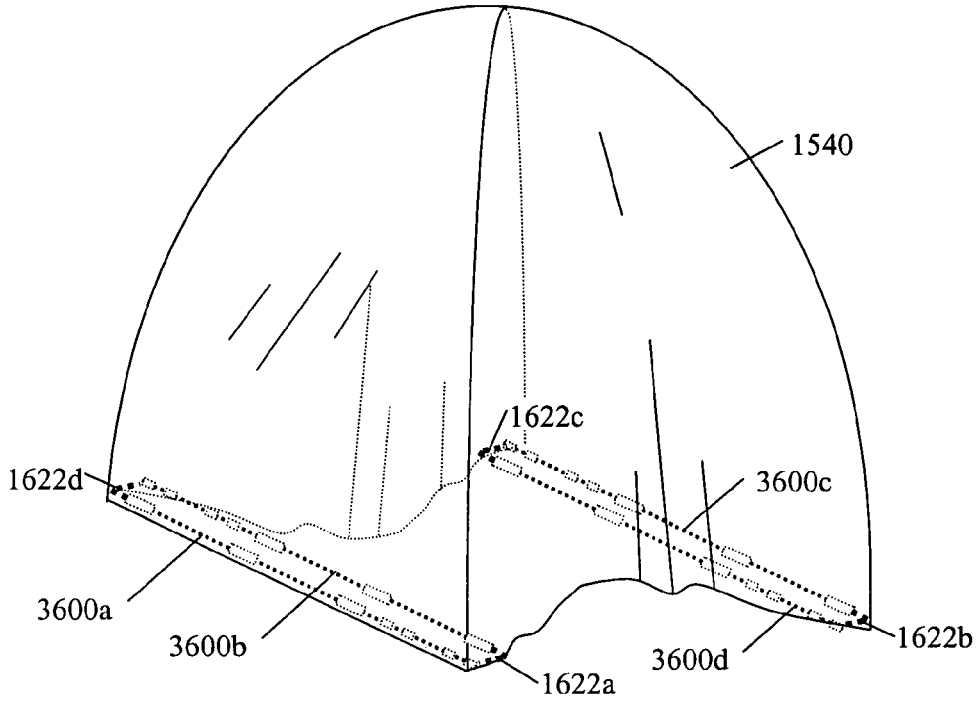

FIG. 13A shows the base segmented shafts 3600*b* and 3600*d* being disconnected at one end and rotated in until they are parallel with the adjacent base shaft (i.e. 3600*a* with 3600*b* and 3600*c* with 3600*d*. This shows an advantage of the novel swiveling corner components, such as shown in FIG. 4E, FIG. 4I through FIG. 4P. With pivoting arches 3700, the blind can be collapsed (into the pita bread shape) as shown in FIG. 13B. The blind can be easily moved to a new location and quickly set up again because no segmented shafts 3600 or 3700 have been broken down.

Figure 13C:
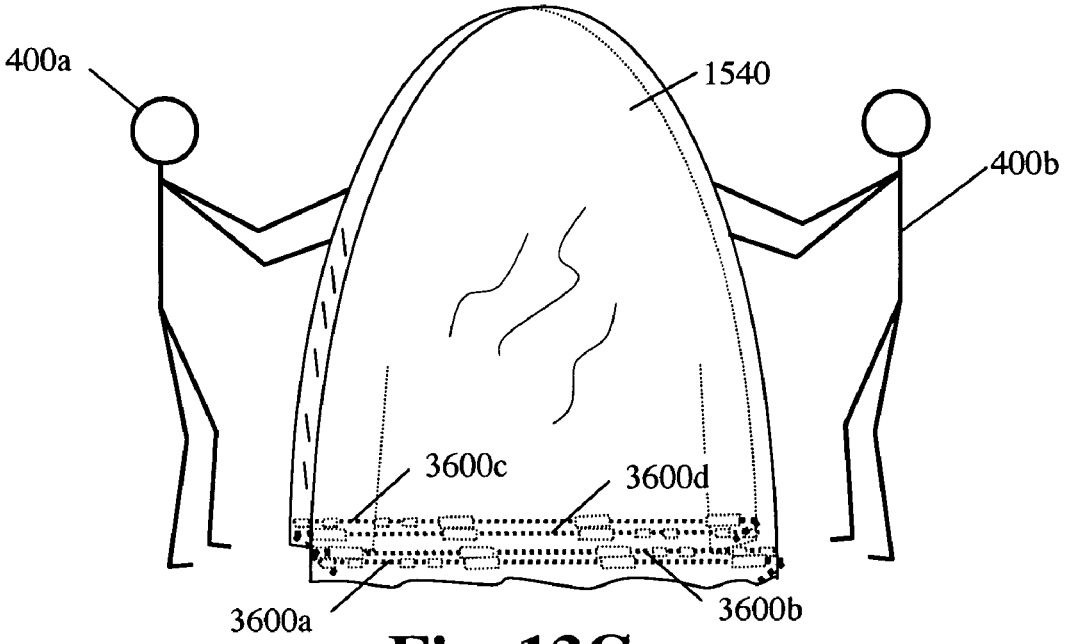

FIG. 13C shows two operators 400*a* and 400*b* moving the partially collapsed, "pita bread" structure a short distance.

Figure 13D:
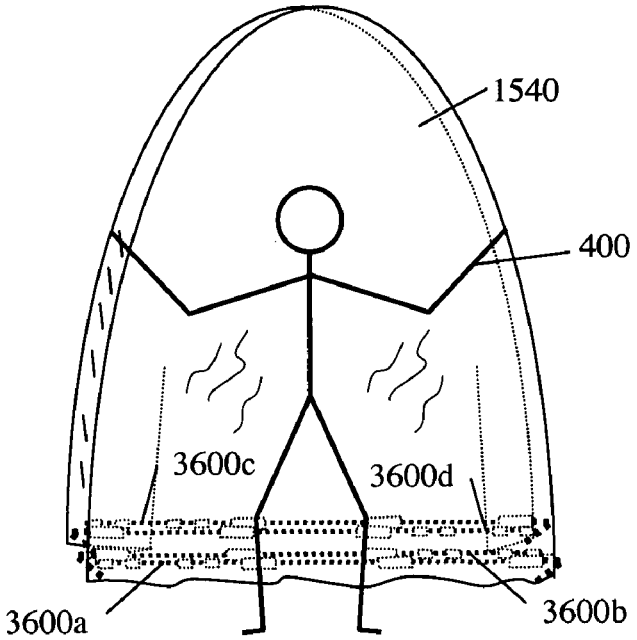

FIG. 13D shows that a single operator 400 could also move the partially collapsed structure.

FIG. 14A Through FIG. 14E

FIG. 14A through FIG. 14E show various operations with an embodiment of the shelter or blind with a frame base comprising pivoting banded supports 3180.

Figure 14A:
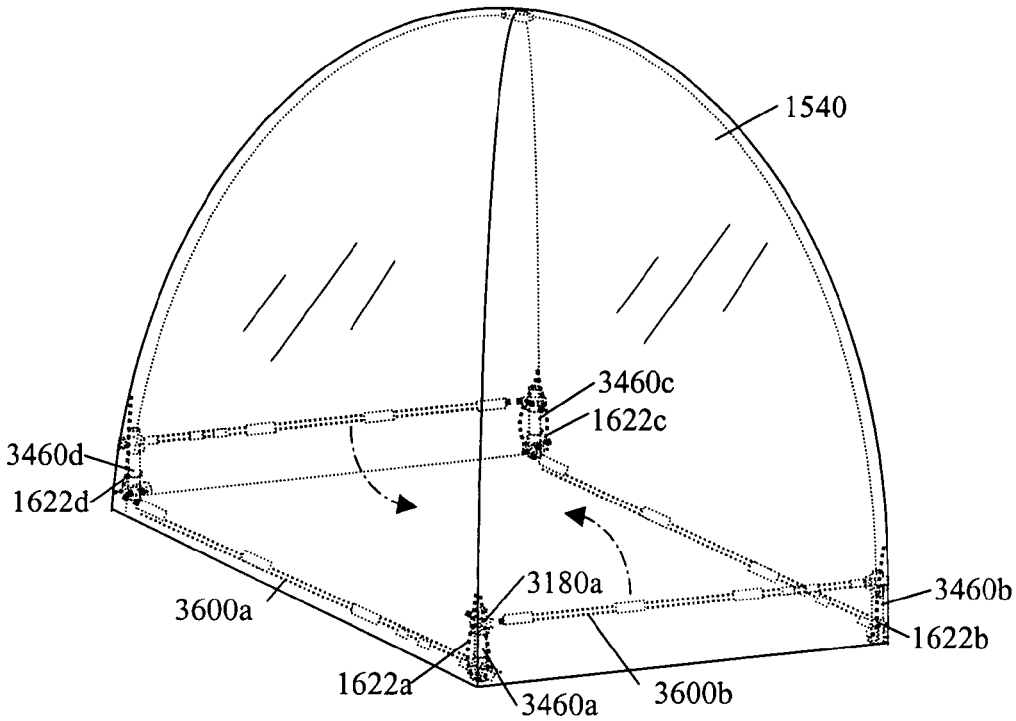
FIG. 14A through FIG. 14E show various operations with an embodiment of the shelter or blind with a frame base comprising pivoting banded supports.

FIG. 14A shows a standalone embodiment wherein the frame base 1531 comprises base segmented shaft 3600(*a-d*) having banded supports 3180, as shown in detail in FIG. 6A through FIG. 6D.

Figure 14B:
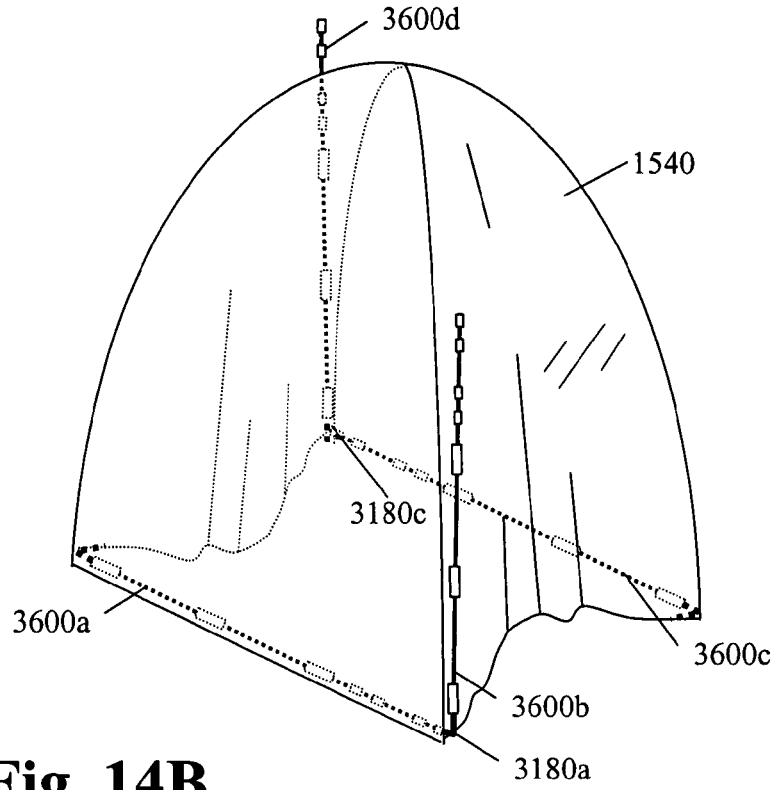
Figure 14C:
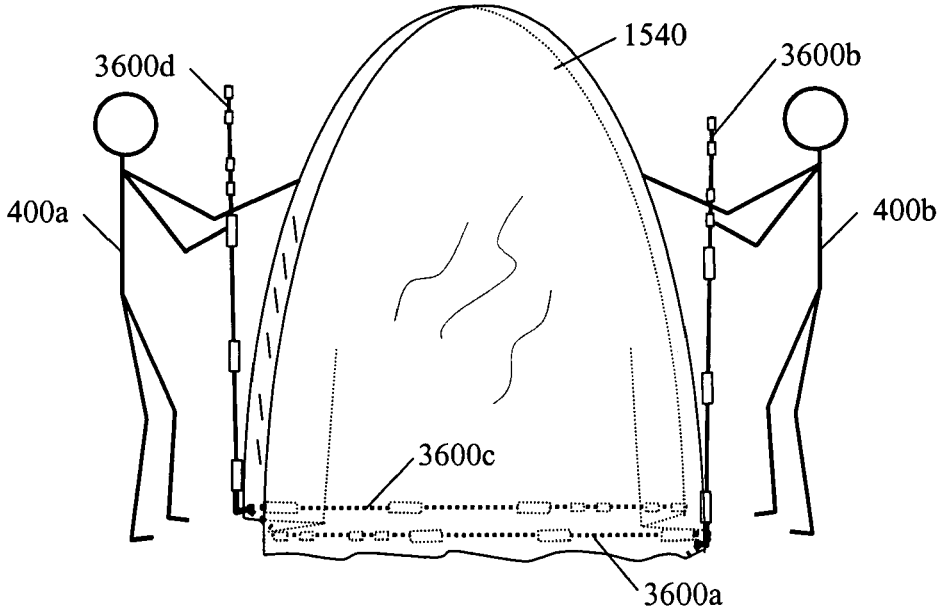
Figure 14D:
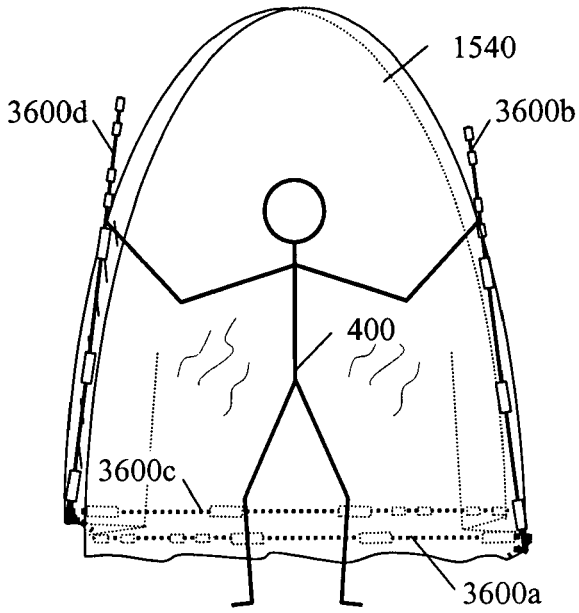

FIG. 14B shows how the base segmented shafts 3600*b* and 3600*d* can be pivoted vertically, allowing the partially collapsed structure to be moved as shown in FIGS. 14C and 14D, by two or one operators, respectively.

Figure 14E:
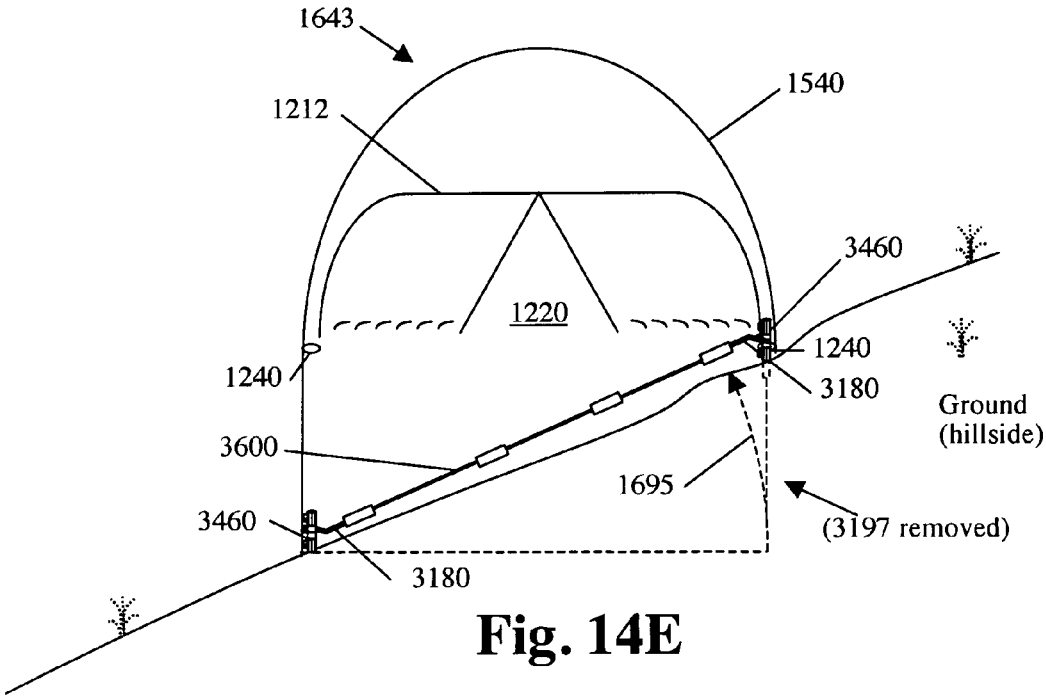

FIG. 14E shows a side view of an alternate extended configuration 1643 placed on a steep hillside. The uphill shaft segments 3197 (or 3199) are both removed and a base segmented shaft 3600 is attached to the cover shaft (e.g. 1500 or 3700) using banded supports 3180 attached to an alternate dual-swivel clip 3460. The cover bottom arc 1695 shows the path of the lower corner of the cover 1540 when it is raised. The optional cover hole 1240 allows a stake (e.g. stake with single cord clip 3458) to pass through the cover 1540, allowing the shortened end of the cover shaft (1500 or 1510) to be anchored firmly to the ground.

This embodiment also shows the novel features of the banded supports 3180 which allows a standalone frame base 1531 to be used in the hillside configuration.

FIG. 15A Through FIG. 15E

FIG. 15A through FIG. 15E show various aspects and operations with an embodiment of the shelter or blind with an adjustable, circular frame base.

Figure 15A:
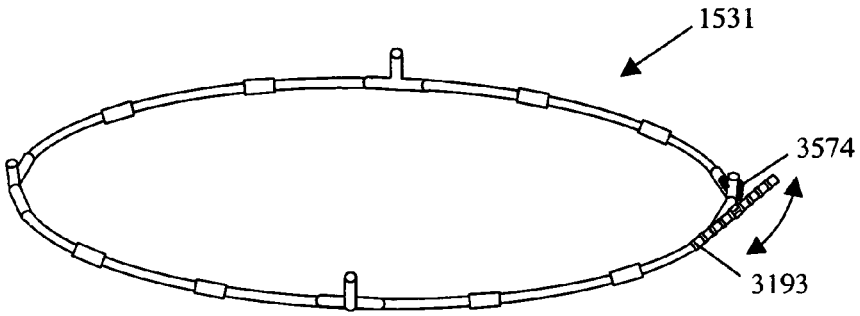
FIG. 15A through FIG. 15E show various aspects and operations with an embodiment of the shelter or blind with an adjustable, circular frame base.

FIG. 15A shows an adjustable, circular frame base 1531. The circumference of the frame base 1531 can be expanded by moving the retaining shaft 3193 (FIG. 7D) to a different position in the swivel clip 3420 (i.e. between different retaining sleeves 3198). The clip is part of corner base connector with clips 3574.

Figure 15B:
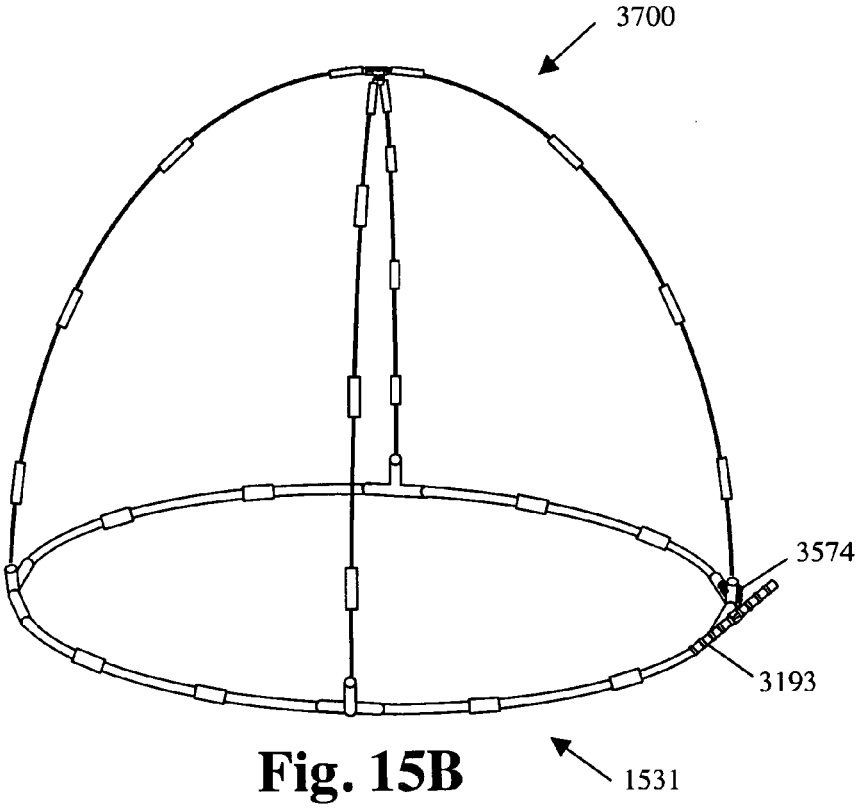

FIG. 15B shows a pair of pivoting arches 3700 connected to the circular frame base 1531 shown in FIG. 15A.

Figure 15C:
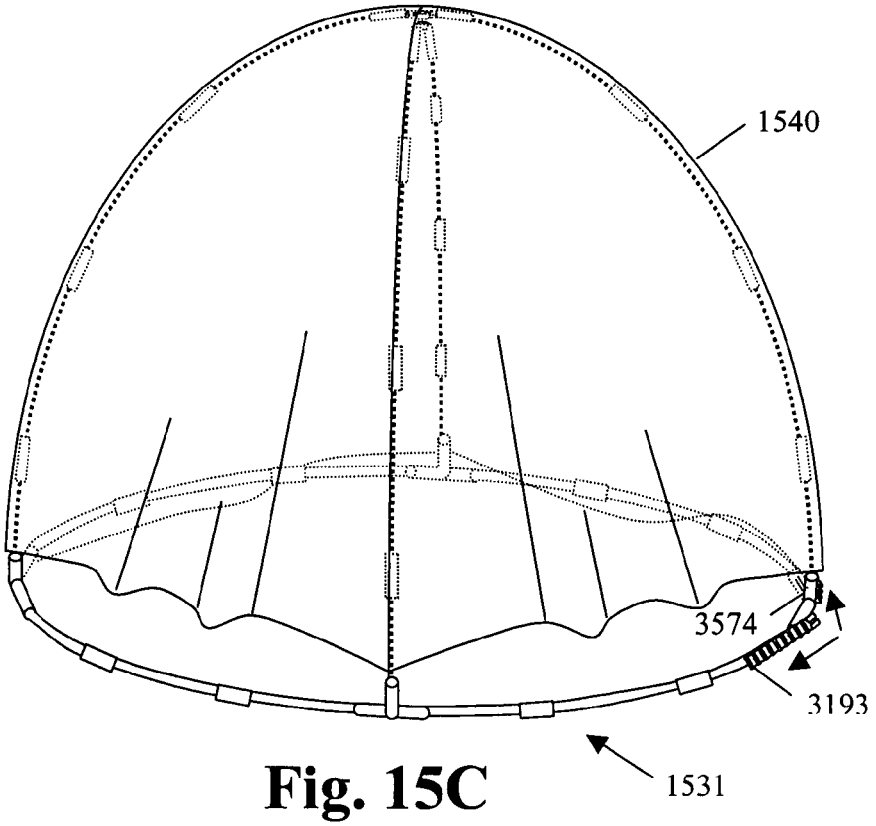

As shown in FIG. 15C after the cover 1540 is placed over the arches 3700 the cover skin is tightened by adjusting the retaining shaft 3193 against the corner base connector with clips 3574.

Figure 15D:
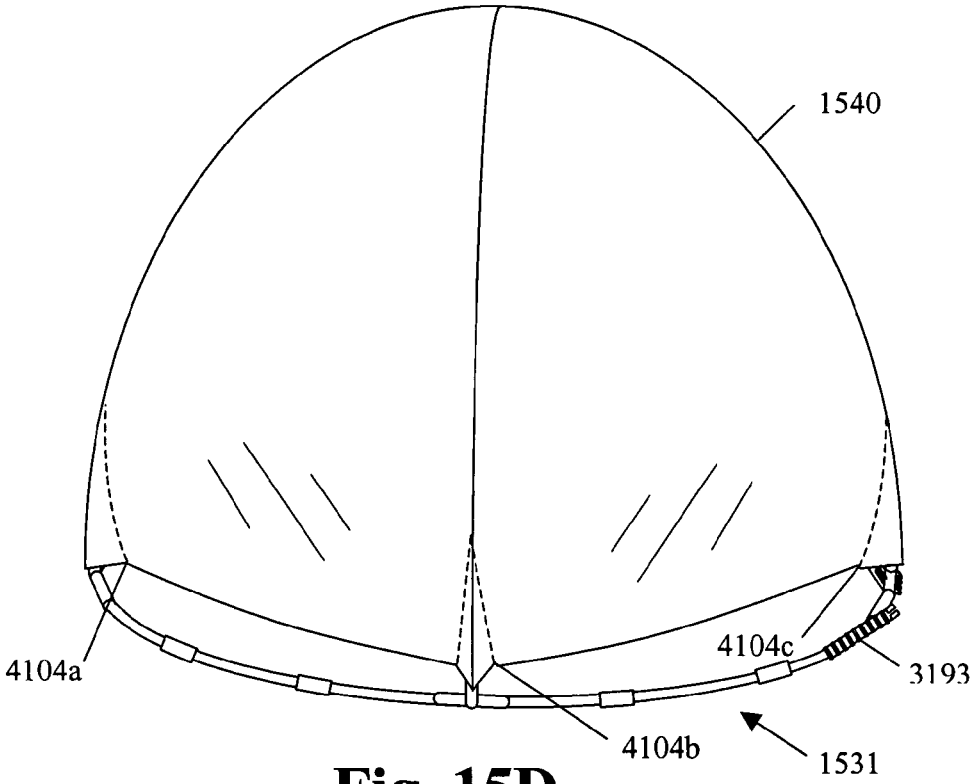

FIG. 15D shows the skin tightening that results from the skin tightening shown in FIG. 15C combined with the corner tightening 4104(*a-c*) shown in FIG. 10F through FIG. 10H.

Figure 15E:
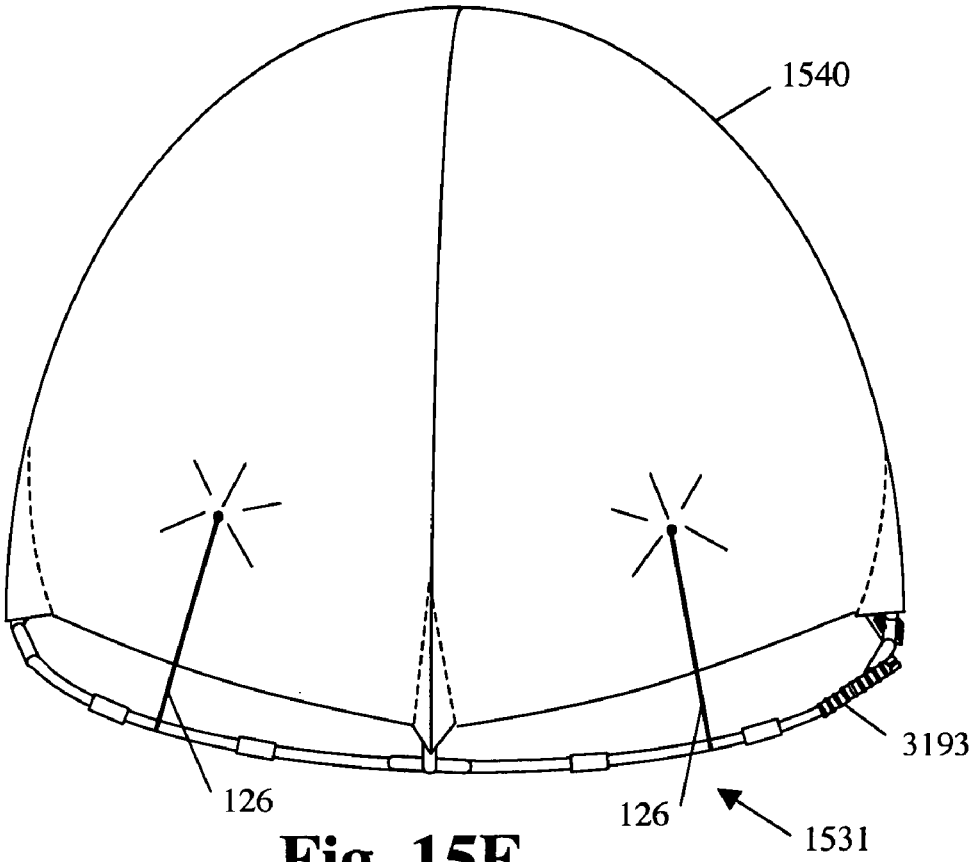

FIG. 15E shows that further skin tightening can be accomplished with the circular frame base 1531 by attaching cords 126 to the lower center of each cover panel 1542 and tightening against the frame base 1531. This one way of addressing the frown edge 1872 looseness.

Figure 16A:
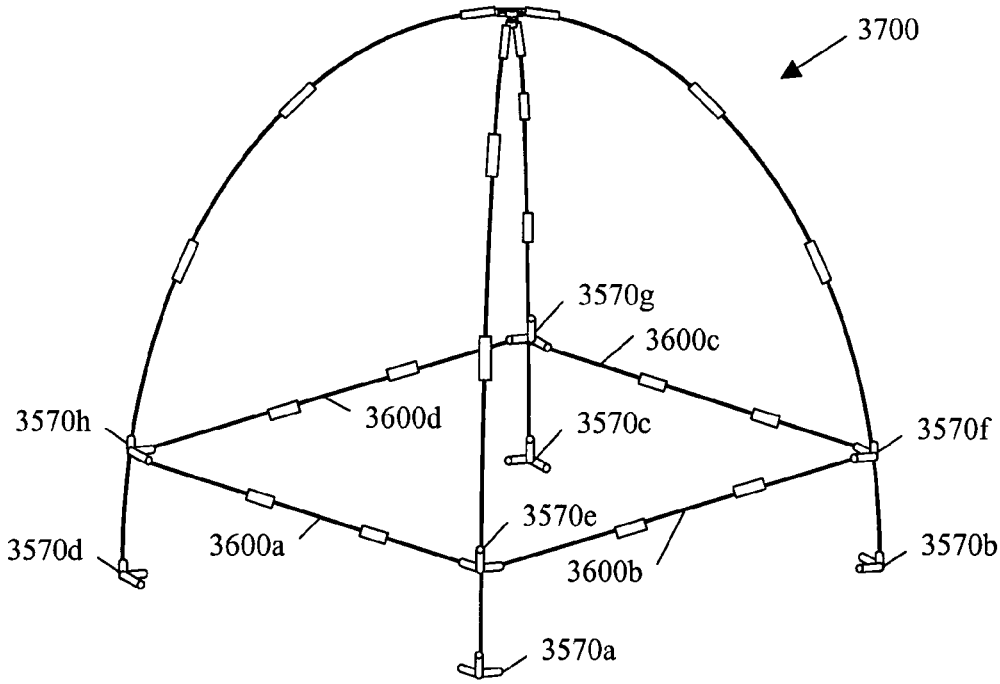
FIG. 16A and FIG. 16B show use of the locking elbow to create an alternate wall frame structure.
Figure 16B:
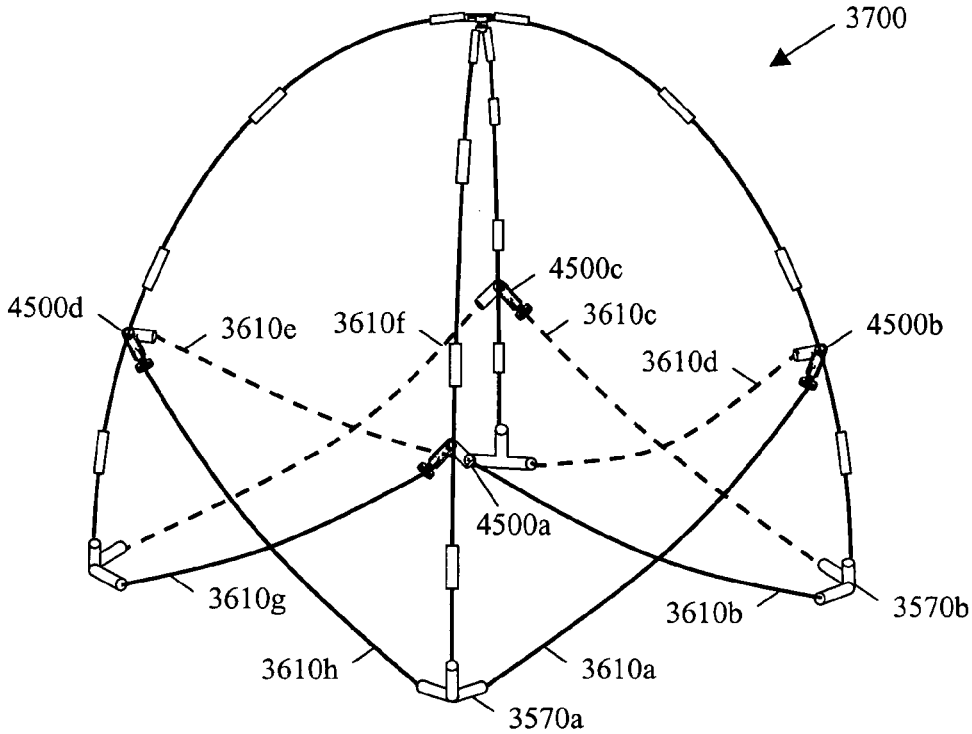

FIG. 16A and FIG. 16B

FIG. 16A and FIG. 16B show use of the locking elbow to create an alternate wall frame structure.

FIG. 16A shows an embodiment of a frame 1530 comprising a pair of pivoting arches 3700 having eight corner base connector 3570(*a-h*), four 3570(*a-d*) on the ground and another four 3570(*e-h*) one segment up. In this embodiment, the base segmented shafts 3600(*a-d*) are connected higher up the cover wall, thereby increasing structural stability and pressing out against the lower portion of the cover panel (not shown).

FIG. 16B shows the use of novel locking elbows 4500(*a-d*) to form a crossing structure to support each wall of the cover at the base of the frame. Eight base cross shaft 3610(*a-h*) are shown connected between adjacent corner base connector 3570(*a-d*) and locking elbows 4500(*a-d*). The base cross shafts 3610 are preferably bowed outward as an alternate means of tightening the lower portion of the cover panel (not shown). This arrangement provides a stable base and a wide unobstructed area in the most useful area of each wall.

Figure 17A:
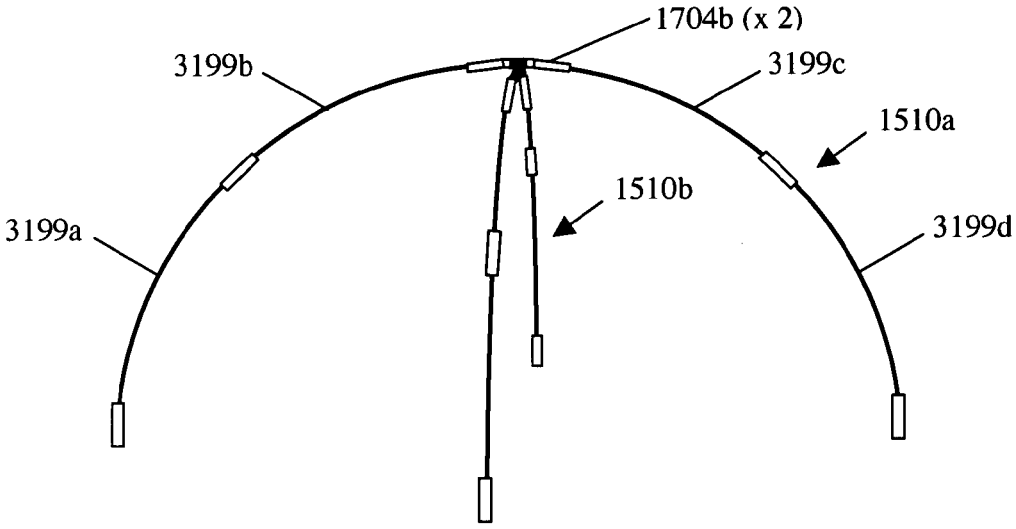
FIG. 17A and FIG. 17B show an alternate frame having pressure release arches.
Figure 17B:
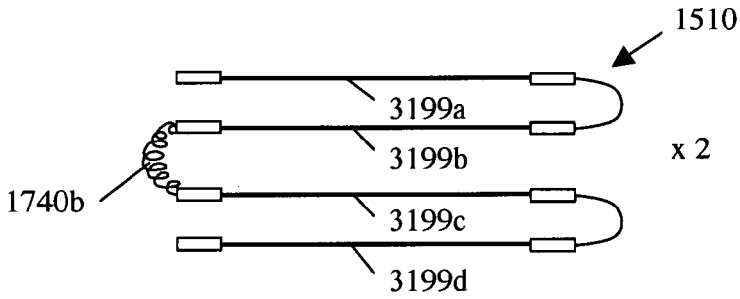

FIG. 17A and FIG. 17B

FIG. 17A and FIG. 17B show an alternate frame having pressure release arches.

A full sized enclosed blind embodiment of the present invention is preferably about six feet high with cover shafts about sixteen feet in total length. There is also a need for a low profile, easily portable, quick popup blind for mobile rifle hunting and military uses. FIG. 17A though FIG. 17D show features of an low profile embodiment with various novel features of the present invention which are also applicable to other currently preferred embodiments of fast setup blinds (for example, FIG. 17E through FIG. 17V, FIG. 23D, etc.).

FIG. 17A shows a novel lower profile frame comprising two alternate cover shafts 1510, identified as top cover shaft 1510*a* and bottom cover shaft 1510*b*. Each alternate cover shaft 1510 is shown comprising four channeled shaft segments 3199(*a-d*) (see FIGS. 2B and 2D for exemplary details). The middle of each alternate cover shaft 1510 is a connector with a pressure release spring 3540, preferably receiving-to-receiving connector 1740*b* (FIG. 5H), or alternatively inserting-to-inserting connector 1760*b* (FIG. 5G) or pivoting intersection connector 3500*b* (FIG. 5F). In this embodiment as shown, the collapsible, quick popup frame results in a low profile blind that is about three feet high. This lower profile blind is about waist high, having alternate cover shafts 1510 which are about nine to ten feet in total length.

FIG. 17B shows how each alternate cover shaft 1510 can be folded with the novel breakdown attachments of the channeled shaft segments 3199 and the pressure release of receiving-to-receiving connector 1740*b*.

Figure 17C:
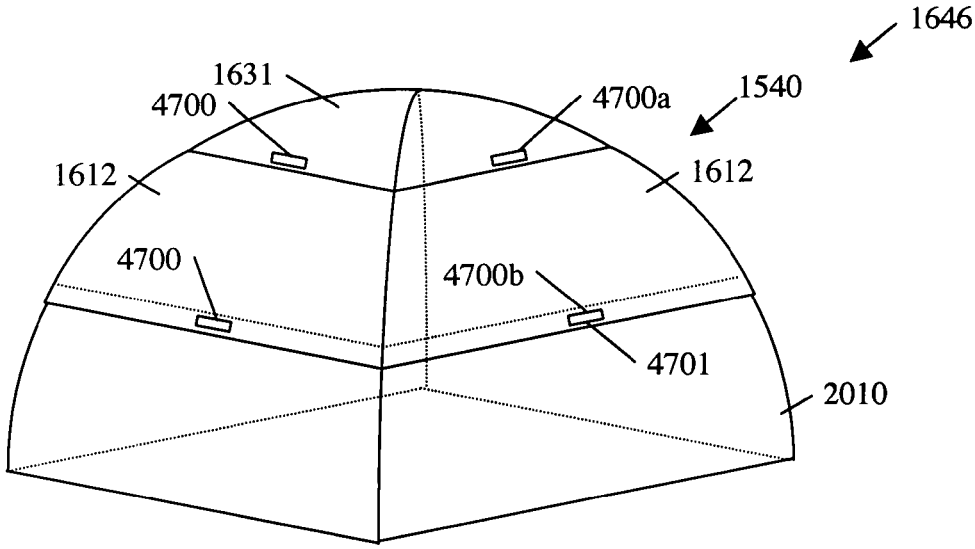
FIG. 17C and FIG. 17D show low profile blind with cover with quiet windows.
Figure 17D:
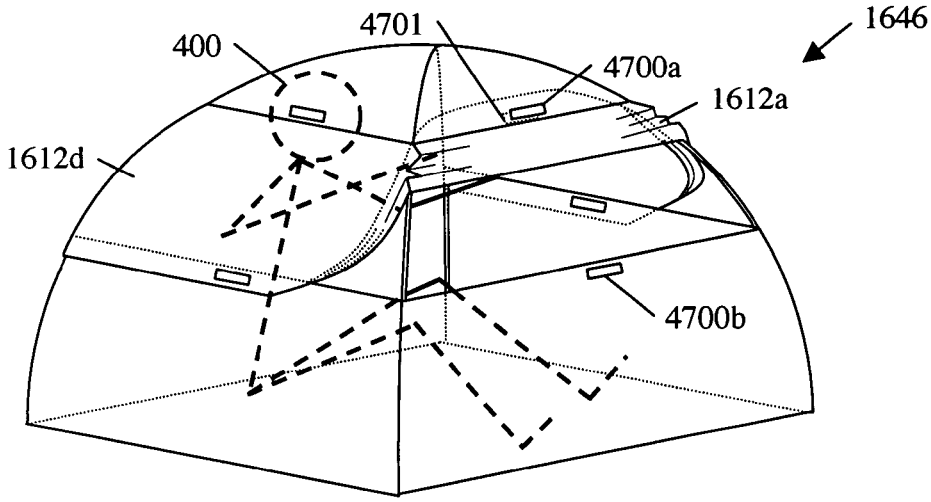

FIG. 17C and FIG. 17D

FIG. 17C and FIG. 17D show the low profile blind with cover with quiet windows.

Figure 19A:
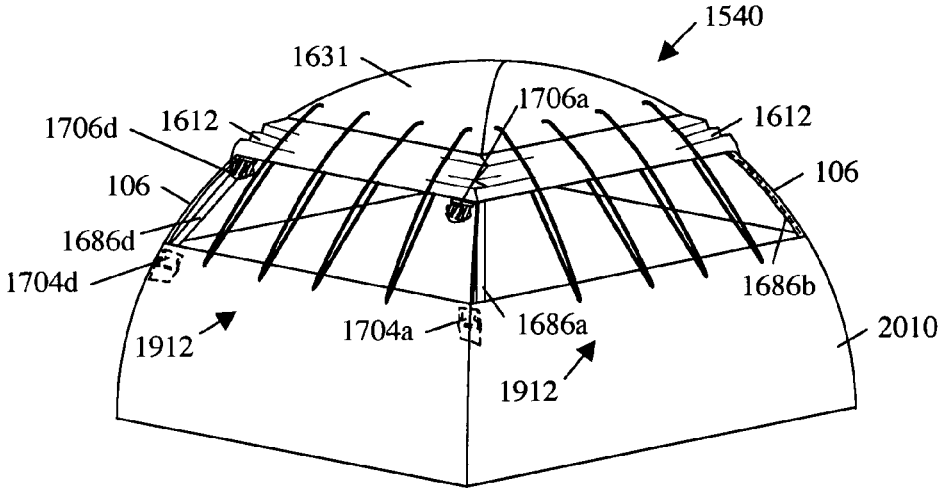
FIG. 19A through FIG. 19H show various embodiments and operation covers with guylines and windows.

FIG. 17C shows a quiet cover 1646 that embodies a novel three-tiered cover (also shown with more detail in the embodiment of FIG. 19A). The top tier comprises a cover cap 1631. The middle tier comprises a ring of windows 1612 that are held open or closed with novel magnetic connections. The bottom tier is a skirt 2010 (which is proportionally smaller than the skirt 2010 disclosed for example in FIG. 23D and in the related applications, i.e. the MOC3 application).

The magnetic connections, between magnets 4700 and magnetic pieces 4701, are a novel means for maintaining tight cover skin on the walls of a blind, while allowing quiet operation of the windows. In this regard magnets are preferred over zippers 1633 and hook and loop fasteners 530 (shown in the related applications). Each window 1612 has a magnetic piece 4701 attached to the lower edge of the window 1612, or sewn in the hem.

FIG. 17C shows the windows being held closed and taut using the magnetic connection between the lower magnet 4700*b* and the magnetic piece 4701 in the edge of the corresponding window 1612.

FIG. 17D shows the left front window 1612*a* being held open using the magnetic connection between the upper magnet 4700*a* and the magnetic piece 4701. The right front window 1612*d* is held partially closed by its respective magnetic connection. The operator 400 is also shown positioned within smaller, lightweight, portable, quick popup, quiet cover 1646 embodiment. This embodiment combined with two alternate cover shafts 1510 is a standalone embodiment not requiring stakes or complex cover shafts. All of the components are attached together (for example via cover loops 1622) so there are no parts to lose. This embodiment is simpler, smaller, lighter, and lower cost than the other full size, fuller function blind embodiments.

FIG. 17E Through FIG. 17K

As discussed above, in reference to the frame shown in FIG. 17A, there is a need for embodiments of blinds that can be set up rapidly and standalone in a variety of configurations. While the alternate cover shafts 1510 work well for the smaller profile embodiment shown in FIG. 17A through FIG. 17D, a stronger, more powerful, and more versatile frame is needed to meet these more universal needs.

Figure 17E:
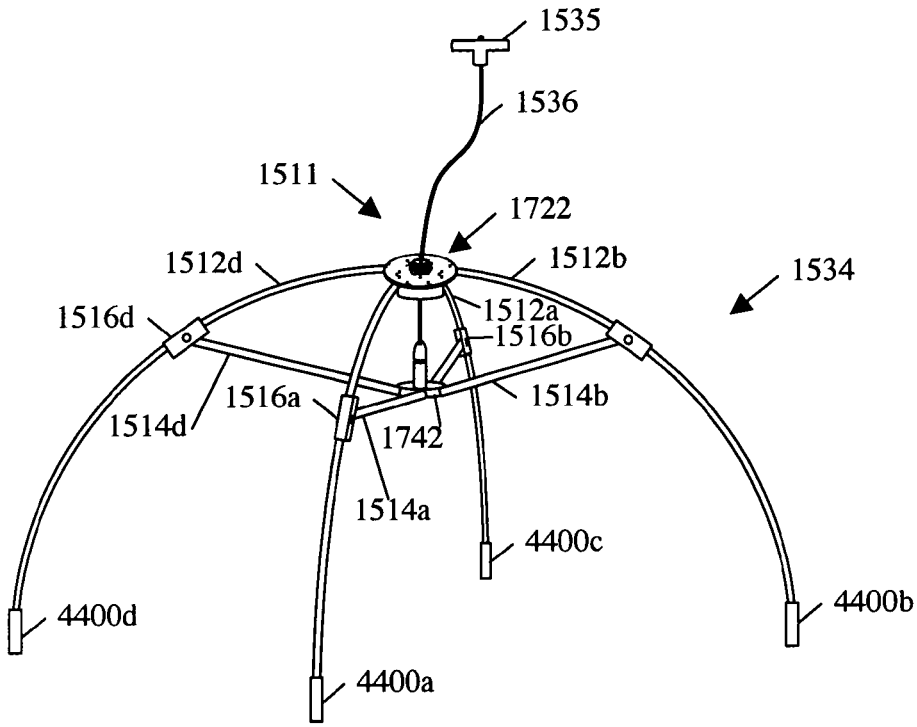
FIG. 17E through FIG. 17V show various aspects and configurations of a currently preferred embodiment of a fast setup frame.

FIG. 17E through FIG. 17T show various aspects and configurations of a currently preferred embodiment of a fast setup frame 1534, including an embodiment with folding arches.

FIG. 17E shows the novel fast setup frame 1534. The fast setup frame comprises a cover shaft intersection 1511 comprising a novel intersection dock 1722, an arch flattening means comprising a novel docking assembly 1742, and a pull cord 1536 for operating the arch flattening means.

A plurality of hinged cover shafts 1512 attach by hinges to the cover shaft intersection 1511, so that each hinged cover shaft 1512 comprise half an arch. Thus, the hinged cover shafts 1512 are also referred to as half arch cover shafts 1512. FIG. 17E and FIG. 17L show embodiments with four half arch cover shafts identified as 1512*a* through 1512*d*. Similar fast setup frames 1534 could be comprised of three or more half arch cover shafts (see, for example, FIG. 17M having three shafts 1512*a* through 1512*c* and FIG. 17M having five shafts 1512*a* through 1512*e*).

This embodiment of the arch flattening means comprising a docking assembly 1742 and a plurality of arch flattening shafts 1514(*a-d*) each connected to the respective half arch cover shafts 1512(*a-d*) with a respective, novel arch flattening hinge 1516(*a-d*). Each arch flattening shaft 1514(*a-d*) is also connected to the docking assembly 1742, in this embodiment, with a hinge.

The pull cord 1536 preferably is attached at one end to a pull handle 1535.

The free ends of the half arch cover shafts 1512 each have an end piece means for attaching the fast setup frame 1534 to a cover 1540 (see, for example, FIG. 4Q through FIG. 4S, and FIG. 17Q). The end piece means are shown as end pieces with hook 4400(*a-d*), respectively.

Figure 17F:
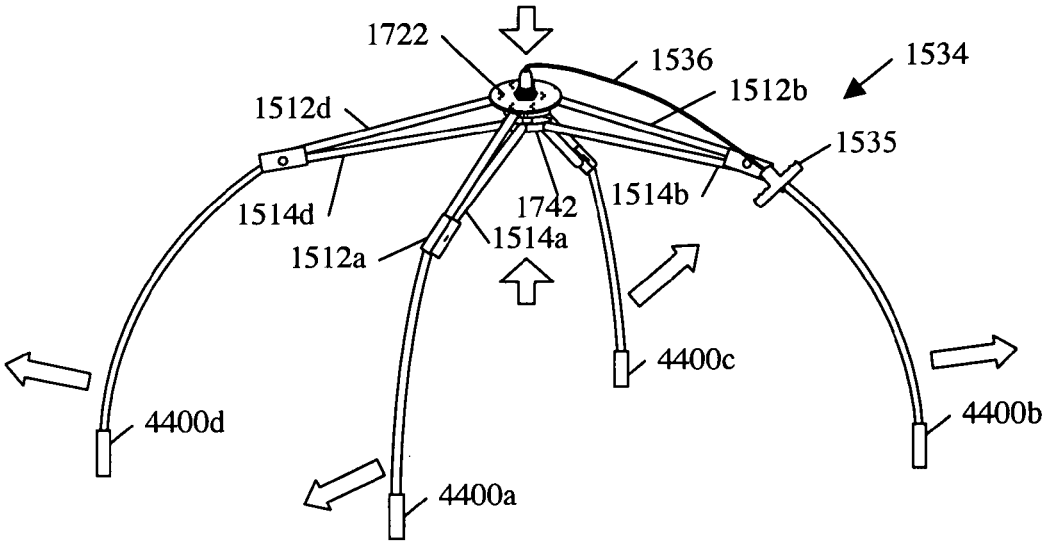

FIG. 17F shows that, when the arch flattening means, shown comprising the novel docking assembly 1742, is pulled toward and engaged with the cover shaft intersection 1511, shown comprising the novel intersection dock 1722, using the pull cord 1536, the arch is flattened. This arch flattening results on a outward and upward skin tightening force being applied through the half arch cover shafts 1512 along the cover corners, as presented by the force arrows.

With the novel features and methods of the present invention as described below, the human operator is able to apply a stronger skin tightening force over a longer working distance than is possible with convention means and methods.

Figure 17G:
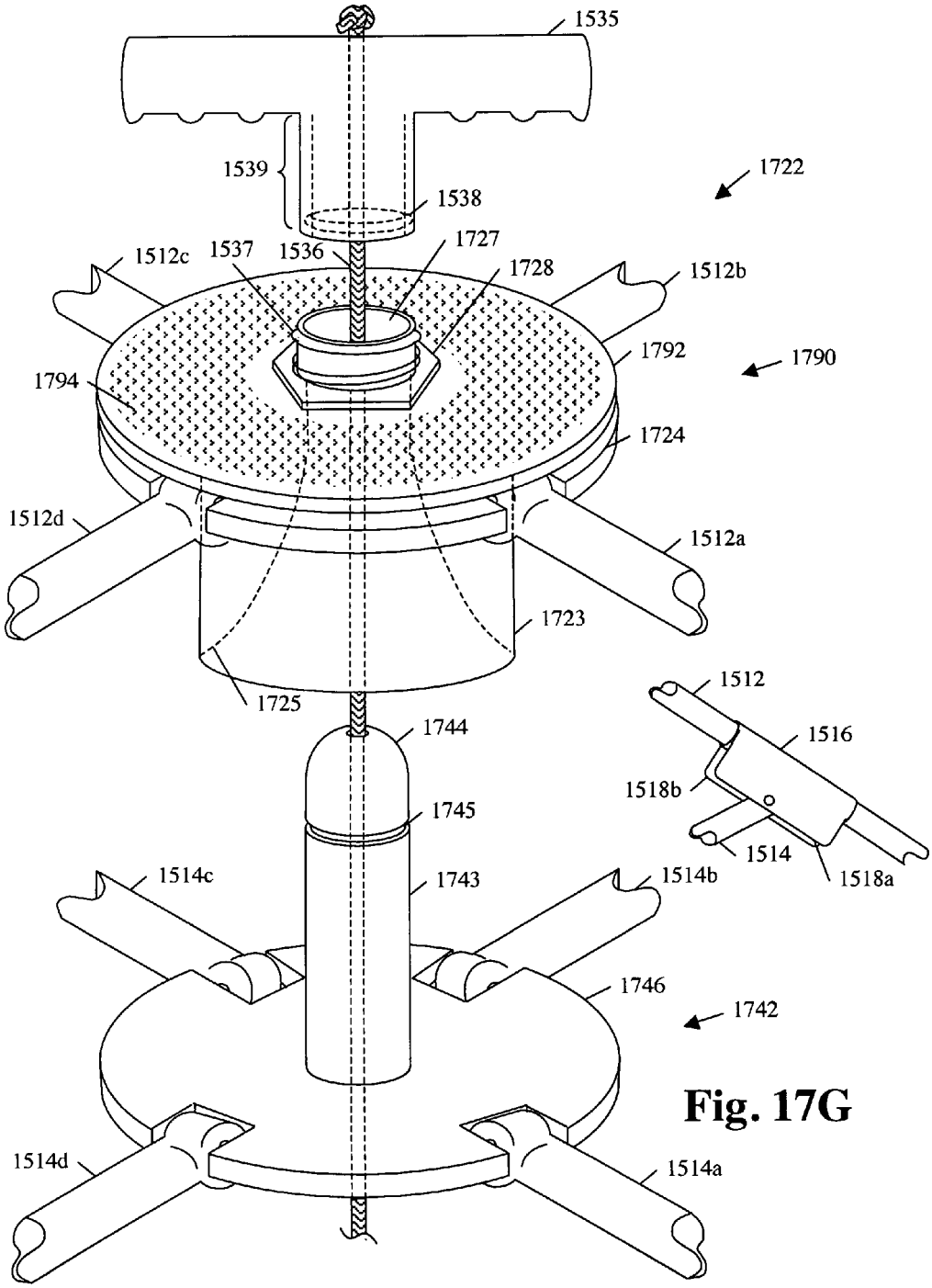

FIG. 17G shows various novel details of embodiments of the novel docking assembly 1742, the novel intersection dock 1722, the novel arch flattening hinge 1516, and a novel pull handle 1535.

The novel docking assembly 1742 comprises a docking plate 1746 and a docking shaft 1743 integrally attached to the docking plate 1746. The docking shaft 1743 has a rounded docking tip 1744 and an optional safety groove 1745. In this novel embodiment the docking plate 1746 is preferably about 3 to 4 inches or more in diameter and is sufficiently thick enough to provide substantial wall mechanical force against the sides of the respective arch flattening shafts 1514(*a-d*). In this embodiment, the pull cord 1536 passes through the center of the docking assembly.

The novel intersection dock 1722 comprises a novel dock plate 1724 and a dock 1723 integrally attached to the dock plate 1724. The dock plate 1724 features a plate hole 1769 extended to form a dock conduit 1727. The dock 1723 is shown with a novel outward curved surface 1725 for engaging the docking tip 1744 of the docking shaft 1743 when it is out of alignment. The dock curved surface 1725 gradually flattens to guide the docking shaft 1743 into the dock conduit 1727. In this novel embodiment dock plate 1724 is preferably about 4 inches or more in diameter and is sufficiently thick enough to provide substantial wall mechanical force against the sides of half arch cover shafts 1512(*a-d*). In this embodiment, the pull cord 1536 passes through the center of the dock 1723 and dock conduit 1727.

The dock conduit 1727 is at least partially threaded on the exterior of its extension so that it can receive a washer nut 1728. The washer nut 1728 is used to hold the cover 1540 material out of the dock conduit 1727 so material does not interfere with the operation of the docking shaft 1743 (see FIG. 20A). Optionally, the washer nut 1728 also holds an embodiment of a foot attaching means 1790, such as foot plate 1792 with gripping texture 1794 as shown.

The arch flattening hinge 1516 is integrally part of the hinged cover shaft 1512(*a-d*) and has hinge walls 1518(*a-b*). See FIG. 17L through 17N for views where the hinged cover shaft 1512 is shown fully intact between the hinge and the intersection dock 1722. The arch flattening shaft 1514 is connected to the arch flattening hinge 1516. Details of the structure and function of the hinge walls 1518(*a-b*) are explained if reference to FIG. 23A through FIG. 23C.

The novel pull handle 1535 retains the pull cord 1536, preventing the pull cord 1536 from passing through the intersection dock 1722 and providing tension when the operator 400 wants to assert a force through the pull cord. The pull handle 1535 preferably comprises integral hand grips 1776 for operator comfort and more secure grasp. The pull handle 1535 also preferably comprises a handle standoff 1539 which holds the handle in a known position (FIG. 21B) that is easy to grasp while setting up the blind using the novel method shown for example in FIG. 21B through FIG. 21E, in particular at the transition from FIG. 21C to FIG. 21D.

The pull handle 1535 also preferably comprises a handle snap receiver 1538 that allows the pull handle 1535 to be temporarily locked onto a corresponding handle snap 1537 on the dock conduit 1727. The handle snap 1537 and a handle snap receiver 1538 could be molded as a groove and ring as shown; however, the handle snap means preferably is manufactured as a groove in each part with an O-ring providing the snap. The handle snap means is advantageous to avoid damage or injury or to provide a secure starting point when pulling the pull cord 1536 from the other end as shown, for example, in FIG. 25A and FIG. 25C.

Figure 17H:
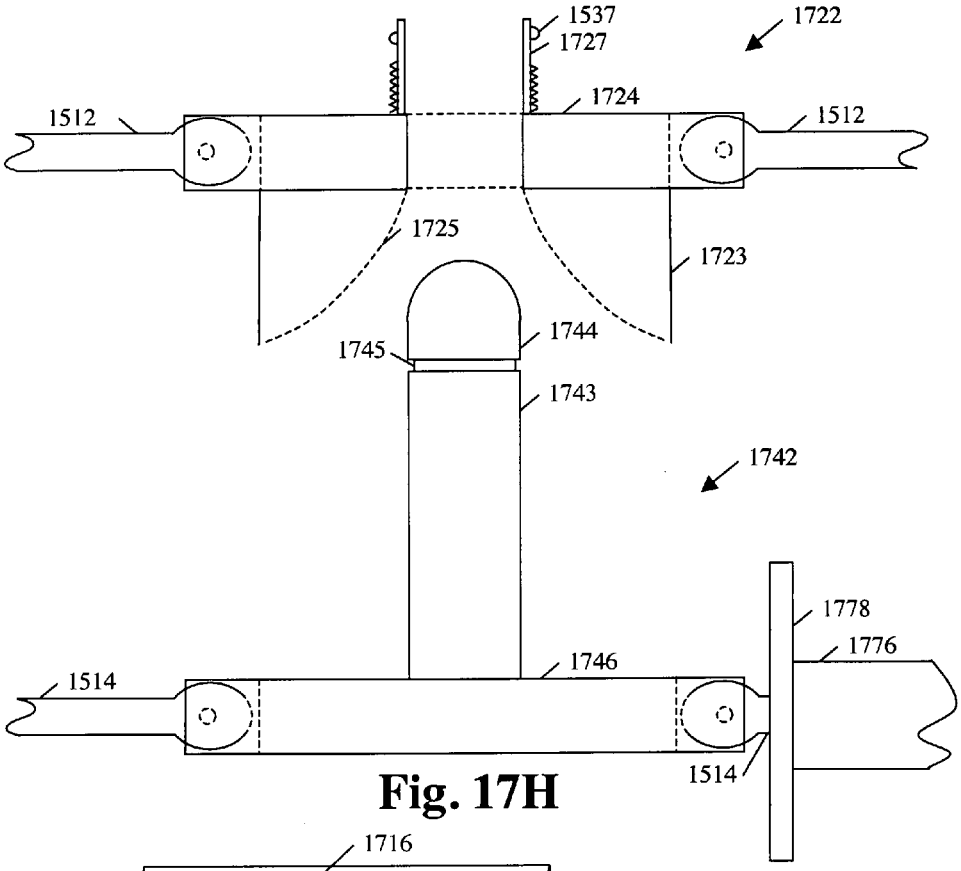

As exemplary shown in FIG. 17G and FIG. 17H, the dock conduit 1727 is only partially threaded allowing the handle standoff 1539 to fit over the dock conduit 1727 above the washer nut 1728, and allowing room for the handle snap 1537 (or other embodiment of the handle snap means).

FIG. 17H is a cross sectional view of the intersection dock 1722 and the docking assembly 1742 having the same referenced items as FIG. 17G. It further shows the position of an optional hand grip 1776 and hand guard 1778 that would be used with an alternate embodiment as discussed in reference to FIG. 25A and FIG. 25C. The hand guard 1778 is of sufficient shape to engage the dock plate 1724 or half arch cover shaft 1512 before the operator's hand or fingers would be squeezed between the approaching parts.

As shown in FIG. 17G and FIG. 17H, the half arch cover shafts 1512(*a-d*) hinge on the dock plate 1724 and the arch flattening shafts 1514(*a-d*) hinge on the docking plate 1746. Like the arch flattening hinge 1516(*a-d*), the hinge positions in the pates (1724 and 1746) are thick enough to form flat walls on either side of the shaft ends 1513(*a-d*). Each shaft end with hole 1513(*a-d*) (see also FIG. 17O and FIG. 17P) that interfaces with the plate hinge walls is also preferably flat and tight inside the hinge position, such that the shaft end 1513 applies an advantageous mechanical force against the plate.

The optional safety groove 1745 shown, for example, in FIG. 17G and FIG. 17H provides an embodiment of a safety means in combination with a safety clip 1715.

Figure 17I:
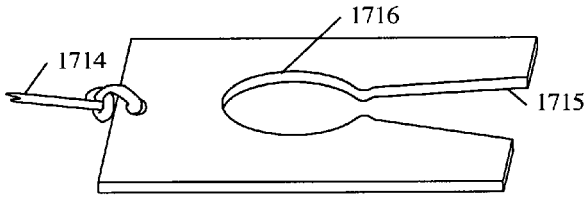

FIG. 17I shows a preferred embodiment of the safety clip 1715 which may be attached to the blind with safety clip cord 1714. This embodiment is made from a flat piece of metal or plastic with a central hole that provides a safety clip edge 1716 which mates securely with the safety groove 1745. When fully docked (e.g. FIG. 17F), the operator applies the safety clip 1715 (for example, between the steps shown FIG. 21E and FIG. 21F; see also FIG. 17T). The safety means prevents the unplanned release of the energy stored in the fast setup frame 1534. The safety means is removed before collapsing the blind (e.g. before FIG. 21H).

Figure 17J:
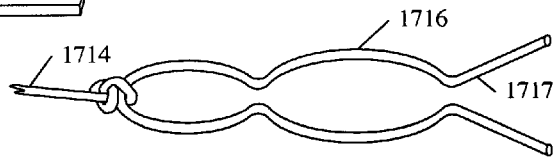

FIG. 17J shows a round wire clip 1717 embodiment of the safety clip 1715 made with round spring wire as is commonly known.

Figure 17K:
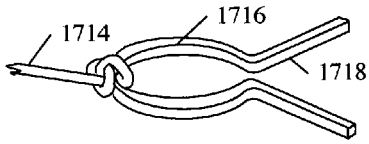
Figure 17L:
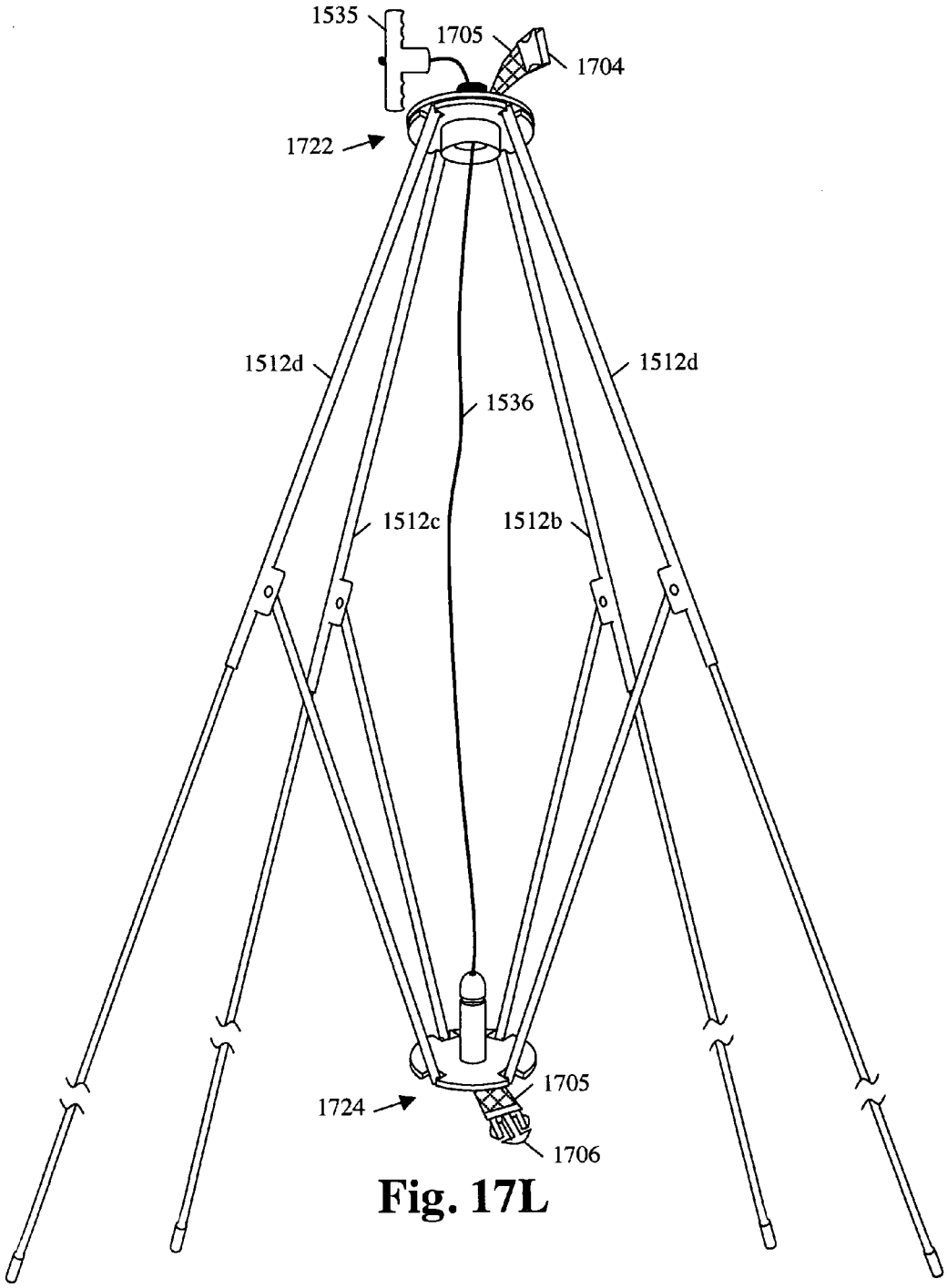

FIG. 17K shows a rectangular wire clip 1718 embodiment of the safety clip 1715 made with rectangular spring wire, which has a more securely mating safety clip edge 1716, than the round wire clip 1717. The rectangular wire clip 1718 is shown attached in FIG. 17T.

However the embodiment of a safety clip 1715 shown in FIG. 17I is currently preferred because it a larger flat surface area making it more visible to the operator and easier to grasp. Further, this embodiment could be colored orange or red such that the operator would be less likely to forget to apply the safety means. An alternative safety means, namely a safety strap 1705 is discussed below in relation to FIG. 17L.

Best Mode Dimensions

When fully docked (e.g. FIG. 17F) the lower edge of the dock 1723 rests centered against the docking plate 1746 maintaining a predetermined standoff distance between the plates (1724 and 1746). The standoff distance is preferable about 1.5 or more inches. The plates (1724 and 1746) are preferably about one inch thick, providing the plate hinge wall surface area described above. The length of the docking shaft is such that when fully docked the docking tip 1744 extends through and beyond the end of the dock conduit 1727 preferably about 2.5 inches. Good results have been obtained with a docking shaft 1743 length of about five inches and a width of about one inch or more. The width of the dock 1723 is preferably about two to three times the width of the docking shaft 1743, the dock 1723 width being preferably wider if the dock plate 1724 is wider. The width of the dock conduit 1727 is slightly wider than the docking shaft 1743, easily allowing the docking shaft 1743 to pass through it. The docking shaft 1743 is preferably made of Delrin® while the other components are made of appropriate metal or plastic. Good results have been obtained by attaching the dock 1723 and the docking shaft 1743 to the respective plates, 1724 and 1746, with three or more long screws (not shown).

The cover shafts 1512 are preferably made from solid fiberglass with diameter between about ⅝ inch and half inch, including 1.5 cm. Each half arch cover shafts 1512, in the low profile configuration, preferably is about five feet in length and, in full size configuration with extensions 4410, preferably collapsible to four feet for shipping, five feet for versatile configurations (e.g. FIG. 19I through FIG. 19N), and fully extended to about eight feet.

Superior Skin Tightening Force Provided by Novel Methods and Structure

As discussed above, conventional quick setup hunting blinds are set up using only the arms and shoulder muscles. We determined that a typical outdoorsman could easily apply about 50 pounds of continual force over about three feet in the power jerk position, or an average of about 40 pounds over about three and a half feet in the seated row position. This is about two to five times the amount of energy that can be applied by using only the arms and shoulder muscles with the arms extended horizontally while standing. Based upon this discovery and upon results of our field-testing, the length of each arch flattening shaft 1514 is preferably between about 18 and 22 inches. However, an embodiment with arch flattening shafts 1514 up to 33 inches could be deployed using a seated row position with arm extensions beyond the head, and an embodiment as small as about 16 inches would accommodate a larger range of body sizes, including youth.

The fast setup frame 1534 of the present invention is thus preferably designed to store between about 150 and about 180 foot-pounds of energy. In order for a typical human body to apply this amount of energy to a currently preferred, fast setup frame 1534, one of the novel methods disclosed in this application (i.e. the method shown in FIG. 21B through FIG. 21E, or the method described in reference to FIGS. 25A through 25C) is required. Conventional methods of using just the arms and shoulder muscles (e.g. applying about 15 pounds over even about five feet, equaling 75 foot-pounds) is one half to one fifth the energy that can be applied via the novel methods and structure of the present invention. Thus, with the present invention, much greater energy can be applied to a blind to provide the required skin tightening forces than can be achieved with convention methods using similar structures.

FIG. 17L Through FIG. 17P

Figure 21A:
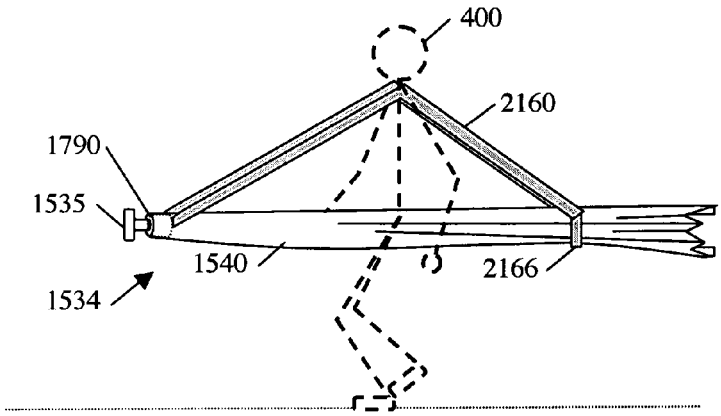
FIG. 21A through FIG. 21H show novel setup and take-down methods of the fast setup frame.

FIG. 17L shows an embodiment of the fast setup frame 1531 with four half arch cover shafts identified as 1512*a* through 1512*d*. This embodiment shows another embodiment of the safety means comprising a safety strap 1705 having receiving clip 1704 and an inserting clip 1706. When fully docked (e.g. FIG. 17F), the operator applies the safety strap (for example, as shown in FIG. 21G).

Figure 17M:
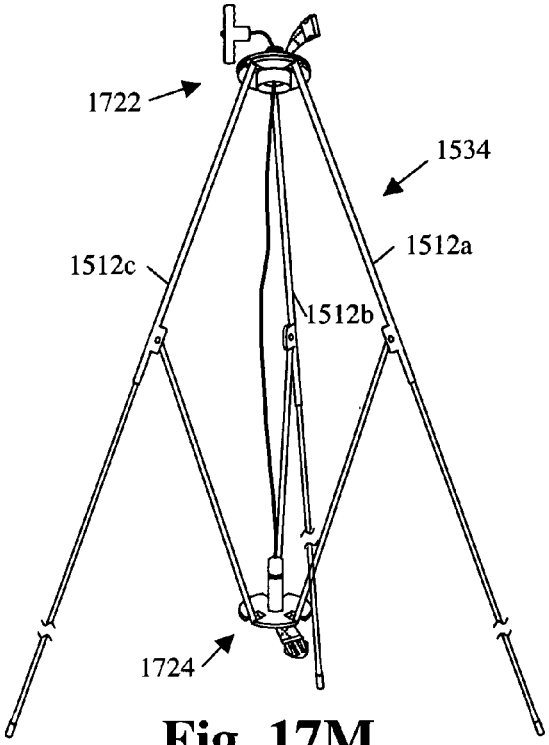

FIG. 17M shows an embodiment of the fast setup frame 1531 with three shafts 1512*a* through 1512*c*. Corresponding parts have been previously described. The shape of the plates and the location of the hinge positions are modified accordingly.

Figure 17N:
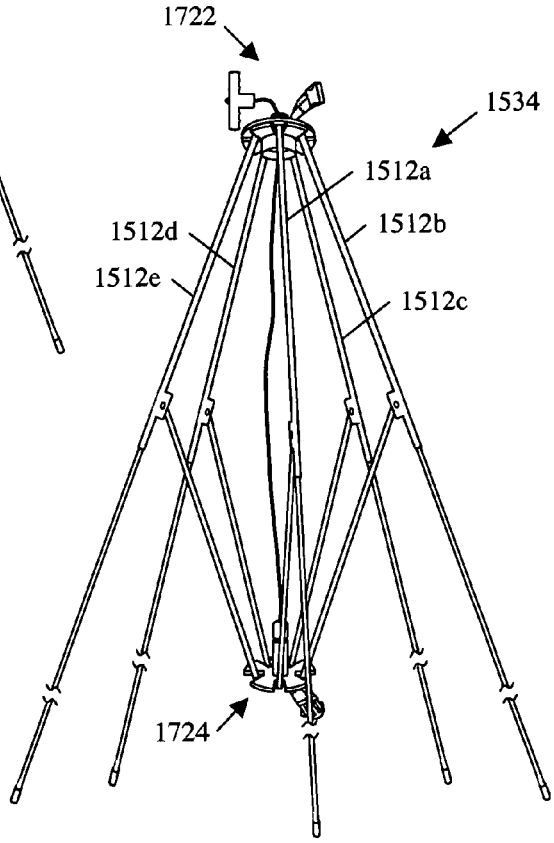

FIG. 17N shows an embodiment of the fast setup frame 1531 with five shafts 1512*a* through 1512*e*. Corresponding parts have been previously described. The shape of the plates and the location of the hinge positions are modified accordingly.

Any number of half arch cover shafts 1512 greater than five could be used to construct a quick setup frame which would provide incremental increase of usable inside room; however, additional shafts 1512 would increase cost and weight and decrease the sturdiness and reliability of the more complex structure.

Figure 17O:
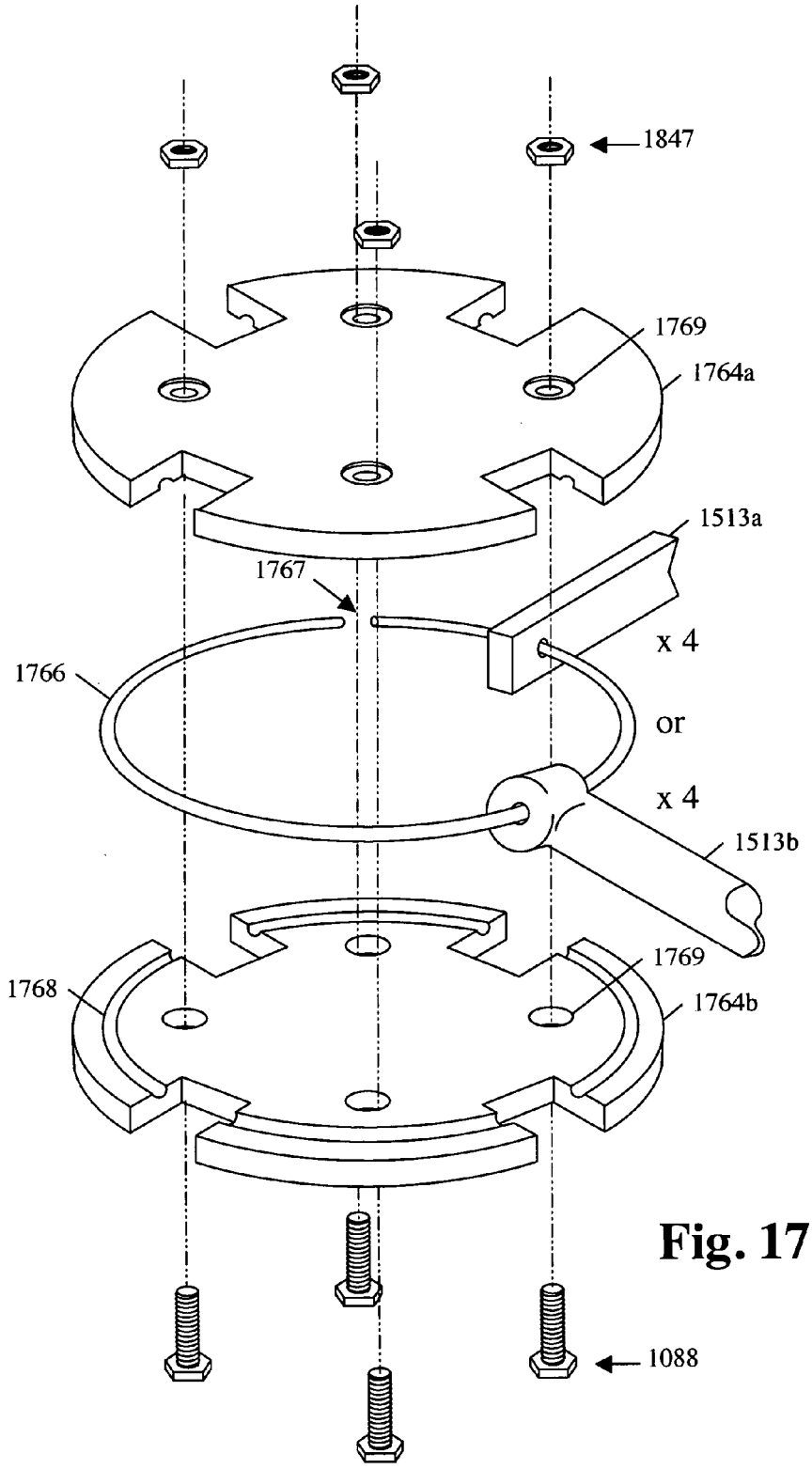

FIG. 17O shows one embodiment for making the plates (1724 and 1746), each plate comprising two half plates 1764, identified as a top half plate 1764*a* and a bottom plate 1764*b*. One, or preferably both, of the two half plates 1764 contain a ring groove 1768 for receiving and hold an axle ring 1766. The ends of the shafts (1512 and 1514) have a hole for receiving the axle ring 1766 (or threaded axles 1763, see FIG. 17P). The axle ring 1766 is one method of providing a strong hinge pin 2102, upon which the shafts pivot. The shaft ends with hole 1513 are connected to the axle ring 1766 through a ring opening 1767. For greater strength, the ring opening 1767 can be welded closed (or clipped with respective J-shape hooks formed in each end, not shown). For easier repair, the ring opening 1767 can be left open. After the shaft ends 1513 are position over the axle ring 1766, the two half plates 1764 are brought together, sandwiching the axle ring 1766, with a plurality of bolts 1088 and corresponding nuts 1847. The bolts 1088 pass through a plurality of plate holes 1769.

As discussed above, the shaft ends with hole 1513 preferably flattened as shown. This can be accomplished using either a plurality of rectangular shafts (identified as 1513*a*) or using a plurality of end pieces with disk shaped end (identified as 1513*b*). The shafts could be made of steel. However, good results have been obtained by making end pieces out of steel with a receiving end 1072 for receiving an inserting solid fiberglass pole for the center portion. For added strength and durability, the fiberglass center portion is also connected to the steel end pieces with a wrapping of fiberglass mesh and resin.

If the plates, i.e. dock plate 1724 and docking plate 1746, are the same size, some manufacturing costs can be saved by making four identical half plates 1764. Then, additional plate holes 1769 can be made in dock plate 1724 for the dock conduit 1727 and other attachments, such as the dock 1723.

Figure 17P:
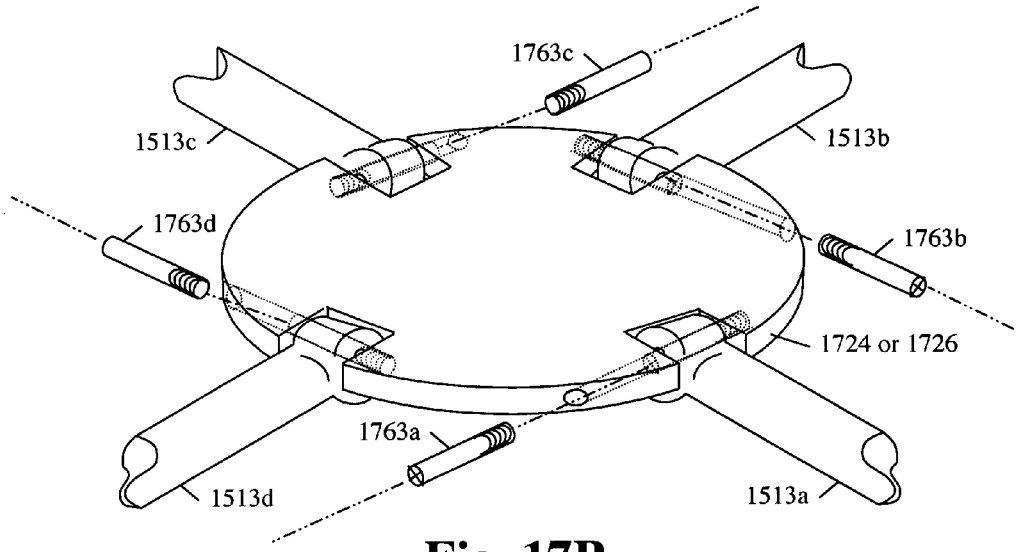

FIG. 17P shows an alternate embodiment of the plates, i.e. dock plate 1724 and docking plate 1746, made of a solid plate with hole drilled and tapped to receive threaded axles 1763 (*a*-*d*). The threaded axle 1763 is another method of providing a strong hinge pin 2102, upon which the shafts pivot (instead of the axle ring 1766 of FIG. 17O). This embodiment provides for easier manufacturing, assembly, and replacement of a single broken shaft.

FIG. 17Q Through FIG. 17V

FIG. 17Q through FIG. 17V show various features of embodiments of the present invention including a spreading strap means, a safety means, and adjustable cover shaft extension means.

FIG. 17Q through FIG. 17T show an embodiment fast setup frame 1534 (FIG. 17F) shown exemplarily with the quiet cover 1646 (FIG. 17C and FIG. 17D). To facilitate the novel setup methods of the present invention, blinds using the fast setup frame 1534 further comprise a spreading strap means. As shown in FIGS. 17Q and 17R, a wishbone strap 2162 is preferably attached to the cover 1540 (shown as quiet cover 1646) at two of the cover corners and to a spreading strap clip 2164 near the apex of the blind. The novel wishbone strap 2162 can be made by threading one long strap of webbing through a loop sewn in one end of a second short strap. The ends of the long strap are preferably permanently attached to the blind cover 1540. The third end of the wishbone strap 2162 contains a clip (shown as an inserting clip 1706) that corresponds to the spreading strap clip 2164 (shown as a receiving clip 1704).

Figure 21B:
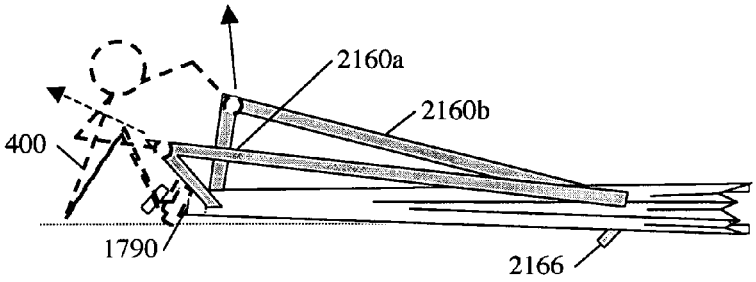

FIG. 17Q shows the blind with a wishbone strap 2162 in the collapsed position, similar to FIG. 21B which uses an alternate spreading strap means comprising two spreading straps 2160(*a-b*). As discussed in FIG. 21A through FIG. 21E, a novel setup method of the present invention includes an initial spreading step which is facilitated with the spreading strap means.

FIG. 17R shows the wishbone strap 2162 still connected to the spreading strap clip 2164 outside the setup blind. See FIG. 19A for a discussion of the receiving clips 1704(*a-d*) and inserting clips 1706(*a-d*).

FIG. 17S shows the wishbone strap 2162 disconnected from the spreading strap clip 2164 and brought inside the blind by the operator 400.

FIG. 17T shows a magnified portion of the apex of the blind in FIG. 17S showing an embodiment of the safety means, the rectangular wire clip 1718 embodiment of the safety clip 1715 being attached in the safety groove 1745 below the docking tip 1744. The safety clip 1715 retains the docking shaft 1743 prevent unplanned passage back through dock conduit 1727, which would result in an unplanned release of energy in the fast setup frame 1534. In this embodiment, the safety clip 1715 is connected to the cover 1540 at the attachment for the spreading strap clip 2164. Alternatively, the safety clip 1715 could be attached to the pull cord 1636 above a knot in the pull handle 1535 (see for example the knot above the handle in FIG. 17G).

Figure 17U:
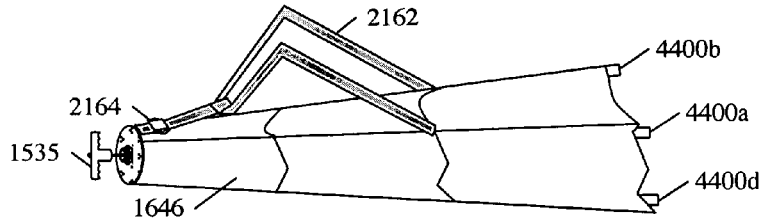
Figure 17V:
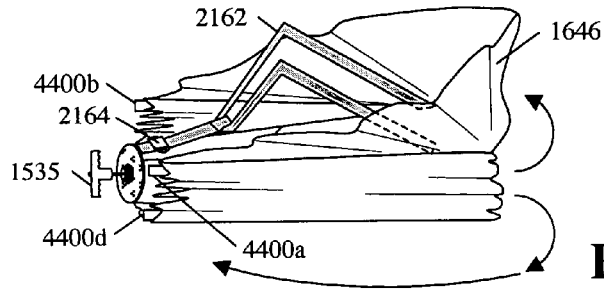

FIG. 17U through FIG. 17V show an embodiment fast setup frame 1534 shown exemplarily with the larger embodiment of the quiet cover 1646 and the same wishbone strap 2162 as shown in FIG. 17Q. Instead of the low profile blind, as shown, for example, in FIG. 17D and FIG. 17S, this embodiment is a full size blind with cover shaft extensions 4410 (e.g. FIG. 23D and FIG. 19K through FIG. 19N). The first and second ends of the spreading strap means are attached half way up the corners of the blind cover. The bottom of the cover is attached to the cover shafts extensions with an end piece, shown as end pieces with hook 4400(*a-d*). Internally the cover can be attached to the shafts using corner loops 1622, cover sleeves, or other attaching means.

Some of the extension means allow the cover shafts extensions 4400 to be folded. FIG. 17V shows how portions of the cover fold up with the folding extensions (for example, as shown in FIG. 22C and FIG. 22D). When setting up the blind the folding extensions would be unfolded (and, if applicable, locked).

FIG. 18A Through FIG. 18L

FIG. 18A through FIG. 18L show various embodiments and operation of covers with adjustable blackout, shoot-through, star, and overhead windows and flies.

Figure 18A:
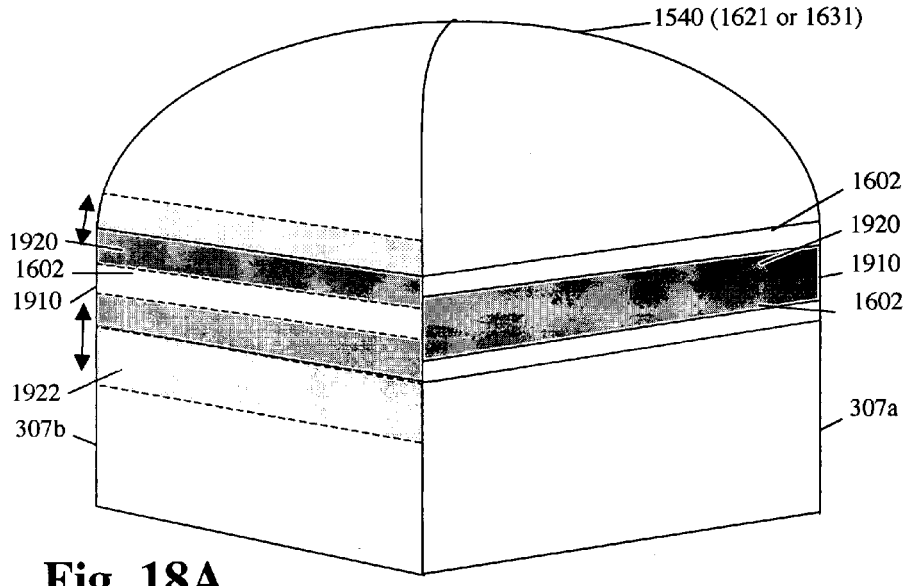
FIG. 18A through FIG. 18L show various embodiments and operation of covers with adjustable blackout, shoot-through, star, and overhead windows and flies.

FIG. 18A shows a covered blind with vertical guyline modules (1910, as previously disclosed in the related applications, e.g. the MOC3 application). The panels 1920 and 1922 can slide past each other because each is attached on each side by a different guyline 1912. The operator can position the panels to cover the opening 1602 as shown on the right (with blackout panel 1920) or with a portion of the opening 1602 covered by one panel (e.g. the blackout panel 1920 on the left) and with another portion covered by the other panel (e.g. the see-through panel 1922 on the left). Note that the panels can slide behind the cover 1540 (or 1621 or 1631) above or the curtain 307 (or skirt 2010, not shown) below because of the novel features of the modular systems. Horizontally guylines were previous disclosed as well.

Figure 18B:
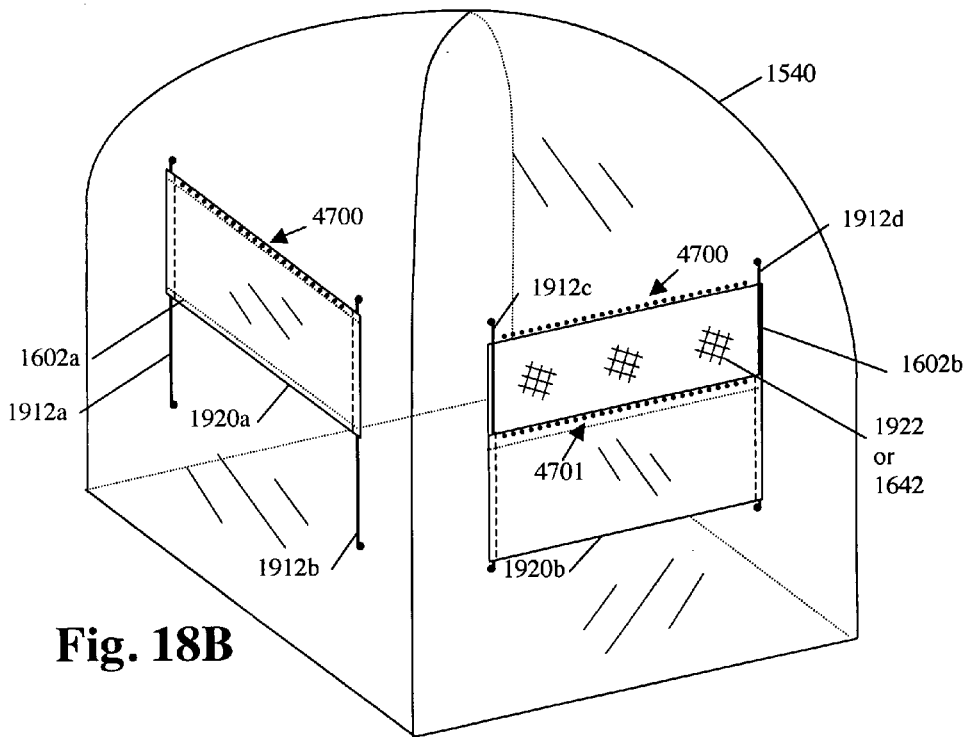

FIG. 18B shows embodiments of guylines 1912 attached to the walls of the cover skin 1540. Guylines in the walls help maintain the wall tension that helps keep the walls taut and reduce motion or noise that may be detectable by wildlife. FIG. 18B illustrates two exemplary openings 1602*a* and 1602*b*, respectively in a cover 1540. A blackout panel 1920*a* slides vertically up and down over opening 1602*a* along guylines 1912*a* and 1912*b* and is held tightly in place by the novel use of a row of magnets 4700 at the edge of the opening 1602*a*. When in this closed position the wall tension is maintained through the blackout panel 1920*a* via the magnetic connection with the magnets 4700 as well as by the guylines 1912*a* and 1912*b*. A blackout panel 1920*b* also slides vertically up and down over opening 1602*b* along guylines 1912*c* and 1912*d* and is exemplary shown in the open position, revealing the see-through panel 1922 (or shoot-through panel 1642) which likewise is held tightly in place by the novel use of a row of magnets 4700 at the edge of the opening 1602*b*. A row of magnetic pieces 4701 is attached to, or in the hem of, the sliding panels (1920 or 1922) or the fixed shoot-through panel 1642. In the example on the right (i.e. over opening 1602*b*) the wall tension is always maintained via the magnetic connection with the row of magnets 4700 and corresponding rows of magnetic pieces 4701 as well as by the guylines 1912*c* and 1912*d*. Maintaining tension on the shoot-through panel 1642 also reduces the interference with the flight of an arrow, for example.

The magnetic connections, between magnets 4700 and magnetic pieces 4701, provide a novel method of maintaining tight cover skin on the walls of a blind, while allowing quiet operation of the windows. In this regard magnets are preferred over zippers 1633 and hook and loop fasteners 530 (shown in the related applications).

Figure 18C:
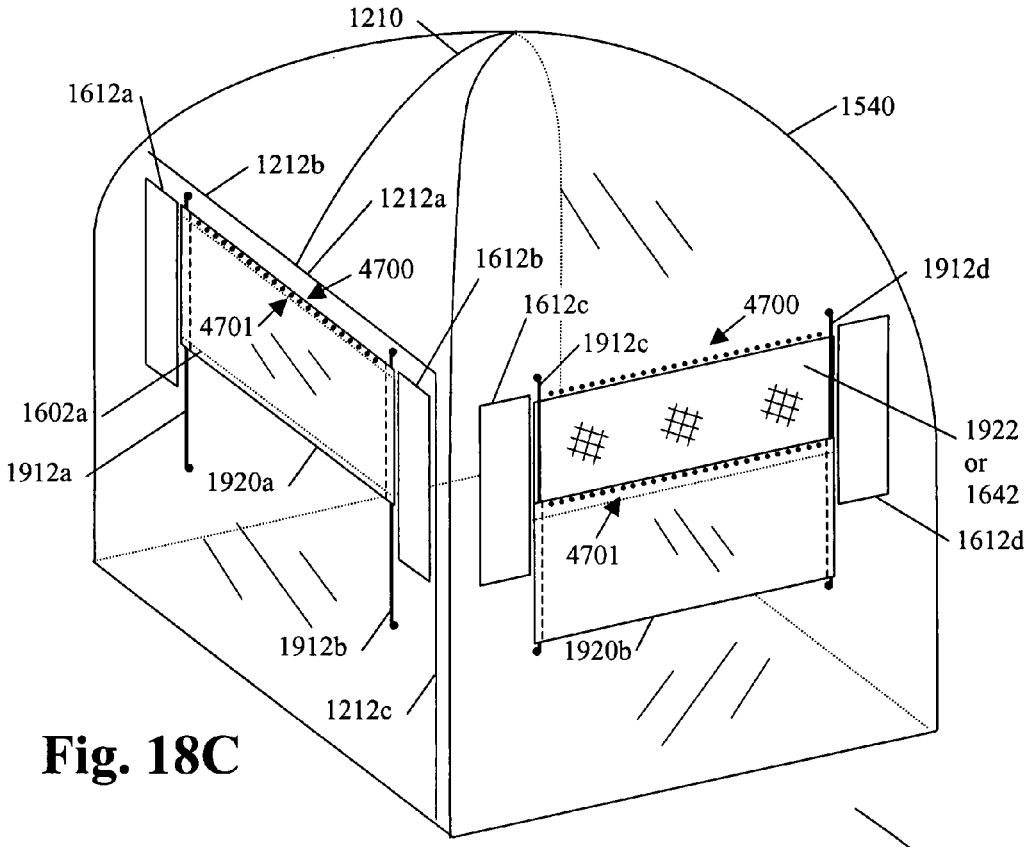

FIG. 18C is similar to FIG. 18B with the additions of side cover windows 1612*a* through 1612*d* and an inverted-T window, which shares many novel features with our star windows layout 1590 (disclosed in the related applications, in particular the MOC4 application; see FIG. 18E through FIG. 18G below). The inverted T-window comprises: 1) a top window fastener 1210 extending upward from the center, 2) a left window fastener 1212*a* extending laterally to the left from the center, and 3) a right window fastener 1212*b* extending laterally to the right from the center. To maintain cover skin wall tension, the windows 1612*a* through 1612*d* are preferably permanently covered with see-through panels 1922.

Figure 18D:
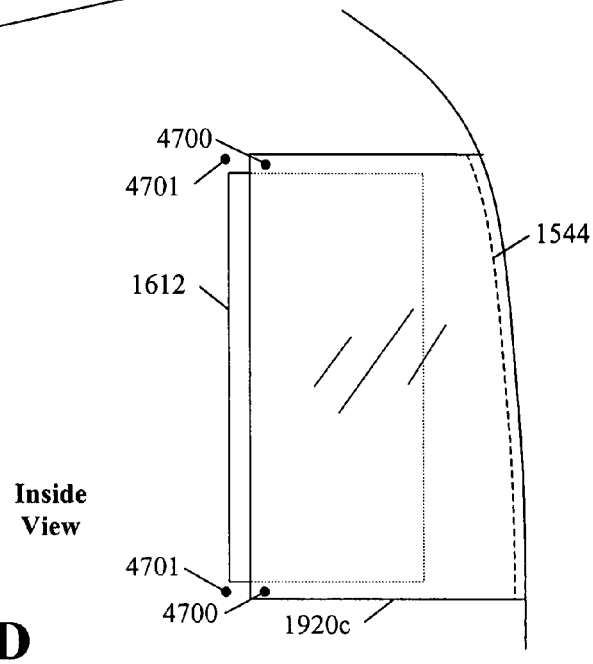

FIG. 18D shows further details of an embodiment of the side cover window 1612 (e.g. an inside view of window 1612*a* from FIG. 18C). The cover window 1612 is preferably a see-through or shoot-through material. The cover window 1612 may be covered with a blackout panel 1920*c*. The blackout panel 1920*c* is permanently attached on the outside edge to the cover seam 1544 and is temporarily attached by a magnetic connection, shown as a magnet 4700 in each of the inside corners and a corresponding magnetic piece 4701 in the cover at the corresponding corners of the cover window 1612.

FIG. 18D shows an embodiment of the cover 1540 having a star window with a door 1634.

Figure 18E:
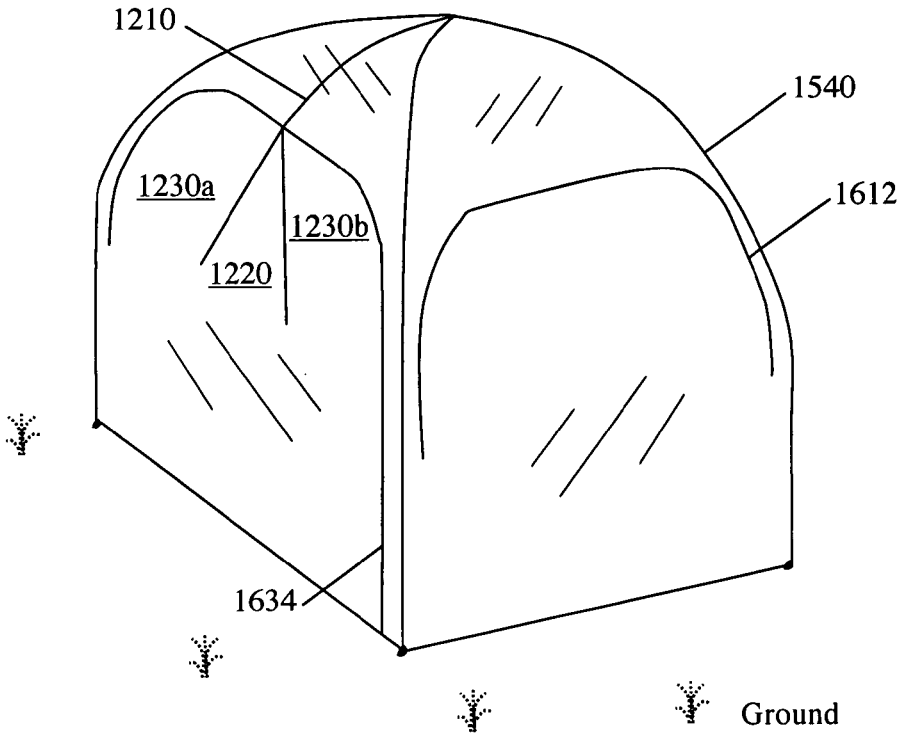

As shown in FIG. 18E, five window fasteners comprise a star-like layout 1590 with each window fastener being one of the five parts of the star. A top window fastener 1210 extends upward from the center. The star window layout 1590 comprises multiple sections between the fasteners, including a triangle section 1220, with a left section 1230*a* and a right section 1230*b* on either side.

Figure 18F:
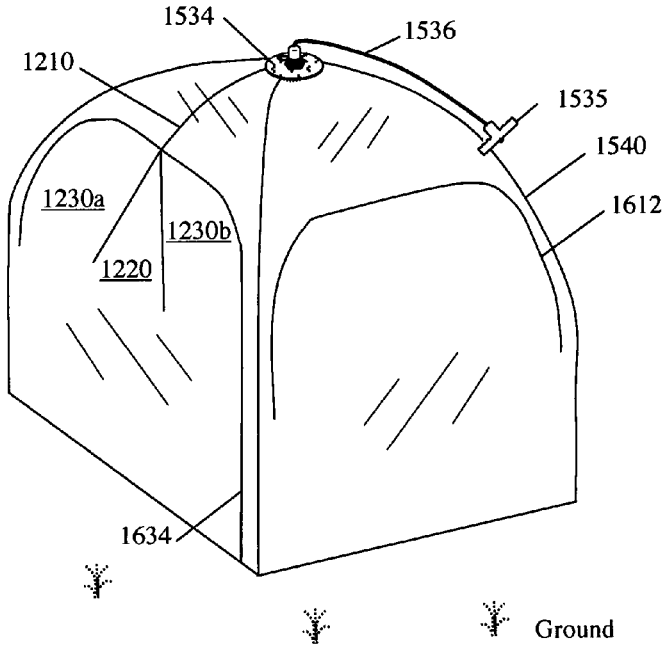
Figure 18G:
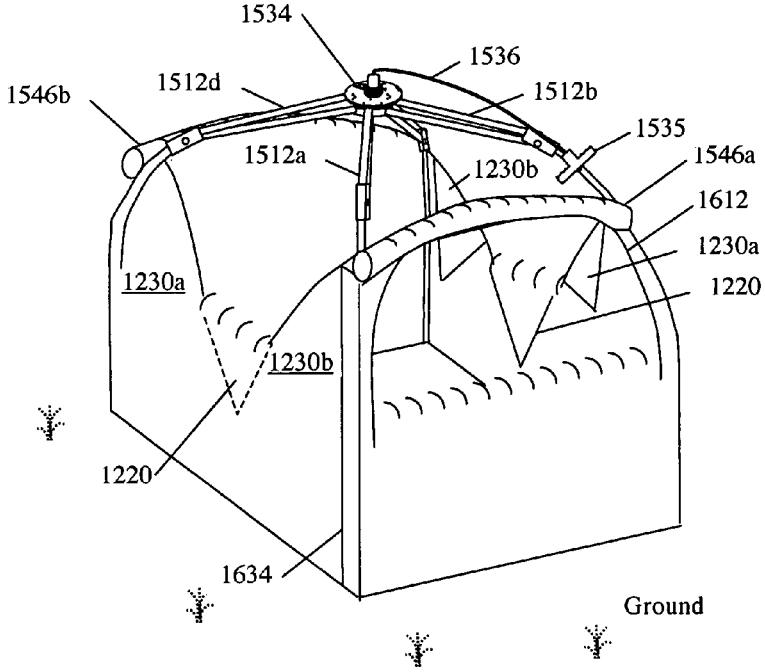

FIG. 18F and FIG. 18G show how the star window can also be used with the fast setup frame 1532.

The top window fastener 1210, left window fastener 1212*a*, and right window fastener 1212*b* are unfastened (e.g. unzipped) to allow the top of the cover 1540 to be fully opened as shown in FIG. 18G.

The user unzips the top window fastener 1210 on opposite sides of the cover and unzip at least partially the other fasteners in the window resulting in the cover configuration shown in FIG. 18G. Each side of the top of the cover 1540 is rolled up on alternate sides, as cover rolls 1546*a* and 1546*b*. In this configuration the blind is used for hunting waterfowl, or for observing up a hill or ridgeline.

Alternatively, the inverted-T window can be used as shown, for example, in FIG. 19I through FIG. 19N.

FIG. 18H through 18L are similar to the disclosures of the related applications (see for example the MOC3 application).

Figure 18H:
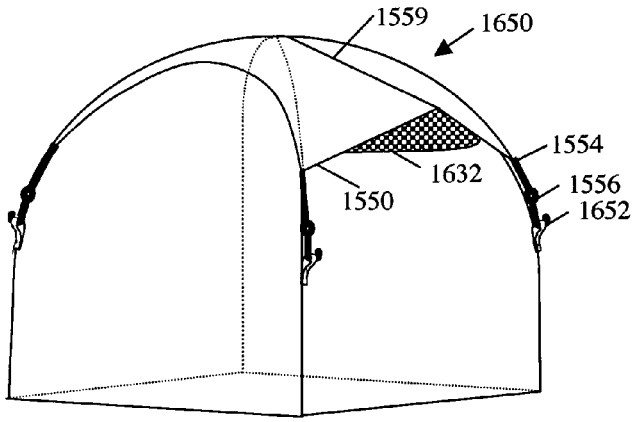

FIG. 18H an alternate embodiment of the cover designed for use in a rain fly configuration 1650. In this embodiment the overhead window 1632 is a mesh that allows for airflow out the top of the shelter. The rain fly 1550 covers the overhead window 1632. Fly loops 1652 are attached to the cover seams 1544. Fly fasteners 1556 attach to the fly loops 1652 and the fly cords 1554 hold the fly 1550 taut. For better concealment the rain fly shaft 1559 can be omitted. For better airflow the rain fly shaft 1559 can be placed in the fly pockets 1558 to raise the fly 1550 to a peak.

Figure 18I:
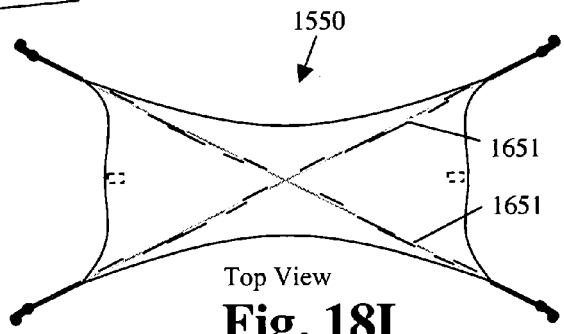

FIG. 18I shows that the shape of the fly 1550 is designed to cover the ridges 1651 caused by the cover shafts 1500 (or 1510) so that the rain will not come into the overhead window 1632.

Figure 18J:
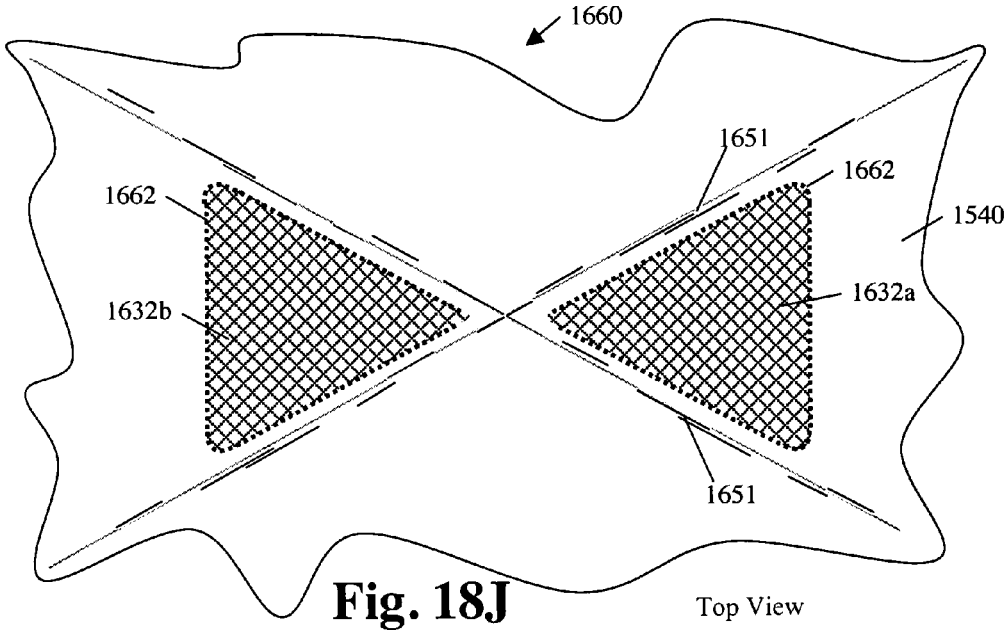

FIG. 18J shows a top view of a cover 1540 fragment showing two overhead windows 1632*a* and 1632*b*. Each overhead window 1632 is removably fastened with an overhead window fastener 1662 such as a zipper 1633, strips of hook and loop fasteners 530, or other fasteners. Another novel feature of removable overhead windows is that the rain fly 1550 and rain fly shaft 1559 can be installed and removed without leaving the shelter. Alternatively, with permanent overhead window 1632 mesh, a top window fastener 1210 can be used to install or remove the rain fly 1550.

Figure 18K:
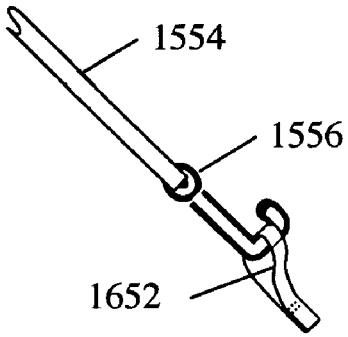

FIG. 18K illustrates the details of the rain fly 1550 attachment, namely the fly cord 1554 connected to the fly fastener 1556 which, in the embodiment shown hooks into the fly loop 1652.

Figure 18L:
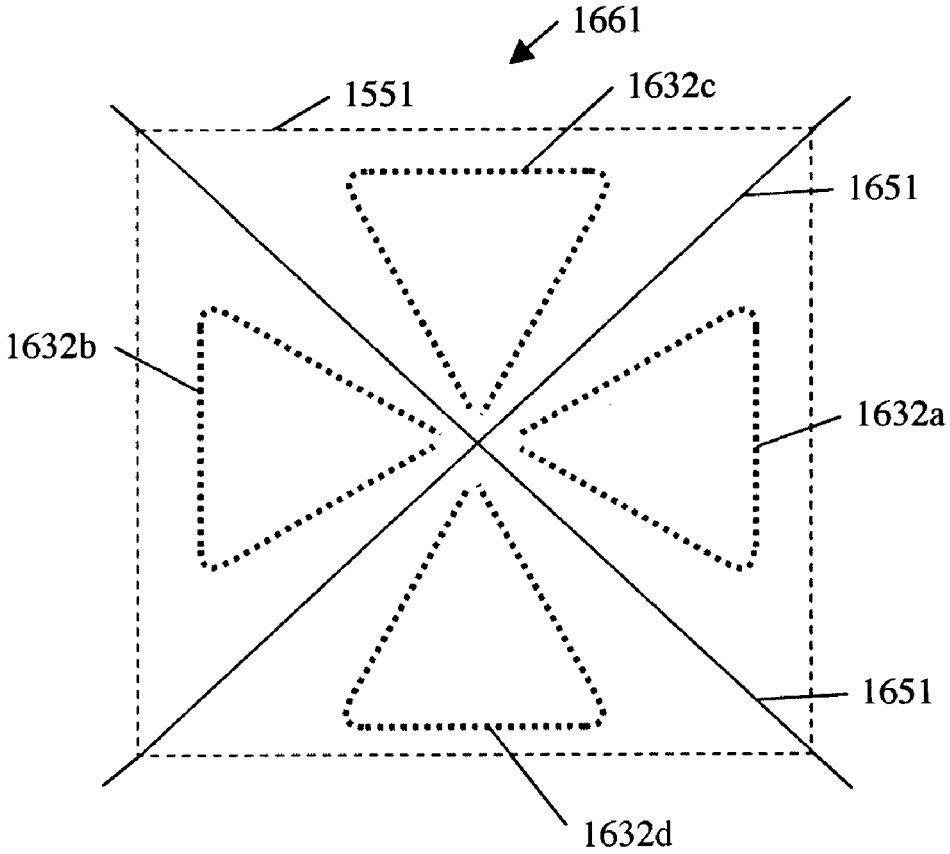
Figure 18M:
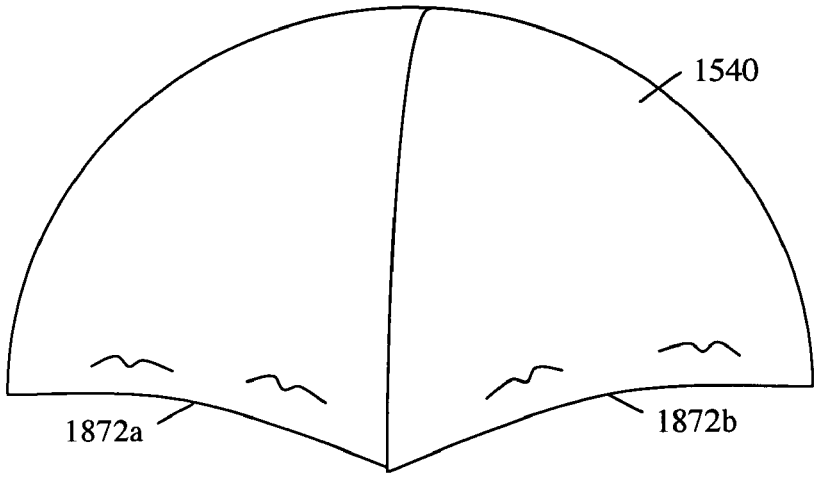
FIG. 18M and FIG. 18N illustrate lower wall skin tightening problem and solutions.

FIG. 18L shows a top view of yet another embodiment of an alternate cover with windows 1661. This embodiment comprises four overhead windows 1632*a* through 1632*d*, one for each cover panel 1542. To cover these windows the rain fly requires a square shape as shown by the alternate fly boundary 1551.

Figure 18N:
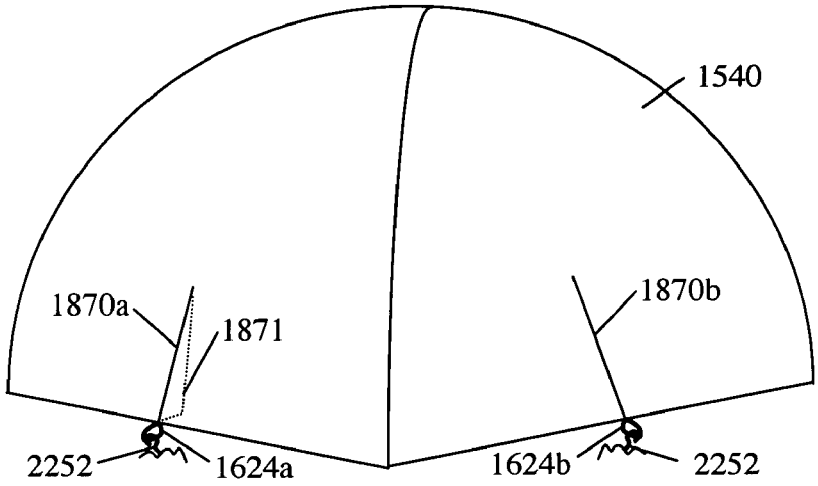

FIG. 18M and FIG. 18N

FIG. 18M and FIG. 18N illustrate lower wall skin tightening problem and solutions.

When a cover 1540 is stretched over a frame 1530 (comprising for example, cover shafts 1500, pivoting arches 3700, or fast setup frame 1534) and pulled down at the corners (e.g. via corner loops 1622), we discovered that the lower portion of the each cover panel 1542 is loose. This is illustrated in FIG. 18M where the bottom edge is like a frown (1872). This is because the forces pulling on the cover skin are toward the cover shafts (e.g. 1500, 1512, 3700) and toward the cover corners where the corner loops 1622 are attached to a cord clip 3414 on a stake (e.g., 3456 or 3458) or endpiece (e.g., 4400 or 4402). There is no force applied to the bottom edge.

FIG. N shows two solutions to the lower wall looseness problem.

During manufacture, cover material folded together forming a gather 1871 in the base of each cover panel wall and sewn with a vertical hem 1870(*a-b*). The extra material in the gather 1871 may then be permanently cut off. As a result when the cover 1540 is stretched over the frame, especially with the higher energy possible with the present invention, the tendency to loosen and form the frown edges 1872(*a-b*) is mediated.

The second solution is to add cover loops 1624(*a-d*) at the center of each wall base which can then be used to stake down the cover, with stakes 2252, which provide the missing tightening force to the bottom edge.

FIG. 19A Through FIG. 19H

FIG. 19A through FIG. 19H show various embodiments and operation covers with guylines and windows.

FIG. 19A shows a quiet cover 1646 that embodies a novel three-tiered cover (previously shown with fewer features in the embodiment of FIG. 17C). The top tier comprises a cover cap 1631. The middle tier comprises a ring of windows 1612 that are optionally held open or closed with novel magnetic connections between magnets 4700 and magnetic pieces 4701 (discussed above). The bottom tier is a skirt 2010.

The cover cap 1631 is connected to the skirt 2101 along the corners with skirt strap 1686(*a-d*) The skirt strap 1686 was previously disclosed in the related applications, in particular the MOC3 application, and can be a simple strap of webbing permanently or removably attached to the cover cap 1631 and the skirt 2010. This is illustrated with skirt straps 1686*a* and 1686*d*. Alternatively, the skirt straps 1686, can be made of tubular webbing that encompass the shaft 106 or the frame as illustrated in the case of 1686*b*.

This embodiment also shows the novel use vertical guylines 1912. Unlike FIG. 18B and FIG. 18C, where the sliding panels 1920 or 1922 are attached to the guylines 1912, in this embodiment the window 1612 material is sandwiched and held up between two sections of guylines 1912. A plurality of guylines are shown across the middle of each cover panel wall. Like the skirt strap 1686 in the corners, the guylines 1912 connect the material of the cover cap 1631 to the material skirt 2101, and thus help to maintain the skin tightening wall tension, even when one or more of the windows 1612 are open. The guylines 1912 also sandwich the material of the windows 1612 so that it does not flutter in the wind.

As also shown in FIG. 17A, the bottom corners of the middle tier windows 1612 of the quiet cover 1646 are shown preferably, removably clipped to the skirt 2010 with clips, identified in each respective corner as receiving clips 1704(*a-d*) and inserting clips 1706(*a-d*). These clips help maintain the wall tension which keeps the blind cover skin taut.

Figure 19B:
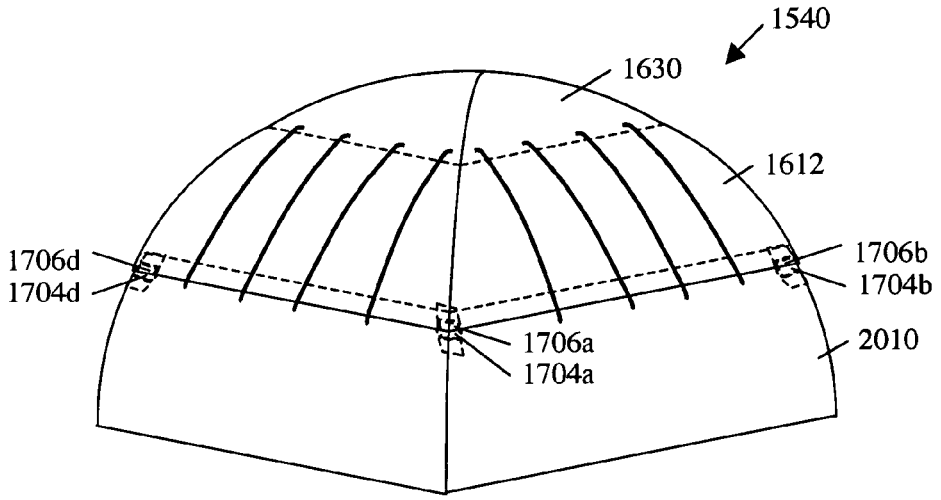

FIG. 19B shows the embodiment of FIG. 19A with each of the visible windows pulled down and each of the corner clips connected.

Figure 19C:
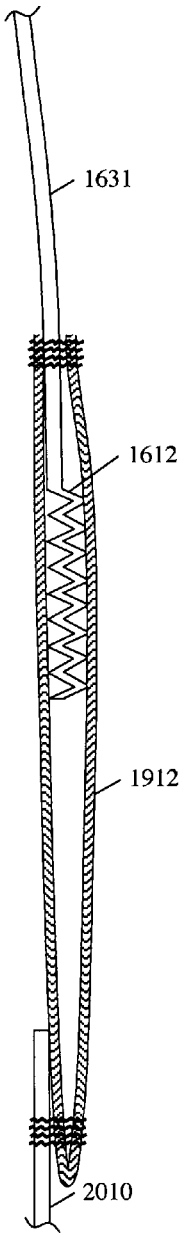

FIG. 19C shows a low cost simple embodiment of the guylines 1912 shown in FIG. 19A and FIG. 19B. This embodiment is formed by folding a single section of cord into a V-shape and sewing the bottom of the V to the outside of the skirt 2010 and sewing one end inside of the cover cap 1631 and one end opposite on the outside. This allows the wall tension to be maintained while allowing the window 1612 to be held at any position between fully open and fully closed. When fully closed the lower edge of the window 1612 is advantageously positioned on the outside of the skirt 2010 so rain (or snow) will be kept outside the blind.

Figure 19D:
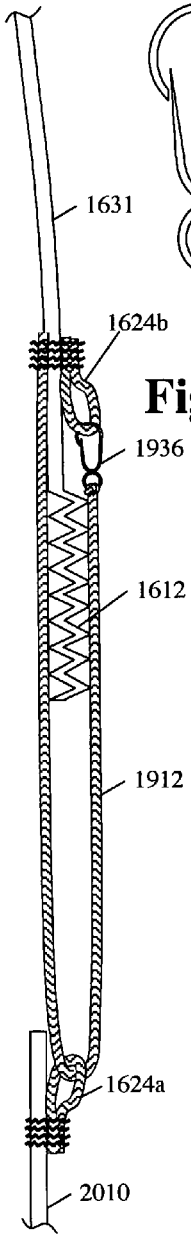

FIG. 19D shows another embodiment of the guylines 1912 shown in FIG. 19A and FIG. 19B. This embodiment is similar to the one shown in FIG. 19C except that the bottom of the V is passed through a first cover loop 1624*a*, which is outside the skirt 2010, and the outside end is removable connected with a guyline hook 1936 to a second cover loop 1624*b*, which is outside the cover cap 1631. This embodiment has the same operation and benefits of the FIG. 19C embodiment, and has the additional feature of being selectively removed from the open window when desired by the operator 400. Because it is still sewn onto the cover cap 1631 it will not be lost.

Figure 19E:
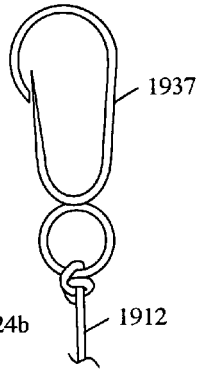

FIG. 19E shows an embodiment of the guyline hook 1936 comprising a closable clip 1937 tied to the free end of the guyline 1912.

Figure 19F:
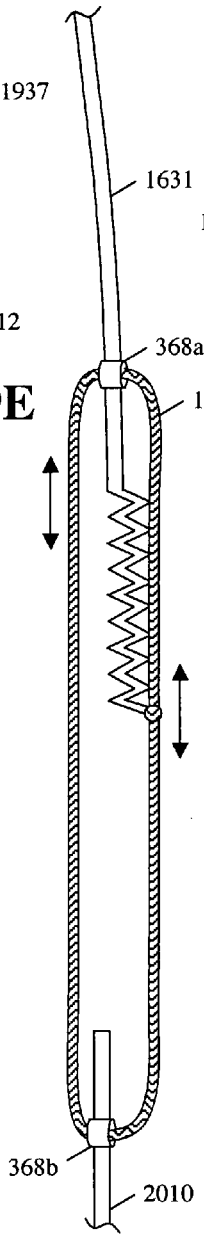

FIG. 19F shows another embodiment of the guylines 1912 shown in FIG. 19A and FIG. 19B. In this embodiment, the guyline 1912 is a continuous loop of cord that passes through grommets: grommet 368*a* at the top in the cover cap 1631 and grommet 368*b* in the skirt 2010. The bottom edge of the window 1612 is attached to the guyline 1912 loop on the outside of the blind. The benefits of the FIG. 19C embodiment are provided. Additionally, this embodiment has the additional feature of allowing the operator 400 to move the window 1612 up or down by moving the inside portion of the loop in the opposite direction, thus allowing finely controlled operation of the window 1612 without the exposure of the operator's hand in the opening.

Figure 19G:
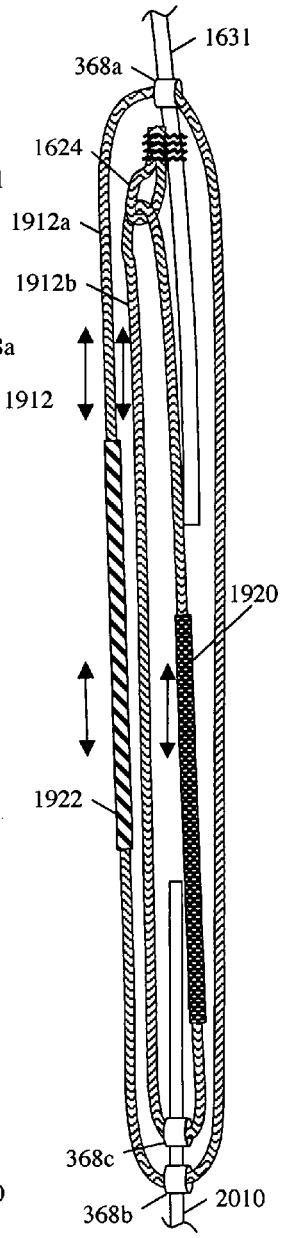

FIG. 19G shows another embodiment of the guylines 1912 shown in FIG. 19A and FIG. 19B. In this embodiment, two guylines 1912 are a continuous loop of cord that passes through grommets or cover loops 1624: grommet 368*a* at the top in the cover cap 1631 and grommets 368*b* and 368*c* in the skirt 2010. Cover loop 1624 attached inside as an alternative to a fourth grommet 368*d* (not shown) with the advantage allowing the blackout panel 1920 to be positioned inside the cover cap 1631 at the top and outside the skirt 2010 at the bottom so that when closed the rain will roll down from the cover cap 1631, to the blackout panel 1920, and finally, to the skirt 2010. The blackout panel 1920, which replaces the window 1612 material, is attached to the outside portion of guyline 1912*b*. The see-through panel 1922 is attached to the inside portion of guyline 1912*a*. This allows the two panels (1920 and 1922) to slide past each other as previously disclosed in the related applications. The benefits of the FIG. 19C embodiment are provided. Additionally, this embodiment has the additional features of allowing the operator 400 to move either panel (1920 or 1922) up or down by moving the inside portion of the loop in the opposite direction, thus allowing finely controlled operation of the panels (1920 and 1922) without the exposure of the operator's hand in the opening.

Figure 19H:
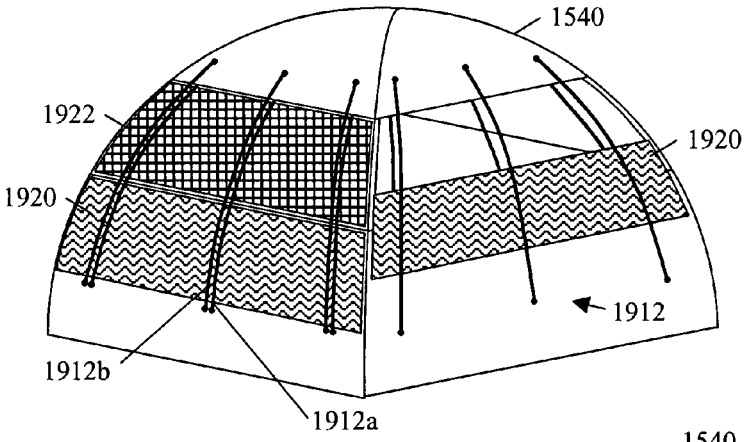

FIG. 19H shows a blind with exemplary use of the novel guyline loops of FIG. 19G. The left side shows an embodiment with a set of three blackout guyline loops 1912*a* and set of three see-through guyline loops 1912*b*. The right side shows an alternative embodiment with only a set of three blackout guyline loops 1912.

Figure 19I:
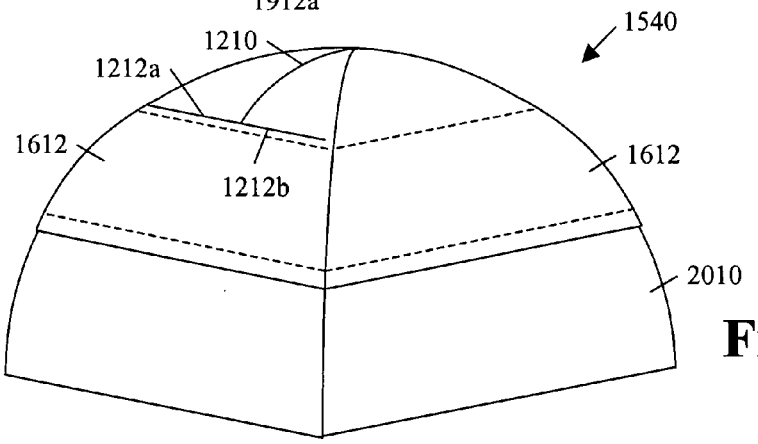
FIG. 19I through FIG. 19O show various configurations with inverted-T windows and guylines window, including use with the fast setup frame.
Figure 19J:
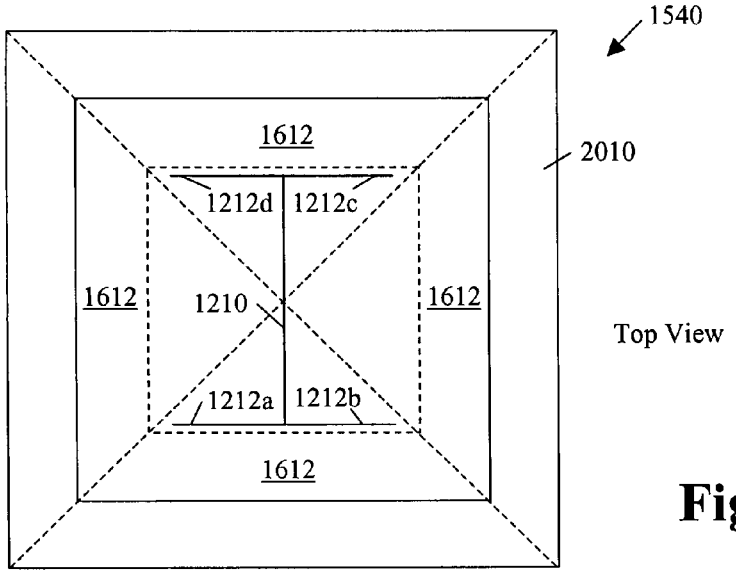
Figure 19K:
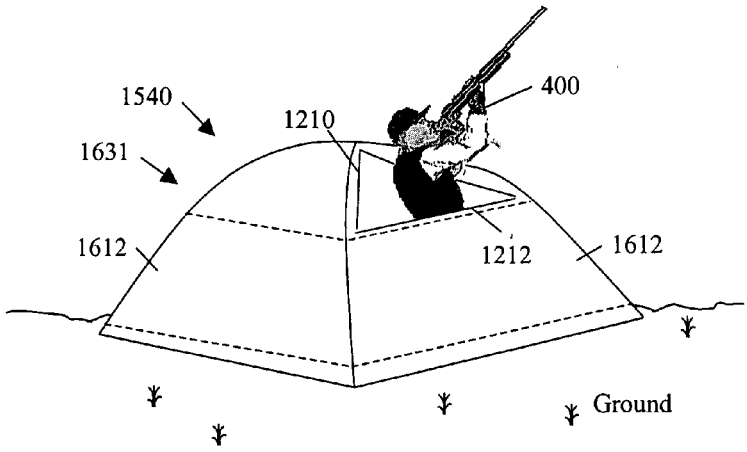
Figure 19L:
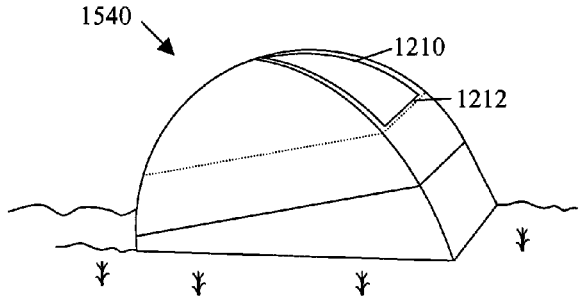
Figure 19M:
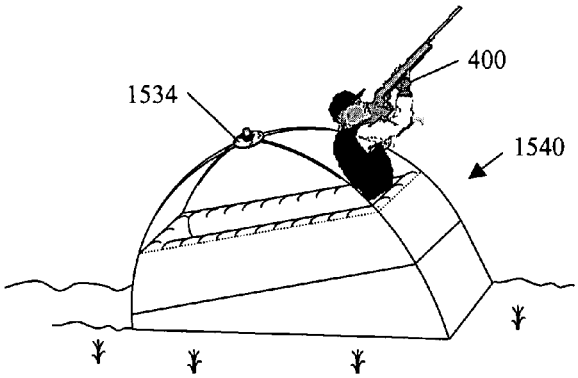
Figure 19N:
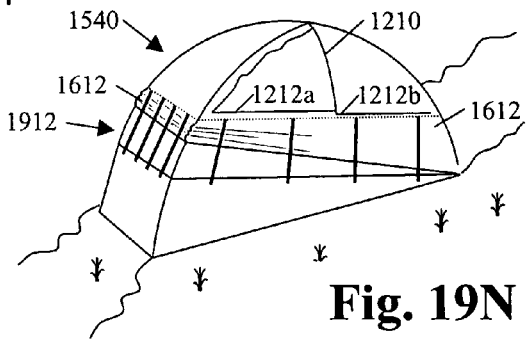
Figure 19O:
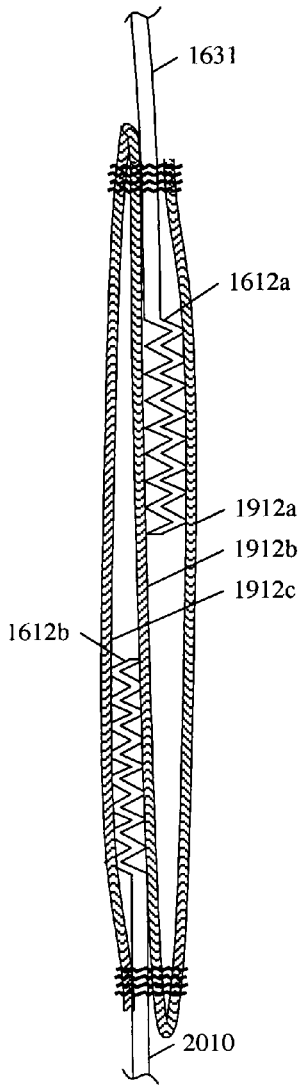

Skipping now to FIG. 19O, another low cost simple embodiment of the guylines 1912 is shown. This embodiment, similar to the embodiment of FIG. 19C, is formed by folding a single section of cord into a N-shape, sewing the top parts of the N-shaped cord to the cover cap 1631 (guyline 1912*a* outside and guyline 1912*b* inside), sandwiching an upper window 1612*a* which is an extension of the material of the cover cap 1631, and sewing the bottom parts of the N-shaped cord to the skirt (guyline 1912*c* inside and guyline 1912*b* outside), sandwiching a lower window 1612*b* which is an extension of the material of the skirt 2010. When fully closed the lower edge of upper window 1612*a* is advantageously positioned on the outside of the lower window 1612*b* (skirt 2010) so rain (or snow) will be kept outside the blind. This embodiment also has the advantage of allowing opening in between the upper window 1612*a* and the lower window 1612*b* to be any height and to be positioned selectively at any level.

Any number and combinations of these novel guyline embodiments could be used to create versatile covers 1540.

FIG. 19I Through FIG. 19N

FIG. 19I through FIG. 19N show various configurations with inverted-T windows and, including use with the fast setup frame.

FIG. 19I shows aspects of a currently preferred cover 1540. An inverted-T window is visible on one of the two visible cover panels. As explained above, the inverted-T window comprises top window fastener 1210, left window fastener 1212*a*, and right window fastener 1212*b*. The left and right window fasteners 1212 run along the top of the moveable cover windows 1612 that form the middle tier of this embodiment.

FIG. 19J shows the top view of a currently preferred cover 1540. Two inverted-T windows share a common top cover window fastener 1210, forming an I-shape. The special interconnect window fastener 1210 of this I-shape embodiment has two zipper pulls, each starting in the center of the opposite inverted-T. Each zipper pull is of the type that is permanently attached on one zipper track with a zipper box and is removably attached using a zipper pin at the end of the teeth of the other track. Thus, the two tracks of the special zipper can be totally separated by unzipping to the respective ends of the tracks and removing the respective pins from the boxes on each end. This allows the configurations shown, for example in FIG. 19K through FIG. 19N. With one zipper pull attached the special zipper can be opened to any point from end to end.

FIG. 19K shows a currently preferred embodiment of the blind in a low profile, rifle hunting configuration. The cover cap 1631 is low to the ground with the extensions 4410 removed or folded inside the cover 1540 (not visible). The middle tier windows 1612 are closed because they are close to the ground. For situations where it is desired to stay low to the ground and shoot towards the sky, the operator can lie inside the cover cap 1631 and raise up through the overhead opening of the top window fastener 1210 when desired. The window fastener 1210 and 1212 can be unfastened and the top sections (1218, not visible) may be held with a small strip of hook and loop fastener (530, not shown) until the operator pops up through the opening.

FIG. 19L shows a currently preferred embodiment of the blind in a dove blind configuration. On two of the four corners, the extensions 4410 are removed or folded inside the cover 1540 (not visible) moving the apex of the blind away from directly overhead. The middle tier windows 1612 are closed. The operator can sit on a chair inside the blind having good visibility through the opening and stand up whenever desired.

FIG. 19L shows a currently preferred embodiment of the blind in a waterfowl configuration. On two of the four corners, the extensions 4410 removed or folded inside the cover 1540 (not visible) moving the apex of the blind away from directly overhead. The middle tier windows 1612 are closed. The two, interconnect inverted-T windows are completely opened allowing the top to be completely open and rolled down. The fast setup frame 1534 is visible.

FIG. 19N shows a currently preferred embodiment of the blind in a hillside or rough terrain configuration. On two of the four corners, the extensions 4410 are removed or folded inside the cover 1540 (not visible) allowing the blind to be level. The middle tier cover windows 1612 are opened in part and are held quietly in place by the guylines 1912. One side section of the inverted-T windows is shown open (by opening fasteners 1210 and 1212*a*) allowing the operator to view up the hill.

FIG. 20A Through FIG. 20E

FIG. 20A through FIG. 20E show various foot attachment means.

Figure 20A:
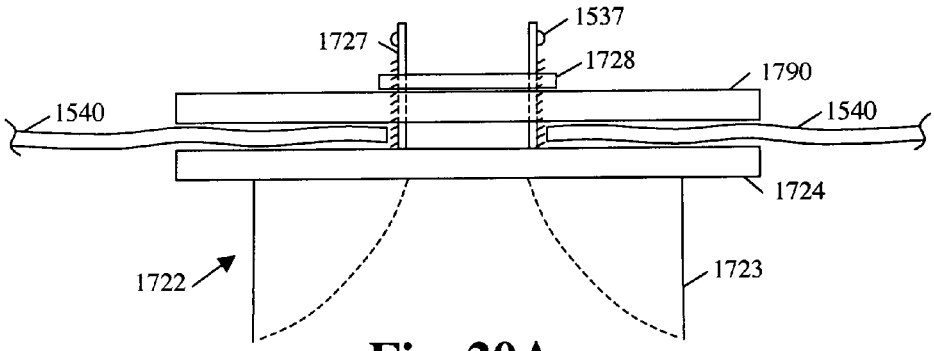
FIG. 20A through FIG. 20E show various foot attachment means.

In FIG. 20A, as shown above FIG. 17G, the washer nut 1728 is used to hold the cover 1540 material out of the dock conduit 1727 so the material does not interfere with the operation of the docking shaft 1743. Optionally, the washer nut 1728 also holds an embodiment of a foot attaching means 1790.

Figure 20B:
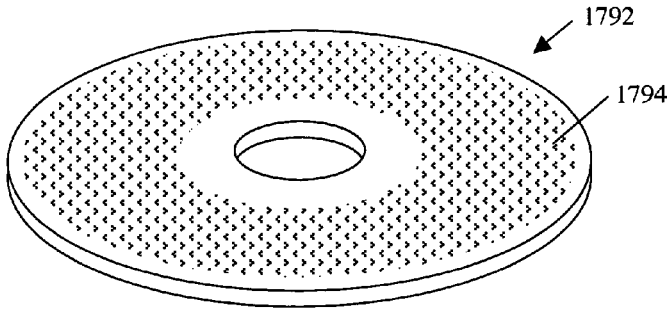

FIG. 20B shows an embodiment of a foot attaching means 1790 which is the foot plate 1792 with gripping texture 1794.

Figure 20C:
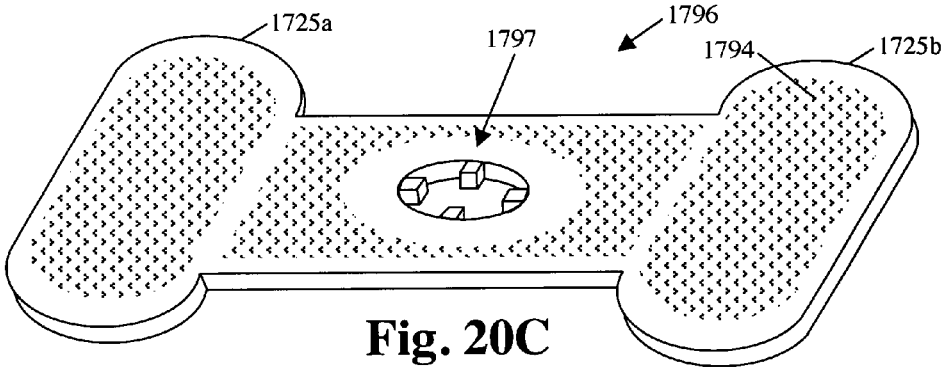
Figure 20D:
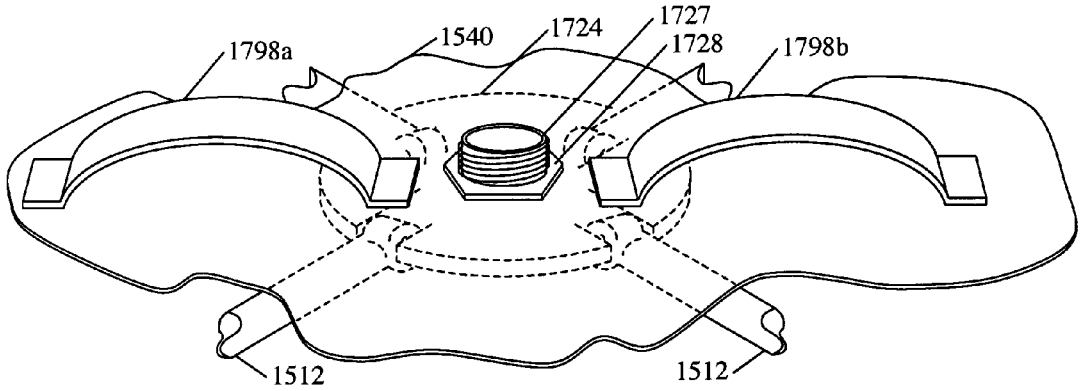

FIG. 20C shows an embodiment of a foot attaching means 1790 which is a foot plate with foot pads 1796. Each foot pad 1795 is shown with gripping texture 1794.

This embodiment optionally comprises one or four foot plate notches 1797. It is preferred, for simplicity of manufacturing assembly and user modular use, that the cover 1540 be able to be connected in any rotation to the fast setup frame 1534 (e.g. FIG. 17E). The spreading strap means (spreading straps 2160(*a-b*) or wishbone strap 2162) is attached to the cover 1540 (e.g. FIG. 17Q or FIG. 21B). To hold the foot plate aligned with the spreading straps means, the dock conduit 1727 could be keyed with respective, four or one, grooves (not shown) for receiving the one or four foot plate notches 1797. The grooves would hold the plate at the proper angle to engage the feet while the spreading straps are being used (FIG. 21B).

FIG. 20C shows an embodiment of a foot attaching means 1790 which is one or two toe straps 1798 preferably sewn to the cover in alignment with the spreading straps means just discussed.

Also, as visualized by the hidden lines in FIG. 20C, if no toe straps 1798 were attached, the operator 400 could attach one or both feet to group of the shafts 1512, dock plate 1724, washer nut 1728, or dock conduit 1727, as an alternate form of foot attaching means 1790.

Figure 20E:
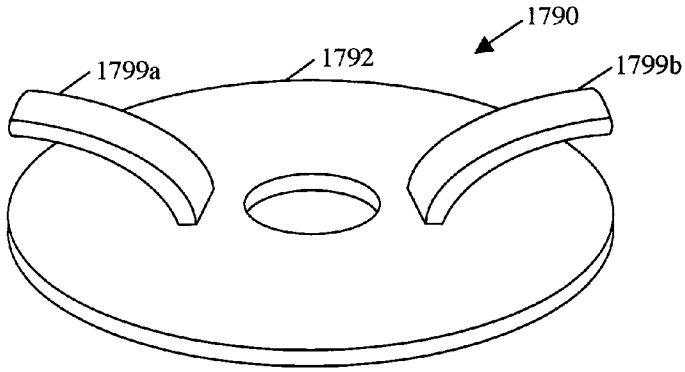

FIG. 20E shows an embodiment of a foot attaching means 1790 which is an embodiment of the foot plate 1792 with one or two rigid stirrups 1799. In yet another embodiment, not shown, one or two toe straps 1798 could be attached to the foot plate 1792. These embodiments could advantageously have the one or four foot plate notches 1797 as discussed above in reference to FIG. 20C.

FIG. 21A Through FIG. 21H

FIG. 21A through FIG. 21G show novel set up and take down methods of the fast setup frame 1534. This sequence is shown using the alternate spreading strap means comprising two spreading straps 2160(*a-b*). The currently preferred wishbone strap 2162 could also be used substantially as described below.

FIG. 21A shows the operator 400 carrying the blind using the spreading strap means, shown as the two spreading straps 2160, over a shoulder. For easier portability the blind is held fully closed with a closure strap 2166. Next the operator 400 places the collapsed blind on the ground, and releases the clip on the closure strap 2166. At this point the fast setup frame 1534 is folded at the blind apex with the half cover shafts 1512 lying in parallel to the axis of the frame.

FIG. 21B show the operator aligning his body along the axis of the blind and placing his feet against the apex of the blind preferable using a foot attaching means 1790 (FIG. 20A through FIG. 2E). The operator applies an initial spreading force by lifting and spreading the spreading strap means until the blind begins to open. Good results have been obtained by either sitting on the ground or a camping chair.

Figure 21C:
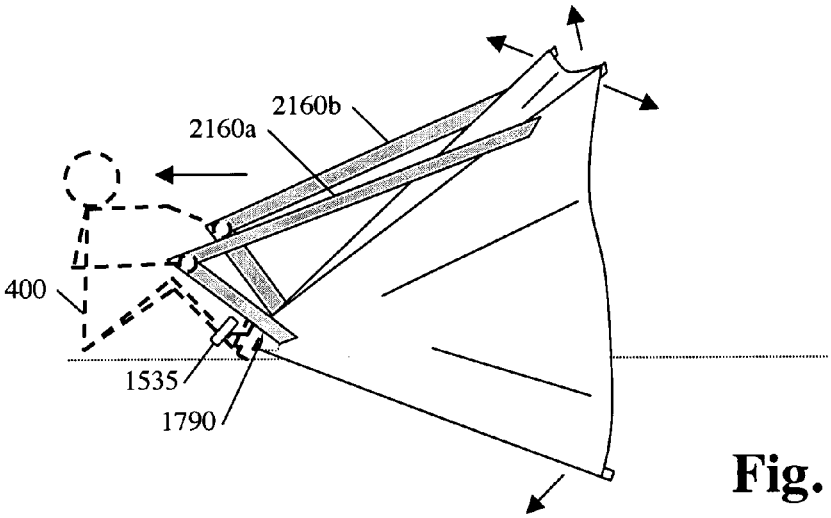

FIG. 21C shows the operator beginning to lean back as the fast setup frame 1534 begins to open. It is during this transition from FIG. 21B to FIG. 21C that the first advantages of the flat walls in the various hinges are used. This transition puts a large stress on the frame to force it to open. The friction within the hinges and against the ground starts to hold the blind open. In practice, opening the blind into a light wind makes this step and process easier.

Figure 21D:
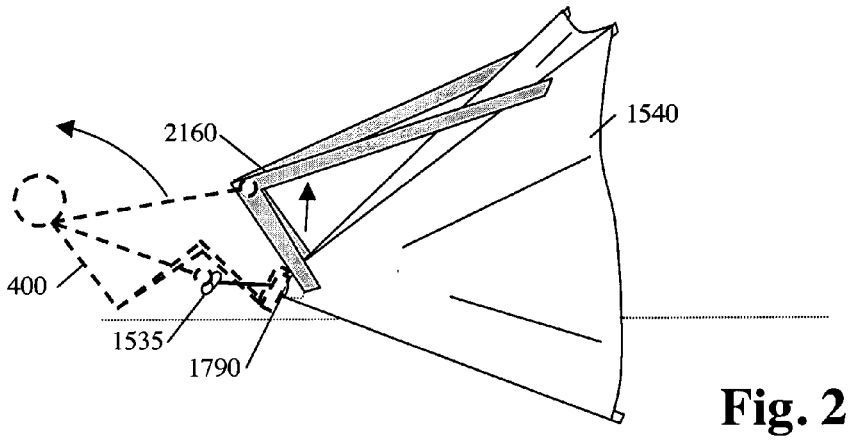

FIG. 21D shows the operator 400 holding the spreading strap means with one hand (either with both spreading straps 2160 in one hand, or preferably, with the one hand sliding down the wishbone strap 2162 along the long strap). While the operator 400 continues to lean back, the other hand makes a smooth transition to the pull handle 1535 which is optionally, advantageously held between the feet, using the handle snap 1537, the handle standoff 1539, or both. By leaning back, the blind continues to open and the operator 400 lifts the apex of the blind off the ground using the foot attaching means 1790.

Figure 21E:
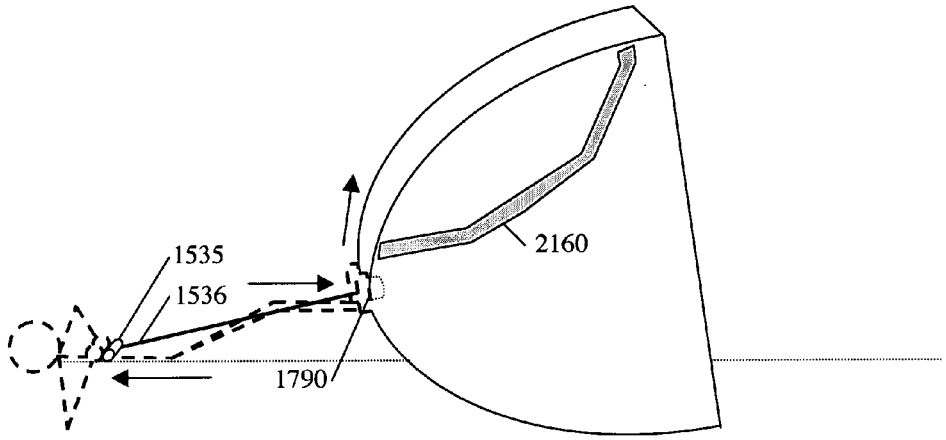

FIG. 21E shows the operator 400 at the end of the seated row stroke. The pull cord 1536 has been moved the full range of motion necessary to engage the docking mechanism of the arch flattening means. The operator has released the spreading strap means (e.g. 2160, shown hanging free). The operator has grasped the pull handle 1535 during the stroke with both hands while continuing to lift the apex of the blind with the foot attaching means 1790. Using this method the operator has been able to apply a cover skin tightening force using a plurality of large muscle groups of the full body from the hands to the feet, whereby the blind is rapidly setup (in only a few seconds). The arch flattening means stores and transfers the force to the arch cover shafts 1512. In turn, the arch cover shafts 1512 stretch the cover panels 1542 with sufficient force that cover skin is held taut without substantial movement or noise detectable by wildlife. The force applied by the human body over the range of movement is greater than a force possible with just the arms and shoulders of the conventional methods.

It is during this transition from FIG. 21D to FIG. 21E that the second advantage of the flat walls in the various hinges is used. This transition puts a large stress on the frame as it tightens the skin and as the docking assembly engages the dock. The mechanical stability provided by the tight hinges help align the docking mechanism. The dock curved surface 1725 smoothly guides the pull cord 1536 and then the docking tip 1744 toward the proper alignment.

At this point the operator would install the safety clip 1715 embodiment of the safety means.

Figure 21F:
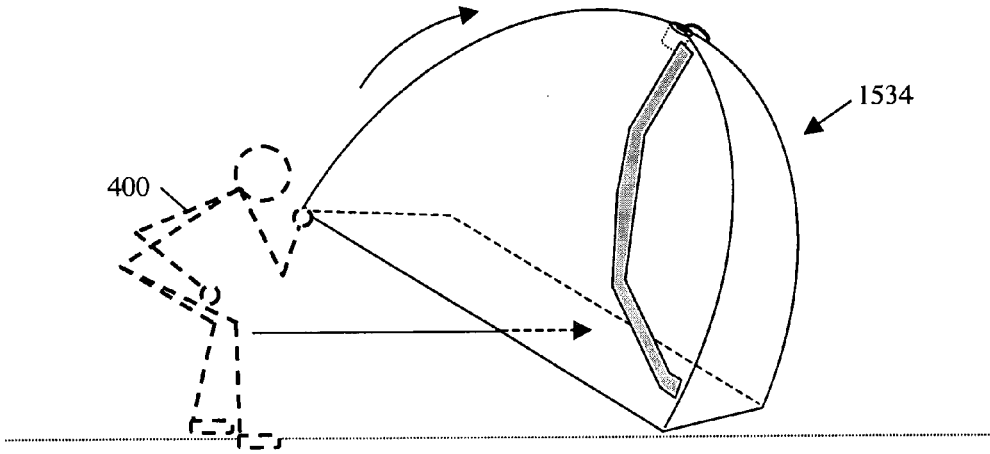
Figure 21G:
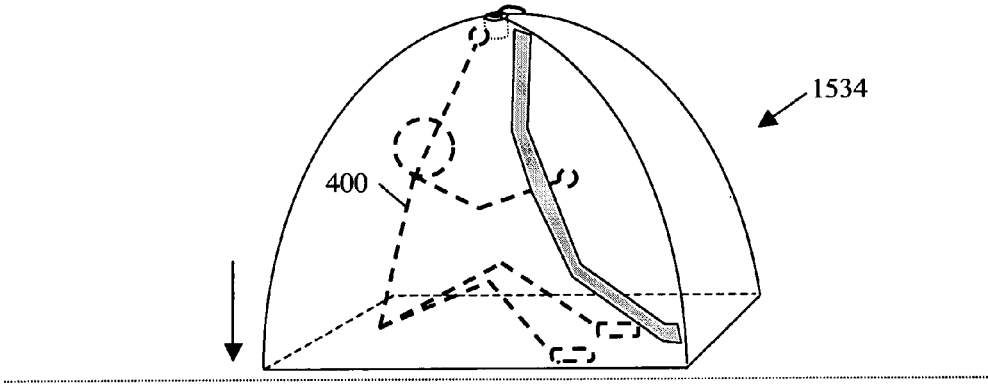

FIG. 21F shows the operator easily lifting the standalone blind and lifting it overhead.

FIG. 21G shows the operator inside the blind. The operator can go from running through the outdoors to being fully concealed (the sequence from FIG. 21A to FIG. 21G) in about seven seconds.

At this point the operator would install the safety strap 1705 embodiment of the safety means. Because the docking mechanism is preferably "past center" when fully engaged the blind can be moved about, as in FIG. 21F, without having to apply any force to keep the docking mechanism engaged. The safety means is a precaution against an unplanned release if someone or something hits the blind, or if a strong wind distorts the frame enough, forcing the docking mechanism back past the safe center.

Because the blind has a strong, standalone frame 1534 with taut skin, the entire lightweight blind can be easily moved short distances just by lifting it with the exterior spreading strap means.

Figure 21H:
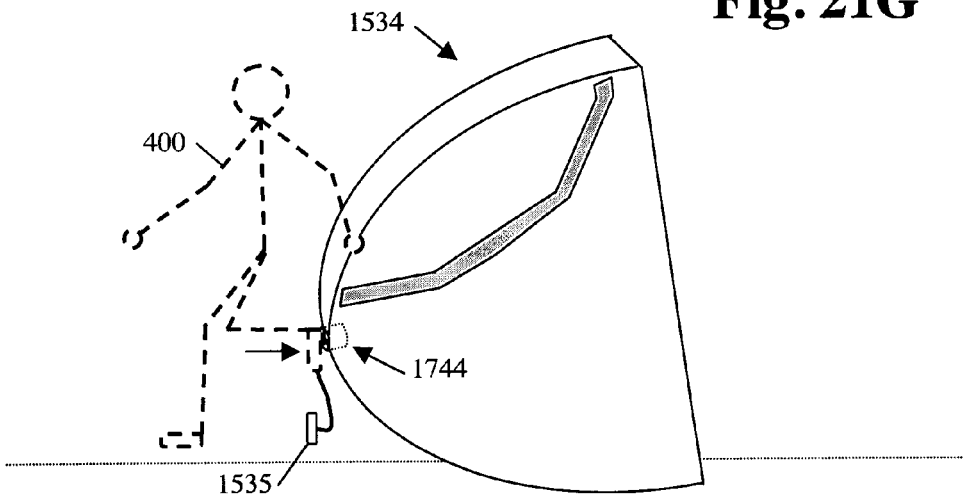

FIG. 21H shows the novel takedown method. "You just kick it."™

The operator 400 disengages the safety mean (safety clip 1715 and/or safety strap 1705), pulls most of the pull cord 1536 inside the blind, and tips the blind horizontally to slightly below knee level. The operator 400, for example, stands on a dominate right foot, holds the cover arch 1512 with the left hand, and kicks the docking tip 1744 with the left foot. When the stored energy is released, the blind will automatically jump forward under the left arm of the operator 400 where the now collapsed blind also can be grasped in front of the body with the right hand. The operator 400 can immediately move the blind to a new location. The blind can be collapsed in a couple of seconds.

For long-term transportation, any cover shaft extensions 4410 would also be collapsed and the closure strap 2166 clipped around the collapsed blind.

FIG. 22A Through FIG. 22F

FIG. 22A through FIG. 22F show various embodiments for collapsing and extending cover shafts, providing for various configurations, shown for example in FIG. 19K through FIG. 19N.

Figure 22A:
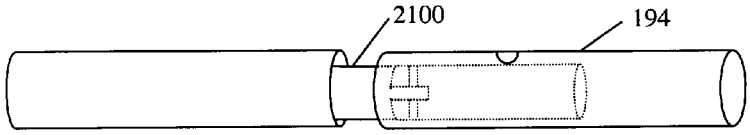
FIG. 22A through FIG. 22F show various embodiments for collapsing and extending cover shafts, providing for various configurations.

FIG. 22A shows an embodiment of a hinged inserting end 2100, as previously disclosed in the related applications (e.g. the MOC3 application). One side of the hinge is mortised for receiving a tenon. A double hinged segment (not shown) was also previously disclosed. The shaft hinge, whether single or double, was disclosed as being locked by a dimpled connecter 194 being locked over the shaft hinge. The connector passes over and locks the one hinge, or both hinges, so that the hinge parts cannot move within the hollow cylinder of the connector.

This concept may be applied to provide novel lockable shaft hinges as described below in reference to FIG. 22C and FIG. 22D.

A currently preferred embodiment of the fast setup frame 1534 comprises solid fiberglass cover shafts 1512. The cover shafts 1512 are preferably shortened and extended to provide various configurations, to reduce shipping cost, and to ease portability in the field.

FIG. 22B shows a simple shaft extension 4410 means. To extend the cover shaft 1512, the end piece (shown as end piece with slot 4402) is removed and placed on the end of another, preferably solid shaft 106, which, in turn, is connected with a dimpled connector 194 to the cover shaft 1512. The shaft 106 and the connector 194 form the extension 4410. As suggested in reference to FIG. 4R and FIG. 10J, multiple extensions 4410 can be added or removed as needed. A disadvantage of this simple approach is that the parts are removable from the blind system and may be lost in the field. FIG. 22C through 22F show alternatives for extension 4410 which do not need to be removed from the blind system.

FIG. 22C shows a shaft extension 4410 means comprising a shaft hinge 2264 between a shaft 106 and the rest of the hinged cover shaft 1512 and a locking slide 2260. The lower portion of the shaft hinge 2264 contains an outward protrusion, shown as a hemispherical outward protrusion 3195 (see FIG. 2A). The locking slide 2260 comprises a straight connector with locking channel 3094 which slides over the shaft hinge 2264 and is selectively locked over the outward protrusion 3195. When the locking slide 2260 is slid up the shaft 1512, the shaft hinge 2264 can fold the extension 4410 shaft 106 inside the blind or outside the blind as shown in FIG. 17V. When the locking slide 2260 is slid down, the shaft hinge 2264 holds the shaft strongly. By using the novel locking channel 3094, the slide is not dependent on gravity to remain engaged allowing the blind to set up while horizontal and allowing the blind to be turned upside down without risk of unplanned folding of the shaft extension 4410. An end piece means for attaching to the corner loop 1622, shown as end piece with slot 4402, is attached to the end of the shaft 106.

FIG. 22D shows a shaft extension 4410 means comprising a shaft hinge 2264 between a shaft 106 and the rest of the hinged cover shaft 1512 and a magnetic slide 2262. The lower portion of the shaft hinge 2264 contains a magnet 4700, shown as a raised ring. The magnetic slide 2262 comprises a straight connector which is magnetic 4701 and which slides over the shaft hinge 2264 where it is magnetically locked. When the magnetic slide 2262 is slid up the shaft 1512, the shaft hinge 2264 can fold the extension 4410 shaft 106 inside the blind or outside the blind as shown in FIG. 17V. When the magnetic slide 2262 is slid down, the shaft hinge 2264 holds the shaft strongly. By using the novel magnetic slide 2262, the slide is not dependent on gravity to remain engaged allowing the blind to set up while horizontal and allowing the blind to be turned upside down without risk of unplanned folding of the shaft extension 4410. An end piece means for attaching to the corner loop 1622, shown as end piece with slot 4402, is attached to the end of the shaft 106.

FIG. 22E shows a shaft extension 4410 means comprising a telescoping shaft 108. An end piece means for attaching to the corner loop 1622, shown as end piece with hook 4400, is attached to the end of the telescoping shaft 108. The hollow telescoping shaft 108 slides over either another telescoping shaft 108 or, as shown, a cover shaft 1512. This extension 4410 means is held in place by a telescope locking means

Figure 22F:
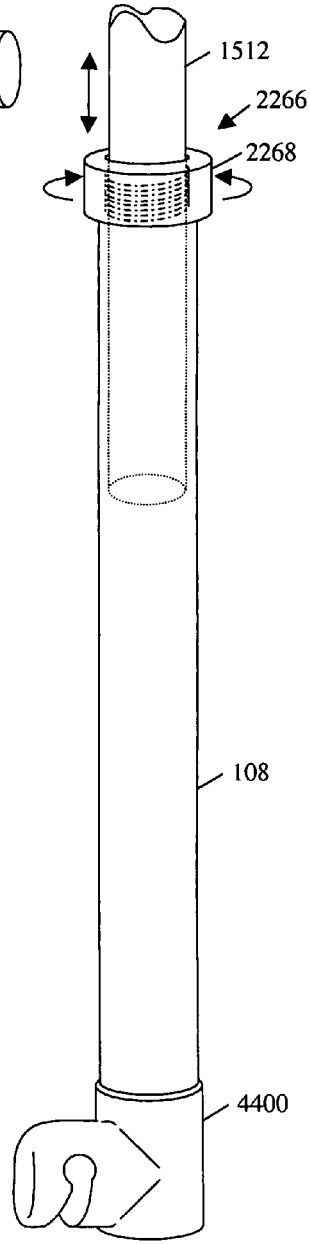
Figures 22B, 22C, 22D, 22E:
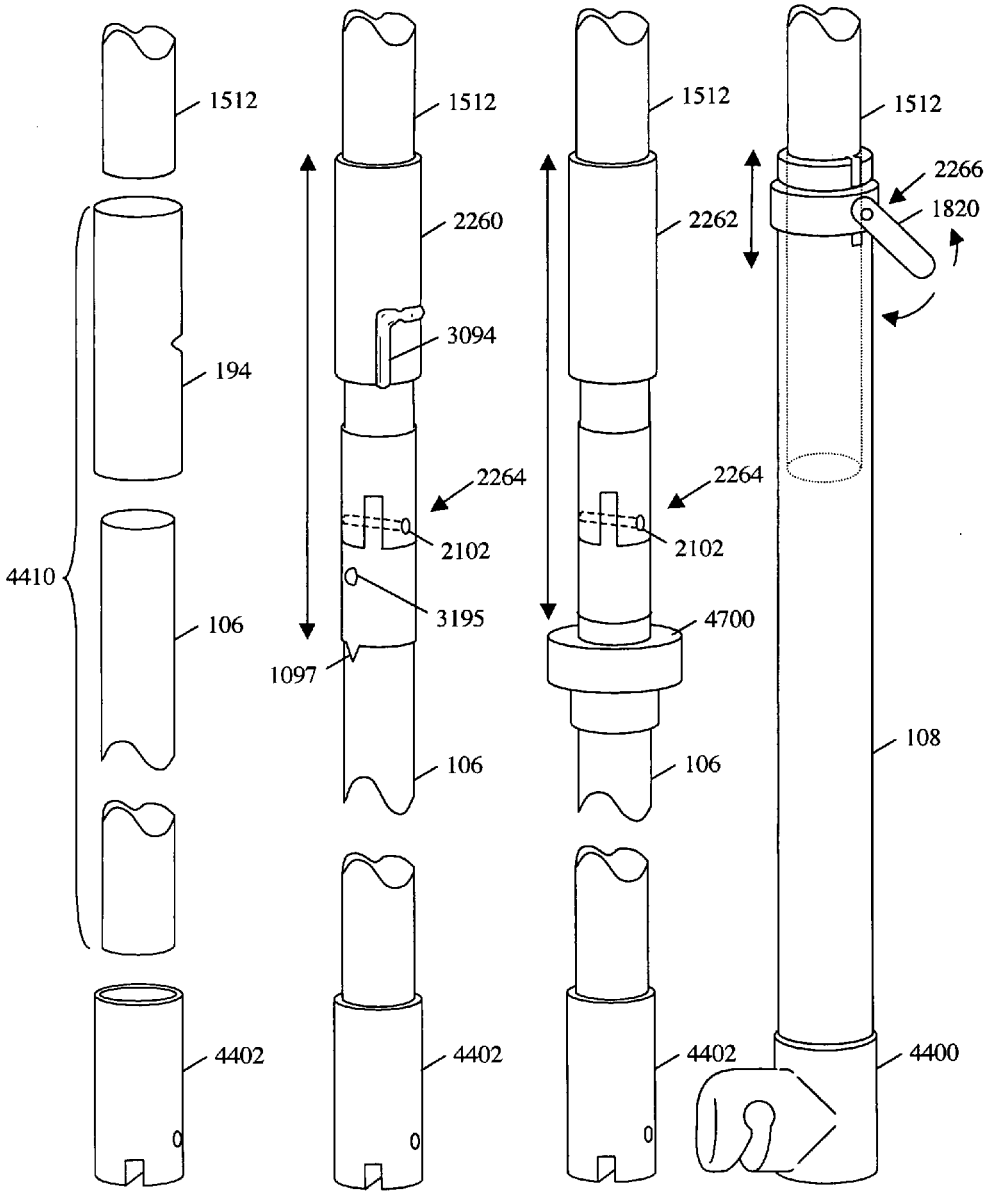

2266 shown as a quick release 1820 (or in FIG. 22F as a threaded sleeve 2268). The telescope locking means 2266 clamps down, closing a slot in the hollow shaft 108 when tightened.

The telescoping shaft 108, especially 22E, is currently preferred as the extension means 4410 because it is infinitely adjustable to provide precise skin tightening along the cover corners.

FIG. 23A Through FIG. 23C

FIGS. 23A through 23C show details of the arch flattening hinge.

As discussed above (FIG. 17G), the arch flattening hinge 1516 is integrally part of the hinged cover shaft 1512(*a-d*) and has two hinge walls 1518(*a-b*). The two hinge walls 1518(*a-b*) are internally flat and extend parallel to the axis of the hinged cover shaft 1512. The end of the arch flattening shaft 1514 that interfaces with the hinge walls 1518(*a-b*) is also preferably flat and tight inside the hinge 1516, such that it applies an advantageous mechanical force against the wall 1518. FIG. 23A shows the position the hinge 1516 and shafts (1512 and 1514) when the blind is fully collapsed (e.g. FIG. 17Q, FIG. 17U, FIG. 21B). FIG. 23B shows the position the hinge 1516 and shafts (1512 and 1514) when the blind is in being setup (e.g. FIG. 21C and FIG. 21D, FIG. 21B). FIG. 23C shows the position the hinge 1516 and shafts (1512 and 1514) when the blind is fully set up (e.g. FIG. 17F, FIG. 21E).

When the blind is initially being spread (FIG. 21C) the arch flattening hinge 1516 provides an advantageous lateral force to cause the fast setup frame to start to open. The tightness and mechanical area of the hinge 1516 especially helpful when the blind is in the horizontal position as required by the method shown in FIG. 21B through FIG. 21E. It also increases the durability of the frame.

The arch flattening hinge 1516 provides a second advantageous force to the fast setup frame, at point where the docking assembly 1742 nearly engages the intersection dock 1722, to help ensure proper alignment. Further, when the blind is fully set up, it continues to provide stabilizing forces and strength within the fast setup frame 1534 to limit motion and breakage.

FIG. 23D

Currently Preferred Embodiment

FIG. 23D shows various features of a currently preferred embodiment of the blind of the present invention. The blind comprises the fast setup frame 1534 (FIG. 17E), a three tiered, quiet cover embodiment of the cover 1540 (FIG. 19A), a rain fly 1550 (FIG. 18H), and a foot attaching means 1790 (not visible, either FIG. 20D or FIG. 20E).

The cover 1540 comprises:

two overhead windows 1632 (FIG. 18J), two inverted-T window, formed by fasteners 1210 and 1212 (FIG. 19J)

windows 1612 sandwiched between guylines 1912 (either FIG. 19C or FIG. 19D), with clips 1706(*a-d*) in each bottom corner, skirt 2101, with corresponding clips 1704(*a-d*) and three cover loops 1622 (FIG. 4R) in each corner, a door fastener 1636, forming a skirt door 2050 a skirt straps 1686 in each corner, wishbone strap 2162 with corresponding spreading strap clip 2164 (FIG. 17R)

lower wall tightening, vertical hems 1870,

The fast setup frame 1534 further comprises:

pull cord 1536 and pull handle 1535, two shaft extensions 4410 as telescoping shaft, 108*a* and 108*b*, (FIG. 4R and FIG. 22E) on each half arch cover shafts 1512, with quick release 1820 telescope locking means 2266*a* and 2266*b*, respectively.

The blind is shown with the inverted-T window half open with the open section in a window 1672.

The door fastener 1636 forming a skirt door 2050 allows the blind to be staked as shown in FIG. 18N, or be setup around a tree mounted seat, such as the Summit Trophy Seat™.

FIG. 24A Through FIG. 24E

FIGS. 24A through 24E show various aspects and configurations of cylindrical arched shelters frames using a shaft intersection clip.

Figure 24A:
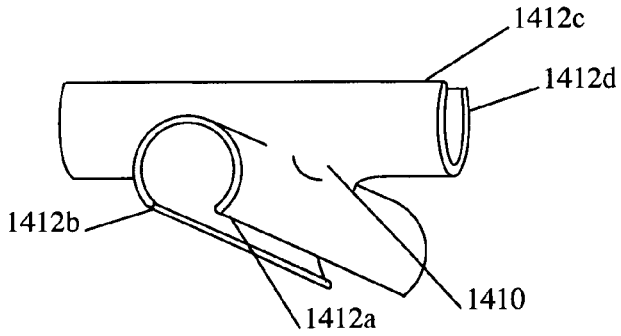
FIGS. 24A through 24E show various aspects and configurations of cylindrical arched shelters frames using a shaft intersection clip.
Figure 24B:
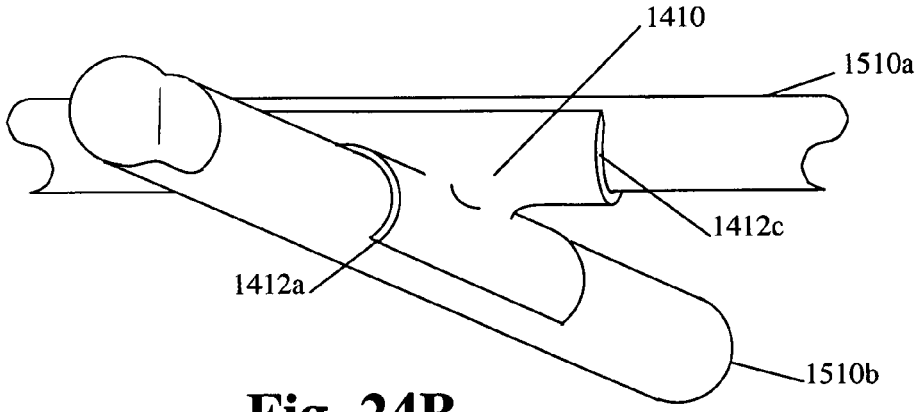

FIG. 24A show a shaft intersection clip 1410. FIG. 24B shows the use of the intersection clip 1410 which has two clip members (1412*a* and 1412*b*), which removably attach to one shaft (e.g. top cover shaft 1510*a*, or 1500 or 1512), and two opposite facing, orthogonal members (1412*c* and 1412*d*), which removably attach a second other shaft (e.g. bottom cover shaft 1510*b*, or 1500 or 1512).

Figure 24C:
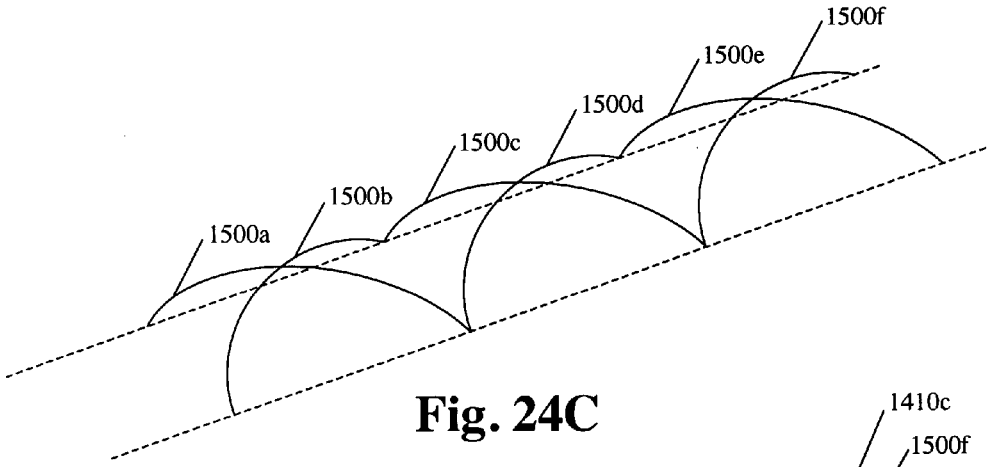

FIG. 24C shows that a number of cover shafts 1500 can be configured forming a series of intersecting pairs of cover shafts: a first pair comprising shafts 1500*a* and 1500*b*, a second pair comprising pair comprising shafts 1500*c* and 1500*d*, and a third pair comprising shafts 1500*e* and 1500*f*. These simple form a cylindrical arched frame that can be covered with a simple cover 1540 formed by a rectangular sheet of material (e.g. camouflage cloth or a mesh). Cylindrical arched roof units 1604 were disclosed in the related applications.

Figure 24D:
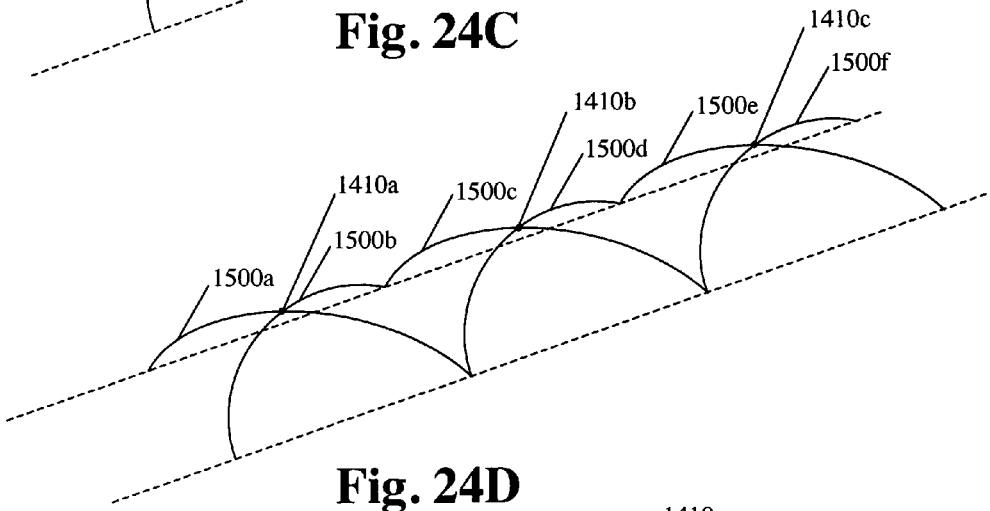

FIG. 24D shows that the simple frame of FIG. 24C can be strengthened by attaching an intersection clip 1410 to each pair of arches, 1410*a* through 1410*c* respectively. Similarly, a plurality of any arched dome frames (e.g. pivoting arches 3700 or the fast setup frame 1534) could be setup without covers to form a modular, cylindrical arched frame.

Figure 24E:
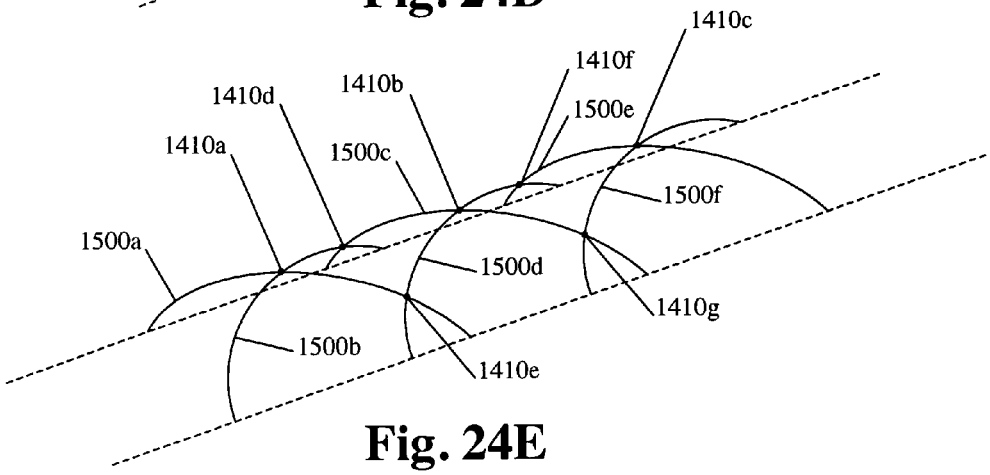

FIG. 24E shows that a stronger structure can be formed by place the same three pairs of arches closer together such that the adjacent arch shafts (1500, 1510, or 1512) intersect. The intersections are held together by intersection clips 1410*d* through 1410*g*, respectively.

These figures shown have the novel modules of the modular system, including the pivoting arches 3700, pair of alternative arch shafts 1510, or the fast setup frame 1534, can advantageously be combined to form larger, compound structures. For example, these could accommodate larger groups or meet the needs of camera units associated with the primary operators of the blinds.

Figure 25A:
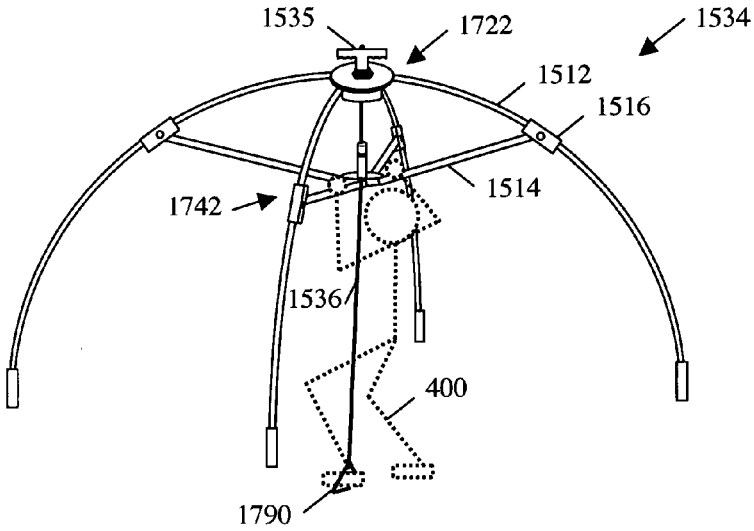
FIGS. 25A through 25C show aspects and operation of an alternate method of using the full human body to setup a quick setup frame.
Figure 25B:
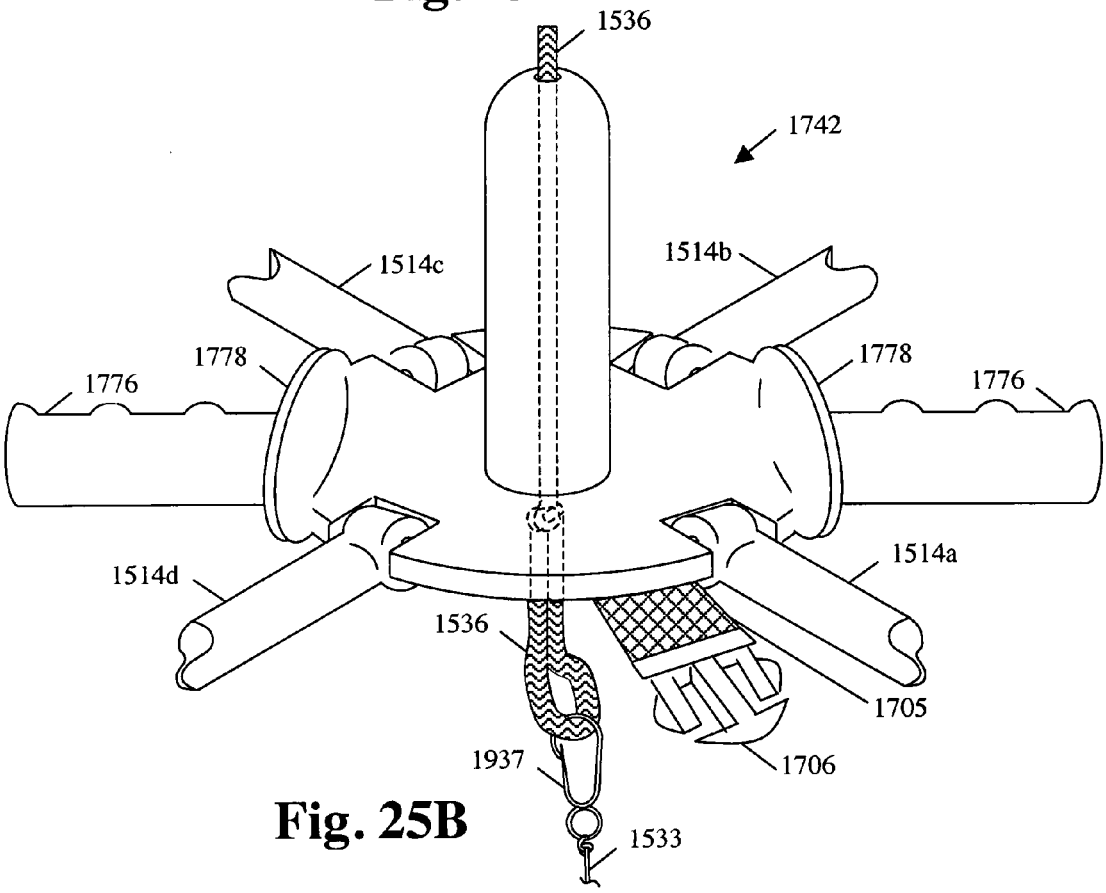
Figure 25C:
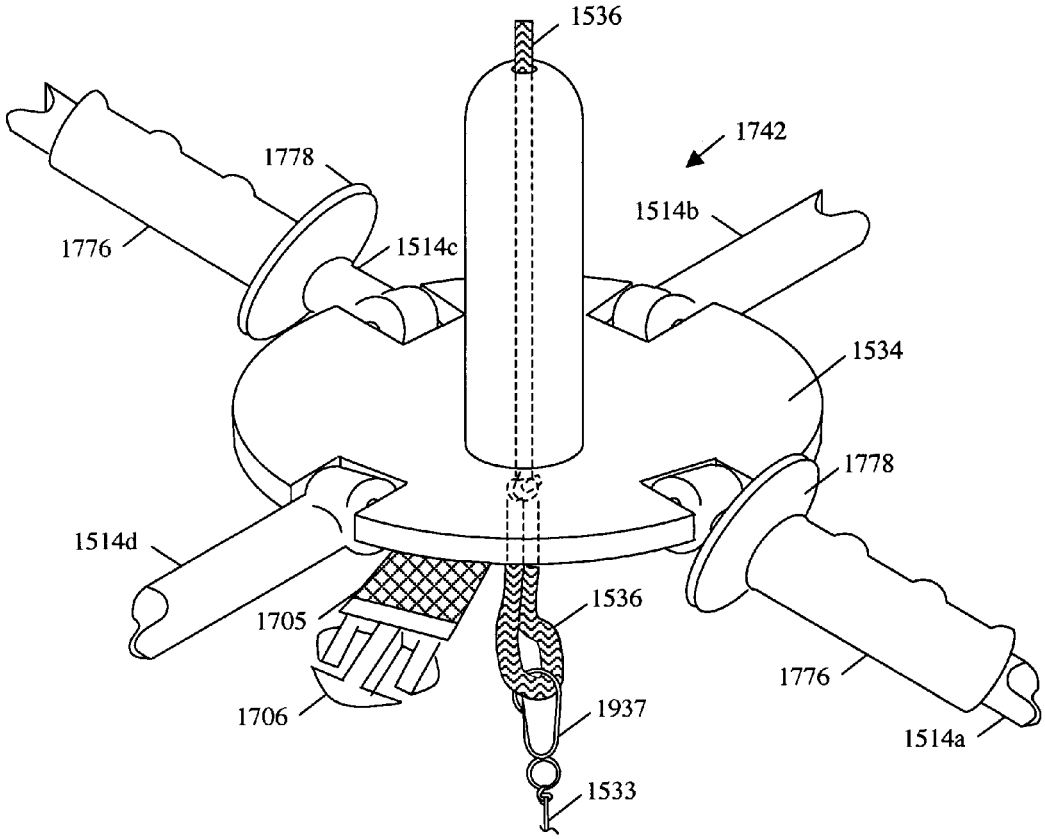
Figure 25C:
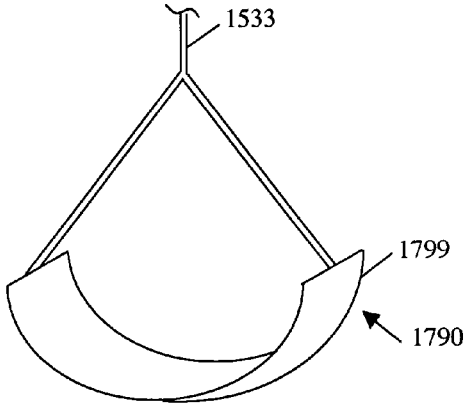

FIG. 25A Through FIG. 25C

FIGS. 25A through 25C show aspects and operation of an alternate power jerk method of using the full human body to setup a fast setup frame 1534.

FIG. 25A shows the operator 400 positioned under the fast setup frame 1534 in the power jerk position. The blind is initially spread while in a vertical position. The operator 400 asserts the skin tightening force by pressing up on hand grips 1776 (configured as shown in one of the embodiments of FIG. 25B or FIG. 25C) with the hands while pressing down through the full body to the feet on a foot attaching means 1790 attached the pull cord extension 1533. A first end of the pull cord is retained at the apex. The pull cord extension 1533 is attached to the second end of the pull cord 1536 inside the frame 1531. To achieve the full range of motion, the operator likely will lift the blind from the ground as some point during the power jerk. The hand grips 1776 provide a stable means of performing the power jerk and automatically positions the operator's hands away from the parts (e.g. shafts 1512 and 1514, or dock 1723 and docking plate 1746) that come together during the docking process. The hand guards 1778 help the operator to hold the collapsed frame when initially opening the frame 1534 and to protect the hands and fingers.

FIG. 25B shows the hand grips 1776 and hand guards 1778 as an integral part of the docking assembly 1742 (otherwise having the same referenced items as FIG. 17F). The safety strap 1705 is the preferred safety means when using the power jerk method because the operator is already inside the blind when it is first set up. Thus, the safety groove 1745 is not shown as part of the docking assembly in FIG. 25B or FIG. 25C.

FIG. 25C shows the hand grips 1776 and hand guards 1778 mounted on two opposite arch flattening shafts 1514 (in the position shown as optional in FIG. 17G). FIG. 25 also shows the foot attaching means 1790 attached the pull cord extension 1533. The foot attaching means 1790 could be implemented as a loop in the pull cord extension 1533 optionally attached or threaded through a stirrup 1799. The stirrup 1799 could be made of rigid metal or plastic, or preferably flexible plastic tubing.

Power Jerk Method

In the power jerk method of setting up the blind, the operator does not have to sit on the ground (or chair) and still is able to use the large muscle groups of the human body from hands to feet. While the range is typically less than the power row position, most outdoorsmen can apply more force in the power jerk position, resulting in the same amount of energy for necessary improved skin tightening, which is substantially greater than can be applied with just the arms and shoulders as in conventional methods.

Figure 26A:
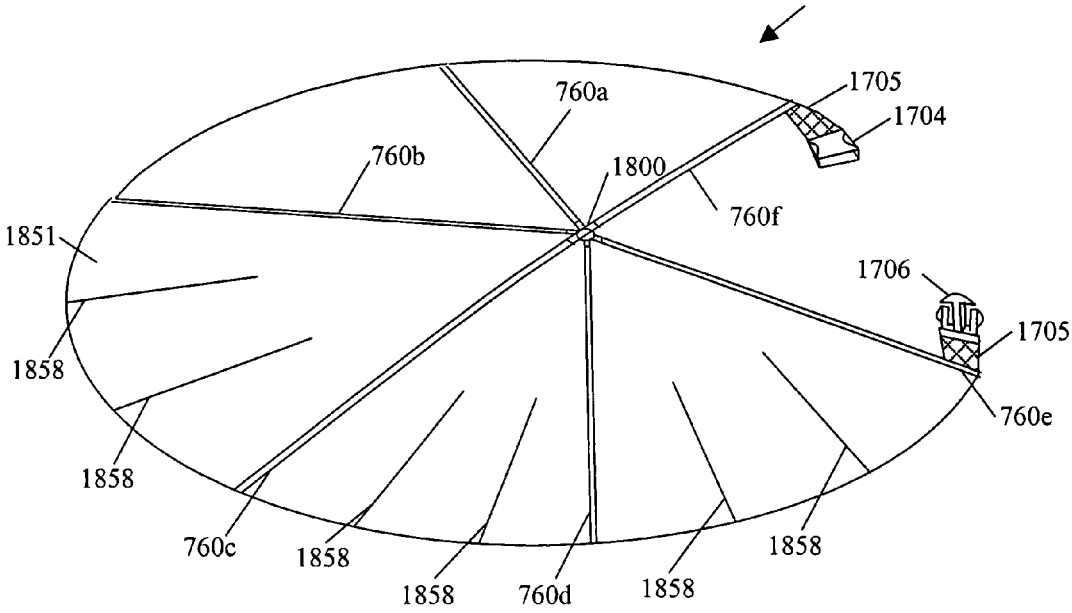
FIG. 26A and FIG. 26B show an alternate embodiment of an arched dome using an adjustable bracket in a fan configuration.
Figure 26B:
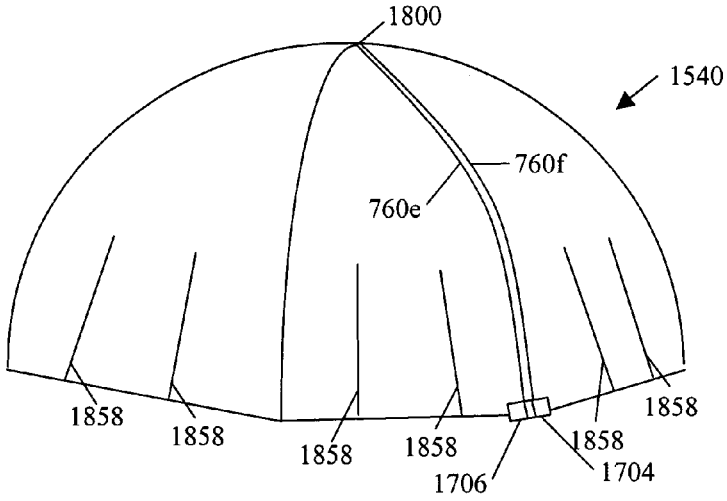

FIG. 26A and FIG. 26B

FIG. 26A and FIG. 26B show an alternate embodiment of an arched dome using an adjustable bracket in a fan configuration.

FIG. 26A shows a novel fan fly embodiment comprising a six-legged adjustable bracket 1800 with six connected shafts 760 forming a fan. This is similar to the fan fly disclosed in the related applications (i.e. the MOC3 application). A fan fly material 1851 is placed over each shaft creating a module that can be used, among other things, as an arched dome blind. The fan fly material 1851 may optionally be reinforced with battens 1858 to maintain the shape of the fan edges and to reduce wind movement. The battens 1858 could be a flat or round piece of wood, plastic, metal, or fiberglass. The two ends of the fan fly material 1851 contain a receiving clip 1704 (shown on the 760*f* side) inserting clip 1706 (shown on the 760*e* side).

FIG. 26B shows that by pulling the two sides together and clipping the clips (1704 and 1706), the fan fly is urged into a arched dome configuration, the fan fly material forming the cover 1540 of the blind. Other features of the blind such as windows 1612 and panels 1920 and 1922 could be added to provide a full functioning blind without requiring the fast setup frame 1534.

Solid Shafts versus Hollow Shafts with Elastic Cords

Some of the foregoing embodiments have explicitly shown the use of hollow shaft segments connected with an internally running cord 126, for example FIG. 3B and FIG. 8B. The present invention also provides a means for attaching solid shaft segments and still allowing the shafts to breakdown (see discussion in related applications). Most of the embodiments can be implemented with either type of segmented shaft. A solid fiberglass shaft has greater strength than the same sized hollow fiberglass shaft. By using solid fiberglass shafts, smaller diameter shafts can be used resulting in lower cost and lower volume. It is anticipated that both hollow shafts with cords and solid shafts with or without hinged connectors will be used. The different types of shafts can be color-coded, for example, black for solid and grey for hollow.

For some applications, an operator may want to use a solid shaft for every other segment in a segmented shaft. The remaining segments could be hollow which would allow for a breakdown at both ends of the hollow shaft segments. The end result would be a stronger overall segmented shaft that would have one breakdown point per each shaft.

In applications where the segmented shaft needs to also have tensile strength, only solid poles without corded attachments would be necessary.

Other Uses

While the descriptions of the various embodiments have been made in reference to an undeveloped outdoor area, the modular system of the present invention could also be used in urban areas. For example, in colder winter climates, the system could be used to form a green house over a garden using clear plastic sheeting and then reassembled in the summer as a shelter for vehicles or bicycles using an opaque tarp. In another example, the supports, shafts, connectors, and curtains could be used to form a backyard maze. In yet another example, the system could be used for constructing outdoor structures for weddings, flea markets, festivals, or even security checkpoints.

Lengths in Multiples and Integrated Features

The present invention anticipates that the various components, modules, and units will be provided in an integrated fashion. For example, shafts segments all either are the same size or be multiples of a standard unit of length. For example, in the currently preferred embodiment, the standard full length is about 27 inches and a half stick is about 13.5 inches. Grommets, including reinforced holes, are placed in covers, cover straps, curtains, skirts, and tarps so that the shaft segments can pass through at any connection. Angles are determined based on the use of standard units of length when forming modules such as the pyramid cap 1621. As mentioned in the related applications, the same tarp 1560 is sized for use as a removable floor and a roof for a cylindrical arched roof unit 1604. The dimpled connectors 194 are designed to receive both a threaded leg that can be screwed into a tree (e.g. 150 or 191) and an inserting end of a segmented shaft. Applying these principles allows the users of the system to configure an unlimited number of different structures to meet the needs of various situations and various sized groups.

Advantages

Modular

The system of the present invention is modular. A user can begin using smaller modules with minimal investment and add more pieces or more complex modules later. A group of users can each own separate modules, which are used independently, and then construct more complex configurations when the group comes together in the outdoors.

Separately Packable

Because the various components and modules can be separated, different users in a group can carry a relatively lighter load, for example, in their backpacks. The removable floor can be removed and only the lighter components need to be carried.

Star Window and Inverted-T Window

The novel star window configurations provide blind windows with four or more sections such that any section or groups of sections can be independently opened while maintaining taut cover panels. The star windows, and inverted-T windows, also allow the top of the blind to be fully opened. A novel window section attachment allows non-adjacent window sections to be attached.

Skin Tightening

The novel means of tightening the skin of the present invention provides methods and means for tightening the skin on the sides of a blind cover to reduce movement and flutter in the wind. The means of the present invention include arch cover shafts that are flattened with various arch flattening means which cause a constant outward pressure on the sides of the cover. This is done with lower cost, lighter weight, and easier to use structures.

Simple

The present invention is simple to make and use. Each component is easily made. The present invention requires little time to attach and to set up.

The fast setup frame (and other basic modules) can be quickly setup to provide initial concealment. Other components can be added and configured as needed.

Easy to Use

The present invention is easy to use. To install, the operator 400 simply attaches the support and optional shafts, connectors, curtains, and covers. To use as a tree blind, the support 100 is angularly position to raised or lowered position.

Unlike conventional tents, or other complex blind systems, the user can simple place supports in the ground. Next, a shelter frame can be assembled from shafts that can be preconfigured and quickly deployed. And then, a cover can be placed over a freestanding structure.

Lightweight

The present invention comprises a few simple parts that can easily be constructed of lightweight materials. Being lightweight is important for those who have to carry gear into the outdoors.

Compact

The present invention is compact. The support, shafts, connectors, and curtains can easily be rolled together into a small bundle or placed in a slender sack such as the case 1300. Even larger modules such as covers with cover shafts can be broken down and rolled together in relatively small bundles. This is advantageous for both storage and carrying.

Portable

The present invention is lightweight and compact allowing it to be carried long distances into the outdoors and to be used in a variety of locations. The curtain 300 can be folded or rolled up with various components of the attaching pivoting support 100 and placed in the case 1300 for easily carrying on a waist belt or in a backpack. Other components can be separately packable by a group of users.

The cover 1540 and other loose parts can be placed in a novel cover bag for easy movement.

Quiet

The skin tightening features reduce noise from wind movement or flutter. The attaching pivot support with a curtain has no moving parts that would make a noise or rattle together. In some cases the screws turning against the attaching structure could make a quiet sound. However the design is such that once screwed in all the way the screw can be backed out a turn or two to reduce the volume of noise made to a negligible level.

The novel use of guylines to secure and move windows and the use of magnetic window fasteners eliminate the need for zippers or hook and loop fasteners providing for quiet window or opening operation during wildlife observation.

Universal

The modular system of the present invention uses the same brackets and shafts to construct a variety of both tree blinds and ground blinds. The same parts and equipment can be used to construct configurations for different purposes and for different environments. This maximizes the user's investment in the materials and minimizes the number of items to be packed. The use of standard shaft segments and half-length extension shafts provide for a large number of configurations using the same basic components.

Lower Cost, Longer Reliability

The present invention provides a number of novel features that reduce the complexity and cost of manufacture and that increase the reliability of the parts.

Avoiding Scent Detection

The present invention provides a number of features that reduce the scent that is released from a blind in the wind that is passing by wildlife that might be down wind.

CONCLUSION, RAMIFICATION, AND SCOPE

Accordingly, the reader will see that the present invention provides an easy to use, simple, lightweight, compact, portable, quiet, multi-use modular system for concealment and shelter.

While the above descriptions contain several specifics these should not be construed as limitations on the scope of the invention, but rather as examples of some of the preferred embodiments thereof. Many other variations are possible. For example, other embodiments of an arch flattening means without cover shaft intersection plates could be used. For example, instead of intersecting plates, pivoting arches or a fan fly configuration could be used. Also the docking mechanism could be inverted. The variations could be used without departing from the scope and spirit of the novel features of the present invention.

Accordingly, the scope of the invention should be determined not by the illustrated embodiments, but by the appended claims and their legal equivalents.

We claim:

1. A method of tightening the skin of a collapsible, lightweight, portable hunting blind by a human operator, the human operator having a body having hands and feet, wherein said blind comprises:

i) a quick setup frame, the frame comprising:

three or more half arch cover shafts foldably connected to a shaft intersection means which forms an apex of the blind, the blind having an axis substantially perpendicular to the shaft intersection at the center of the shaft intersection, an arch flattening means connected to the plurality of arch cover shafts, and a pull cord connected to the arch flattening means and passing through the shaft intersection means, ii) a cover skin, the skin having a predetermined shape having a number cover panels corresponding to the number of arch cover shafts and being connected to the arch cover shafts at each of a plurality of corners formed by the cover seams between the cover panels, and iii) a spreading means connected to two of the corners, the method comprising the steps of:

a) placing the collapsed blind horizontally on the ground, the collapsed frame being folded at the apex, b) sitting along the axis of the collapsed blind nearest the apex, c) placing one or more feet of the operator on the apex, d) lifting and spreading the two corners via the spreading means, thereby spreading each of the corners via the cover skin attachments, and thereby initially engaging the arch flattening means, e) pulling the pull cord with at least one of the hands while lifting the apex with the one or more feet, thereby further engaging the arch flattening means, and f) applying a skin tightening force using a plurality of large muscle groups of the full body of the operator from the hands to the feet in a seated row position, wherein the arch flattening means stores and transfers the force to the arch cover shafts, wherein the arch cover shafts stretch the cover panels with sufficient force that skin is held taut without substantial movement or noise detectable by wildlife, and wherein steps a) through f) are completed within a predetermined time period measured in seconds, the time period starting when the blind touches the ground in the placing step and ending when the plurality of corners are spread and the skin is held taut.

2. The method of claim 1 wherein the predetermined time period is less than about seven seconds.

3. The method of claim 1 wherein the blind further comprises foot attaching means, and wherein the placing the feet step comprises temporarily attaching the one or more feet to the foot attaching means, whereby the setup is performed smoothly, and whereby the force is applied in a controlled manner.

4. The method of claim 1 wherein the blind further comprises a safety means comprising one of a safety strap or a safety clip, the method further comprising a step of engaging the safety means.

5. The method of claim 1 further comprising a takedown step, wherein the operator, positioned outside the blind, holds the apex substantially horizontally and kicks the arch flattening means with the bottom of one foot to release the stored force, whereby the hands and head of the operator are positioned safely away from the area of potential injury.

6. A method of tightening the skin of a collapsible, lightweight, portable hunting blind by a human operator, the human operator having a body having hands and feet, wherein said blind comprises:

i) a quick setup frame, the frame comprising:

three or more half arch cover shafts foldably connected to a shaft intersection means which forms an apex of the blind, the blind having an axis substantially perpendicular to the shaft intersection at the center of the shaft intersection, an arch flattening means connected to the plurality of arch cover shafts, and a pull cord passing through at least one of the shaft intersection means and the arch flattening means, the pull cord having a first end and a second end, ii) a cover skin, the skin having a predetermined shape having a number cover panels corresponding to the number of arch cover shafts and being connected to the arch cover shafts at the corners formed by the cover seams between the cover panels, and iii) a foot attaching means for temporarily attaching at least one foot of the operator to the blind, the method comprising the steps of:

a) placing the collapsed blind on the ground, the collapsed frame being folded at the apex, b) aligning the human operator along the axis of the blind, c) spreading the cover shafts, and d) applying a skin tightening force using a plurality of large muscle groups of the full body from the hands to the feet, whereby the arch flattening means stores and transfers the force to the arch cover shafts, and whereby the arch cover shafts stretch the cover panels with sufficient force that skin is held taut without substantial movement or noise detectable by wildlife.

7. The method of claim 6, wherein the arch flattening means further comprises hand grips and hand guards for protecting the hands of the operator and for ensuring safe and proper body position for the operator, wherein the first end of the pull cord is retained at the apex, wherein the second end of the pull cord is attached to a foot attaching means, wherein the placing step comprises placing the collapsed blind vertically on the ground, wherein the aligning step comprises standing under the axis of the blind, and wherein the method, prior to the applying step, further comprises the steps of:

a) placing at least one foot of the operator on the foot attaching means, and b) grasping the hand grips, wherein the body is in a power jerk position, whereby the blind is setup by a single person while standing.

8. The method of claim 6, wherein the arch flattening means further comprises a plurality of arch flattening shafts, each arch flattening shaft being connected to a respective half arch cover shaft and having a length between about 16 and about 33 inches, such that an effective range of motion of the arch flattening means is between about 32 and about 66 inches, whereby a range of movement between the feet and the hands in the applying the skin tightening force step is between about 32 and about 66 inches, whereby the force applied by the human body over the range of movement is greater than a force possible with just the arms and shoulders, and whereby strength of the full human body is optimally used to apply the skin tightening force.

* * * * *